United States Patent [19]

Means et al.

[11] 4,114,730

[45] Sep. 19, 1978

[54] TRANSPORTATION SYSTEM WITH INDIVIDUAL PROGRAMMABLE VEHICLE PROCESSORS

[75] Inventors: David K. Means, Palo Alto, Calif.; Clyde A. Boenke, Ann Arbor, Mich.

[73] Assignee: Reliance Electric Company, Cleveland, Ohio

[21] Appl. No.: 721,062

[22] Filed: Sep. 7, 1976

[51] Int. Cl.[2] ..... B66B 1/18

[52] U.S. Cl. ..... 187/29 R

[58] Field of Search ..... 187/29

[56] References Cited

U.S. PATENT DOCUMENTS

| | | | |
|---|---|---|---|
| 3,750,850 | 8/1973 | Winkler et al. | 187/29 |
| 3,851,735 | 12/1974 | Winkler et al. | 187/29 |
| 4,037,688 | 7/1977 | Winkler | 187/29 |
| 4,042,067 | 8/1977 | Mandel | 187/29 |

*Primary Examiner*—Robert K. Schaeffer
*Assistant Examiner*—W. E. Duncanson, Jr.
*Attorney, Agent, or Firm*—William J. Clemens

[57] ABSTRACT

A transportation system, illustrated as an elevator system, including a programmable processor for controlling the operation of the elevator car. The processor generates all the control signals to an elevator control means in response to the reception of service condition signals representing data on the status of the elevator system components. Where two or more elevator cars are grouped together for servicing a plurality of common stations, each car has an associated processor and one processor is designated as the master processor. The master processor is programmed to assign the hall calls at the stations to its associated elevator car or to a selected one of the various other elevator cars through their processors designated as slave processors. Each processor reads the service condition signals for its associated car such as calls from passengers within the car, vehicle position signals, the status of its prime mover, the assignment of a car to receive passengers queued up at a given station, and whether or not the car doors are closed and generates the control signals in response thereto in accordance with a predetermined program.

53 Claims, 41 Drawing Figures

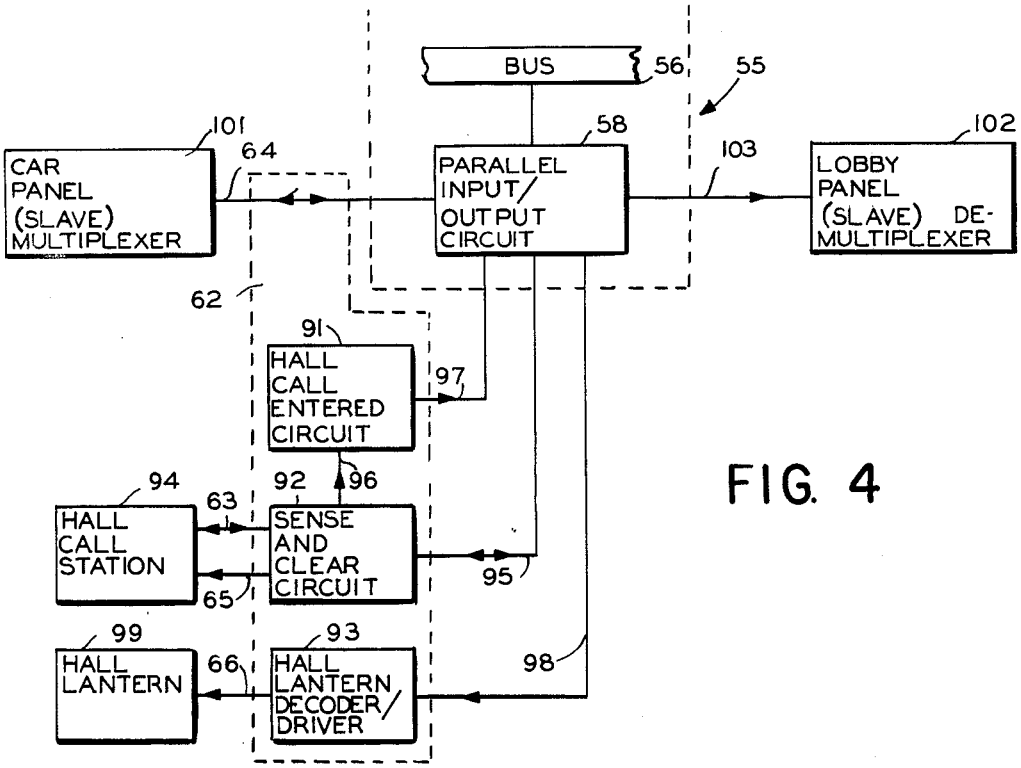
FIG. 4
FIG. 5
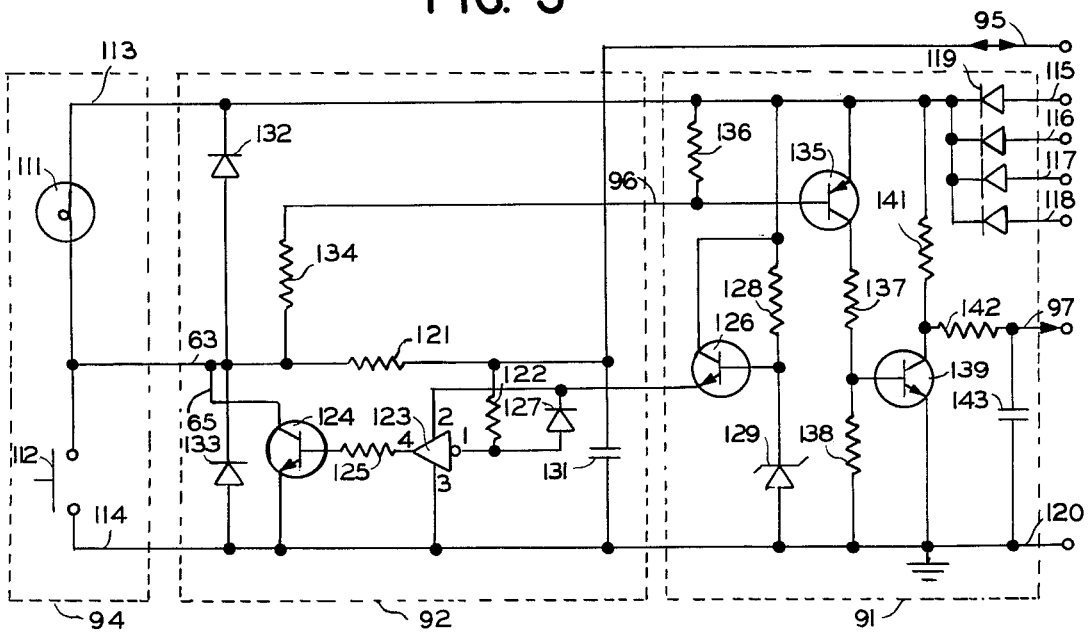

FIG. 7

HALL LANTERN DECODER / DRIVER CODING TABLE

| FLOOR | INPUT CODE | | | | | | ZONE | SUBZONE | UP OUTPUT | | DOWN OUTPUT | |
|---|---|---|---|---|---|---|---|---|---|---|---|---|
| NUMBER | L0 | $\overline{L1}$ | $\overline{L2}$ | $\overline{L3}$ | $\overline{L4}$ | $\overline{L5}$ | 0 | 0 | 1 | 0 | 1 | 0 |
| PARKING | X | 1 | 1 | 1 | 1 | 1 | $\overline{L00}$ | $\overline{S0}$ | D | I | I | D |
| BASEMENT | X | 0 | 1 | 1 | 1 | 1 | $\overline{L00}$ | $\overline{S1}$ | D | H | H | D |
| 1 | X | 1 | 0 | 1 | 1 | 1 | $\overline{L00}$ | $\overline{S2}$ | D | G | G | D |
| 2 | X | 0 | 0 | 1 | 1 | 1 | $\overline{L00}$ | $\overline{S3}$ | D | F | F | D |
| 3 | X | 1 | 1 | 0 | 1 | 1 | $\overline{L00}$ | $\overline{S4}$ | D | E | E | D |
| 4 | X | 0 | 1 | 0 | 1 | 1 | $\overline{L00}$ | $\overline{S5}$ | F | G | G | F |
| 5 | X | 1 | 0 | 0 | 1 | 1 | $\overline{L00}$ | $\overline{S6}$ | F | H | H | F |
| 6 | X | 0 | 0 | 0 | 1 | 1 | $\overline{L00}$ | $\overline{S7}$ | F | I | I | F |
| 7 | X | 1 | 1 | 1 | 0 | 1 | $\overline{L01}$ | $\overline{S0}$ | C | I | I | C |
| 8 | X | 0 | 1 | 1 | 0 | 1 | $\overline{L01}$ | $\overline{S1}$ | C | H | H | C |
| 9 | X | 1 | 0 | 1 | 0 | 1 | $\overline{L01}$ | $\overline{S2}$ | C | G | G | C |
| 10 | X | 0 | 0 | 1 | 0 | 1 | $\overline{L01}$ | $\overline{S3}$ | C | F | F | C |
| 11 | X | 1 | 1 | 0 | 0 | 1 | $\overline{L01}$ | $\overline{S4}$ | C | E | E | C |
| 12 | X | 0 | 1 | 0 | 0 | 1 | $\overline{L01}$ | $\overline{S5}$ | C | D | D | C |
| 13 | X | 1 | 0 | 0 | 0 | 1 | $\overline{L01}$ | $\overline{S6}$ | G | H | H | G |
| 14 | X | 0 | 0 | 0 | 0 | 1 | $\overline{L01}$ | $\overline{S7}$ | G | I | I | G |
| 15 | X | 1 | 1 | 1 | 1 | 0 | $\overline{L10}$ | $\overline{S0}$ | B | I | I | B |
| 16 | X | 0 | 1 | 1 | 1 | 0 | $\overline{L10}$ | $\overline{S1}$ | B | H | H | B |
| 17 | X | 1 | 0 | 1 | 1 | 0 | $\overline{L10}$ | $\overline{S2}$ | B | G | G | B |
| 18 | X | 0 | 0 | 1 | 1 | 0 | $\overline{L10}$ | $\overline{S3}$ | B | F | F | B |
| 19 | X | 1 | 1 | 0 | 1 | 1 | $\overline{L10}$ | $\overline{S4}$ | B | E | E | B |
| 20 | X | 0 | 1 | 0 | 1 | 0 | $\overline{L10}$ | $\overline{S5}$ | B | D | D | B |
| 21 | X | 1 | 0 | 0 | 1 | 0 | $\overline{L10}$ | $\overline{S6}$ | B | C | C | B |
| 22 | X | 0 | 0 | 0 | 1 | 0 | $\overline{L10}$ | $\overline{S7}$ | H | I | I | H |
| 23 | X | 1 | 1 | 1 | 0 | 0 | $\overline{L11}$ | $\overline{S0}$ | A | I | I | A |
| 24 | X | 0 | 1 | 1 | 0 | 0 | $\overline{L11}$ | $\overline{S1}$ | A | H | H | A |
| 25 | X | 1 | 0 | 1 | 0 | 0 | $\overline{L11}$ | $\overline{S2}$ | A | G | G | A |
| 26 | X | 0 | 0 | 1 | 0 | 0 | $\overline{L11}$ | $\overline{S3}$ | A | F | F | A |
| 27 | X | 1 | 1 | 0 | 0 | 0 | $\overline{L11}$ | $\overline{S4}$ | A | E | E | A |
| 28 | X | 0 | 1 | 0 | 0 | 0 | $\overline{L11}$ | $\overline{S5}$ | A | D | D | A |
| 29 | X | 1 | 0 | 0 | 0 | 0 | $\overline{L11}$ | $\overline{S6}$ | A | C | C | A |
| 30 | X | 0 | 0 | 0 | 0 | 0 | $\overline{L11}$ | $\overline{S7}$ | A | B | B | A |

X = 0 UP
X = 1 DOWN

TABLE I

| INSTRUCTION | F1 MΦ | F1 M1 | F1 M2 | F2 MΦ | F2 M1 | F2 M2 | F3 MΦ | F3 M1 | F3 M2 | X MΦ | X M1 | X M2 |
|---|---|---|---|---|---|---|---|---|---|---|---|---|
| LOAD | AR←PC<br>PC←AR+1 | $\overline{DIP}$ | IR←BUS | AR←PC<br>PC←AR+1 | $\overline{DIP}$ | IRX←BUS | AR←PC<br>PC←AR+1 | $\overline{DIP}$ | BLT←BUS | AR←BLT,IRX<br>BR←FR | $\overline{DIP}$ | FR←BR AND BUS THRU ALU |
| LOAD INDEXED | AR←PC<br>PC←AR+1 | $\overline{DIP}$ | IR←BUS | | | | | | | AR←FR<br>BR←FR | $\overline{DIP}$ | FR←BR AND BUS THRU ALU |
| LOAD IMMEDIATE | AR←PC<br>PC←AR+1 | $\overline{DIP}$ | IR←BUS | AR←PC<br>PC←AR+1 | $\overline{DIP}$ | IRX←BUS | AR←PC<br>PC←AR+1 | $\overline{DIP}$ | BLT←BUS | AR←BLT, IRX | | FR←AR THRU ALU |
| STORE | AR←PC<br>PC←AR+1 | $\overline{DIP}$ | IR←BUS | AR←PC<br>PC←AR+1 | $\overline{DIP}$ | IRX←BUS | AR←PC<br>PC←AR+1 | $\overline{DIP}$ | BLT←BUS | AR←BLT,IRX<br>BUS←FR | $\overline{DOP}$ | |
| STORE INDEXED | AR←PC<br>PC←AR+1 | $\overline{DIP}$ | IR←BUS | | | | | | | AR←FR<br>BUS←FR | $\overline{DOP}$ | |
| ALU OPERATION | AR←PC<br>PC←AR+1 | $\overline{DIP}$ | IR←BUS | AR←PC<br>PC←AR+1 | $\overline{DIP}$ | IRX←BUS | | | | AR←FR | BR←FR | FR←ALU<br>NOTE 1 |
| JUMP | AR←PC<br>PC←AR+1 | $\overline{DIP}$ | IR←BUS | AR←PC<br>PC←AR+1 | $\overline{DIP}$ | IRX←BUS | AR←PC<br>PC←AR+1 | $\overline{DIP}$ | BLT←BUS<br>NOTE 2 | AR←BLT,IRX | PC←AR THRU ALU | |
| CALL | AR←PC<br>PC←AR+1 | $\overline{DIP}$ | IR←BUS | AR←PC<br>PC←AR+1 | $\overline{DIP}$ | IRX←BUS | AR←PC<br>PC←AR+1 | $\overline{DIP}$ | BLT←BUS<br>NOTE 2 | AR←BLT,IRX<br>BR←PC | PC←AR THRU ALU | TP←BR THRU ALU |
| TRAP | AR←PC<br>PC←AR+1 | $\overline{DIP}$ | IR←BUS<br>NOTE 2 | | | | | | | AR←TP<br>BR←PC | PC←AR THRU ALU | TP←BR THRU ALU |
| INC/DEC | AR←PC<br>PC←AR+1 | $\overline{DIP}$ | IR←BUS | | | | | | | AR←FR | | FR←AR±1 THRU ALU<br>NOTE 3 |
| FLAG | AR←PC<br>PC←AR+1 | $\overline{DIP}$ | IR←BUS | | | | | | | | FLAG←IR | |

NOTE 1: THE IRX0, IRX1 AND IRX2 BITS ADD TO THE CAPABILITY OF THE ALU INSTRUCTION
NOTE 2: THE JUMP, CALL AND TRAP INSTRUCTION MAY OR MAY NOT PASS THROUGH THE X STATE
NOTE 3: THE INC AND DEC INSTRUCTIONS ALWAYS CAUSE THE FLAGS TO BE SET ON THE RESULT OF THE OPERATION

STATE CLOCK

FIG. 19

503
505-8
505-7 BD7
505-6 BD6
505-5 BD5
505-4 BD4
505-3 BD3
505-2 BD2
505-1 BD1
BD0
717
502-1
502-2
502-3
502-4
502-5
502-6
502-7
502-8
509-8
509-7 IRX7
IRX6
532-1
532-2 A
B
502-9
502-10
502-11
502-12
509-6
509-5 IRX5
509-4 IRX4
509-3 IRX3
IRX2
502-13
502-14
502-15
502-16
509-2
509-1 IRX1
IRX0
711
712
713
714
715
716
503-16 FD15
503-15 FD14
503-14 FD13
503-13 FD12
503-12 FD11
503-11 FD10
503-10 FD9
503-9 FD8
503-8 FD7
503-7 FD6
503-6 FD5
503-5 FD4
503-4 FD3
503-3 FD2
503-2 FD1
503-1 FD0

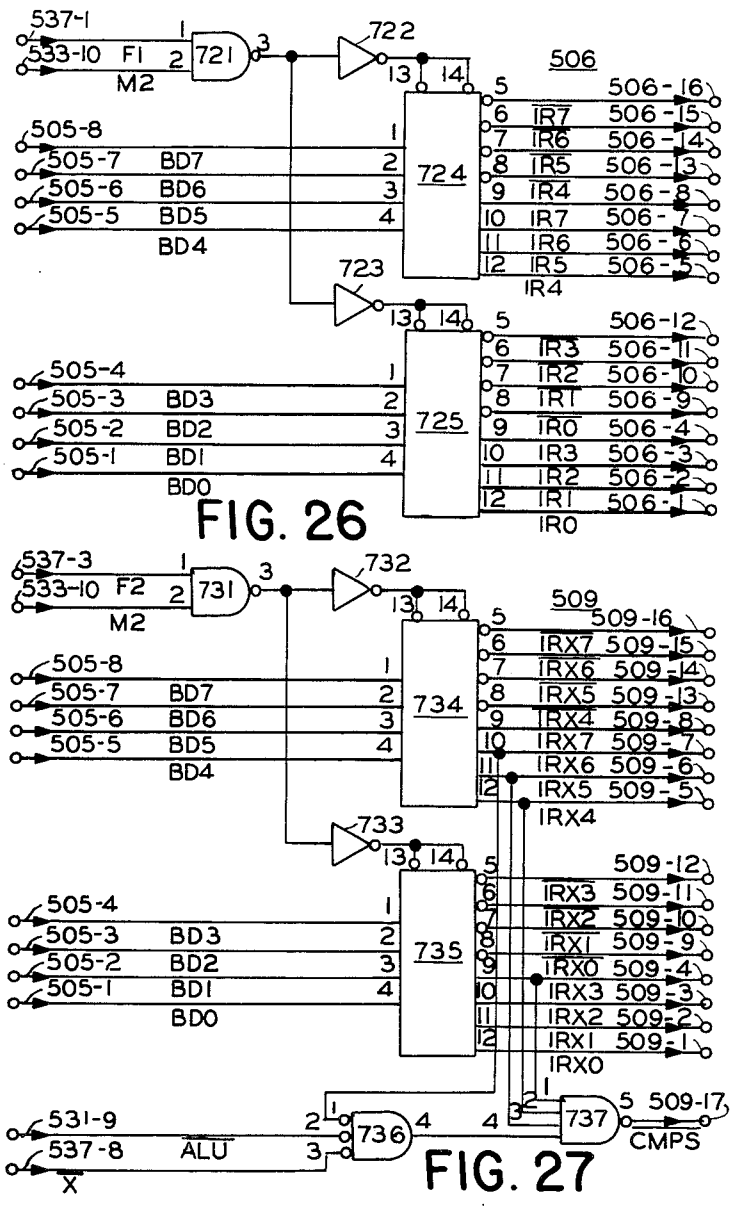
FIG. 26
FIG. 27
FIG. 34
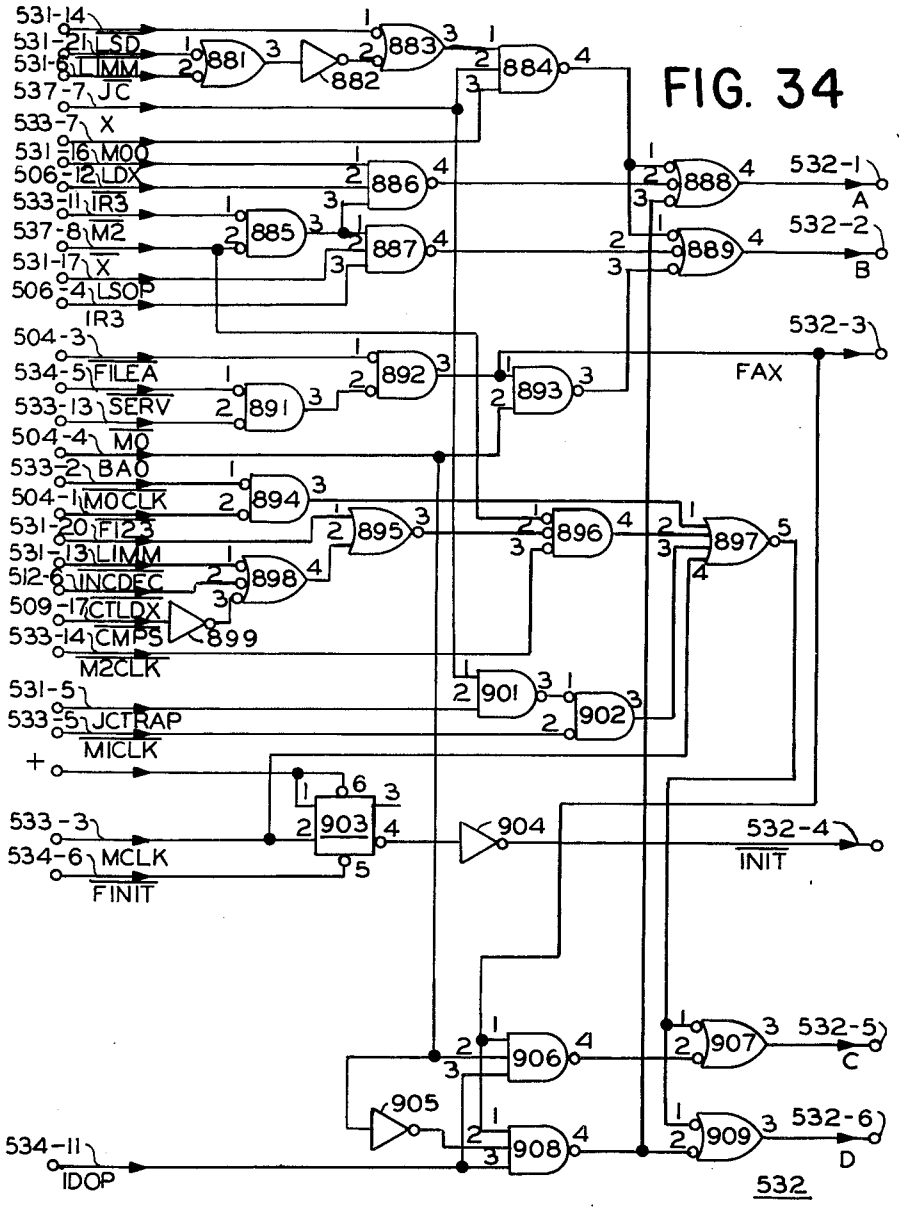

508
754
755
756
757
758
759
761
762
763
764
765
766
767
IR3
LDX
FD15
FD14
FD13
FD12
FD11
FD10
FD9
FD8
ALU
MICLK
MOCLK
CTLDX
FD7
FD6
FD5
FD4
FD3
FD2
FD1
FD0
BT15
BT14
BT13
BT12
BT11
BT10
BT9
BT8
BT7
BT6
BT5
BT4
BT3
BT2
BT1
BT0

507
741
742
743
744
745
746
747
748
749
750
MOOCLK
BUSY
FD15
FD14
FD13
FD12
FD11
FD10
FD9
FD8
FD7
FD6
FD5
FD4
FD3
FD2
FD1
FD0
AT15
AT14
AT13
AT12
AT11
AT10
AT9
AT8
AT7
AT6
AT5
AT4
AT3
AT2
AT1
AT0

TABLE II

| SELECTION INPUTS 771- | | | | LOGIC FUNCTIONS INPUT 771-14 AT "1" | ARITHMETIC FUNCTIONS INPUT 771-14 AT "0" | |
|---|---|---|---|---|---|---|
| 12 | 11 | 10 | 9 | | CARRY INPUT 771-13 AT "0" | CARRY INPUT 771-13 AT "1" |
| 0 | 0 | 0 | 0 | $F=\overline{A}$ | F = A MINUS 1 | F = A |
| 0 | 0 | 0 | 1 | $F=\overline{AB}$ | F = AB MINUS 1 | F = AB |
| 0 | 0 | 1 | 0 | $F=\overline{A}+B$ | $F=A\overline{B}$ MINUS 1 | $F=A\overline{B}$ |
| 0 | 0 | 1 | 1 | F = 1 | F = MINUS 1 (2'S COMP) | F = ZERO |
| 0 | 1 | 0 | 0 | $F=\overline{A+B}$ | $F=A$ PLUS $(A+\overline{B})$ | F = A PLUS (A + B) PLUS 1 |
| 0 | 1 | 0 | 1 | $F=\overline{B}$ | $F=AB$ PLUS $(A+\overline{B})$ | F = AB PLUS $(A+\overline{B})$ PLUS 1 |
| 0 | 1 | 1 | 0 | $F=\overline{A\oplus B}$ | F = A MINUS B MINUS 1 | F = A MINUS B |
| 0 | 1 | 1 | 1 | $F=A+\overline{B}$ | $F=A+\overline{B}$ | $F=(A+\overline{B})$ PLUS 1 |
| 1 | 0 | 0 | 0 | $F=\overline{A}B$ | F = A PLUS (A + B) | F = A PLUS (A + B) PLUS 1 |
| 1 | 0 | 0 | 1 | $F=A\oplus B$ | F = A PLUS B | F = A PLUS B PLUS 1 |
| 1 | 0 | 1 | 0 | F = B | $F=A\overline{B}$ PLUS (A + B) | $F=A\overline{B}$ PLUS (A+B) PLUS 1 |
| 1 | 0 | 1 | 1 | F = A+B | F = A + B | F = (A + B) PLUS 1 |
| 1 | 1 | 0 | 0 | F = 0 | F = A PLUS A* | F = A PLUS A PLUS 1 |
| 1 | 1 | 0 | 1 | $F=A\overline{B}$ | F = AB PLUS A | F = AB PLUS A PLUS 1 |
| 1 | 1 | 1 | 0 | F = AB | $F=A\overline{B}$ PLUS A | $F=A\overline{B}$ PLUS A PLUS 1 |
| 1 | 1 | 1 | 1 | F = A | F = A | F = A PLUS 1 |

*EACH BIT IS SHIFTED TO THE NEXT MOST SIGNIFICANT POSITION

FIG. 30 B 502
801
536-5
536-4 FA4
536-3 FA3
536-2 FA2
536-1 FA1
501-16 FA0
501-15 ALU15
501-14 ALU14
501-13 ALU13
ALU12
802
803
502-1
502-2
502-3
502-4
532-5
C
501-12
501-11 ALU11
501-10 ALU10
501-9 ALU9
ALU8
804
805
502-5
502-6
502-7
502-8
501-8
501-7 ALU7
501-6 ALU6
501-5 ALU5
ALU4
806
807
502-9
502-10
502-11
502-12
532-6
D
501-4
501-3 ALU3
501-2 ALU2
501-1 ALU1
ALU0
808
809
502-13
502-14
502-15
502-16
531-3
531-7 TRAP
537-4 CALL
533-12 F2
MI
811
812
502-17
LTR
502-18
TP0
502-19
TP1
TP2
502-20
813

535
537-7
531-19
504-6
505-16
X
ILLOP
SHF
BD7
532-4
INIT
505-15
BD6
504-5
534-11
CSR
IDOP
505-14
BD5
531-1
506-2
FLAG
505-13
IR3
BD4
533-6
506-1
MICLK
506-2
IR0
506-3
IR1
IR2
504-7
RESIR
531-7
CALL
537-2
504-9
FI
533-1
HIR
531-9
MOOCLK
531-13
ALU
INCDEC
537-8
533-14
X
505-12
M2CLK
505-1
BD3
505-10
BD2
505-9
BD1
501-20
BD0
501-19
E4
501-18
E3
501-17
E2
E1
952
535-1
HALT
535-2
HALT
535-3
PROCR
535-4
FL6
535-5
FBI
535-6
FBI
535-7
FBO
535-8
FBO
535-9
CARRY
535-10
ZERO
535-11
SIGN
535-12
OVER

FIG. 37
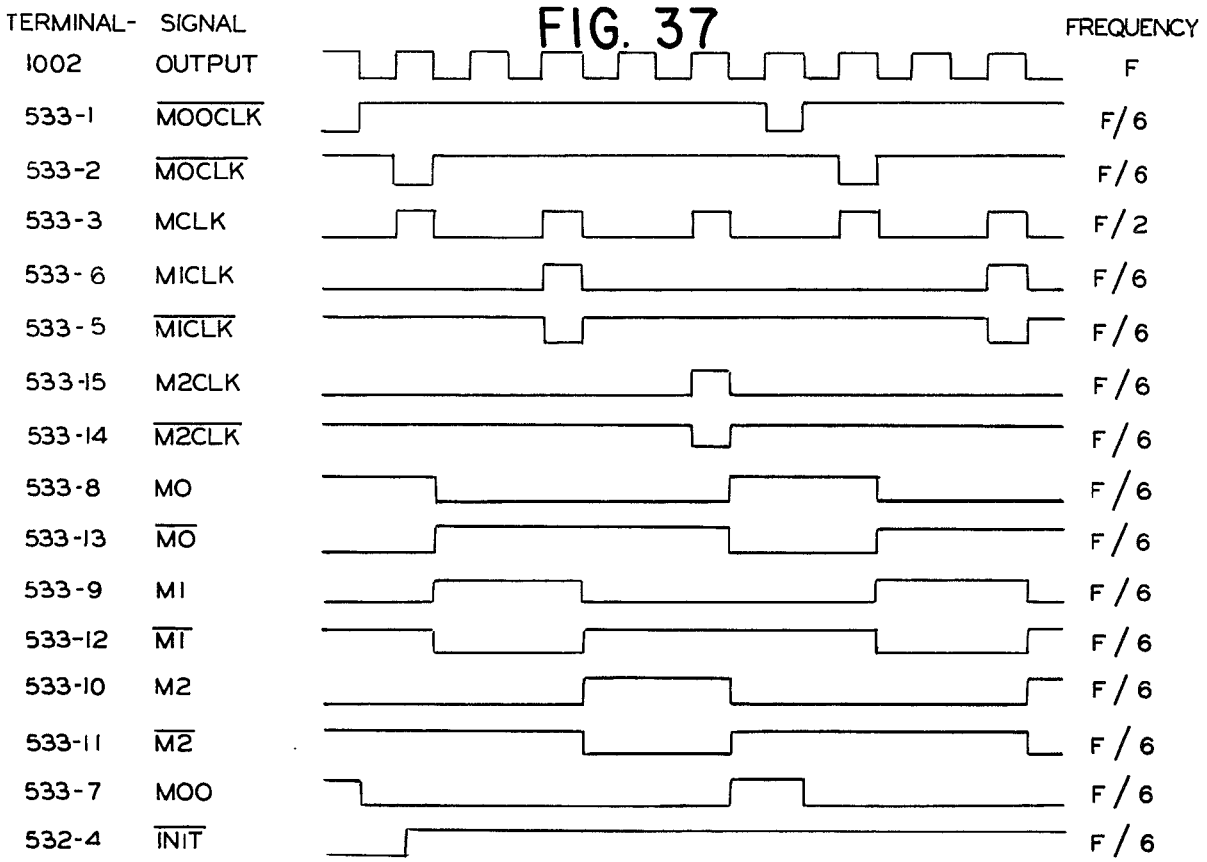
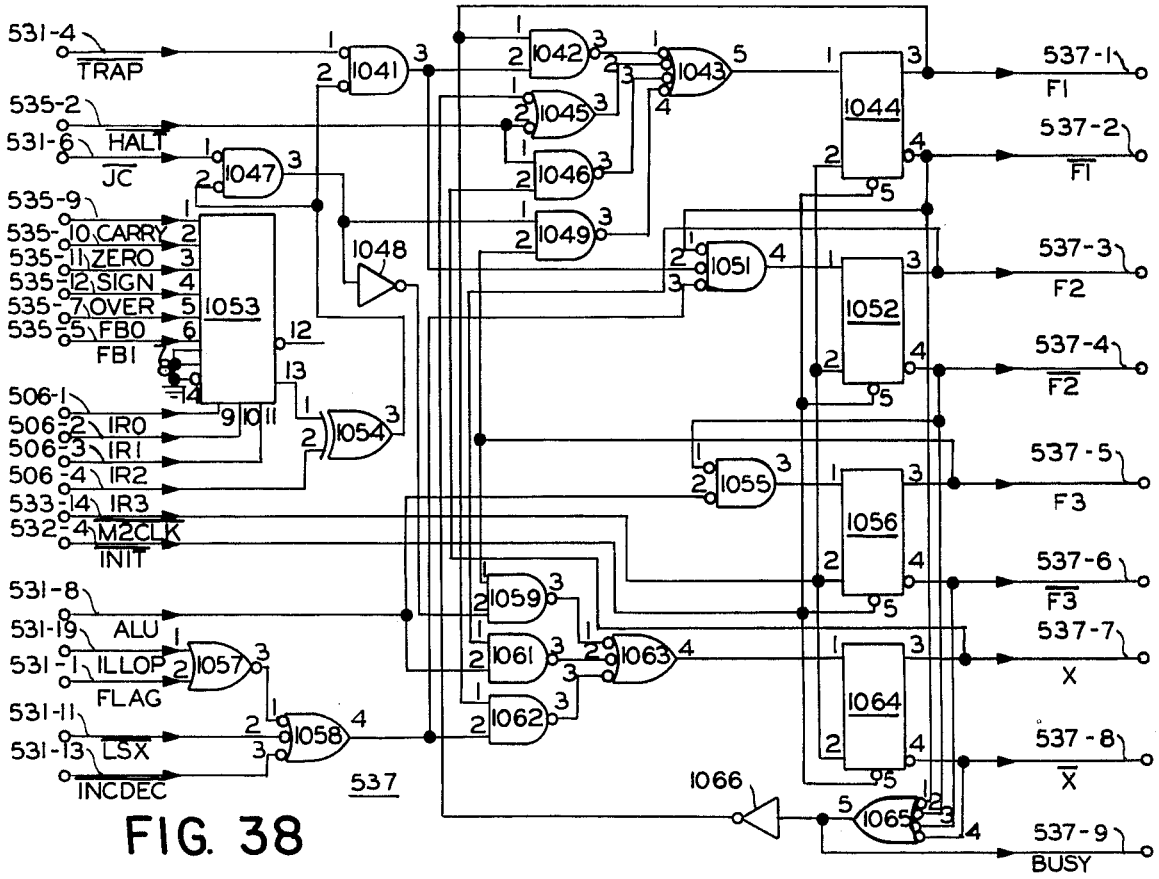
FIG. 38

536
509-8
509-7 IRX7
509-6 IRX6
509-5 IRX5
509-4 IRX4
533-1 IRX3
531-8 M2
504-3 ALU
229-6 FILEA
506-10 A5
535-6 IRI
FBI
535-8
506-9 FBO
229-5 IRO
A4
504-2
531-5 F123
537-7 JCTRAP
506-11 X
506-14 IR2
IR5
229-4
509-11 A3
502-20 IRX2
TP2
533-8
MO
531-10
533-7 LSX
MOO
533-10
M2
506-10
506-13 IRI
IR4
229-3
509-10 A2
502-19 IRXI
TPI
506-9
506-12 IRO
506-14 IR3
229-2 IR5
509-9 AI
502-18 IRXO
TPO
502-17
LTR
1071
1072
1073
1074
1075
1076
1077
1078
1079
1081
1082
1083
1084
1085
1086
1087
1088
1089
1091
1092
1093
1094
1095
1096
1097
1098
1099
536-5
FA4
536-4
FA3
536-3
FA2
536-2
FAI
536-1
FAO

TRANSPORTATION SYSTEM WITH INDIVIDUAL PROGRAMMABLE VEHICLE PROCESSORS

CROSS-REFERENCE TO RELATED APPLICATIONS

The following applications are assigned to the same assignee as the present application and are incorporated by reference herein: U.S. Pat. application Ser. No. 510,498, filed Sept. 30, 1974 in the name of Theodore A. Oliver and entitled "Pulsed Power Supply"; U.S. Pat. application Ser. No. 546,201, filed Feb. 2, 1975 in the name of George S. Dixon et al. and entitled "D. C. Motor Control System"; and U.S. Pat. application Ser. No. 579,921, filed May 22, 1975 in the name of Theordore A. Oliver and entitled "Digital Firing Control For A Converter".

BACKGROUND OF THE INVENTION

1. Field of the Invention

This invention relates in general to a supervisory system for controlling the operation of a vehicle in a transportation system and, in particular, to a programmable processor for controlling a vehicle by receiving service condition signals from the control system and generating control signals in response thereto to control the vehicle in accordance with a predetermined program.

2. Description of the Prior Art

In the discussion which follows, the transportation system of the invention will be disclosed as an elevator system in which the vehicle or vehicles of the system are elevator care, the station calls registered by prospective passengers will be elevator hall calls, the calls registered by passengers within the vehicle will be elevator car calls and the various other system functions will be discussed in elevator system parlance. However, it is to be understood that the invention is applicable to other transportation systems such as horizontally traveling cars or trains of cars for mass transit systems, the class of systems employing smaller vehicles identified as personal rapid transit systems, or conveyors as employed in warehousing and local distribution systems.

Heretofore, the operations of elevators have been controlled by combinations of switching elements having timing and storage functions which establish operating sequences according to various anticipated combinations of car position, call location, car speed, door conditions, car loading and safety conditions. The combinations of elements have been specifically constructed for the control to be achieved such that essentially custom equipment is assembled for each elevator system.

Even the relatively simple logic of a single car selective-collective elevator requires a substantial amount of circuitry to correlate operation of the car starting and stopping controls, direction controls and door controls with call registering devices in the car and at the landings, door protective devices and the various safety devices. Further, where logic circuitry is hard wired for such control functions, little or no flexibility in the operating patterns of the car is available at reasonable expense. The inflexibility of prior elevator systems becomes even more significant as the complexity of the systems increases.

A transportation system including a programmable computer controlled supervisor is disclosed in co-pending U.S. Pat. application Ser. No. 536,199, filed Dec. 24, 1974 in the name of Robert E. Senn et al. and entitled "Transportation System With Programmable Computer Controlled Supervisor", which is assigned to the same assignee as the present application. This system utilizes a general purpose computer with appropriate interfacing to the elevator hoist motor, call registering devices, car position sensors, door operators and safety devices whereby a wide latitude of logic functions is available in establishing the control and operating patterns of elevators. The computer includes a processor for performing the control logic for each car and a memory for storing data. A feature of the system is to maximize, within practical limits, the logic functions performed within the processor and as a corollary, to minimize the logic functions performed in the interface hardware between the system and the processor. One aspect of these features is the utilization of the computer memory in preference to the interface memory to thereby reduce the more expensive interface equipment and increase the speed of access by the processor to the data in the memory.

An elevator system utilizing a system processor to assign hall calls to a plurality of elevator cars is disclosed in U.S. Pat. No. 3,854,554, issued Dec. 17, 1974 to Clyde A. Booker, Jr. Each elevator car includes a car controller capable of directing the car to independently answer hall calls. The system processor controls the elevator cars by providing assignment signals for the car controllers of all the cars which override the normal operation of the car controllers and prevent selected hall calls from being considered by selected cars. Failure of the system processor to provide assignment signals automatically enables the car controllers of all of the cars to consider all of the hall calls. The system is implemented by a system processor which generates assignment signals to selected cars and generates a master assignment signal to all the cars representing all hall calls which have been assigned. The car controller for each car compares its assignment with the master assignment signal and provides inhibit signals for blocking those calls from consideration which are not assigned thereto.

SUMMARY OF THE INVENTION

The transportation system according to the present invention utilizes a programmable processor on a per elevator car basis with appropriate interfacing to the elevator hoist motor, call registering devices, car position sensors, door operators and safety devices. The processor reads service condition signals, processes the service condition signals and generates control signals in response thereto for its associated elevator car under the direction of a stored program. When two or more elevator cars are grouped together for servicing a plurality of common stations, one of the processors is designated as the master processor while the other processors are designated as slave processors. The master processor is programmed to assign the hall calls of the stations to its associated elevator car or to a selected one of the various other elevator cars through their slave processors.

The processor and its associated interface circuits form a supervisor for the elevator car. The interface circuits include a parallel input/output circuit, a safety and power input/output circuit and a position-velocity circuit. Communication between the processor and the interface circuits is accomplished through the transmission of signals over a bus made up of a plurality of address and data lines.

The processor includes a memory for storing the program, an arithmetic logic unit for performing the calculations required by the program and a plurality of registers for manipulating data. Data representing service conditions in the elevator system is received by the interface circuits and is transmitted to the processor over the bus under the direction of the program. The processor utilizes the data to generate control signals which are transmitted over the bus to the interface circuits to control the various elements of the elevator system.

The parallel input/output circuit is connected to a half call interface circuit which receives hall call input signals from push buttons at the landings on hall call lines and receives multiplexed car input signals from the elevator car. The multiplexed car input signals are passed through the hall call interface circuit to the parallel input/output curcuit as are multiplexed car control signals generated by the processor to the parallel input-/output circuit.

When the hall call push button at a landing is pressed, a signal is generated on an associated hall call line to the hall call interface circuit. A sense and clear circuit in the hall call interface circuit responds by setting a latch which sends a signal back to the push button to maintain the push button lamp in a lighted condition. When the call has been served, the processor will generate a clear control signal to the hall call interface circuit through the parallel input/output circuit to reset the latch.

When the car approaches the floor at which it is to stop to service a hall call, the processor generates a hall lantern control signal. The control signal is sent to a hall lantern decoder/driver circuit which generates a signal to turn on the hall lantern.

When two or more cars are to be controlled as a system, each car will be associated with a supervisor as described above. However, one of the supervisors will be designated as the master supervisor and will include the master processor which has control over the assignment of hall calls to all the cars in the system. The rest of the supervisors are designated as the slave supervisors and will include the slave processors. The supervisors are connected in parallel with bi-directional lines so that the master processor can communicate with each of the slave processors through any intervening slave processors to allot the hall calls. If the master processor should fail, each of the slave processors will operate independently to accept hall calls.

it is an object of the present invention to provide an elevator system having an individual programmable processor associated with each elevator car for controlling that elevator car.

It is another object of the present invention to maximize the logic functions performed within the processor thereby decreasing the cost of the hardware associated with an elevator system.

It is a further object of the present invention to provide a plural car elevator system having individual car control processors wherein one processor allots all hall calls among the cars.

BRIEF DESCRIPTION OF THE DRAWINGS

FIG. 4 is a block diagram of the hall call interface circuit of FIG. 3;

FIG. 5 is a schematic diagram of the hall call entered circuit, the sense and clear circuit and the hall call station of FIG. 4;

FIG. 7 is a coding table for the hall lantern decoder/-driver of FIG. 6;

FIG. 19 is a table of processor instructions;

FIG. 26 is a schematic diagram of the instruction register circuit of FIG. 18;

FIG. 27 is a schematic diagram of the instruction register extended circuit of FIG. 18;

FIG. 30B is a table of logic and arithmetic functions performed by the arithmetic logic unit of FIG. 30A;

FIG. 34 is a schematic diagram of the file register/-multiplexer control circuit of FIG. 20;

FIG. 37 is a waveform diagram of the clock pulse trains generated by the clock circuit of FIG. 36;

FIG. 38 is a schematic diagram of the state counter included in the control circuit of FIG. 18;

DESCRIPTION OF THE PREFERRED EMBODIMENT

Figure 1:
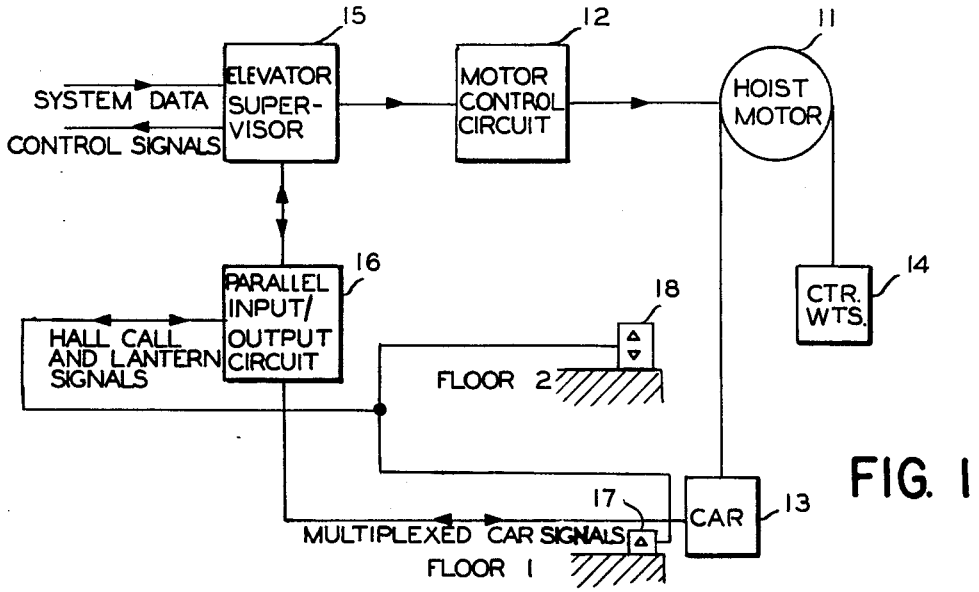
FIG. 1 is a block diagram of a single car elevator system embodying the present invention.
Figure 2:
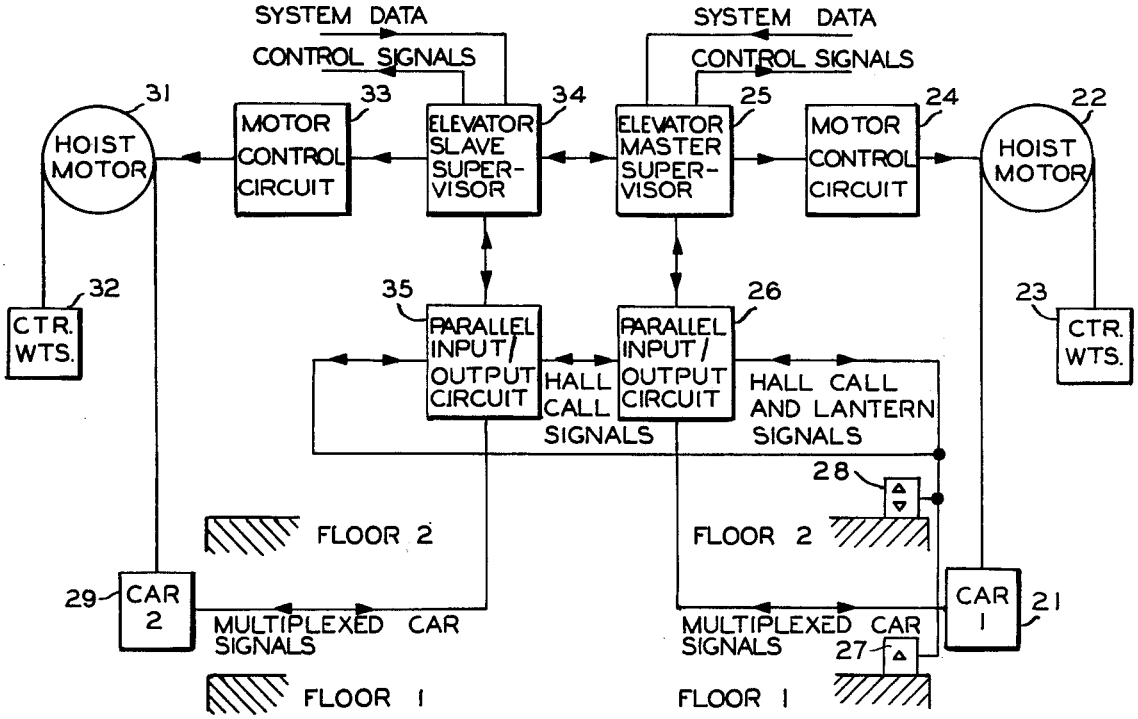
FIG. 2 is a block diagram of a two car elevator system utilizing an alternate embodiment of the present invention for a multi-car system.

FIGS. 1 and 2 ELEVATOR SYSTEM

FIG. 1 is a block diagram of a single car elevator system embodying the present invention. In that system, a hoist motor 11, which advantageously from the standpoint of speed control, can be a D.C. motor having a separately energized shunt field winding, and an armature supplied with power from a motor control circuit 12, drives an elevator car 13. The car 13 is counter weighted as at 14 to compensate for some suitable portion of the weighted load of the car, ordinarily 40% by weighted load, whereby the car is fully counter balanced when loaded to 40% capacity, is less than counter balanced when loaded in excess of 40%, and is overbalanced when loaded to less than 40% of rated capacity. Control of the speed of the hoist motor 11 is performed by the motor control circuit 12. The control circuit 12 may include a direct current generator having its armature driven from a suitable prime mover at a constant speed, and a shunt field current varied to control the voltage applied to the motor armature in accordance with well-known Ward-Leonard principles. The shunt field of the generator may be supplied from any suitable source, as for example, a group of silicon controlled rectifiers having phased control firing circuits which may be of the general type disclosed in U.S. Pat. No. 3,593,077 which issued July 13, 1971 to Richard C. Loshbough, entitled "Electrical Circuit For Pulse Fed Induction Load".

Alternately, the motor control circuit 12 may include a field control circuit as disclosed in U.S. Pat. application Ser. No. 510,498, filed Sept. 30, 1974 in the name of Theordore A. Oliver and entitled "Pulsed Power Supply" and an armature control circuit as disclosed in U.S. Pat. application Ser. No. 579,921, filed May 22, 1975 in the name of Theodore A. Oliver and entitled "Digital Firing Control For A Converter". The field and armature current command signals for the field and armature control circuits may be generated by the motor control system disclosed in U.S. Pat. application Ser. No. 546,201, filed Feb. 3, 1975 in the name of George S. Dixon et al. and entitled "D.C. Motor Control System". The above-identified applications are co-pending with and are assigned to the same assignee as the present application.

The motor control circuit 12 receives a speed pattern control signal from an elevator supervisor 15, which controls the operation of the elevator system. The elevator supervisor 15 receives system data signals representing car position, car speed, direction of travel, and target floor data. Car position data can be attained digitally as through an up/down counter activated by the rotational motion of the governor or elevator drive sheave. Pulses generated in given sequences can signify the direction of travel and displacement, conveniently in increments of 0.01 foot. Correction for missed count, false count, and cable stretch or slip can be superimposed on the count of the counter from a set of vanes at each floor which produce a binary code strobed each time a floor is passed. The target floors are generated by the elevator supervisor 15 utilizing target floor data which include hall call and car call data from a parallel input/output circuit 16. The circuit 16 receives multiplexed car call signals from the elevator car 13 and hall call signals from a pair of push buttons 17 and 18 located at the floors or landings where the elevator car 13 can stop.

The system data input to the elevator supervisor 15 includes service condition signals such as door open, door close, safe ray, car start and others. The supervisor 15 includes a processor which is programmed to control the operation of the elevator car. The processor utilizes the system data signals, the car signals, and the hall call signals to generate the supervisory and speed pattern signals for the elevator system.

The elevator supervisor and parallel input/output circuit of the present invention may also be utilized in a multi-car system as shown in FIG. 2 where two or more cars are controlled under a common program. A first elevator car 21 is driven by a hoist motor 22 and is counter weighted at 23 to compensate for some suitable portion of the rated load of the car. Power is applied to the hoist motor 22 by a motor control circuit 24. The motor control circuit 24 receives a speed pattern control signal from an elevator supervisor 25. The supervisor 25 has as inputs the system data signals and the hall call and multiplex car signals from a parallel input/output circuit 26 for the first elevator car 21. The hall call signals are received from push buttons such as 27 and 28 located at the floors which the elevator car services. A second elevator car 29 is driven by a hoist motor 31 and is counter weighted at 32 to compensate for some suitable portion of the rated load of the car. Power is applied to the hoist motor 31 by a motor control circuit 33. The motor control circuit 33 receives a speed pattern control signal from an elevator supervisor 34. The supervisor has as inputs, the system data signals and the hall call and multiplex cell signals from a parallel input-/output circuit 35 for the second elevator car 29. The hall call signals are received from push buttons such as the push buttons 27 and 28 located at the floors which the elevator car services.

Since the hall calls of any particular floor can be serviced by either elevator car, provision must be made for elevator master supervisor which controls the allotment of hall calls between the elevator cars 21 and 29. In FIG. 2, the supervisor 25 is designated as the elevator master supervisor and the supervisor 34 is designated as the elevator slave supervisor. The elevator master supervisor 25 receives hall calls through the parallel input/output circuit 26 and allots them to either the car 21 or the car 29. The hall calls alloted to the car 29 are sent to the elevator slave supervisor 34 by the elevator master supervisor 25 which accepts the allocated hall calls rather than hall calls from its associated parallel input-/output circuit 35. Should there be a failure of the elevator master supervisor 25, the elevator slave supervisor 34 would be free to accept hall calls from the parallel input/output circuit 35 for allotment to the elevator car 29 only.

FIG. 3 ELEVATOR CONTROL CIRCUITS

Figure 3:
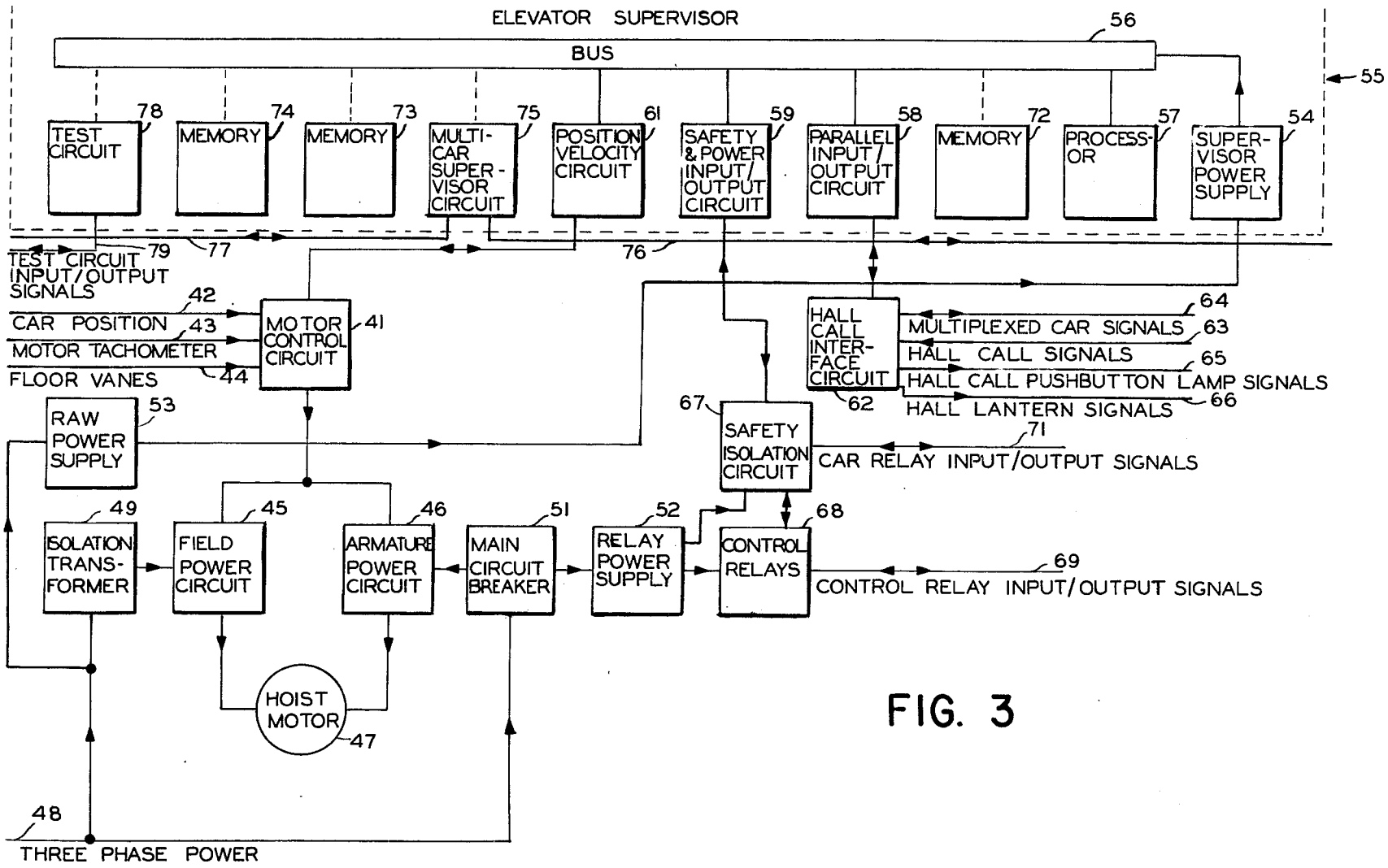
FIG. 3 is a more detailed block diagram of the control circuits which may be utilized in the elevator systems of FIGS. 1 and 2.

Referring to FIG. 3, there is shown a more detailed block diagram of an elevator system including the control circuits which may be utilized in the elevator systems of FIGS. 1 and 2. A motor control circuit 41 which is similar to the motor control circuit 12 of FIG. 1 and the motor control circuit 24 and 33 of FIG. 2, receives signals representing the position of the elevator car on the car position input line 42, motor speed on a motor tachometer input line 43 and the position of the car with respect to an adjacent floor on a floor vanes input line 44. The motor speed signal is utilized by the motor control circuit 41 along with a speed pattern control signal from the elevator supervisor to generate current command signals to a field power circuit 45 and an armature power circuit 46.

The field power circuit 45 responds to a field current command signal to regulate the field current supplied to a hoist motor 47. Similarly, the armature power circuit 46 responds to an armature current command signal to regulate the armature current supplied to the hoist motor 47. The controlled field and armature currents determine the speed of rotation of the hoist motor, and therefore, the speed of an elevator car (not shown) driven by the direct current hoist motor 47.

Both the field power circuit 45 and the armature power circuit 46 may be supplied with power from a conventional three-phase alternating current power source (not shown) on an input line 48. The input line 48 is connected to the field power circuit 45 through a transformer 49 which isolates the field power circuit 45 from the three-phase power supply. The transformer 49 may also transform the three-phase input power into a single-phase power in order that a relatively inexpensive single-phase converter may be utilized in the field power circuit 45 to generate direct current power for the motor field winding. The input line 48 is connected to the armature power circuit 46 through a main circuit breaker 51 which protects the hoist motor 47 from damage due to an over current condition.

The main circuit breaker 51 also protects a relay power supply 52 which is connected to the input line 48 through the breaker. The input line 48 is also connected to a raw power supply 53 which transforms the relatively high voltage input power into a relatively low voltage, typically twenty-four volts, unregulated direct current input power. The unregulated power from the raw power supply 53 is connected to a supervisor power supply 54 which supplies regulated power at various voltages to the circuit elements of an elevator supervisor 55. Typically, the supervisor power supply 54 may generate regulated direct current power at positive five volts, negative twelve volts, positive and negative fourteen volts, and positive and negative twenty-four volts.

The output power from the supervisor power supply 54 is connected to a bus 56 which distributes the power to the circuits comprising the elevator supervisor 55. The basic supervisor includes a supervisor power supply 54, the bus 56, a processor 57, a parallel input/output circuit 58, a safety and power input/output circuit 59, and a position-velocity circuit 61. Communication between the elements of the elevator supervisor 55 is accomplished through the transmission of signals over the bus 56 which is made up of a plurality of parallel address and data lines.

The processor 57 includes a memory for storing a program and data and an arithmetic and logic unit for performing the calculations required by the program. Data representing service conditions in the elevator system is received by the supervisor interface circuits 58, 59 and 61 and is transmitted to the processor 57 over the bus 56. The processor 57 utilizes the data to generate control signals which are transmitted over the bus 56 to the interface circuits 58, 59 and 61 to generate the supervisory and speed pattern control signals to the various elements of the elevator system.

The parallel input/output circuit 58 is connected to a hall call interface circuit 62. The hall call interface circuit 62 receives hall call input signals from push buttons at the landings on a hall call line 63 and also receives from the elevator car, multiplexed car input signals on a multiplexed car signals line 64. The multiplexed car input signals, including car calls, door open requests, and door close request signals, are passed through the hall call interface circuit 62 to the parallel input/output circuit 58. Multiplexed car output signals, including car call indicator, direction indicator and position indicator signals, generated by the processor 57 and the parallel input/output signal 58, are sent through the hall call interface circuit 62 and to the elevator car on the multiplexed car signals line 64.

Each hall call signal received on the line 63 sets a latch in the hall call interface circuit 62. The latch sends a signal on a hall call push button lamp signals line 65 to maintain in a lighted condition the lamp associated with the push button wherefrom the hall call was originated until the hall call is served. When the hall call is served, the processor 57 directs the parallel input/output circuit 58 to reset the latch which removes the latch signal from the hall call push button lamp signals line 65 to extinguish the hall call push button lamp.

When a car is approaching a floor at which the car is to stop to service a registered hall call, the processor directs a hall lantern decorder/driver circuit (not shown) included in the parallel input/output circuit 58, to generate a signal to turn on the hall lantern which will indicate the direction of travel the car at the floor of the registered hall call. This signal is sent through the hall call interface circuit and onto a hall lantern signals line 66 to the respective hall lanterns. When the elevator car reaches the floor at which it is to stop, the processor cancels the hall lantern signal through the hall lantern decoder/driver circuit (not shown) and the hall call interface circuit 62 to extinguish the hall lantern.

The safety and power input/output circuit 59 is connected to a safety isolation circuit 67 through which signals pass to and from a control relays circuit 68. The control relays are supplied with 120 volt alternating current power from the relay power supply 52. The input signals to, and the output signals from, the control relays 68 are carried on a line 69. These control relays include such switches and relays as the safety string, the lobby fire service switch, the lobby shut down switch, the up peak and down peak clock control, and the car and counter buffer switches. The input signals to and the output signals from the car relays also pass through the safety isolation circuit 67 and are carried on a car relay input/output signals line 71. These car relays include such switches and relays as the fire service on switch, the car door open and close relays, and the safe edge relays. The power for the car relays is supplied from the relay power supply 52. The control relay and car relay input signals are provided with photo isolation between the relays and the safety and power input/output circuit 59 to eliminate electrical noise which may generate false signals.

The relay input signals from the control relays and the car relays represent service conditions in the elevator system. These signals are stored in a memory in the safety and power input/output circuit until they are read from the memory by the processor 57 over the bus 56. The processor then generates associated supervisory control signals which are sent to various elements of the elevator system through the safety and power input-/output circuit 59.

The signals on the car position line 42 are sent through the motor control circuit 41 to the position-velocity circuit 61 where they are accumulated as a car position count with respect to the path of travel of the elevator car. Each time the car passes or stops at a floor, a set of floor vanes is read on the floor vanes line 44. The floor vanes signal is sent through the motor control circuit 41 to the position-velocity circuit 61 where it is utilized to address a memory containing a binary representation of the location of that floor with respect to the path of travel of the elevator car. The floor location data may then be utilized to correct any errors which may have occurred in the accumulated car position count.

The processor 57 generates a speed pattern control signal through the position-velocity circuit 61 to the motor control circuit 41. The processor has stored in its memory a velocity pattern program which includes a set of velocity equations written in terms of distance and elapsed time from the start from the last stop of the car. The processor reads the car position from the accumulated count in the position-velocity circuit 61 and keeps track of the elapsed time. Since the processor can also remember the location of the last stop for the car, it can sequentially generate velocity pattern control signals in the form of binary words to the position-velocity circuit 61. The position-velocity circuit 61 includes a digital-to-analog converter for generating an analog speed pattern control signal to the motor control circuit 41. The motor control circuit 41 compares the analog speed pattern control signal with the analog motor tachometer signal on line 43 and adjusts the magnitudes of the field and armature current command signals to minimize any difference between the two. Thus, the car velocity closely follows the set of velocity equations in the processor velocity pattern generation program for optimum movement of the elevator car between stops.

Many of the more complicated control programs will require more memory capacity than is available in the processor 57. As shown, additional memories may be added to the elevator supervisory 55 such as memories 72, 73 and 74 to expand the capacity of the system. Each memory can be addressed by the processor 57 which then can write into or read from that memory as required through the innerconnecting bus 56.

Where two or more elevator cars are to be controlled together, each car will be associated with control circuits such as the ones shown in FIG. 3. However, one of the elevator supervisors will be designated as the master supervisor and therefore must have control over the assignment of hall calls to all the cars. The elevator supervisor associated with each car will have multi-car supervisor circuit such as circuit 75 of FIG. 3 connected to the bus 56. The circuit 75 is connected to a multi-car supervisor circuit of another elevator supervisor by a bi-directional line 76 and may be connected to another multi-car supervisor circuit if it is available by another bi-directional line 77. The bi-directional lines are connected in to the inputs of the circuit so that all multi-car supervisor circuits in the system are connected in parallel. Therefore, the processor in the master elevator supervisor is able to communicate with each of the slave supervisors through any intervening slave supervisors to preempt the distribution of hall calls individually, and to allot hall calls to the slave supervisors in accordance with an alloting procedure program contained in the memory of the master elevator supervisor.

If the master elevator supervisor failed, hall calls would no longer be alloted by the master elevator supervisor and each slave elevator supervisor would be free to accept hall calls on an individual basis. In the alternative, the supervisors may be programmed so that the supervisor of one of the slave elevators takes over as the master elevator supervisor.

The elevator supervisor 55 may also include a test circuit 78 which is left connected to the bus 56 or is connected to the bus 56 only when the supervisor 55 is to be checked. The test circuit 78 is an interface between the elevator supervisor 55 and a programming control computer (not shown). The programming control computer is connected to a test circuit input/output signals line 79 and is utilized to check the operation of the supervisor 55 with various testing programs which simulate the operation and malfunctions in an elevator system. The computer may also be utilized to initially program the processor 57 and enter data into the memory 72, 73 and 74.

In summary, there is shown in FIG. 3 a block diagram of an elevator system according to the present invention. The elevator supervisor 55 includes a processor 57 which is programmed to generate supervisory control signals and speed pattern control signals to an elevator control means in response to the reception of service condition signals representing data on the status of the system components. The service condition signals are received through and the supervisory control signals and speed pattern control signals are sent through the supervisor interface circuits such as the parallel input/output circuit 58, the safety and power input/output circuit 59 and the position-velocity circuit 51 which are connected in parallel to the bus 56. The bus 56 is made up of a plurality of address and data lines for transmitting signals between the elements of the elevator supervisor 55.

Where two or more cars are included in the system, each car is controlled by a supervisor such as the elevator supervisor 55. One of the supervisors may be disignated as the master supervisor for alloting hall calls to the cars in the system. In this case, hall call information is transmitted between the supervisors through a multi-car supervisor circuit connected to the bus in each supervisor. Each slave supervisor performs the same functions for its associated elevator car as are performed by the master supervisor except that the slave supervisor receives hall call information from the master supervisor rather than from its own hall call interface circuit such as the circuit 62 of FIG. 3.

FIG. 4 HALL CALL INTERFACE CIRCUIT

FIG. 4 is a block diagram of a hall call interface circuit 62 of FIG. 3. The parallel input/output circuit 58 is connected to the bus 56 and both are included in the elevator supervisor 55. The hall call interface circuit 62 includes a hall call entered circuit 91, a sense and clear circuit 92, and a hall lantern decoder/driver 93. Although only one hall call station 94 is shown, each landing will have at least one of these stations associated therewith. The hall call station 94 includes a hall call push button and indicator lamp (not shown). When the push button is pressed, the indicator lamp is lighted and a hall call input signal is sent to the sense and clear circuit 92 on the hall call signal line 63. Each hall call station has an associated sense and clear circuit in the hall call interface circuit 62. If a selected one of two or more cars is to respond to a hall call, the hall call station will be connected by the hall call signal line 63 to a sense and clear circuit in a hall call interface circuit common to all the cars.

At the same time the indicator lamp is lighted, the sense and clear circuit 92 responds to the hall call signal by generating a latch signal to the lamp on the hall call push button lamp line 65 to maintain the lamp in a lighted condition after the push button has been released. The sense and clear circuit 92 also sends the hall call input signal on a sense and clear line 95 to the parallel input/output circuit 58 where it is stored and read by the processor.

Each hall call interface circuit 62 includes one hall call entered circuit 91 which is common to all the sense and clear circuits 92 in the hall call interface circuit 62. When the push button is pressed, the signal on the hall call signals line 63 passes through the sense and clear circuit 92 and is sent to the hall call entered circuit 91 on a line 96 to generate a hall call entered signal on a line 97 to a parallel input/output circuit 58. Therefore, the parallel input/output circuit 58 receives a signal on the hall call entered line 97 whenever any one of the hall call push buttons is pressed, to indicate that a hall call has been registered.

The hall call interface circuit 62 also includes the hall lantern decoder/driver 93 which receives an address signal on a group of address lines 98 from the parallel input/output circuit 58. This address signal is a binary coded representation of the floor location and direction indication of the hall lantern which is to be lighted when the elevator car approaches the floor at which it is to stop. A hall lantern 99 representing the up and/or down hall lanterns at each floor receives an enable signal on the hall lantern signal line 66 after the address signal has been decoded by the hall lantern decoder/-driver 93. The enable signal is removed to extinguish the hall lantern when the car stops at the floor.

A car panel (slave) multiplexer circuit 101 is connected to the parallel input/output circuit 58 by the multiplexed car signals line 64 which passes through the parallel input/output circuit 58. The car panel (slave) multiplexer circuit 101 sends car signals in multiplexed form to a master multiplexer (not shown) in the parallel input/output circuit 58. Multiplexed signals which are returned from the parallel input/output circuits include enable signals for the car call push button indicator lamps, for the floor indicator lamps and for the direction of travel indicator lamps which are demultiplexed by the car panel circuit 101.

A lobby panel (slave) demultiplexer circuit 102 is connected to the parallel input/output circuit 58 by a multiplexed lobby signals line 103. The parallel input-/output circuit 58 sends multiplexed lobby signals which represent the floor numbers as the elevator car moves past or stops at each floor. The lobby panel (slave) demultiplexer circuit 102 demultiplexers the lobby signals to generate enable signals for the floor indicator lamps in the lobby.

FIG. 5 HALL CALL ENTERED CIRCUIT, SENSE AND CLEAR CIRCUIT, AND HALL CALL STATION

Referring to FIG. 5, there is shown a schematic diagram of the hall call entered circuit 91, the sense and clear circuit 92, and the circuit of the hall call station 94. In the hall call station 94, an indicator lamp 111 and a hall call push button 112 are connected in series between a direct current power line 113 and a ground line 114 which are common to the three circuits. The hall call signals line 63 and the hall call push button lamp signals line 65 can be connected together in the sense and clear circuit 92, as shown, so that only the one line 63 is needed to connect the circuit 92 with the junction between the lamp 111 and the push button 112 in the hall call station 94.

The power line 113 is connected to a positive power supply (not shown), typically twenty-four volts direct current, in the parallel input/output circuit for each elevator supervisor which is responsive to the hall calls. In the hall call entered circuit 91 there is shown a plurality of power input lines 115, 116, 117 and 118 connected in parallel to the power line 113 for a four car system. Each power supply is isolated from the other power supplies by a diode, such as a diode 119 in the line 115, which blocks current which might flow back to its associated power supply. The ground line 114 is also connected in the circuit 91 to a ground input line 120 which is connected to the same power supplies as are the power input lines to complete the circuits.

Before the push button 112 is pressed, there will be no current flowing through the lamp 111 so that the hall call signals line 63 will be at the same voltage as the power line 113. The line 63 is connected to the sense and clear line 95 in the sense and clear circuit 92 through a resistor 121 to provide the power supply voltage to the parallel input/output circuit to indicate the absence of a hall call. When the push button 112 is pressed, the lamp 111 is connected to the ground line 114 and current will flow to light the lamp 111. The voltage on the lines 63 and 95 will fall to a magnitude near ground potential, representing any voltage drop across the push button 112, to generate a hall call input signal on the sense and clear line 95.

The lines 63 and 95 are also connected through a resistor 122 to an input 123-1 of an inverter 123. In the following descriptions, those elements which may be integrated circuits will be designated with a reference numeral and their leads will be designated by the same reference number followed by a hyphen and lead numeral such as the input lead 123-1. The inverter 123 also has a supply voltage lead 123-2, a ground lead 123-3 connected to the ground line 114 and an output lead 123-4. A signal on the input lead 123-1 is inverted at the output lead 123-4. If a "1" is utilized to designate the presence of a high voltage, positive or logic true signal and a "0" is utilized to designate a low voltage, negative or logic false signal, then a "1" at the input 123-1 will generate a "0" at the output 123-4 and a "0" at the input 123-1 will generate a "1" at the output 123-4. The magnitude of the "1" that is generated will be determined by the magnitude of a supply voltage at the lead 123-2.

Before the push button 112 is pressed, the power supply voltage on the lines 63 and 95 will place a "1" at the input 123-1 to generate a "0" at the output 123-4.

Since the output 123-4 is connected to a base of a NPN transistor 124 through a resistor 125, the transistor 124 is turned off. A collector of the transistor 124 is connected to the hall call push button lamp signals line 65 and an emitter is connected to the ground line 114. The "0" from the inverter 123 turns off the transistor 124 to prevent current flow through the lamp 111 and the transistor 124 from the power line 113 when the push button 112 is not actuated.

The input 123-1 is also connected to an emitter of a NPN transistor 126 through a diode 127 having its anode connected to the emitter and its cathode connected to the input 123-1. The transistor 126 has a collector connected to the power line 113 and the base connected to the junction of a resistor 128 and anode of a zener diode 129. The opposite end of the resistor 128 is connected to the power line 113 to provide a bias current to the base of the transistor 126. A cathode of the zener diode 129 is connected to the ground line 114 to provide a biase voltage at the base of the transistor which is equal to the zener voltage and typically may be approximately one half of the power supply voltage. Thhe emitter of the transistor 126 is connected to the supply voltage lead 123-2 and the transistor 126, the resistor 128 and the zener diode 129 form a power supply for the inverter 123.

When the push button 112 is pressed, the voltage on the lines 63 and 95 will fall to a relatively low magnitude near ground potential to place a "0" at the input 123-1. This "0" is blocked from the supply voltage lead 123-2 and the emitter of the transistor 126 by the diode 127. Therefore, the power supply including the transistor 126 connectes the lead 123-2 to the supply voltage on the power line 113 less the voltage drop across the transistor 126. This voltage is prevented from reaching the input 123-1 by the diode 127 so that the inverter 123 now generates a "1" at its output 123-4 to the base of the transistor 124. The collector of the transistor 124 will be near ground potential while the push button 112 is depressed so that the transistor 124 remains turned off.

When the push button 112 is released, the voltage of the collector of the transistor 124 will be equal to the supply voltage on the line 113 less the voltage drop across the lamp 111 so that the transistor 124 turns on. Therefore, current, representing the latch signal, will flow through the lamp 111 and the transistor 124 which are connected by a hall call push button lamp signals line 65. The lamp 111 is now latched on and can only be turned off by applying a "1" clear signal on the sense and clear line 95. This "1" is applied at the input 123-1 of the inverter 123 to generate a "0" at the base of the transistor 124 to turn it off and stop current flow through the lamp 111. While the lamp 111 is latched on, the lines 63 and 65 rise only to the saturation voltage of the transistor 124 to maintain a "0" on the line 95.

Since the sense and clear circuit 92 is located in the hall call interface circuit 62, which is typically remote from the hall call station 94, the line 63 can be quite long and, therefore, susceptible to electrical noise. This is also true to a lesser extent of the line 95. A capacitor 131 is connected between the sense and clear line 95 and the ground line 114 to filter short duration noise pulses which otherwise could set or clear the latch. Furthermore, large transient voltages can also be picked up by the line 63 from nearby wiring. Therefore, a pair of diodes 132 and 133 are untilized to protect the inverter 123 and the transistor 124. The diode 132 has an anode connected to the power line 113 and a cathode connected to the hall call signals line 63. The diode 133 has an anode connected to the hall call signals line 63 and a cathode connected to the ground line 114.

The sense and clear circuit 92 is connected to the hall call entered circuit 91 by the line 96 which includes a series resistor 134 connected to the line 63. The line 96 is connected to a base of a PNP transistor 135 as would be all other lines similar to the line 96 from the other sense and clear circuits associated with the other hall call stations. A biasing resistor 136 is connected between the base of the transistor 135 and the power line 113 and an emitter of the transistor 135 is connected to the power line 113. A collector of the transistor 135 is connected to the ground line 114 through a pair of resistors 137 and 138 connected in series.

A NPN transistor 139 has a base connected to the junction between the resistors 137 and 138, an emitter connected to the ground line 114, and a collector connected to the power line 113 through a resistor 141. The collector of the transistor 139 is connected to the hall call entered line 97 through a resistor 142.

Before the push button 112, or any other similarly connected push button, is pressed, the base of the transistor 135 will be connected to the supply voltage by the resistors 134 and 136 to keep the transistor 135 turned off. Since there is no current flowing through the transistor 135, the base of the transistor 139 will be grounded through the resistor 138 to keep the transistor 139 turned off. The line 97 will be supplied with the power supply voltage from the power line 113 to represent the absence of the hall call entered signal.

When a push button 112, or any other similarly connected push button, is pressed, the voltage on the line 63 will fall near ground potential so that the resistors 134 and 136 function as a voltage divider to generate a base voltage for the transistor 135 to turn it on. When a transistor 135 turns on, the supply voltage less the voltage drop across the transistor 135 will be applied across the resistors 137 and 138 which function as the voltage divider to generate a base voltage for the transistor 139 to turn it on. When the transistor 139 turns on, the voltage on the line 97 will fall to the level of the voltage drop across the transistor 139 less the voltage drop across the the resistor 142 to generate the hall call entered signal. This signal will continue to be generated until the clear signal is supplied to the line 95. A capacitor 143 is connected between the line 97 and the ground line 114 to filter any electrical noise on the line 97 which could falsely indicate the presence or absence of the hall call entered signal.

In summary, when the push button 112 in the hall call station 94 is pressed, the lamp 111 is lighted and a hall call input signal is sent on the hall call signals line 63 through the sense and clear circuit 92 and onto the sense and clear line 95 to the parallel input/output circuit. The pressing of the push button 112 also generates a "1" from an inverter 123 to supply a base voltage for the transistor 124. When the push button 112 is released, the transistor 124 turns on to latch the lamp 111 in a lighted condition on the hall call push button lamp signals line 65. The hall call input signal on the line 63 also turns on the transistors 135 and 139 in the hall call entered circuit 91 to generate a hall call entered signal on the line 97 to the parallel input/output circuit.

When the hall call has been serviced, a clear signal is supplied to the sense and clear line 95 to extinguish the lamp 111 and to reset the latch signal on the line 65, the hall call input signal on the line 95 and the hall call entered signal on the line 97.

FIG. 6 HALL LANTERN DECODER/DRIVER

FIG. 7 HALL LANTERN DECODER/DRIVER CODING TABLE

Figure 6:
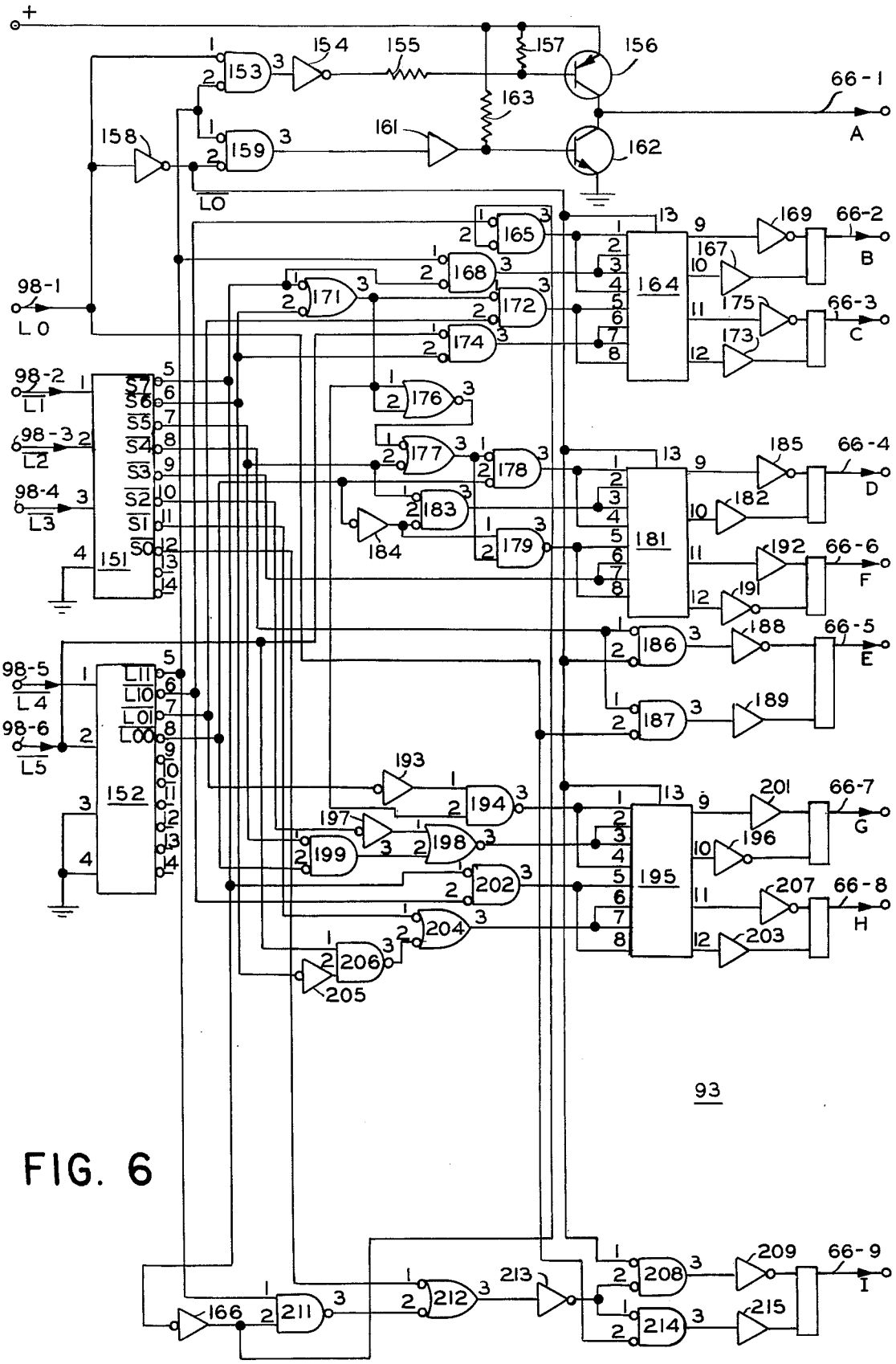
FIG. 6 is a schematic diagram and the hall lantern decoder/driver of FIG. 4.

Referring to FIG. 6, there is shown a schematic diagram of the hall lantern decoder/driver 93 of FIG. 4. Typically, a hall lantern is lighted to indicate that direction of travel the elevator car will take after it leaves a floor. Commonly, the hall lantern is lighted as the car approaches the floor at which it will stop to allow the potential passengers to queue in front of the correct elevator doors in an attempt to reduce the stopping time. When the hall lantern is to be lighted, the parallel input/output circuit 58 of FIG. 4 generates a binary coded hall lantern address signal on the hall lantern address lines 98-1 through 98-6. The signal is decoded to generate a binary coded hall lantern signal on a selected two of the hall lantern signals lines 66-1 through 66-9 to light the hall lantern corresponding to the stopping floor and the subsequent direction of travel of the elevator car. When the car stops at the floor, the address signal is removed from the lines 98-1 through 98-6 to extinguish the hall lantern.

The hall lantern address lines 98-1 through 98-6 receive a six bit address designated as L0, $\overline{L1}$, $\overline{L2}$, $\overline{L3}$, $\overline{L4}$ and $\overline{L5}$ respectively. In the following discussion, a symbol such as "$\overline{L0}$" will represent a "1" for logic true and a "0" for logic false and the inverse symbol "L0" will represent "0" for logic true and "1" for logic false. Five of the six address lines are connected to the inputs of a pair of four line to ten line decoders 151 and 152. The decoder 151 decodes the signals on the lines 98-2 through 98-4 to generate eight subzone signals designated as $\overline{S0}$ through $\overline{S7}$. The decoder 152 decodes the signals on the lines 98-5 and 98-6 to generate four zone signals designated as $\overline{L00}$, $\overline{L01}$, $\overline{L10}$ and $\overline{L11}$. The zone and subzone signals and the L0 signal on the line 98-1 are combined to generate hall lantern signals on the hall lantern signals lines 66-1 through 66-9 designated as "A" through "I" respectively. These lines are connected in pairs to the up and/or down hall lanterns at each floor, such as the hall lantern 99 of FIG. 4. The hall lanterns are conventional elements which are well known in the elevator industry.

The decoder 151 has four address inputs 151-1 through 151-4 which receive signals representing the binary one, binary two, binary four and binary eight bits respectively. As "0" and "1" address signals are applied to the address inputs, a "0" will be placed on a selected one of the outputs 151-5 through 151-14 while the remaining outputs are held at "1". For example, if all the address inputs are at "0", the output 151-5 will be at "0" and the outputs 151-6 through 151-14 will be at "1". Since there are four inputs, the total number of addresses is sixteen. However, there are only ten outputs so that for the addresses binary ten through binary fifteen all outputs will be at "1".

The lines 98-2 ($\overline{L1}$), 98-3 ($\overline{L2}$) and 98-4 ($\overline{L3}$) are connected to the address inputs 151-1, 151-2 and 151-3 respectively and the address input 151-4 is grounded to provide a "0". Therefore, as the address to the decoder 151 is varied from binary zero, a "0" at each address input, to binary seven, a "1" at inputs 151-1 through 151-3 and a "0" input at input 151-4, a "0" will appear at the selected one of the outputs 151-5 through 151-12 in turn. The lines 98-5 ($\overline{L4}$) and 98-6 ($\overline{L5}$) are connected to the address inputs 152-1, and 152-2 respectively and the address inputs 152-3 and 152-4 are grounded to provide a "0". Therefore, as the address to the decoder 152 is varied from binary zero, at "0" at each address input, to binary three, a "1" at inputs 152-1 and 152-2 and a "0" at inputs 152-3 and 152-4, a "0" will appear at the selected one of the outputs 152-5 through 152-8 in turn. If the decoders 151 and 152 are addressed simultaneously, there are thirty-two (eight times four) combinations of output signals from the decoders which may represent 32 different floors. The signals at the outputs 152-5 through 152-8 may be designated as the zones $\overline{L11}$, $\overline{L10}$, $\overline{L01}$ and $\overline{L00}$ respectively while the signals at the outputs 151-12 through 151-5 may be designated as subzones $\overline{S0}$, $\overline{S1}$, $\overline{S2}$, $\overline{S3}$, $\overline{S4}$, $\overline{S5}$, $\overline{S6}$ and $\overline{S7}$ respectively within those zones. Therefore, the section of a different zone and a subzone combination for each floor permits the circuit of FIG. 6 to serve the hall lanterns at 32 floors.

The L0 signal on the address line 98-1 may be utilized to designate the direction of travel for the elevator car, a "0" for upward and a "1" for downward. Therefore, the circuit shown in FIG. 6 has the capability of decoding the direction and floor number for 32 different floors as represented by the address signals on the address lines 98-1 through 98-6. The hall lanterns could be driven from the output signals of the decoders 151 and 152 and the signal on the line 98-1 but this would require a cable containing thirteen wires stretching from the location of the parallel input/output circuit 58, typically the penthouse, to the lowest floor with three connections at each floor for the direction, the zone and the subzone signals. The circuit of FIG. 6 further decodes the address signals to generate hall lantern signals on nine wires connected to the outputs 66-1 through 66-9 wherein there are only two connections at each floor.

FIG. 7 is a coding table for the hall lantern decoder/driver 93 of FIG. 6 as utilized in a building having a maximum of 30 stories plus a basement and a parking level. The columns headed $\overline{L1}$ through $\overline{L5}$ show the address input signal for addressing the corresponding floors listed under the column headed "FLOOR NUMBER". These addresses generate a "0" at the zone and subzone listed under those column headings. The combination of the "0" for the zone and subzone for a floor and a "1" or "0" for the direction on the address input signal L0 will generate a "1" and a "0" on the pair of lines corresponding to the correct hall lantern for that floor. When L0 = "0", the pair of lines is found in the column headed "UP OUTPUT" and when L0 = "1", the pair of lines is found in the column headed "DOWN OUTPUT". For example, the address input signals for floor one are $\overline{L1}$ = "1", $\overline{L2}$ = "1", $\overline{L3}$ = "1", $\overline{L4}$ = "1" and $\overline{L5}$ = "1". The zone is $\overline{L00}$ = "0" and the subzone is $\overline{S2}$ = "0". If L0 = "0", the up hall lantern at floor one will receive a "1" on the line 66-4, the D line, and will receive a "0" on the line 66-7, the G line, to light the up lantern. If L0 = "1", the signals are reversed and the down lantern at floor one will receive a "0" on the line 66-4 and a "1" on the line 66-7 to light the down lantern.

It is obvious that the nine hall lantern signals lines 66-1 through 66-9 provide seventy-two possible pairs of lines for addressing the hall lanterns whereas the address input lines 98-1 through 98-6 provide only sixty-four possible combinations. Since eight lines only provide fifty-six possible pairs of lines, the ninth line is required for a full thirty-two floor capability even though the extra pairs of lines are not used.

Referring to FIG. 6, let us assume that the address for the up hall lantern at floor one has been applied to the address lines 98-1 through 98-6. The decoder 151 will generate a "0" at the output 151-10 for the subzone $\overline{S2}$ and the decoder 152 will generate a "0" at the output 152-8 for the zone $\overline{L00}$. All other decoder outputs will be at "1".

The "A" hall lantern signal on the line 66-1 is determined by the zone $\overline{L11}$ and the direction address input L0. The address input line 98-1 is connected to an input 153-1 of a negative logic NOR element 153. If the NOR has a "0" at both inputs 153-1 and 153-2, it will generate a "1" at an output 153-3 and will generate a "0" at the output 153-3 for any other combination of input signals. Since L0 = "0" and $\overline{L11}$ = "1", the output 153-3 will be at "0" which is changed to a "1" by an inverter 154. The output of the inverter 154 is connected through a resistor 155 to a base of a PNP transistor 156. An emitter of the transistor 156 is connected to a positive polarity direct current power supply (not shown) and the base of the transistor 156 is connected to the same power supply through a resistor 157. The "1" at the base of the transistor 156 will bias it near the power supply potential to turn off the transistor 156 and prevent the power supply potential from being applied to the hall lantern signals line 66-1 connected to a collector of the transistor 156.

The L0 signal is inverted to a "1" by an inverter 158 to generate a $\overline{L0}$ signal which is applied to an input 159-2 of a NOR 159. The $\overline{L11}$ signal is applied to an input 159-1 to generate a "0" at an output 159-3. The "0" is applied through a buffer 161 to base of a NPN transistor 162. An emitter of the transistor 162 is connected to ground potential and a collector is connected to the hall lantern signals line 66-1. The base of the transistor 162 is connected to the positive polarity power supply through a resistor 163. The "0" on the base of the transistor 162 turns it off so that there is no signal on the A hall lantern signals line 61-1. However, with both transistors turned off, the line 61-1 will be at approximately one half of the power supply potential which is neither a "1" nor a "0".

It will be observed that a $\overline{L11}$ = "0" signal at the inputs 153-2 and 159-1 will enable the NORs 253 and 159. A L0 = "0" signal will be applied at the input 153-1 to generate a "1" which is inverted to a "0" at the base of the transistor 156 to turn it on and connect the line 61-1 to the positive polarity power supply. As shown in FIG. 7, A = "1" in the "UP OUTPUT" column for the floors twenty-three through thirty where the zone $\overline{L11}$ = "0" as the subzones $\overline{S0}$ through $\overline{S6}$ are selected respectively. When L0 = "1", the inverter 158 will generate a "0" at the input 159-2. The NOR 159 will then generate a "1" to turn of the transistor 162 which connects the line 66-1 to ground to set A = "0" as shown in the "DOWN OUTPUT" column of FIG. 7.

The B and C outputs on the lines 66-2 and 66-3 are generated by a two line to one line data selector/multiplexer 164 and a pair of output networks, a B network and C network. When there is a "1" at a selection input 164-13, the signals applied to the inputs 164-1, 164-3, 164-5 and 164-7 are placed on the outputs 164-9 through 164-12 respectively. When there is a "0" at the selection input 164-13, the signals applied to the inputs 164-2, 164-4, 164-6 and 164-8 are placed on the outputs 164-9 through 164-12 respectively.

The inputs 164-1 and 164-4 are connected to an output 165-3 of a NOR 165 and the inputs 164-2 and 164-3 are connected to an output 168-3 of a NOR 168. If a $\overline{L10}$ = "1" signal is applied to an input 165-1 and a $\overline{L11}$ = "1" signal is applied to an input 168-1, a "0" would be generated at both of the outputs 165-3 and 168-3. Therefore, whether L0 = "0" or "1", a "0" will be generated by a buffer 167 connected to the output 164-10 and a "1" will be generated by an inverter 169 connected to the output 164-9 to the B network. The B network is similar to the output network for the A signal, as defined by the resistors 155, 157 and 163 and the transistors 156 and 162, and is shown in block form, as are the output networks for the C through I signals, only to simplify FIG. 6. The previously described input signals will turn off both transistors (not shown) and no signal will be generated on the hall lantern signals line 66-2 connected to the output of the B network.

It will be observed that a $\overline{L10}$ = "0" signal at the input 165-1 will enable the NOR 165 which will generate a "1" as the subzones $\overline{S0}$ through $\overline{S6}$ are selected. If $\overline{L0}$ = "1", the input 164-1 is selected to place the "1" at the output 164-9 where it is inverted to a "0" to turn on the PNP transistor (not shown) in the B network to generate a "1" on the line 66-2 as shown for the floors fifteen through twenty-one in the "UP OUTPUT" column of FIG. 7. If $\overline{L0}$ = "0", the input 164-4 is selected to turn on the NPN transistor (not shown) to generate a "0" on the line 66-2. If $\overline{L11}$ = "0" and $\overline{S7}$ = "0", the NOR 168 will generate a "1". If $\overline{L0}$ = "1". the input 164-3 is selected and the "1" will turn on the NPN transistor (not shown) to generate a "0" on the line 66-2 to make B = "0" for floor thirty in the "UP OUTPUT" column of FIG. 7. If $\overline{L0}$ = "0", the input 164-2 is selected and a B = "1" is generated on the line 66-2.

The $\overline{S7}$ and $\overline{S6}$ signals are applied to a pair of inputs 171-1 and 171-2 respectively of a negative logic NAND element 171. A "1" at each of the inputs will generate a "0" at an output 171-3 while any other combination of input signals will generate a "1" at the output 171-3. The output signal at the output 171-3 is designated as S67 and is applied to an input 172-1 of a NOR 172 as a "0" in our example. An input 172-2 receives the $\overline{L01}$ = "1" signal which generates a "0" at an output 172-3. The output 172-3 is connected to the inputs 164-5 and 164-8. The $\overline{L5}$ = "1" and $\overline{S6}$ = "1" signals are applied to a pair of inputs 174-1 and 174-2 of a NOR element 174 which has an output 174-3 connected to the inputs 164-6 and 164-7. Whether $\overline{L0}$ = "0" or "1", a "0" will be generated by a buffer 173 connected to the output 164-12 and a "1" will be generated by an inverter 175 connected to the output 164-11 to turn off both transistors in the C network so that no signal is generated on the C line 66-3.

It will be observed that a $\overline{L01}$ = "0" at the input 172-2 will enable the NOR 172 to generate a "1" as the subzones $\overline{S0}$ through $\overline{S5}$ are selected. If $\overline{L0}$ = "1", the input 164-5 is selected and the C network will generate a "1" on the line 66-3 as shown for the floors seven through twelve in the "UP OUTPUT" column of FIG. 7. If $\overline{L0}$ = "0", the C network will generate a "0" for the same floors. If $\overline{L10}$ = "0" or $\overline{L11}$ = "0" then $\overline{L5}$ must be "0" to enable the NOR 174 at the input 174-1. When the subzone $\overline{S6}$ is selected, the NOR 174 will generate a "1". If $\overline{L0}$ = "1", the input 164-6 is selected and the C network will generate C = "0" for the floors twenty-one or twenty-nine respectively. If $\overline{L0}$ = "0", the C network will generate a "1" for the same floors as shown in the "DOWN OUTPUT" column of FIG. 7.

The S67 = "0" signal is applied to a pair of inputs 176-1 and 176-2 of a positive logic NOR 176 to generate a "1" at an input 177-1 of a NAND 177. An input 177-2 receives the $\overline{S5}$ = "1" signal to generate a "0" at an output 177-3 which is connected to an input 178-1 of a NOR 178 and an input 179-2 of a positive logic NAND element 179. An input 178-2 receives the $\overline{L00}$ = "1" signal to generate a "0" at an output 178-3 which is connected to a pair of inputs 181-1 and 181-4 of a two line to one line data selector/multiplexer 181. The $\overline{S5}$ = "1" signal is received by an input 183-1 of a NOR 183 and the $\overline{L00}$ = "1" signal is changed to a "0" by an inverter 184 at an input 183-2 to generate a "0" at an output 183-3. The output 183-3 is connected to a pair of inputs 181-2 181-2 and 181-3. Whether $\overline{L0}$ = "0" or "1", a "0" will be generated by a buffer 182 connected to the output 181-10 and "1" will be generated by an inverter 185 connected to an output 181-9 to turn off both transistors in the D network so that no signal is generated on the D line 66-4.

It will be observed that a $\overline{L00}$ = "0" signal enables the NOR 178 to generate a "1" as the subzones $\overline{S0}$ through $\overline{S4}$ are selected. If $\overline{L0}$ = "1", the D network will generate a "1" on the line 66-4 as shown for the floors parking through three in the "UP OUTPUT" column of FIG. 7. If $\overline{L0}$ = "0", the D network will generate a "0" for the same floors. If $\overline{L10}$ = "0" or $\overline{L11}$ = "0", then $\overline{L00}$ must be a "1" to enable the NOR 183 at the input 183-2. When the subzone $\overline{S5}$ is selected, the NOR 183 will generate a "1". If $\overline{L0}$ = "1", the input 181-3 is selected and the D network will generate a "0" for the floors twelve, twenty or twenty-eight respectively as shown in the "DOWN OUTPUT" column of FIG. 7. If $\overline{L0}$ = "0", the input 181-2 is selected and the D network will generate a "1" for the same floors.

The $\overline{S4}$ = "1" signal is connected to a pair of inputs 186-1 and 187-1 of a pair of NORs 186 and 187. An output 186-3 is connected through an inverter 188 and an output 187-3 is connected through a buffer 189 to the E network. The NORs each generate a "0" to turn off the transistors in the E network so that no signal is generated on the hall lantern signals line 66-5.

It will be observed that when subzone $\overline{S4}$ is selected, the "0" at the inputs 186-1 and 187-1 will enable the NORs 186 and 187. If L0 = "0" and $\overline{L0}$ = "1", the "1" applied to an input 186-2 of the NOR 186 will generate a "0" which is changed to a "1" by the inverter 188 and the "0" applied to an input 187-2 will generate a "1" so that the E network generates a "0" as each zone is selected for the floors three, eleven, nineteen and twenty-seven. If L0 = "1" and $\overline{L0}$ = "0", the NOR 186 will generate a "1" which is changed to "0" by the inverter 188 and the NOR 187 will generate a "0" so that E = "1" as each zone is selected for the floors three, eleven, nineteen and twenty-seven as shown in the "DOWN OUTPUT" column of FIG. 7.

The "0" output signal from the NAND 177 is designated as the S567 signal and is applied to the 179-2 input of the NAND 179. The $\overline{L00}$ "0" signal is changed to a "1" by the inverter 184 and is applied to an input 179-1 to generate a "1" at an output 179-3 which is connected to a pair of inputs 181-5 and 181-8. Whether $\overline{L0}$ = "0" or "1", a "0" will be generated by a buffer 192 connected to an output 181-11 and a "1" will be generated by an inverter 191 connected to an output 181-12 to turn off both transistors in the F network so that no signal is generated on the F line 66-6. The $\overline{S3}$ = "1" signal is applied to a pair of inputs 181-6 and 181-7.

It will be observed that when $\overline{L00}$ = "0", the NAND 179 is enabled to generate a "0" as the subzones $\overline{S5}$ through $\overline{S7}$ are selected. If $\overline{L0}$ = "1", the F network will generate a "1" on the line 66-6 as shown for the floors four through six in the "UP OUTPUT" column of FIG. 7. If $\overline{L0}$ = "0", the F network will generate a "0" for those floors. If the subzone $\overline{S3}$ is selected and $\overline{L0}$ = "1", the "0" at the input 181-7 will generate a "1" for floors two, ten, eighteen and twenty-six as each zone is selected. If $\overline{L0}$ = "0", the "0" at the input 181-8 will be changed to a "1" by the inverter 191. Therefore, as each zone is selected for the floor two, ten, eighteen and twenty-six, F = "1" as shown in the "DOWN OUTPUT" column of FIG. 7

The $\overline{L01}$ = "1" signal is changed to "0" by an inverter 193 at an input 194-1 of a NAND 194. The S67 = "0" signal from the NAND 171 is applied to an input 194-2 to generate a "1" at a pair of inputs 195-1 and 195-4 of a two line to one line data selector/multiplexer 195. The $\overline{S2}$ = "1" signal is changed to a "0" by an inverter 197 at an input 198-1 of a NOR 198. The $\overline{S5}$ = "1" and $\overline{L00}$ = "1" signals are applied to a pair of inputs 199-1 and 199-2 respectively of a NOR 199 to generate a "0" at an output 199-3. The output 198-3 is connected o an input 198-2 and the NOR 198 generates a "1" at an output 198-3 to a pair of inputs 195-2 and 195-3. Whether $\overline{L0}$ = "0" or "1", a "0" will be generated by a buffer 201 connected to an output 195-9 and a "1" will be generated by an inverter 196 connected to an output 195-10 to turn off both transistors in the G network so that no signal is generated on the G line 66-7.

It will be observed that when $\overline{L01}$ = "0", the NAND 194 is enabled to generate a "0" as the subzones $\overline{S6}$ and $\overline{S7}$ are selected. If $\overline{L0}$ = "1" the G network will generate a "1" on the line 66-7 as shown for the floors thirteen and fourteen in the "UP OUTPUT" column of FIG. 7. If $\overline{L0}$ = "0", the line 66-7 will be at "0" for the same floors. When the subzone $\overline{S2}$ is selected and $\overline{L00}$ = "0", the NOR 198 will generate a "O". If $\overline{L0}$ = "1", the input 195-3 is selected and the G network will generate a "0" on the line 66-7. If $\overline{L0}$ = "0", the input 195-2 is selected and the G network will generate a "1" on the line 66-7. These are the signals for floor one and, as each zone is selected for the floors one, nine, seventeen and twenty-five, the G hall lantern signal on the line 66-7 will be as shown in the "UP OUTPUT" and "DOWN OUTPUT" columns of FIG. 7. If $\overline{L00}$ = "0" and $\overline{S5}$ = "0", the NOR 199 will generate a "1" to the input 198-2 of the NOR 198 which in turn will generate a "0". If $\overline{L0}$ = "1", the "0" will generate a "1" from the G network on the line 66-7. If $\overline{L0}$ = "0", the G network will generate a "0 " for the floor four as shown in the "DOWN OUTPUT" column of FIG. 7.

The $\overline{S7}$ = "1" and the $\overline{L10}$ = "1" signals are applied to a pair of inputs 202-1 and 202-2 respectively of a NOR 202 to generate a "0" at an output 202-3 to a pair of inputs 195-5 and 195-8. The $\overline{S1}$ = "1" signal is applied to an input 204-1 of a NAND 204. The $\overline{S6}$ = "1" signal is changed to a "0" by an inverter 295 at an input 206-2 of a NAND 206. The $\overline{L5}$ = "1" signal is applied to an input 206-1 to generate a "1" at an output 206-3 which is connected to an input 204-2. The NAND 204 generates a "0" at an output 204-3 to a pair of inputs 195-6 and 195-7. An output 195-11 is connected through an inverter 207 and an output 195-12 is connected through a buffer 203 to the H network. Whether $\overline{L0}$ = "0" or "1" both transistors in the H network are turned off so that no signal is generated on the hall lantern signals line 66-8.

It will be observed that when $\overline{L10}$ = "0" and $\overline{S7}$ = "0" the NOR 202 will generate a "1". If $\overline{L0}$ = "1", the H network will generate a "1" on the line 66-8 as shown for the floor twenty-two in the "UP OUTPUT" column of FIG. 7. If $\overline{L0}$ = "0", the H network will generate a "0" on the line 66-8. If the subzone $\overline{S1}$ is selected, the "0" on the input 204-1 will generate a "1" at the output 204-3. If $\overline{L0}$ = "1", the input 195-7 is selected and the H network will generate a "0" on the line 66-8. If $\overline{L0}$ = "0", the input 195-6 is selected and a "1" is generated. Therefore, as each zone is selected for the floors basement, eight, sixteen and twenty-four, the G hall lantern signal will be as shown in the "UP OUTPUT" and "DOWN OUTPUT" columns of FIG. 7. If the subzone $\overline{S6}$ is selected, the "0" is changed to a "1" by the inverter 205 at the input 206-2 to enable the NAND 206. The address bit $\overline{L5}$ = "1" for the zones $\overline{L00}$ and $\overline{L01}$ to generate a "0" at the input 204-2. The NAND 204 will generate a "1" and, if $\overline{L0}$ = "1", the "1" will generate a "0" from the H network on the line 66-8. If $\overline{L0}$ = "0", A "0" will be generated on the line 66-8. Therefore, as the zones $\overline{L00}$ and $\overline{L01}$ are selected for the floors five and thirteen, the H hall lantern signal will be as shown in the "UP OUTPUT" and "DOWN OUTPUT" columns of FIG. 7.

The $\overline{L0}$ signal is applied to an input 208-1 of a NOR 208 which has an output 208-3 connected to an inverter 209. The $\overline{S7}$ = "1" signal is charged to a "0" by the inverter 166 and is applied to an input 211-2 of a NAND 211. The $\overline{L11}$ = "1" signal is applied to an input 211-1 to generate a "1" at an output 211-3 to an input 212-2 of a NAND 212. The $\overline{S0}$ = "1" signal is applied to an input 212-1 to generate a "0" at an output 212-3. The "0" is changed to a "1" by an inverter 213 at an input 208-2 of the NOR 208 and an input 214-1 of a NOR 214. The NOR 208 will generate a "0" at the output 208-3 which is connected to the I network through the inverter 209. The NOR 214 will generate a "0" at an output 214-3 which is connected to the I network through a buffer 215. The L0 signal is applied to an input 214-2 of the NOR 214. Whether L0 = "0", the transistors in the I network are turned off and no signal is generated on the line 66-9.

It will be observed that when subzone $\overline{S0}$ is selected, the NAND 212 will generate a "1" which is changed to a "0" by the inverter 213 at the input 214-1. If L0 = "0", the NOR 214 will generate a "1" and the I network will generate a "0" on the line 66-9. If L0 = "1", the NOR 208 will generate a "1" and the I network will generate a "1" on the line 66-9. Therefore, as each zone is selected for the floors parking, seven, fifteen and twenty-three, the I hall lantern signal will be as shown in the "UP OUTPUT" and "DOWN OUTPUT" columns of FIG. 7. If the subzone $\overline{S7}$ is selected, the NAND 211 will be enabled by a "1" at the input 211-2. If $\overline{L11}$ = "1" which it will as each of the other three zones is selected, the NAND 211 will generate "0" at the input 212-2 to generate a "1" at the output 212-3. The "1" is changed to a "0" by the inverter 213. If L0 = "0", the NOR 214 will generate a "1" and the I network will generate a "0" on the line 66-9. If L0 = "1", the NOR 208 will generate a "1" and the I network will generate a "1" on the line 66-9. Therefore, as the zones $\overline{L00}$, $\overline{L01}$ and $\overline{L10}$ are selected for the floors six fourteen, and twenty-two, the I hall lantern signal will be as shown in the "UP OUTPUT" and "DOWN OUTPUT" columns of FIG. 7.

In summary, the parallel input/output circuit 58 of FIG. 4 generates a binary coded hall lantern address signal on the hall lantern address lines 98-1 through 98-6 as the signal L0 for up and down direction and the signals $\overline{L1}$ through $\overline{L5}$ for the floor. The floor signals are decoded by a pair of four line to ten line decoders 151 and 152 to generate zone signals $\overline{L00}$, $\overline{L01}$, $\overline{L10}$ and $\overline{L11}$ and subzone signals $\overline{S0}$ through $\overline{S7}$. The zone, subzone and L0 direction signals are utilized to generate a plurality of binary coded hall lantern signals on the hall lantern signals lines 66-1 through 66-9. A different pair of hall lantern signals lines are connected to the hall lanterns at each floor such as the hall lantern 99 of FIG. 4. The hall lantern address signals is generated on the lines 98 as the car approaches the floor at which it is to stop. When the car stops at the floor, the address signal is removed from the lines 98-1 through 98-1 to extinguish the hall lantern.

FIG. 8 PARALLEL INPUT/OUTPUT CIRCUIT

Figure 8:
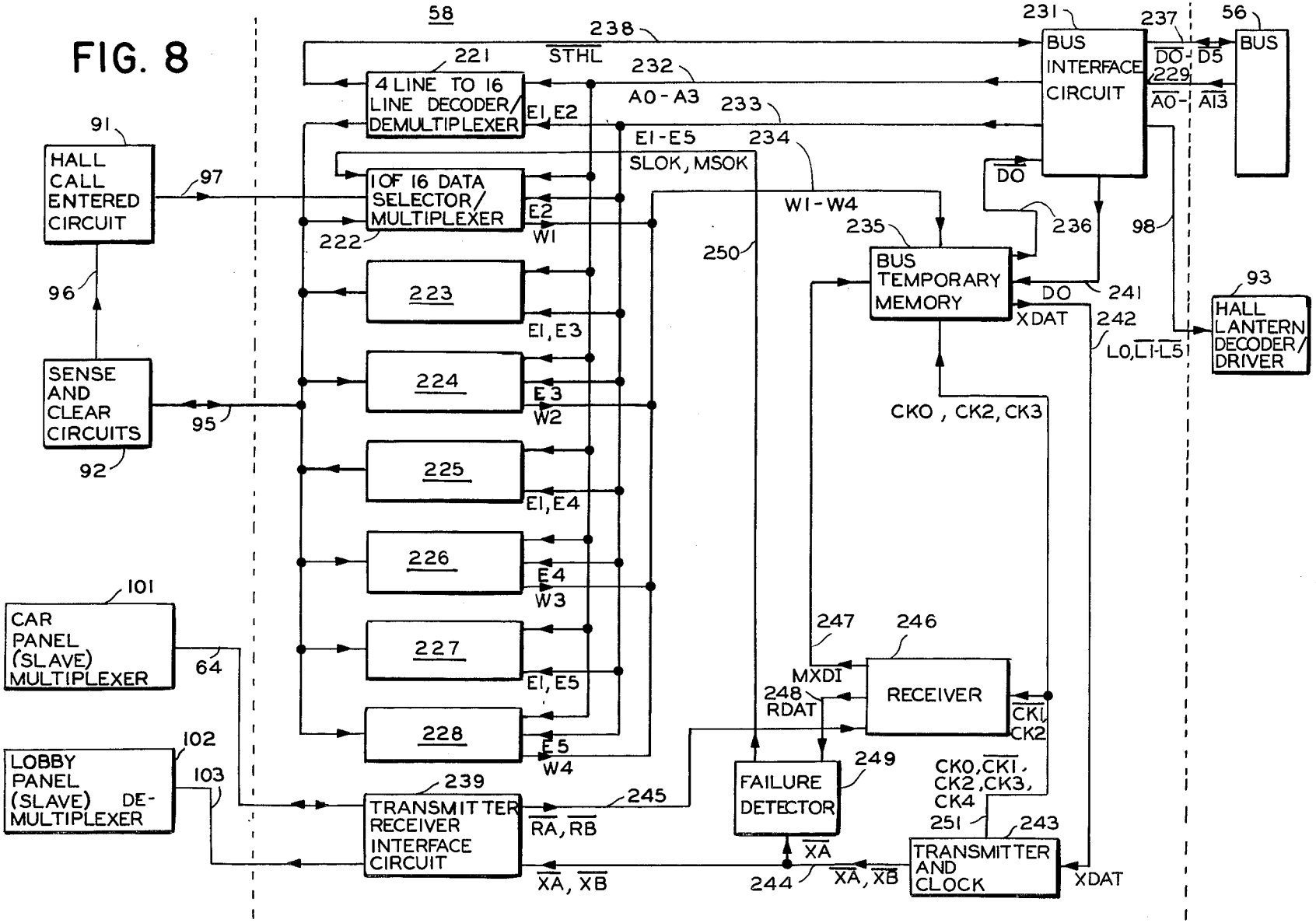
FIG. 8 is a block diagram of the parallel input/output circuit of FIGS. 3 and 4.

A block diagram of the parallel input/output circuit 58 of FIGS. 3 and 4 is shown in FIG. 8. Inputs to the circuit 58 are the hall call entered signal on the hall call entered line 97 from the hall call entered circuit 91, the hall call input signals on the sense and clear lines 95 from the sense and clear circuits 92, the multiplexed car input signals on the multiplexed car signals line 64 from the car panel (slave) multiplexer 101, and address, data and control signals from the bus 56. Outputs from the circuit 58 are the clear signal on the sense and clear line 95, multiplexed lobby signals on the line 103 to the lobby panel (slave) demultiplexer, multiplexed car output signals on the multiplexed car signals line 64, the address signals on the hall lantern address lines 98 to the hall lantern decoder/driver 93 and data signals representing hall calls to the bus 56.

The following list of element reference numerals and signal definitions is provided as an aid in understanding the circuits of FIGS. 8 through 16.

| | |
|---|---|
| 221 | 4 line to 16 line decoder/demultiplexer |
| 222 | 1 to 16 data selector/multiplexer |
| 231 | Bus interface circuit |
| 235 | Bus temporary memory |
| 239 | Transmitter receiver interface circuit |
| 243 | Transmitter and clock |
| 246 | Receiver |
| 249 | Failure detector |
| $\overline{A0}$ - $\overline{A6}$, $\overline{A8}$ | Inverted address bits |
| A0 - A13 | Bus address bits |
| BUSR | Bus read signal |
| BUSW | Bus write signal |
| CK | Clock basic pulse train |
| CK0, CK1, $\overline{CK1}$, CK2, CK3, CK4 | Clock output pulse trains |
| $\overline{DIP}$ | Bus data input signal |
| $\overline{DOP}$ | Bus data output signal |
| DO | Data for memory signal |
| $\overline{D0}$ - $\overline{D5}$ | Bus data bits |
| E1 - E5 | Data selector/multiplexer and decoder/demultiplexer enable signals |
| EW | Enable write signal |
| L0, $\overline{L1}$ - $\overline{L5}$ | Hall lantern address signals |
| MSOK | Master multiplexer failure signal |
| MXDI | Demultiplexed data in signals |
| $\overline{RA}$, $\overline{RB}$ | Multiplexed data received |
| RCV | Receiver status signal |
| RCV OUTPUT | Transmitter status signal |
| RDAT | Data received signal |
| SLOK | Slave multiplexer failure signal |
| $\overline{STHL}$ | Generate hall lantern address signals signal |
| W1 - W4 | Data selector/multiplexer output signals |
| $\overline{XA}$, $\overline{XB}$ | Multiplexed data transmitted |
| XDAT | Data signals to be transmitted |

-continued

| | |
|---|---|
| XMT | Enable transmitter signal |

The parallel input/output circuit 58 includes a plurality of four line to sixteen line decoder/demultiplexers 221, 223, 225, and 227 and a plurality of one of sixteen data selector/multiplexers 222, 224, 226 and 228 for receiving the hall call input signals and the hall call entered signal and for generating the clear signals to extinguish the hall call push button lamps. The hall call entered line 97 is connected to one input of the data selector/multiplexer 222 and each sense and clear circuit 92 has a separate sense and clear line connected to an input of one of the data selector/multiplexers and an output of one of the decoder/demultiplexers. The data selector/multiplexers receive the status of the hall call entered signal and the hall call input signals and may be selectively addressed for reading the status of any one of the stored signals.

The address signal for the signal to be read is generated by the processor (not shown) onto the bus 56 and is received on a plurality of bus address lines 229 as the address bits $\overline{A0}$ through $\overline{A13}$. The address bits $\overline{A0}$ through $\overline{A3}$ are inverted to A0 through A3 in a bus interface circuit 231. The A0 through A3 signals are sent on a plurality of address lines 232 to all the decoder/demultiplexers and the data selector/multiplexers. The bus interface circuit 231 also generates enable signals E2 through E5, one for each data selector/multiplexer, on a plurality of enable lines 233. A portion of the address from the processor determines which enable signal is generated and therefore which one of the data selector/multiplexers is enabled. The A0 through A3 address signals select one of the storage positions in the enabled data selector/multiplexer and the status of the signal is generated as the corresponding one of the output signals W1 through W4 on the associated output line of a plurality of output lines 234 to a bus temporary memory 235. The bus temporary memory responds by generating the output signal as the $\overline{D0}$ bit of data on a line 236 which is passed through the bus interface circuit 231 and onto one of a plurality of data lines 237 of the bus 56.

When a hall call has been serviced, the processor generates the address bits $\overline{A0}$ through $\overline{A13}$ on the address lines 229 of the bus 56. The bus interface circuit 231 responds by generating the address bits A0 through A3, an enable signal E1 and the one of the enable signals E2 through E5 which selects the data selector/multiplexer and the decoder/demultiplexer and the correct selection positions therein for the hall call station. The selected decoder/demultiplexer generates a clear signal on the proper sense and clear line 95 to extinguish the hall call push button lamp. The clear signal is also applied to the data selector/multiplexer to reset the status of the hall call signal. Now when the processor removes the address, the data selector/multiplexer is ready to receive a hall call input signal from that hall call station.

When a hall lantern is to be turned on, the processor sends the address bits $\overline{A0}$ through $\overline{A13}$ on the address lines 229 and the data bits $\overline{D0}$ through $\overline{D5}$ on the data lines 237. The bus interface circuit 231 responds to the address bits by generating an address A0 through A3 and the E1 and E2 enable signals to the decoder/demultiplexer 221 which generates a $\overline{STHL}$ signal on a line 237 to the bus interface circuit 231. The bus interface circuit responds to the $\overline{STHL}$ signal and the $\overline{D0}$ through $\overline{D5}$ data bits to generate the L0 and $\overline{L1}$ through $\overline{L5}$ hall lantern address signals on the lines 98 to the hall lantern decoder/driver. The bus interface circuit 231 includes a latch for storing the L0 and $\overline{L1}$ through $\overline{L5}$ signals until they are changed by the processor to extinguish the hall lantern.

The car panel (slave) multiplexer 101 is connected by the multiplexed car signals line 64 to a transmitter/receiver interface circuit 239 in the parallel input/output circuit 58. The lobby panel (slave) demultiplexer 102 is connected to the interface circuit 239 by the multiplexed lobby signals line 103. When data is to be transmitted to the slave circuits 101 and 102, the processor generates the address bits which are received on the address lines 229 and generates the $\overline{D0}$ data bit on one of the data lines 237. The $\overline{D0}$ data bit is inverted to D0 by the bus interface circuit 231 and is received by the bus temporary memory 235 on a D0 line 241. The bus temporary memory 235 generates the D0 data on a XDAT line 242 to a transmitter and clock 243. The transmitter and clock 243 then multiplexes and generates the D0 data on the $\overline{XA}$, $\overline{XB}$ transmit lines 244 to the transmitter/receiver interface circuit 239 which places the data onto the lines 64 and 103, as multiplexed output signals. The multiplexed output signals are demultiplexed by both slaves.

When data is generated as multiplexed car input signals on the line 64, the transmitter/receiver interface circuit 239 generates the data on the $\overline{RA}$ and $\overline{RB}$ receive lines 245 to a receiver 246. The receiver demultiplexes the data and generates it on a MXDI line 247 to the bus temporary memory. The processor may then address the parallel input/output circuit 58 and the bus temporary memory will generate the received data as the $\overline{D0}$ data on the line 236 to the bus interface circuit 231 which will pass the $\overline{D0}$ signal onto one of the data lines 237 to be read by the processor. The receiver also utilizes the MXDI signal to generate a RDAT signal. The $\overline{XA}$ transmit line 244 and the RDAT line 248 are monitored by a failure detector 249 which generates a MSOK signal to indicate a failure in the master multiplexer, the transmitter and clock 243, or generates a SLOK signal to indicate a failure in the slave multiplexer, the slaves 101 and 102. The MSOK and SLOK signal are generated on a pair of lines 250 to the data selector/multiplexer 222.

The transmitter and clock generates clock pluse trains at various predetermined frequencies, such as clock pulse trains CK0, $\overline{CK1}$, CK2, CK3 and CK4, on a plurality of clock lines 251. These clock pluse trains synchronize the passage of data through the parallel input/output circuit 58 to enable the individual data bits to be identified as they are multiplexed, demultiplexed, placed in storage or read from storage.

FIG. 9 HALL CALL INPUT/OUTPUT CIRCUITS

Figure 9:
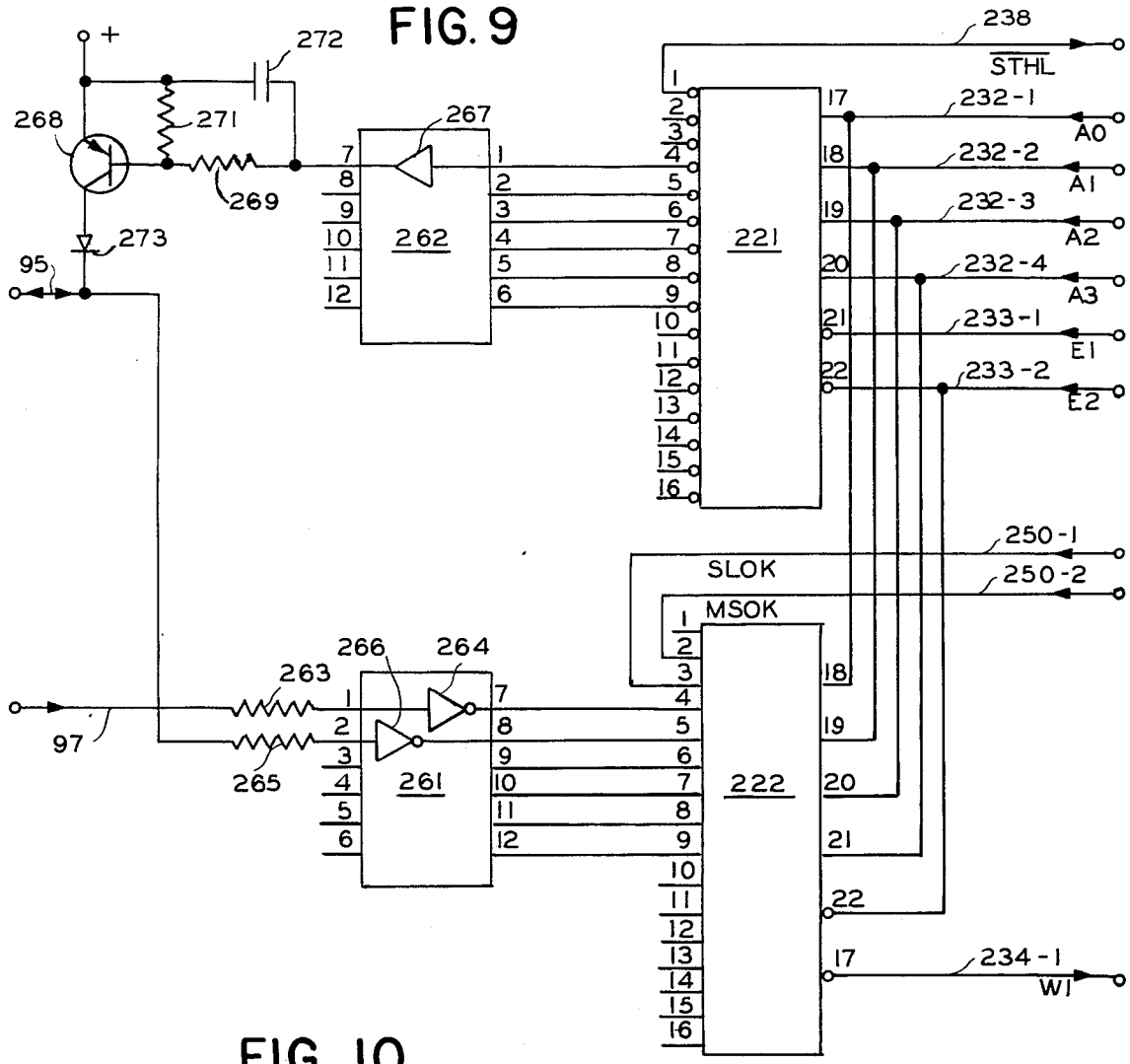
FIG. 9 is a schematic diagram of the hall call input-/output circuits of FIG. 8.

Referring to FIG. 9, there is shown a schematic diagram of the hall call input/output circuits of the parallel input/output circuit 58 of FIG. 8. These circuits include the four line to sixteen line decoder/demultiplexers 221, 223, 225 and 227 and the one of sixteen data selector/multiplexers 222, 224, 226, and 228. FIG. 9 shows the decoder/demultiplexer 221 and the data selector/multiplexer 222 as representative of all such circuit elements.

Hall call input signals on the lines 95 and hall call entered signals on the line 97 are inverted and buffered by a buffer/converter 261. The inverted signals are the inputs to the data selector/multiplexer 222. When the data selector/multiplexer 222 is addressed on the address lines 232 and enabled on the enable lines 233, one of its inputs is selected and generated as an output signal on an output line 234.

Hall call input signals are cancelled when the decoder/demultiplexer 221 is addressed on the address lines 232 and enabled lines 233 to generate a clear signal at one of its outputs. The clear signal passes through a buffer 262 and onto the correct one of the sense and clear lines 95 to change the state of the associated hall call sense and clear circuit 92.

The buffer/converter 261 is representative of a plurality of such buffer/converters each having six inputs and six outputs. The buffer/converter 261 has inputs 261-1 through 261-6, each connected to a separate inverter, and outputs 261-7 through 261-12 respectively. The hall call entered line 97 is connected to the input 261-1 through a current limiting resistor 263. An inverter 264 is connected between the input 261-1 and the output 261-7 to invert the signal on the line 97 and apply it to an input 222-4 of the data selector/multiplexer 222.

The sense and clear line 95 represents one of a plurality of such lines, one for each hall call push button. The line 95 is connected to the input 261-2 through a current limiting resistor 265. An inverter 266 is connected between the input 261-2 through a current limiting resistor 265. An inverter 266 is connected between the input 261-2 and the output 261-8 to invert the signal on the line 95 and apply it to an input 222-5 of the data selector/multiplexer.

The data selector/multiplexer has sixteen inputs, 222-1 through 222-16, any one of which may be connected to an output 222-17. An address signal comprising the bits A0 through A3 is received on the lines 232-1 through 232-4 respectively. The lines 232-1 through 232-4 are connected to four address inputs 222-18 through 222-21 respectively. If the address signal is in binary code, where A0 represents the binary one place and A3 represents the binary eight place, then a "0" on each of the address lines 232 will select the input 232-1 and each input will be selected in turn as the binary address is incremented until there is a "1" on each of the address lines to select the input 222-16. An enable line 233-2 is connected to an enable input 222-22. IF an E2 = "0" signal is placed on the enable line 233-2, the selected input will be connected to the output and the inverted signal from the associated line 95 will appear at the output 222-17. The output 222-17 is connected to the output line 234-1 and the output signal W1 will be sent to the bus temporary memory 235 of FIG. 8.

It will be observed that additional buffer/converters such as 261 may be added to serve additional sense and clear lines 95. The four data selector/multiplexers of FIG. 8 have a total of sixty-four inputs which would require ten buffer/converters to provide the capability of accepting sixty separate input lines. Each data selector/multiplexer is enabled by a different enable signal so that the sixty-four inputs may be addressed with the four bit address signal and the four enable signals.

The SLOK slave failure signal and the MSOK master failure signal are received from the failure detector 249 of FIG. 8 on the lines 250-1 and 250-2 respectively. The line 250-1 is connected to the input 222-3 and the line 250-2 is connected to the input 222-2 so that the failure signals are sent to the bus temporary storage when those inputs are addressed and the data selector/multiplexer 222 is enabled.

If the E1 = "0" signal is received on the enable line 233-1 at the same time as the E2 = "0" signal on the line 233-2, the decoder/demultiplexer 221 will also be enabled to generate a "0" clear signal at the one of sixteen outputs 221-1 through 221-16 selected by the address signal on the address lines 232-1 through 232-4. The address lines 232-1 through 232-4 are connected to four address inputs 221-17 through 221-20 respectively. The buffer 262 is representative of a plurality of such buffers each having six inputs and six outputs. The buffer 262 has inputs 262-1 through 262-6, each connected to a separate buffer element, and outputs 262-7 through 262-12 respectively. The output 262-7 is connected through a transistor switching circuit to the sense and clear line 95. A buffer 267 is connected between the input 262-1 and the output 262-7 to amplify the signal for driving the transistor switching circuit.

The "0" clear signal at the output 262-7 is applied to a base of a PNP transistor 268 through a resistor 269. An emitter of the transistor 268 is connected to a positive polarity power supply (not shown) having a potential sufficient to supply a "1" logic signal. The emitter is also connected to the base of the transistor through a resistor 271 and a capacitor 272 is connected in parallel with the resistors 269 and 271 between the power supply and the output 262-7. When the output 221-4 is not selected, a "1" will be generated through the buffer 267 and the resistor 269 to the base of the transistor 268. Since the base and the emitter are at or near the same potential, the transistor 268 will be turned off and the capacitor 272 will not be charged. When the "0" clear signal is generated at the output 262-7, the capacitor will begin to charge from the power supply since the voltage across a capacitor cannot change instantaneously. The resistors 269 and 271 function as a voltage divider for the voltage across the capacitor 272. The falling base voltage will turn on the transistor 268 and the power supply will be connected to generate a "1" clear signal on the line 95 through the transistor 268 and a diode 273 having an anode connected to a collector of the transistor 268 and a cathode connected to the line 95.

The decoder/demultiplexer 221 may also be addressed and enabled to generate the $\overline{STHL}$ = "0" signal at the output 221-1. The $\overline{STHL}$ signal is sent on the line 238 to the bus interface circuit 231 of FIG. 8 to cooperate with the $\overline{D0}$ through $\overline{D5}$ signals to generate the hall lantern address signals on the lines 98.

In summary, the hall call input/output circuit of FIG. 9 receives hall call input signals on the lines 95 and the hall call entered signal on the line 97. The input signals are inverted by the buffer/converter 261 and are connected to individual inputs of the data selector/multiplexer 222. Address signals on the address lines 232-1 through 232-4 and an enable signal on an enable line 233-2 cause the data selector/multiplexer to connect a selected one of its inputs to the output 222-17 to send the inverted signal on the W1 output line 234-1 through the bus temporary memory 235 and the bus interface circuit 231 of FIG. 8. When a hall call input signal is to be cancelled, address signals on the address lines 232-1 through 232-4 and enable signals on the enable lines 233-1 and 233-2 cause the decoder/demultiplexer 221 to generate a clear signal through a buffer 267 to turn on a transistor switch and apply the clear signal to the line 95. The data selector/multiplexer also reads the clear signal to change the status of the hall call input signal thereby cancelling the hall call.

FIG. 10 TRANSMITTER AND CLOCK

FIG. 11 CLOCK PULSE TRAIN

Figure 10:
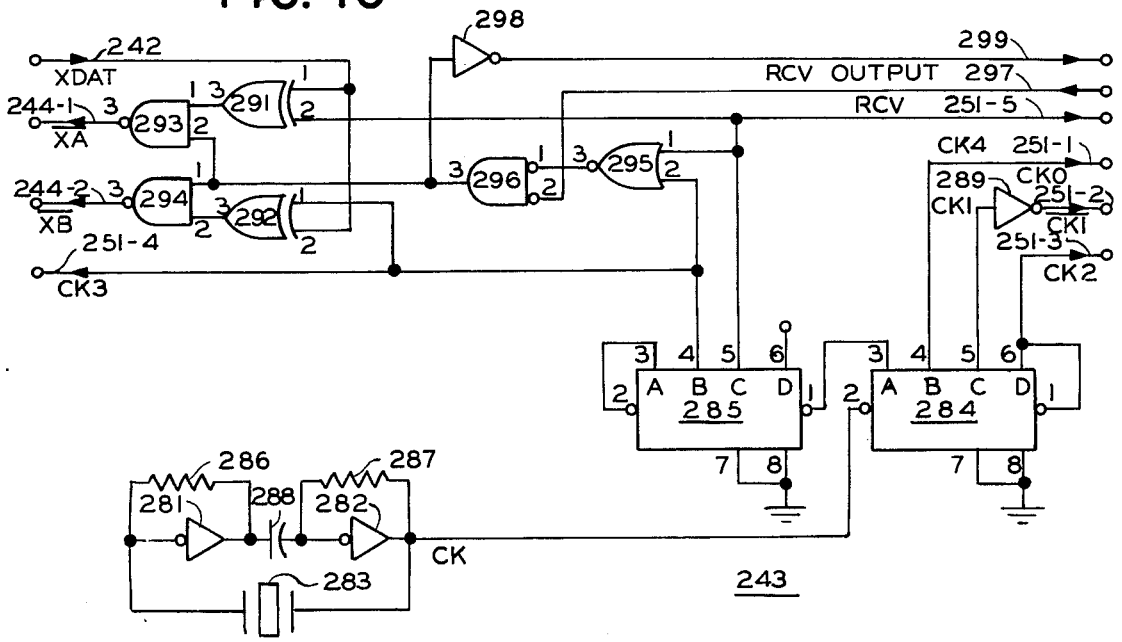
FIG. 10 is a schematic diagram of the transmitter and clock of FIG. 8.

Referring to FIG. 10, there is shown the transmitter and clock 243 of FIG. 8 A pair of inverters 281 and 282 cooperate with a crystal 283 to generate a train of clock pulses CK having a frequency "*f*". The clock pulse train is divided by various denominators in a pair of counters 284 and 285 to generate the clock pulse trains CK0, CK1, CK2, CK3 and CK4 which are utilized to synchronize the elements of the parallel input/output circuit 58. The CK3 and CK4 pulse trains are also utilized to multiplex data from the bus temporary memory 235 of FIG. 8. The data is received on the XDAT line 242 and is sent out on the XA and XB transmit lines 244-1 and 244-2 respectively to the transmitter/receiver interface circuit 239 of FIG. 8.

The crystal 283 has one lead connected to an input of the inverter 281 and the other lead connected to an output of the inverter 282. A resistor 286 is connected between the input and an output of the inverter 281 and a resistor 287 is connected between an input and the output of the inverter 282. A capacitor 288 is connected between the output of the inverter 281 and the input of the inverter 282.

The inverters 281 and 282 represent an amplifier and the crystal 283 represents a feedback network of a free running squarewave oscillator. Assuming that the signal at the input of the inverter 281 changes from a "0" to "1", the output will change from a "1" to a "0". The capacitor 288 is a direct current blocking capacitor which will pass the relatively high frequency signal transitions of the oscillator. Therefore, the signal at the input to the inverter 282 will change from a "1" to a "0". This will change the output from a "0" to a "1". This change is coupled to the input of the inverter 281 through the crystal 283. As long as there is a positive feedback, the circuit will tend to oscillate.

The frequency of oscillation is determined by the resonant frequency of the crystal 283. The alternating voltage applied across the crystal causes it to vibrate and, if the frequency of the applied alternating voltage approximates a frequency at which mechanical resonance can exist in the crystal, the vibrations will be intense and will control the frequency of oscillation. The resistors 286 and 287 provide biasing for the inverters 281 and 282 respectively. The output from the oscillator is a frequency stabilized squarewave identified as the CK pulse train which is applied to an input 284-2 of the counter 294. The CK pulse train is shown in FIG. 11.

The counters 284 and 285 are divide by twelve binary counters and only the operation of the counter 284 will be explained. A train of pulses applied to an "A" input 284-1 will be divided by two at an "A" output 284-3. A train of pulses applied to a "B" input 284-2 will be divided by three at a "B" output 284-4 and a "C" output 284-5, wherein the leading edges of the "C" pulses coincide with the trailing edges of the "B" pulses, and will be divided by six at a "D" output 284-6. If the "A" output 284-3 is connected to the "B" input 284-2, there will be a division by six at the "B" and "C" outputs and a division by twelve at the "D" output. The counter will perform the division when either or both reset inputs 284-7 and 284-9 are at "0".

Figure 11:
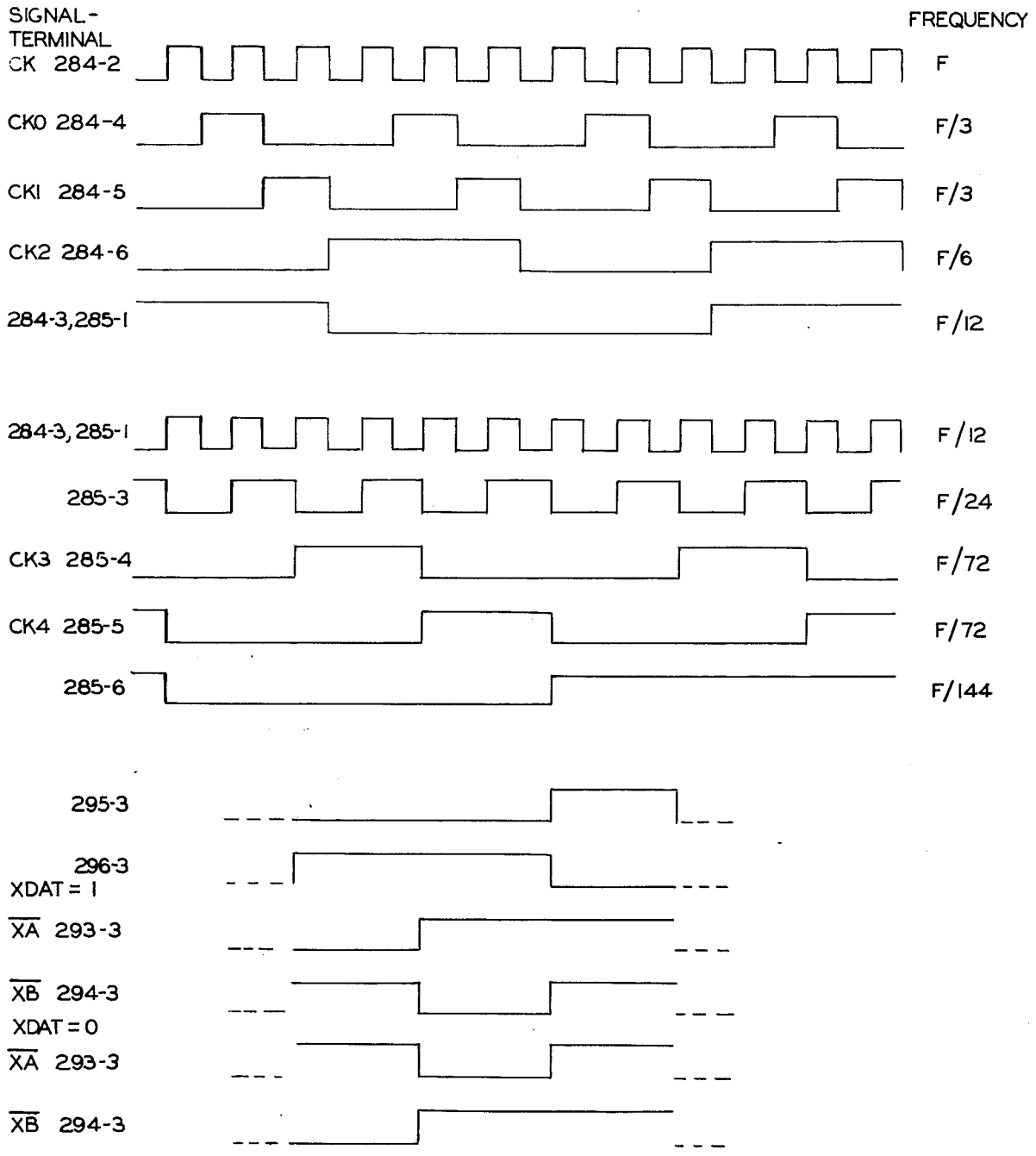
FIG. 11 is a waveform diagram of the clock pulse trains generated by the transmitter and clock of FIG. 10.

The input pulse rain CK and the pulse trains generated by the counters 284 and 285 are shown in FIG. 11. The CK pulse train is applied to the "B"input 284-2 and is divided by three at the "B" output 284-4 to generate the CK0 pulse train on a clock line 251-1. The CK pulse train is also divided by three at the "C" output 284-5 to generate the CK1 pulse train which is inverted by an inverter 289 to generate the $\overline{CK1}$ pulse train on the clock line 251-2. The CK pulse train is divided by six at the "D" output 284-6 to generate the CK2 pulse train on the clock line 251-3. The "D" output 284-6 is connected to the "A" input 284-1 to divide the CK2 pulse train by 2 or the CK/12 pulse train at the "A" output 284-3.

The "A" output 284-3 is connected to the "A" input 285-1 of the counter 285. In FIG. 11, the CK/12 pulse train has been redrawn on a compressed scale for purposes of illustration. The CK/12 pulse train is divided by two at the "A" output 285-3 and is applied to the "B" input 285-2 as the CK/24 pulse train. The CK/24 pulse train is divided by three at the "B" output 285-4 to generate the CK3 pulse train on the clock line 251-4. The CK/24 pulse train is also divided by three at the "C" output 285-5 to generate the CK4 pulse train on the clock line 251-5. The CK/24 pulse train is divided by six at the "D" output 285-6 as shown in FIG. 11.

The pulse trains from the transmitter and clock 243 are applied to various elements of the parallel input-/output circuit 58. The CK0, CK2 and CK3 pulse trains are applied to the bus temporary memory on the clock lines 251-1, 251-3 and 251-4 respectively. The $\overline{CK1}$ and CK2 pulse trains are applied to the receiver 246 on the cock lines 251-2 and 251-3. The CK2 and CK4 pulse trains are applied to the bus interface circuit 231 on the cock lines 251-3 and 251-5.

A data bit is received from the bus temporary memory 235 on the XDAT line 242 at a pair of inputs 291-1 and 292-2 of a pair of exclusive-OR elements 291 and 292. When both inputs to an exclusive-OR are receiving a "1" or a "0", a "0" will be generated at an output. When one input receives a "1" and the other input receives a "0", a "1" will be generated at the output. An input 291-2 receives the CK4 pulse train and an input 292-1 receives the CK3 pulse train such that the XDAT bit is multiplexed and transmitted through a pair of NAND elements 293 and 294 onto the $\overline{XA}$ and $\overline{XB}$ transmit lines respectively.

Looking at the CK3 and CK4 pulse trains in FIG. 11, it may be seen that first CK3 is at "1", then CK4 is at "1" and then both are at "0" before the cycle is repeated. The CK4 pulse train is applied to an input 295-1 and the CK3 pulse train is applied to an input 295-2 of a NOR 295 to generate a "0", "0" and "1" pulse train at an output 295-3 as shown in FIG. 11. This pulse train is applied to an input 296-1 of a NOR 296. Another input 296-2 receives a RCV signal on a line 297 from the bus temporary memory 235. If the receiver 246 is receiving data through the transmitter/receiver interface circuit 239, the RCV signal will be "1" to disable the NOR 296 and generate a "0" at an output 296-3. The output 296-3 is connected to a pair of inputs 293-2 and 294-1 to generate a "1" from the NANDs 293 and 294 at a pair of outputs 293-3 and 294-3. The output 293-3 is connected to the $\overline{XA}$ transmit line 244-1 and the output 294-3 is connected to the $\overline{XB}$ transmit line 244-2. Since both lines are at the same potential, no information is transmitted.

If the transmitter and clock 243 is to transmit, the bus temporary memory 235 generates a "0" on the RCV line 297 to enable the NOR 296 at the input 296-2. The NOR 296 will invert the pulse train from the NOR 295 at the output 296-3 as shown in FIG. 11. When the pulse train is at "1", the NANDs 293 and 294 will be enabled and when the pulse train is at "0", the NANDs 293 and 294 will be disabled to generate a "1". Therefore, two bits of information can be transmitted and the "1" on both transmit lines during the cycle serves to separate those two data bits from the two bits in the succeeding cycle.

The output 296-3 is connected through an inverter 298 to a RCV output line 299. When RCV = "1" or when both transmit lines are at "1", the output line 299 will be at "1" to indicate that the transmitter and clock 243 is not transmitting. The output line 299 will be at "0" when data is being transmitted. The RCV output line 299 is connected to the bus temporary memory 235.

If the XDAT signal is "1", the exclusive-OR 291 will respond to the CK4 pulse train at the input 291-2 to generate a "1", "0" and "1" pulse train at an output 291-3 to an input 293-1 of the NAND 293. The NAND 293 is enabled during the first two signals to invert them to a "0" and a "1" at the output 293-3 on the $\overline{XA}$ transmit line 244-1 as shown in FIG. 11. At the same time, the exclusive-OR 292 will respond to the CK3 pulse train at the input 292-1 to generate a "0", "1" and "1" pulse train at an output 292-3 to an input 294-2 of the NAND 294. The NAND 294 is enabled during the first two signals to invert them to a "1" and a "0" at the output 294-3 on the $\overline{XB}$ transmit line 244-2 as shown in FIG. 11. Therefore, a "1" data bit on the XDAT line 242 is multiplexed during the signal cycle generated from the CK3 and CK4 pulse trains and is sent on the $\overline{XA}$ transmit line as a "0" followed by a "1" while it is simultaneously sent on the $\overline{XB}$ transmit line as a "1" followed by a "0".

If the XDAT signal is a "0", the output from the exclusive-OR 291 will be a "0", "1" and "0" pulse train and the output from the exclusive-OR 292 will be a "1", "0" and "0" pulse train. The NAND 293 is enabled during the first two signals to generate a "1" and a "0", while the NAND 294 is enabled to generate a "0" and a "1". Therefore, a "0" data bit on the XDAT line 242 is multiplexed during the signal cycle generated from the CK3 and CK4 pulse trains and is sent on the $\overline{XA}$ transmit line as a "1" followed by a "0" while it is simultaneously sent on the $\overline{XB}$ transmit line as a "0" followed by a "1" as shown in FIG. 11.

In summary, the transmitter and clock 243 generates various clock pulse trains CK0, $\overline{CK1}$, CK2, CK3 and CK4 to the bus interface circuit 231, the bus temporary memory 235 and the receiver 246 to synchronize data flow in these elements of the parallel input/output circuit 58 of FIG. 8. The CK3 and CK4 pulse trains are utilized to multiplex a data bit on the XDAT line 242. The multiplexed data bit is sent as a sequential pair of signals on the $\overline{XA}$ and $\overline{XB}$ transmit lines 244-1 and 244-2 respectively. A "1" data bit on the XDAT line is sent as a "0" and "1" on the line 244-1 and at the same time as a "1" and a "0" on the line 244-2. A "0" data bit on the XDAT line is sent as a "1" and a "0" on the line 244-1 and at the same time a "0" and a "1" on the line 244-2. The two bits of information representing a data bit on the XDAT line are separated from the next two bits of information by a "1" signal on both transmit lines.

FIG. 12 TRANSMITTER/RECEIVER INTERFACE CIRCUIT

Figure 12:
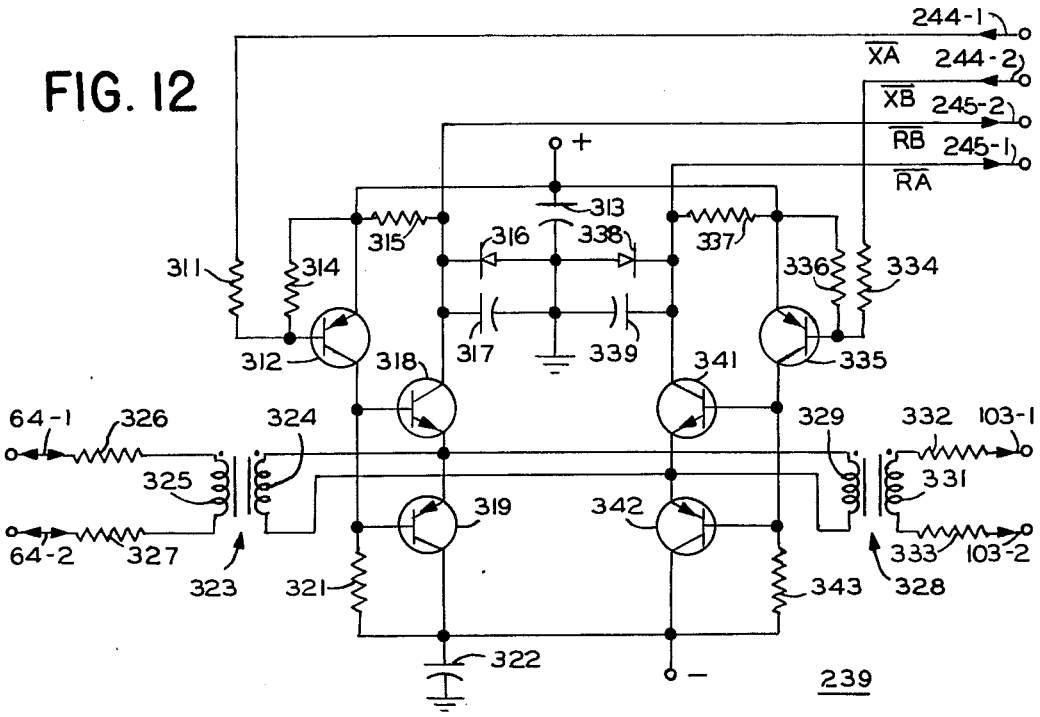
FIG. 12 is a schematic diagram of the transmitter/-receiver interface circuit of FIG. 8.

Referring to FIG. 12, there is shown a schematic diagram of the transmitter/receiver interface circuit of FIG. 8. Information bits to be transmitted are received on the $\overline{XA}$ and $\overline{XB}$ transmit lines 244-1 and 244-2 respectively from the transmitter and clock 243 of FIG. 10. The information bits are then sent on a pair of multiplexed car signals lines 64-1 and 64-2 to the car panel (slave) multiplexer 101 and on a pair of multiplexed lobby signals lines 103-1 and 103-2 to the lobby panel (slave) demultiplexer as shown in FIG. 8. Multiplexed car signals received on the lines 64 are sent to the receiver 246 on a pair of receive lines, $\overline{RA}$ receive line 245-1 and $\overline{RB}$ receive line 245-2.

The $\overline{XA}$ transmit line 244-1 is connected through a current limiting resistor 311 to a base of a PNP transistor 312. An emitter of the transistor 312 is connected to a positive polarity direct current power supply (not shown) and to one side of a capacitor 313. The other side of the capacitor 313 is connected to ground potential and the capacitor is charged to the potential of the power supply. The emitter is connected to the base through a resistor 314 to supply a base biasing voltage which turns off the transistor 312. The emitter of the transistor 312 is also connected through a resistor 315 to a parallel connected diode 316 and a capacitor 317. A cathode of the diode 316 and one side of the capacitor 317 are connected to the resistor 315 and an anode of the diode 316 and the other side of the capacitor 317 are connected to ground potential.

A collector of the transistor 312 is connected to a base of a NPN transistor 318, a base of a PNP transistor 319 and through a resistor 321 to one side of a capacitor 322 and a negative potential direct current power supply (not shown). The other side of the capacitor 322 is connected to ground potential and the capacitor is charged to the potential of the negative power supply.

A collector of the transistor 318 is connected to the junction of the resistor 315, the diode 316 and the capacitor 317. An emitter of the transistor 318 is connected to an emitter of the transistor 319 which has a collector connected to the junction of the resistor 321, the capacitor 322 and the negative polarity power supply. An isolation transformer 323 has one end of a winding 324, designated by a dot, connected to the junction of the emitters of the transistors 318 and 319. The other winding 325 of the isolation transformer 323 has one end, designated by a dot, connected through a current limiting resistor 326 to the multiplexed car signals line 64-1 and has the other end of the winding 325 connected through a current limiting resistor 327 to the multiplexed car signals line 64-2. An isolation transformer 328 has one end of a winding 329, designated by a dot, connected to the junction of the emitters of the transistors 318 and 319. The other winding 331 of the isolation transformer 328 has one end, designated by a dot, connected through a current limiting resistor 332 to the multiplexed lobby signals line 103-1 and has the other end of the winding 331 connected through a current limiting resistor 333 to the multiplexed lobby signals line 103-2.

The $\overline{XB}$ transmit line 244-2 is connected through a current limiting resistor 334 to a base of a PNP transistor 335. An emitter of the transistor 335 is connected to the junction of the positive polarity power supply and the capacitor 313 and is connected to the base through a resistor 336 to supply a base biasing voltage which turns off the transistor 335. The emitter of the transistor 335 is also connected through a resistor 337 to a parallel connected diode 338 and capacitor 339. A cathode of the diode 338 and one side of the capacitor 339 are connected to the resistor 337 and an anode of the diode 338 and the other side of the capacitor 339 are connected to ground potential.

A collector of the transistor 335 is connected to a base of a NPN transistor 341, a base of a PNP transistor 342 and through a resistor 343 to the negative potential power supply. A collector of the transistor 341 is connected to the junction of the resistor 337, the diode 338 and the capacitor 339. The transistor 342 has a collector connected to the junction of the resistor 343, the capacitor 322 and the negative polarity power supply. The other ends of the isolation transformer windings 324 and 329 are connected to the junction of the emitters of the transistors 341 and 342.

When no data is being transmitted, the $\overline{XA}$ and $\overline{XB}$ transmit lines are both at "1". Thus the transistors 312 and 335 remain turned off. Since the bases of the transistors 318, 319, 341 and 342 are connected to the negative potential power supply the emitters of the transistors 318 and 319 are connected together and the emitters of the transistors 341 and 342 are connected together, the transistors 318, 319, 341 and 342 will be turned off and no signals will appear on the lines 64 or the lines 103.

If the "1" remains on the $\overline{XA}$ transmit line 244-1 and a "0" is applied to the $\overline{XB}$ transmit line 244-2, the transistor 312 will remain turned off and the transistor 335 will turn on to connect the bases of the transistors 341 and 342 to the positive polarity power supply. The transistor 341 will turn on to connect the windings 324 and 329 to the positive potential power supply through the resistor 337. This places a positive potential voltage on the emitter of the transistor 319 to turn it on and to connect the dotted ends of the windings 324 and 329 to the negative potential power supply. If the lines 64-2 and 103-2 are utilized as references, a negative potential signal will be transmitted on the lines 64 and 103 which represents the first half of a "0" data bit or the last half of a "1" data bit on the XDAT line 242 of FIG. 10.

If the "1" remains on the $\overline{XB}$ transmit line 244-2 and a "0" is applied to the $\overline{XA}$ transmit line 244-1, the transistor 335 will remain turned off and the transistor 312 will turn on to connect the bases of the transistors 318 and 319 to the positive power supply. The transistor 318 will turn on to connect the dotted ends of the windings 324 and 329 to the positive potential power supply through the resistor 315. This places a positive potential voltage on the emitter of the transistor 342 to turn it on and to connect the other ends of the windings 324 and 329 to the negative potential power supply. If the lines 64-2 and 103-2 are again utilized as references, a positive potential signal will be transmitted on the lines 64 and 103 which represents the last half of a "1" data bit or the first half of a "0" data bit on the XDAT line 242 of FIG. 10.

The capacitors 313 and 322 are provided as current storage devices to prevent a fall in the voltage potential of the positive and negative power supplies respectively when the various transistors are turned on.

A $\overline{RA}$ receive line 245-1 is connected to the junction of the resistor 337, the diode 338, the capacitor 339 and the collector of the transistor 341. A $\overline{RB}$ receive line 245-2 is connected to the junction of the resistor 315, the diode 316, the capacitor 317 and the collector of the transistor 318. If the lines 64-2 and 103-2 are utilized as references, a positive potential signal on the lines 64 or 103 will be placed at the junction between the emitters of the transistors 318 and 319. The transistor 318 will remain turned off and the transistor 319 will turn on to connect the dotted ends of the windings 324 and 329 to the negative potential power supply. At the same time, the other ends of the windings fall below the negative power supply potential to turn on the transistor 341 to connect the $\overline{RA}$ receive line 245-1 to the windings 324 and 329 thereby placing a "0" on the $\overline{RA}$ receive line while the $\overline{RB}$ receive line 245-2 remains at "1" since it is connected to the positive potential power supply through the resistor 337.

If the lines 64-1 and 103-1 are utilized as references, a positive potential signal on the lines 64 or 103 will be placed at the junction between the emitters of the transistors 341 and 342. The transistor 342 will be turned on to connect the undotted ends of the windings 324 and 329 to the negative potential power supply. At the same time, the other ends of the windings fall below the negative power supply potential to turn on the transistor 318 to connect the RB receive line 245-2 to the windings 324 and 329 thereby placing a "0" on the $\overline{RB}$ receive line while the $\overline{RA}$ receive line 245-1 remains at "1" since it is connected to the positive potential power supply through the resistor 315.

When there is no signal on the lines 64 and 103, both the RA and RB receive lines will be at "1". The capacitors 317 and 339 function as filters to pass any noise on the lines 64 or 103 to ground before the received signal is placed on the $\overline{RA}$ and $\overline{RB}$ receive lines. The diodes 316 and 338 prevent the $\overline{RA}$ and $\overline{RB}$ receive lines from falling below the ground potential during either the transmit or receive cycles.

In summary, the transmitter/receiver interface circuit 239 receives multiplexed data signals on the XA and XB transmit lines from the transmitter and clock 243 and sends those signals to either the car panel (slave) multiplexer 101 on the lines 64 and to the lobby panel (slave) demultiplexer 102 on the lines 103. When signals are received on the lines 64, they are generated on the RA and RB receive lines to the receiver 246.

FIG. 13 RECEIVER

Figure 13:
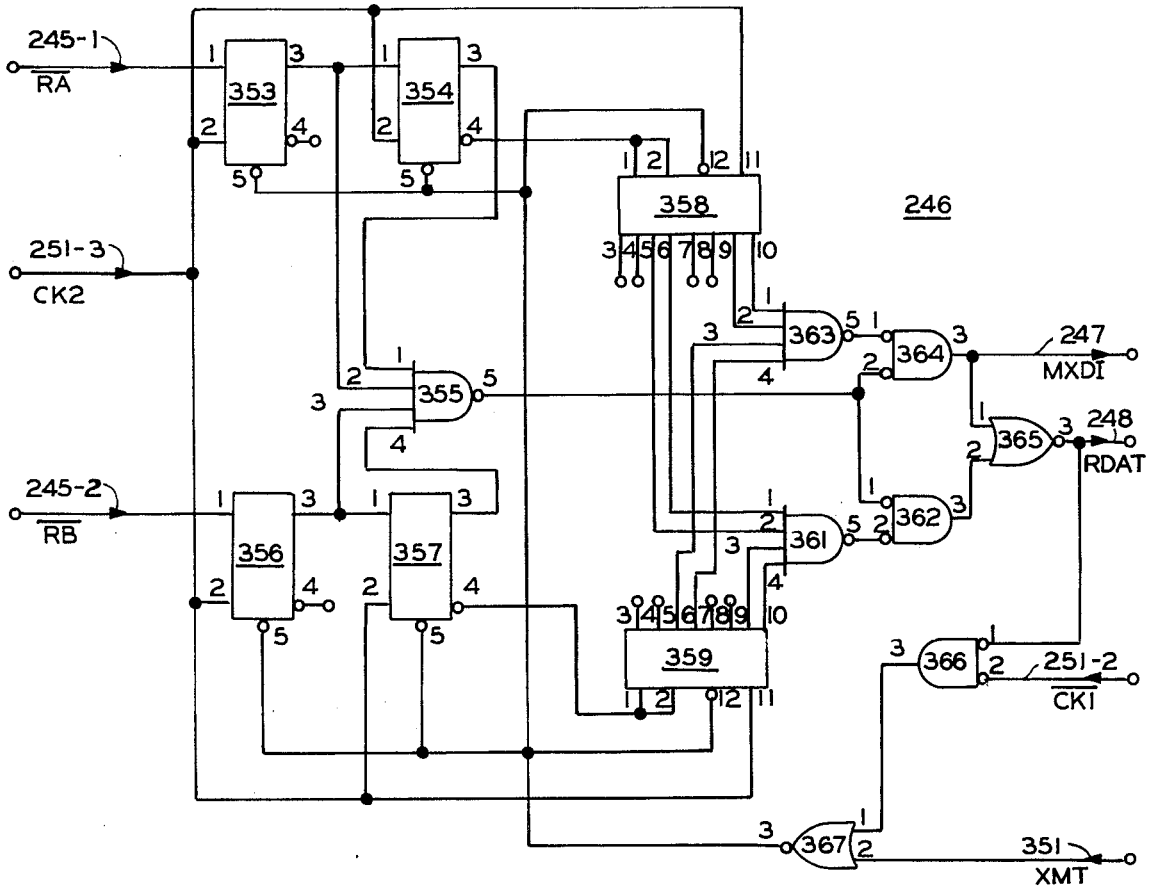
FIG. 13 is a schematic diagram of the receiver of FIG. 8.

FIG. 13 is a schematic diagram of the receiver 246 of FIG. 8. Inputs to the receiver are the multiplexed car signals from the car panel (slave) multiplexer 101 which have been passed through the transmitter/receiver interface circuit 239 and are applied to the $\overline{RA}$ receive line 245-1 and the $\overline{RB}$ receive line 245-2, the clock pulse trains $\overline{CK1}$ on the line 251-2 and CK2 on the line 251-3 from the transmitter and clock 243, and a XMT signal on a line 351 from the bus temporary memory 235. Outputs from the receiver are the RDAT signal on the line 248 and a MXDI signal on the line 247 to the bus temporary memory. The receiver 246 demultiplexes the multiplexed car signals on the receive lines 245 and generates the demultiplexed data on the MXDI line 247.

The $\overline{RA}$ receive line 245-1 is connected to a data input 353-1 of a D-type flip flop 353. The signal applied at the input 353-1 is generated at a Q output 353-3 when the signal applied at a clock input 353-2 shifts from "0" to "1". At the same time; the complement of the signal at the input 353-1 is generated at a $\overline{Q}$ output 353-4. The outputs 353-3 and 353-4 can be set to "0" and "1" respectively by applying a "0" signal to a clear input 353-5. The output 353-3 of the flip flop 353 is connected to a data input 354-1 of a flip flop 354 and is also connected to an input 355-2 of a NAND 355. An output 354-3 is connected to an input 355-1 of the NAND 355.

The $\overline{RB}$ receive line 245-2 is connected to a data input 356-1 of a flip flop 356. An output 356-3 is connected to a data input 357-1 of a flip flop 357 and is also connected to an input 355-3 of the NAND 355. An output 357-3 is connected to an input 355-4 of the NAND 355. The clock inputs 353-2, 354-2, 356-2 and 357-2 are all connected to the clock line 251-3 to receive the CK2 pulse train. Each time the pulse train changes from "0" to "1", the flip flops will be clocked to shift data from the data inputs to the outputs. When no data is being received, the $\overline{RA}$ and $\overline{RB}$ receive lines will both be at "1". After two clock pulse train changes from "0" to "1", all the inputs to the NAND 355 will be at "1" to generate a "0" at an output 355-5. If multiplexed signals are being received, the $\overline{RA}$ and $\overline{RB}$ receive lines will be at opposite signal levels corresponding to the signals transmitted on the $\overline{XA}$ and $\overline{XB}$ transmit lines as discussed in connection with FIG. 10. Therefore, at least one of the inputs to the NAND 355 will be at "0" to generate a "1" at the output 355-5.

A $\overline{Q}$ output 354-4 of the flip flop 354 is connected to a pair of inputs 358-1 and 358-2 of an eight-bit parallel-out serial shift register 358. If both inputs are at "1", a "1" will be generated at an output 358-3 when the signal applied to a clock input 358-11 changes from "0" to "1". Any other combination of input signals will generate a "0". Each subsequent change from "0" to "1" at the clock input 358-11 will shift the data bit to the next output of a plurality of outputs 358-4 through 358-10. If a "0" is applied to a clear input 358-12, all the outputs 358-3 through 358-10 will be set to "0". A $\overline{Q}$ output 357-4 of the flip flop 357 is connected to a pair of inputs 359-1 and 359-2 of a shift register 359 having outputs 359-3 through 359-10, a clock input 359-11 and a clear input 359-12. The clock inputs 358-11 and 359-11 are connected to the CK2 clock line 251-3.

The outputs 358-5 and 358-6 of the shift register 358 are connected to a pair of inputs 361-2 and 361-1 respectively of a NAND 361 and the outputs 359-9 and 359-10 of the shift register 359 are connected to a pair of inputs 361-3 and 361-4 respectively. An output 361-5 of the NAND 361 is connected to an input 362-2 of a NOR 362. The outputs 358-9 and 358-10 are connected to a pair of inputs 363-2 and 363-1 respectively of a NAND 363 and the outputs 359-5 and 359-6 are connected to a pair of inputs 363-3 and 363-4 respectively. An output 363-5 of the NAND 363 is connected to an input 364-1 of a NOR 364. The output 355-5 of the NAND 355 is connected to an input 362-1 of the NOR 362 and to an input 364-2 of the NOR 364.

An output 362-3 of the NOR 362 is connected to an input 365-2 of a NOR 365. An output 364-3 of the NOR 364 is connected to an input 365-1 of the NOR 365 and to the MXDI line 247. An output 365-3 of the NOR 365 is connected to an input 366-1 of a NOR 366 and to the RDAT line 248. An input 366-2 of the NOR 366 is connected to the $\overline{CK1}$ clock line 251-2 and an output 366-3 is connected to an input 367-1 of a NOR 367. An input 367-2 of the NOR 367 is connected to the XMT line 351 and an output 367-3 is connected to the clear inputs 353-5, 354-5, 356-5, 357-5, 358-12 and 359-12 to supply a clear signal.

If the transmitter and clock 243 of FIG. 8 is transmitting, the XMT line 351 will receive a "1" to generate a "0" at the output 367-3 to continuously clear the flip flops and the shift registers. All of the inputs to the NAND 355 will be at "0" to generate a "1" to the inputs 362-1 and 364-2. The NORs 362 and 364 will each generate a "0" to the NOR 365 which in turn generates a "1" on the RDAT line 248. The "0" at the output 364-3 is applied to the MXDI line 247.

If the receiver 246 is to receive multiplexed signals, a "0" is applied to the XMT line 351 to enable the NOR 367. The $\overline{CK1}$ pulse train on the clock line 251-2 generates a "0", "0" and "1" pulse train during both the "0" and "1" portions of the CK2 pulse train cycle as shown in FIG. 11. As long as the RDAT signal is "1", the NOR 366 will generate a "0" to the input 367-1 and the NOR 367 will generate a "1" to remove the clear signal from the flip flops and the shift registers so that the multiplexed data on the $\overline{RA}$ and $\overline{RB}$ receive lines can be clocked in by the CK2 pulse train.

If we assume that the multiplexed signals on the $\overline{RA}$ and $\overline{RB}$ receive lines 245 are coded the same as the multiplexed signals on the $\overline{XA}$ and $\overline{XB}$ transmit lines 244, then the receiver 246 will generate the decoded multiplexed signals on the MXDI line 247. A multiplexed "1" will be received as a "0" portion on the line 245-1 and a "1" portion on the line 245-2 followed by a "1" portion on the line 245-1 and a "0" portion on the line 245-2. A multiplexed "0" will be received in the opposite order and a pause between coded signals will be received as a "1" portion on both of the receive lines 245.

Each time the CK2 clock line signal changes from "0" to "1", the flip flops 353 and 356 sample the $\overline{RA}$ receive line 245-1 and the $\overline{RB}$ receive line 245-2 respectively. If we assume that each portion of the multiplexed input signal is equal in length to four cycles of the CK2 clock pulse train, then it will be appreciated that at some point in time two samples of the first portion will appear at the outputs 358-9, 358-10, 359-9 and 359-10; two samples of the second portion will appear at the outputs 358-5, 358-6, 359-5 and 359-6; and two samples of the pause portion will appear at the outputs 353-3, 354-3; 356-3 and 357-3 no matter when the sampling of the multiplexed signal is begun.

For the purpose of illustration, let us assume that a "1" multiplexed signal is being received and that sampling is begun during the first half of the first portion of the signal. After each of the first nine "0" to "1" changes of the CK2 pulse train, at least one of the inputs of the NAND 355 will be "0" to maintain the "0" on the MXDI line 247 and the "1" on the RDAT line 248. After the tenth "0" to "1" change, all the inputs will be at "1", representing two samples of the $\overline{RA}$ and $\overline{RB}$ receive lines, to generate a "0" to the inputs 362-1 and 364-2 to enable the NORs 362 and 364. Since a multiplexed "1" signal is at "0" on the $\overline{RA}$ receive line during its first portion, the flip flop 354 will invert to a "1" the two samples which appear at the 358-9 and 358-10 outputs. The multiplexed "1" signal is also at "0" on the $\overline{RB}$ receive line during the second portion so that the flip flop 357 will invert to a "1" the two samples which appear at the 359-5 and 359-6 outputs. All the inputs of the NAND 363 are at "1" to generate a "0" to the input 364-1. The NOR 364 generates a "1" on the MXDI line 247 as the demultiplexed signal.

The inputs to the NAND 361 are at "0" to generate a "1" to the input 362-2. The NOR 362 generates a "0" at the input 365-2 to enable the NOR 365 which then generates a "0" on the RDAT line 248. The NOR 366 responds to the "0" during the "0" portion of the $\overline{CK1}$ pulse train to generate a "1" at the input 367-1. The NOR 367 generates a "0" to clear the flip flops and the shift registers for the next multiplexed input signal. It can be seen that a "0" multiplexed input signal will generate a "0" on the MXDI line 247 and "0" clear signal from the NOR 367.

In summary, the receiver 246 samples the multiplexed input signal on the $\overline{RA}$ and $\overline{RB}$ receive lines and decodes the multiplexed input signal to generate a data signal on the MXDI line 247. Each portion of the multiplexed input signal is sampled twice and the samples are shifted through a pair of flip flops and a shift register connected in series for each receive line 245. Since the signal on one receive line during one portion of the multiplexed input signal is the same as the signal on the other receive line during the other portion, the samples of like signals are utilized to generate the decoded signal and a signal to clear the flip flop and the shift registers for the next multiplexed input signal.

FIG. 14 FAILURE DETECTOR

Figure 14:
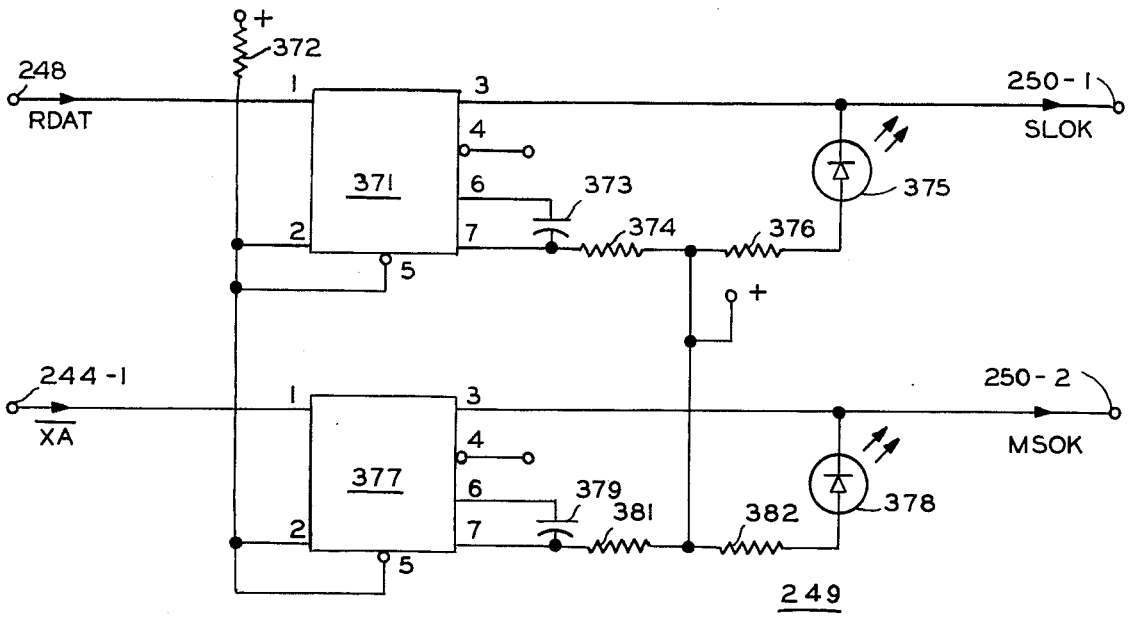
FIG. 14 is a schematic diagram of the failure detector of FIG. 8.

Referring to FIG. 14, there is shown a schematic diagram of the failure detector 249 of FIG. 8. The RDAT signal on the line 248 and the $\overline{XA}$ signal on the line 244-1 are monitored by the failure detector which generates a SLOK signal on a line 250-1 if there is a failure of the slave multiplexer 101 and a MSOK signal on a line 250-2 if there is a failure of the transmitter and clock 243.

The RDAT line 248 is connected to an input 371-1 of a monostable multivibrator 371. A second input 371-2 and a clear input 371-5 are connected to a positive polarity direct current power supply (not shown) through a current limiting resistor 372. A "1" at the input 371-1, a "0" at the input 371-2 or a "0" at a clear input 371-5 will generate a "0" at a non-inverting output 371-3 and a "1" at an inverting output 371-4. If the input 371-1 is at "0" or the input 371-2 is at "1", a "0" to "1" transition at the input 371-2 or a "1" to "0" transition at the input 371-1 respectively will trigger a "1" pulse at the output 371-3 and a "0" pulse at the output 371-4. The duration of the pulses is determined by the charging of a capacitor 373 connected between a pair of timing inputs 371-6 and 371-7 through a resistor 374 connected between the input 371-7 and a positive polarity direct current power supply (not shown).

At the end of each multiplexed input signal on the $\overline{RA}$ and $\overline{RB}$ receive lines, the receiver 246 changes the RDAT signal on the line 248 from "1" to "0" to trigger the monostable multivibrator 371. A "1" is generated at the output 371-3 on the SLOK line 250-1 to the data selector/multiplexer 222 of FIG. 9. A light emitting diode (LED) 375 has a cathode connected to the output 371-3 and an anode connected through a resistor 376 to the junction of the resistor 374 and the positive polarity power supply. If the "1" from the output 371-3 and the power supply are at or near the same potential, the LED 375 will be turned off. If the time between the "0" signals on the RDAT line 248 is less than the timing duration of the monostable multivibrator 371, the "1" at the output 371-3 will be continuously generated to maintain the LED in the off state during the operation of the receiver. If there is a failure in the slave multiplexer or the receiver, the multivibrator will time out and the output 371-3 will change to "0" allowing current flow through the LED 375 to light it to indicate a failure.

The $\overline{XA}$ transmit line 244-1 is connected to an input 377-1 of a monostable multivibrator 377. A second input 377-2 and a clear input 377-5 are connected to the positive polarity power supply (not shown) through the resistor 372. A non-inverting output 377-3 is connected to the MSOK line 250-2 and a cathode of a LED 378. A capacitor 379 is connected between a pair of timing inputs 377-6 and 377-7 and a resistor 381 is connected between the input 377-7 and the positive polarity power supply. An anode of the LED 378 is connected to the junction of the resistor 381 and the power supply through a resistor 382.

During each multiplexed signal on the $\overline{XA}$ transmit line 244-1, a "0" is generated to trigger the multivibrator 377. If the time between the "0" signals is less than the timing duration of the multivibrator 377, the "1" at the output 377-3 will be continuously generated to maintain the LED 378 in the off state during the operation of the transmitter and clock. If there is a failure in the multiplexer of the transmitter and clock, the multivibrator will time out and the output 377-3 will change to "0" allowing current flow through the LED 378 to light it to indicate a failure.

FIG. 15 BUS INTERFACE CIRCUIT

Figure 15:
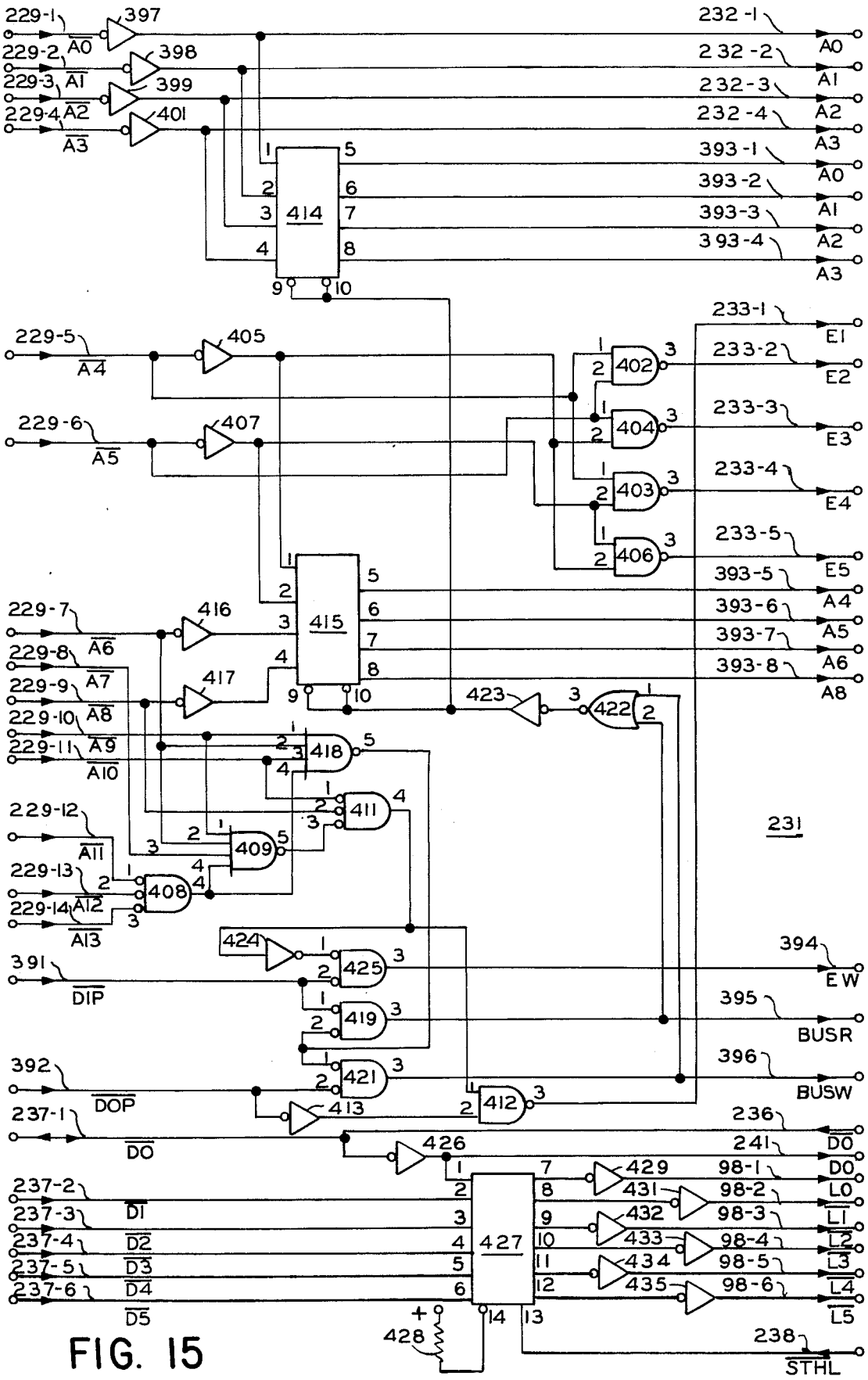
FIG. 15 is a schematic diagram of the bus interface circuit of FIG. 8.

Referring to FIG. 15, there is shown the bus interface circuit 231 of FIG. 8. Inputs to the bus interface circuit are the address signals $\overline{A0}$ through $\overline{A13}$ on the lines 229-1 through 229-14 respectively, the data signals $\overline{D0}$ through $\overline{D5}$ on the lines 237-1 through 237-6 respectively, a data input signal $\overline{DIP}$ on a line 391, a data output signal $\overline{DOP}$ on a line 392, the $\overline{STHL}$ signal on the line 238 and the $\overline{D0}$ signal on the line 236. The address lines 229, the data lines 237, the $\overline{DIP}$ line 391 and the $\overline{DOP}$ line 392 are connected to the bus 56 of FIG. 8. The $\overline{STHL}$ line 238 is connected to the decoder/demultiplexer of FIGS. 8 and 9 and the $\overline{D0}$ signal line 236 is connected to the bus temporary memory 235 of FIG. 8. A "0" on one of the address lines 239 represents the presence of that address signal and a "1" represents the absence of that address signal.

Outputs from the bus interface circuit are the A0 through A4 address signals on the lines 232-1 through 232-4 respectively, the E1 through E5 enable signals on the lines 233-1 through 233-5 respectively, the D0 data signal on the line 241 and the L0 and $\overline{L1}$ through $\overline{L5}$ hall lantern address signals on the lines 98-1 through 98-6 respectively. The A0 through A6 and A8 address signals are also stored in a pair of latches to be applied to a plurality of output lines 393-1 through 393-8 respectively. Other outputs include an enable write EW signal on a line 394, a bus read BUSR signal on a line 395 and a bus write BUSW signal on a line 396. The address lines 232 and the enable lines 233 are connected to the decoder/demultiplexers and the data selector/multiplexers of FIGS. 8 and 9. The address output lines 393, the EW line 394, the BUSR line 395, the BUSW line 396 and the DO line 241 are connected to the bus temporary memory 235 of FIG. 8. The hall lantern address lines 98 are connected to the hall lantern decoder/driver 93 of FIGS. 6 and 8.

The $\overline{A0}$ through $\overline{A5}$ address signals are utilized to generate the address and enable signals to the decoder/demultiplexers and the data selector/multiplexers of FIGS. 8 and 9. The $\overline{A0}$ through $\overline{A3}$ address signals are changed to the A0 through A3 address signals on the lines 232-1 through 232-4 respectively by a plurality of inverters 397, 398, 399 and 401 respectively. The $\overline{A4}$ and $\overline{A5}$ address signals are utilized to generate the E2 through E5 enable signals. Since each address signal may be a "1" or a "0", there are four different combinations of the two signals $\overline{A4}$ and $\overline{A5}$ each of which will generate one of the enable signals.

The $\overline{A4}$ line 229-5 is connected to an input 402-1 of a NAND 402 and an input 403-1 of a NAND 403. The $\overline{A5}$ line 229-6 is connected to an input 402-2 of the NAND 402 and an input 404-1 of a NAND 404. The $\overline{A4}$ signal is changed to an A4 signal by an inverter 405 and is applied to an input 404-2 of the NAND 404 and an input 406-2 of a NAND 406. The $\overline{A5}$ signal is changed to an A5 signal by an inverter 407 and is applied to an input 403-2 of the NAND 403 and an input 406-1 of the NAND 406.

If the $\overline{A4}$ and $\overline{A5}$ address signals are both at "1", the NAND 402 will generate a "0" at an output 402-3 as the E2 enable signal on the line 233-2. The A4 and A5 address signals will apply a "0" to at least one of the inputs of the NANDs 403, 404 and 406 to generate a "1" at their outputs indicating the absence of the other enable signals.

If the $\overline{A4}$ signal is at "0" and the $\overline{A5}$ signal is at "1", the A4 and $\overline{A5}$ signals will apply a "1" to the inputs of the NAND 404 to generate a "0" at an output 404-3 as the E3 enable signal on the line 233-3. The $\overline{A4}$ and A5 address signals will apply a "0" to at least one of the inputs of the NANDs 402, 403 and 406 to generate a "1" at their outputs indicating the absence of the other enable signals. If the $\overline{A4}$ signal is a "1" and the $\overline{A5}$ signal is at "0", the $\overline{A4}$ and A5 signals will apply a "1" to the inputs of the NAND 403 to generate a "0" at an output 403-3 as the E4 enable signal on the line 233-4. The A4 and $\overline{A5}$ address signals will apply a "0" to at least one of the inputs of the NANDs 402, 404 and 406 to generate a "1" at their outputs indicating the absence of the other enable signals.

If the $\overline{A4}$ and $\overline{A5}$ signals are both at "0", the A4 and A5 signals will apply a "1" to the inputs of the NAND 406 to generate a "0" at an output 406-3 as the E5 enable signal on the line 233-5. The $\overline{A4}$ and $\overline{A5}$ address signals will apply a "0" to at least one of the inputs of the NANDs 402, 403 and 404 to generate a "1" at their outputs indicating the absence of the other enable signals. Thus, the $\overline{A0}$ through $\overline{A5}$ address signals are utilized to address and enable any one of the data selector/multiplexers of FIGS. 8 and 9 to obtain a data bit representing the status of a hall call which is then sent to the bus temporary memory.

The A0 through A3 address and the E2 through E5 enable signals also cooperate with the E1 enable signal to address and enable the decoder/demultiplexers of FIGS. 8 and 9 to cancel hall calls. The $\overline{A11}$ address line 229-12, the $\overline{A12}$ address line 229-13 and the $\overline{A13}$ address line 229-14 are connected to inputs 408-1, 408-2 and 408-3 respectively of a NOR 408. An output 408-4 of the NOR 408 is connected to an input 409-4 of a NAND 409. The $\overline{A9}$ address line 229-10, the $\overline{A6}$ address line 229-7 and the $\overline{A7}$ address line 229-8 are connected to inputs 409-1, 409-2 and 409-3 respectively of the NAND 409. An output 409-5 is connected to an input 411-3 of a NOR 411. The $\overline{A10}$ address line 229-11 is connected to an input 411-1 and the $\overline{A8}$ address line 229-9 is connected to an input 411-2 of the NOR 411. An output 411-4 is connected to an input 412-1 of a NAND 412. An input 412-2 is connected to the $\overline{DOP}$ line 392 through an inverter 413. An output 412-3 is connected to the line 233-1 to generate the E1 enable signal.

If the $\overline{A11}$, $\overline{A12}$ and $\overline{A13}$ address signals are at "1", the NOR 408 will generate a "0" at the input 409-4, the NAND 409 will generate a "1" at the input 411-3, the NOR 411 will generate a "0" at the input 412-1 and the NAND 412 will generate a "1" on the line 233-1 to indicate the absence of the E1 enable signal. The E1 enable signal is generated when the $\overline{DOP}$, $\overline{A8}$, $\overline{A10}$, $\overline{A11}$, $\overline{A12}$ and $\overline{A13}$ signals are set to "0". All the inputs to the NAND 409 will now be at "1" to generate a "0" at the input 411-3. All the inputs to the NOR 411 will be at "0" to generate a "1" at the input 412-1 to enable the NAND 412. When the $\overline{DOP}$ signal changes to "0", the inverter 413 will place a "1" at the input 412-2 to generate the E1 = "0" enable signal on the line 233-1.

The A0 through A3 address signals are applied to a plurality of inputs 414-1 through 414-4 respectively of a four bit latch 414. When there is a "1" at the clock inputs 414-9 and 414-10, the data on the inputs is transferred to a plurality of outputs 414-5 through 414-8 corresponding to the inputs 414-1 through 414-4 respectively. When the signal at the clock inputs 414-9 and 414-10 changes to "0", the data on the outputs is latched. The outputs 414-5 through 414-8 are connected to the address output lines 393-1 through 393-4 respectively.

The A4 and A5 address signals are connected to a pair of inputs 415-1 and 415-2 respectively of a second four bit latch 415. The $\overline{A6}$ address signal is changed to an A6 signal by an inverter 416 and is applied to an input 415-3. The $\overline{A7}$ address signal is changed to an A7 signal by an inverter 417 and is applied to an input 415-4. A plurality of outputs 415-5 through 415-8 are connected to the address outputs 393-5 through 393-8 respectively. The latches 414 and 415 are clocked by the $\overline{A6}$, $\overline{A9}$, $\overline{A10}$, $\overline{A11}$, $\overline{A12}$ and $\overline{A13}$ address signals and either the $\overline{DIP}$ or $\overline{DOP}$ signal.

The $\overline{A9}$ address line 229-10 is connected to an input 418-1 of a NAND 418, the $\overline{A6}$ address line 229-7 is connected to an input 418-2, the $\overline{A10}$ address line 229-11 is connected to an input 418-3 and the output 408-4 is connected to an input 418-4. An output 418-5 is connected to a pair of inputs, 419-2 of a NOR 419 and 421-1 of a NOR 421. The $\overline{DIP}$ line 391 is connected to an input 419-1 of the NOR 419 which has an output 419-3 connected to the BUSR line 395 and an input 422-2 of a NOR 422. The $\overline{DOP}$ line 392 is connected to an input 421-2 of the NOR 421. An output 421-3 of the NOR 421 is connected to the BUSW line 396 and an input 422-1 of the NOR 422. An output 422-3 of the NOR 422 is connected through an inverter 423 to the clock inputs of the latches 414 and 415.

When the $\overline{A11}$, $\overline{A12}$ and $\overline{A13}$ address lines are at "1", the NOR 408 generates a "0" at the input 418-4. The NAND 418 then generates a "1" at the inputs 419-2 and 421-1 of the NORs 419 and 421 to disable them. The NORs 419 and 421 will generate a "0" on the BUSR line 395 and the BUSW line 396 and at the inputs 422-1 and 422-2. The NOR 422 will generate a "1" which is changed to a "0" by the inverter at the clock inputs of the latches 414 and 415. When the $\overline{A11}$, $\overline{A12}$ and $\overline{A13}$ address signals are changed to "0", the NOR 408 will generate a "1" to the input 418-4. If the $\overline{A6}$, A9 and $\overline{A10}$ address signals are at "1", all the inputs of the NAND 418 are now at "1" to generate a "0" at the inputs 419-2 and 421-1 to enable the NORs 419 and 421. If the $\overline{DIP}$ signal changes to "0", the NOR 419 will generate a "1" BUSR signal. The "1" at the input 422-2 will generate a "0" which is changed to a "1" by the inverter 423. Now the address signals at the latch inputs will appear on the latch outputs. When the $\overline{DIP}$ signal is changed back to "1", a "0" will again appear at the clock inputs and the address signals A0 through A6 and A8 will be latched onto the address output lines 393. In a similar manner, the $\overline{DOP}$ = "0" signal will place the address signal at the latch outputs and will latch them there when it returns to "1".

The $\overline{DIP}$ signal and the $\overline{A6}$ through $\overline{A13}$ address signals cooperate to generate the EW signal on the line 394. An output 411-4 of the NOR 411 is connected through an inverter 424 to an input 425-1 of a NOR 425. When the $\overline{A11}$, $\overline{A12}$ and $\overline{A13}$ address signals are at "1", the NOR 408 will generate a "0" at the input 409-4, the NAND 409 will generate a "1" at an input 411-3, the NOR 411 will generate a "0" which is changed to a "1" by the inverter 424 and the NOR 425 will generate a "0" on the EW line 394. If the $\overline{A11}$, $\overline{A12}$ and $\overline{A13}$ address signals are changed to "0", the NOR 408 will generate a "1". If the address signals $\overline{A6}$, $\overline{A7}$ and $\overline{A9}$ are at "1", all the inputs of the NAND 409 will be at "1" to generate a "0" at the input 411-3. If the $\overline{A8}$ and $\overline{A10}$ address signals also change to "0", the NOR 411 will generate a "1" which is changed to a "0" by the inverter 424 at the input 425-1 to enable the NOR 425. When the $\overline{DIP}$ signal signal changes to "0", an EW = "1" signal will be generated by the NOR 425 on the line 394.

The $\overline{D0}$ signal on the line 237-1 is changed to a D0 signal by an inverter 426 at the D0 line 241 and an input 427-1 of a hex flip flop 427. The hex flip flop 427 has a plurality of inputs 427-1 through 427-6 and a plurality of corresponding outputs 427-7 through 427-12 respectively. A clear input 427-14 is connected to a positive polarity direct current power supply through a resistor 428 to supply a "1" thereby enabling a "0" to "1" transition at a clock input 427-13 to transfer the signals on the inputs to the corresponding outputs.

The data lines 237-2 through 237-6 are connected to the inputs 427-2 through 427-6 respectively. The outputs 427-7 through 427-12 are connected to the hall lantern address lines 98-1 through 98-6 respectively. When the $\overline{STHL}$ signal on the line 238 changes from "0" to "1", the data signals are generated at the flip flop outputs and are inverted before being applied to the hall lantern address lines. The D0 signal is clocked from the input 427-1 to the output 427-7 and is inverted by an inverter 429 on the line 98-1 to become the L0 signal. The $\overline{D1}$ through $\overline{D5}$ data signals are inverted by a plurality of inverters 431 through 435 respectively to become the $\overline{L1}$ through $\overline{L5}$ hall lantern address signals.

In summary, the bus interface circuit 231 is an interface between the bus 56 and various elements of the parallel input/output circuit 58 of FIG. 8. The $\overline{A0}$ through $\overline{A5}$ address signals are utilized to generate the A0 through A3 address signals and the E2 through E5 enable signals to the decoder/demultiplexers and the data selector/multiplexers of FIGS. 8 and 9. The processor 57 of FIG. 3 sends the $\overline{A0}$ through $\overline{A5}$ address signals over the bus 56 to the bus interface circuit 231. The A0 through A3 address signals and the E2 through E5 enable signals determine which hall call input signal is generated on the W1 through W4 output lines 234 to update the status of the hall call signal at the bus temporary memory. The $\overline{A6}$ through $\overline{A13}$ address signals and the data output $\overline{DOP}$ signal may also be utilized to generate the E1 enable signal. Then the selected hall call will be cancelled as the decoder/demultiplexer is enabled and the bus temporary memory will be updated.

The $\overline{A0}$ through $\overline{A6}$ and $\overline{A8}$ address signals are inverted and latched onto the address output lines 393 to provide address signals to the bus temporary memory whenever data is read into or read out of the bus temporary memory. The address signals $\overline{A6}$ and $\overline{A9}$ through $\overline{A13}$ and either the $\overline{DIP}$ or $\overline{DOP}$ signal will latch the address signals and will generate a bus read BUSR or bus write BUSW signal to the bus temporary memory.

The $\overline{DIP}$ signal and the $\overline{A6}$ through $\overline{A13}$ address signals will generate the enable write EW signal to the bus temporary memory. The EW signal enables the W1 through W4 output signals to be generated on the $\overline{D0}$ line 236 so that they may be sent to the processor on the $\overline{D0}$ data line 237-1.

The $\overline{D0}$ through $\overline{D5}$ data signals from the processor and the $\overline{STHL}$ signal from the decoder/demultiplexer 221 of FIGS. 8 and 9 generate the L0 and L1 through $\overline{L5}$ hall lantern address signals on the lines 98. The $\overline{STHL}$ = "0" signal is generated by a "0" for the address signals A0 through A3 and the enable signals E1 and E2 at the decoder/demultiplexer 221 of FIG. 9. When the $\overline{STHL}$ signal is changed to "1", the hall lantern address signals are generated.

FIG. 16 BUS TEMPORARY MEMORY

Figure 16:
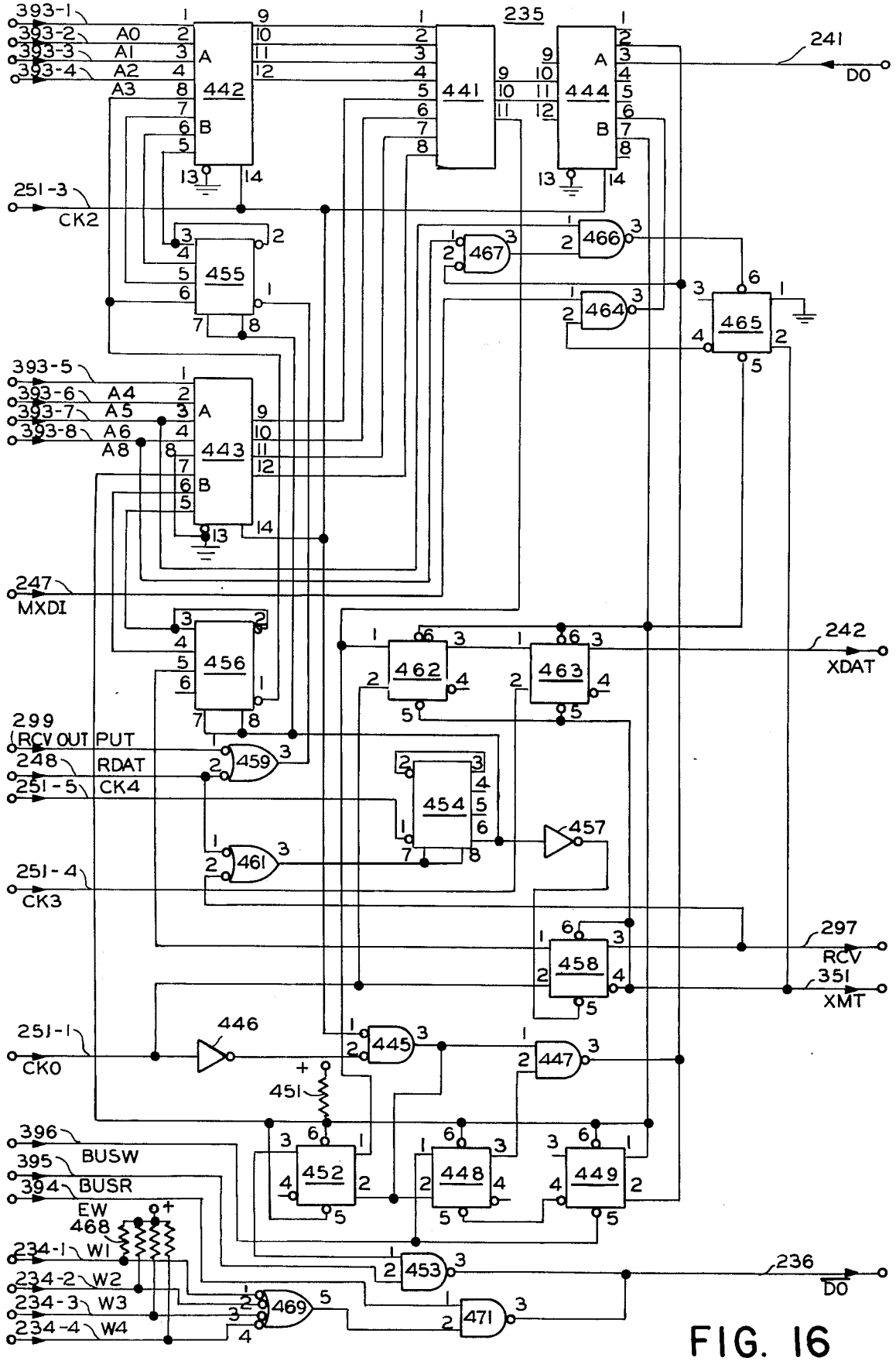
FIG. 16 is a schematic diagram of the bus temporary memory of FIG. 8.

FIG. 16 is a schematic diagram of the bus temporary memory 235 of FIG. 8. Inputs to the memory are the A0 through A6 and A8 address signals on the output lines 393, the enable write EW signal on the line 394, the bus read BUSR signal on the line 395 and the bus write BUSW signal on the line 396 from the bus interface circuit 231; the CK0, CK2, CK3 and CK4 clock pulse trains, the read data RDAT signal on the line 248 and the multiplexed data in signal on the line 247 from the receiver 246; the RCV OUTPUT signal on the line 299 from the transmitter and clock 243; and the W1 through W4 output signals on the lines 234 from the data selector/multiplexers 222, 224, 226 and 228 respectively. Outputs from the memory are the $\overline{D0}$ data signal on the line 236 to the bus interface circuit 231; the transmit XMT signal on the line 351 to the receiver 246; and the XDAT signal on the line 242 and the RCV signal on the line 297 to the transmitter and clock 243.

The bus temporary memory 235 includes a two hundred and fifty-six bit random access memory RAM 441 for storing data received on the D0 line 241 through the bus interface circuit or received on the MXDI line 247 from the receiver. Data may be read from the RAM 441 and placed on the XDAT line 242 for multiplexed transmission to the car panel (slave) multiplexer or lobby panel (slave) demultiplexer or may be placed on the $\overline{D0}$ line 236 for transmission on the bus. The RAM 441 provides a storage place for the car calls, car supervisory signals, and the lobby panel signals as they await use in the system.

The A0 through A3 address signals are applied to a plurality of "A" inputs 442-1 through 442-4 of a two to one line data selector/multiplexer. The data selector/multiplexer 442 also has a plurality of "B" inputs 442-5 through 442-8 and a plurality of outputs 442-9 through 442-12. If a "0" is placed at a strobe input 442-13 and at a select input 442-14, the signals on the "A" inputs 442-1 through 442-4 will appear on the outputs 442-9 through 442-12 respectively. If a "0" is placed on the strobe input 442-13 and a "1" is placed on the select input 442-14, the signals on the "B" inputs 442-5 through 442-8 will appear on the outputs 442-9 through 442-12 respectively.

The A4 through A6 and A8 address signals are applied to a plurality of "A" inputs 443-1 through 443-4 of a two line to one line data selector/multiplexer 443 having a plurality of outputs 443-9 through 443-12. The strobe inputs 442-13 and 443-13 are grounded to receive a "0" such that, each time the CK2 clock signal on the line 251-3 goes to "0" at the select inputs 442-14 and 443-14, the address signals on the address lines 393-1 through 393-8 are applied to a plurality of inputs 441-1 through 441-8 respectively of the RAM 441 to select one of the two hundred fifty-six one bit binary words stored therein.

The address inputs of the RAM 441 receive a binary coded address wherein the input 441-1 is the binary one position and the input 441-8 is the binary one hundred twenty-eight position. If there is a "0" at a write enable input 441-9, a signal applied at an input 441-10 will be written into the storage position selected by the address on the lines 393. If there is a "1" on the write enable input 441-9, the bit of data stored in the selected storage position will appear at an output 441-11.

If data is to be written into or read out of the RAM 441 under the control of the processor 57 of FIG. 3, the address lines 393 and the BUSW line 396 or the BUSR line 395 are utilized. A data bit from the processor is placed on the bus 56 of FIG. 8 and is sent into the bus interface circuit 231 on the $\overline{D0}$ line 237-1. The data bit is changed to a D0 signal by the inverter 426 of FIG. 15 and is sent to the bus temporary memory 235 on the D0 line 241. The D0 line 241 is connected to an input 444-3 of a data selector/multiplexer 444. The CK2 clock pulse train line 251-3 is connected to a select input 444-14 so that the D0 signal appears at an output 444-11 whenever the CK2 signal goes to "0". The output 444-11 is connected to the input 441-10 of the RAM 441 but a "0" write signal is required at the write enable input 441-9 to place the D0 signal into storage.

The CK2 clock pulse train line 251-3 is also connected to an input 445-1 of a NOR 445. The CK0 clock pulse train line 251-1 is connected to an input 445-2 through an inverter 446. Referring to FIG. 11, it may be seen that the CK0 pulse train will be "1" when the CK2 pulse train is "0" once each cycle of the CK2 pulse train to generate a "1" at an output 445-3 of the NOR 445. The "1" is applied to an input 447-1 of a NAND 447.

The BUSW line 396 is connected to a data input 448-1 of a D-type flip flop 448. If it is assumed that there is a "0" at the non-inverting output 448-3, the "0" will be applied to an input 447-2 to generate a "1" at an output 447-3 to an input 444-2 of the data selector/multiplexer 444. A BUSW = "1" signal will be transferred to the output 448-3 when the output 445-3 changes from "0" to "1" at a clock input 448-2. The NAND 447 will now generate a "0" at the input 444-2 which is applied to the write enable input 441-9 since the CK2 clock pulse train is at "0". At the same time, the data selector/multiplexers 442 and 443 have their "A" inputs connected to the outputs to select the storage position into which the D0 data bit is written.

When the CK2 clock pulse train goes to "1", the NOR 445 will generate a "0" to the NAND 447. The NAND 447 will then generate a "1" at a clock input 449-2 of a D-type flip flop 449. If it is assumed that the flip flop 449 was previously cleared, a "1" from a positive potential direct current power (not shown) connected to a data input 449-1 through a resistor 451 will be clocked onto a non-inverting output 449-3. An inverting output 449-4 will change from "1" to "0" at a clear input 448-5 to reset the output 448-3 to a "0". A subsequent "0" to "1" transition at the output 445-3 will clock BUSW = "1" signal into the flip flop 448 and the D0 line 241 signal will again be read into the RAM 444. If the BUSW signal is changed to "0", the next "0" to "1" transition of the output 445-3 will clock the "0" onto the 448-3 output to disable the NAND 447 which generates a "1".

When data is to be read out of the RAM 441 and onto the $\overline{D0}$ line 236, the address signals will be applied to the RAM inputs and the "1" from the NAND 447 will be applied to the write enable input 441-9 when the CK2 clock pulse train goes to "0". The NAND 447 generates a "1" which is applied through the data selector/multiplexer 444 to the write enable input 441-9. The data bit in the selected storage position will appear at the output 441-11 which is connected to a data input 452-1 of a D-type flip flop 452. A clock input 452-2 is connected to the output 445-3 so that a "0" to "1" transition at the output 445-3 will clock the selected data bit onto a non-inverting output 452-3. The output 452-3 is connected to an input 453-1 of a NAND 453 which also has an input 453-2 connected to the BUSR line 395. When the BUSR signal is "1", the NAND 453 is enabled to generate the inverse of the data bit onto the D0 line 236. Therefore, the $\overline{D0}$ data bit stored in the RAM 441 is read out as the $\overline{D0}$ data bit on the line 236 to the bus interface circuit 231.

The RAM 441 is utilized to store the multiplexed data received on the MXDI line 247 and to output data in multiplexed form on the XDAT line 242. The pulses of the CK4 clock pulse train on the line 251-5 are counted by a four-bit binary counter 454. A pair of counters 455 and 456 are connected in series to count the pulses on the RDAT line 248 and the RCV OUTPUT line 299. Since the counters function in a similar manner, only the operation of the counter 454 will be described. When either of a pair of reset inputs 454-7 and 454-8 are at "0", a pulse train applied at an input 454-1 is divided by two at an output 454-3. If the output 454-3 is connected to a second input 454-2, the counter functions as a ripple through counter and the pulse train is divided by four at an output 454-4, by eight at an output 454-4 and by sixteen at an output 454-6.

The output 454-6 is connected through an inverter 457 to a clear input 458-5 of a D-type flip flop 458 and to the reset inputs of the counters 455 and 456. Assuming that all of the counters have been reset to zero, an output 456-5 of the counter 456 is connected to a data input 458-1 of the flip flop 458 to supply a "0". The CK0 clock pulse train line 251-1 is connected to a clock input 458-2 to clock a "0" onto a non-inverting output 458-3 and a "1" onto an inverting output 458-4. The output 458-3 is connected to the RCV line 297 and the output 458-4 is connected to the XMT line 351. The "1" on the XMT line 351 enables the transmitter and clock 243 of FIG. 10 to code the data signals on the XDAT line 242 and transmit them to the car panel (slave) multiplexer and the lobby panel (slave) demultiplexer. Each coded bit that is transmitted generates a "0" pulse on the RCV OUTPUT line 299 which is connected to an input 459-1 of a NAND 459.

When the XMT signal is "1", the receiver 246 of FIG. 8 will generate a "1" on the RDAT line 248 which is connected to an input 459-2. The "0" RCV OUTPUT pulses are inverted by the NAND 459 to "1" pulses at an output 459-3 which is connected to an input 455-1 of the counter 455. The counter 455 has an output 455-6 connected to an input 456-1 of the counter 456. The frequency of the RCV OUTPUT pulse train is divided by one hundred twenty-eight at the output 456-5 which is connected to the data input 458-1 of the flip flop. The output 456-5 will remain at "0" as sixty-four coded bits are transmitted and then will change to "1". Then flip flop 458 will reverse the signals at its outputs to generate a XMT = "0" signal to stop the transmitter and a RCV = "1" signal to start the receiver.

When the RCV signal changes to "1", the RCV OUTPUT signal will remain at "1" while the receiver will generate a "0" on the RDAT line 248 for each coded bit that is received. The "1" at the output 458-3 will enable a NAND 461 at an input 461-2. An input 461-1 is connected to the RDAT line 248 to supply a "1" to the NAND 461 during the transmission time. The RCV = "0" signal during the transmission time disabled the NAND 461 which generated a "1" at the reset inputs 454-7 and 454-8 to maintain the output 454-6 at "0" to enable the counters 455 and 456. Now the RDAT = "0" signal is inverted by the NAND 461 to generate a "1" reset signal to the counter 454 as each coded bit is received to maintain the output 454-6 at "0" to enable the counters 455 and 456. When sixty-four coded bits have been received, the output 456-5 will change from "1" to "0" and the signals at the outputs of the flip flop 458 will be reversed to start the transmission again.

During the transmisson of the coded bits by the transmitter, the data bits are read from the RAM 441 in multiplexed form and are generated on the XDAT line 242. When the XMT signal at the output 458-4 changes to "1", it is applied to a pair of clear inputs 462-5 and 463-5 of a pair of D-type flip flops 462 and 463. The output 441-11 of the RAM 441 is connected to a data input 462-1 and the CKO clock pulse train line 251-1 is connected to a clock input 462-2. As may be seen in FIG. 11, the flip flop will be clocked by the CKO pulse train twice during each cycle of the CK2 pulse train, once when CK2 = "1" and once when CK2 = "0". Each time the flip flop 462 is clocked, the data bit at the output 444-11 will be placed on a non-inverting output 462-3, which is connected to a data input 463-1 of the flip flop 463. The CK3 clock pulse train line 251-4 is connected to a clock input 463-2. The CK3 clock pulse train will clock the output signal at the output 462-3 onto an output 463-3 once for every twelve cycles of the CK2 pulse train. Since the RDAT signal on the line 248 also cycles once for every twelve cycles of the CK2 pulse train, the counters 455 and 456 will increment the address at the "B" inputs to the data selector/multiplexers 442 and 443 to select a different storage position.

The counter 455 has its outputs 455-3 through 455-6 connected to the "B" inputs 442-5 through 442-8 respectively of the data selector/multiplexer 442 to generate a four bit address that is incremented from binary zero to binary fifteen. The counter 456 has its outputs 456-3 and 456-4 connected to the inputs 443-5 and 443-6 respectively of the data selector/multiplexer 443 to generate two more address bits. The six bit address is incremented from binary zero to binary sixty-three. The input 443-7 is connected to the positive potential power supply through the resistor 451 to receive a "1" representing binary sixty-four and the input 443-8 is connected to ground potential to receive a "0". When the CK2 clock pulse train is at "1", the "B" inputs of the data selector/multiplexers 442 and 443 will be connected to the address inputs of the RAM 441. The applied address will be incremented from binary sixty-four to binary one hundred twenty-seven by one address bit for every twelve CK2 clock pulse train pulses.

During the transmission of the coded data bits, the MXDI signal will be at "0" at an input 464-1 of a NAND 464 to generate a "1" at an output 464-3. The output 464-3 is connected to an input 444-6 to supply the "1" to the write enable input 441-9 when the CK2 clock pulse train goes to "1". The signal at the output 441-11 will be determined by the address at the inputs 441-1 through 441-8 so that each of sixty-four bits of stored data is multiplexed onto the XDAT line 242.

An inverting output 465-4 of a D-type flip flop 465 is connected to an input 464-2 of the NAND 464. A data input 465-1 is connected to ground potential to supply a "0" and a clock input 465-2 is connected to the output 458-4 to receive the XMT signal. When the XMT signal changes from "0" to "1", the flip flop 465 is clocked to generate a "1" at the output 465-4 to enable the NAND 464 to pass the inverted MXDI signal. If the car panel (slave) multiplexer transmits a binary coded "0" representing the presence of a particular car signal, the receiver 246 of FIG. 13 will generate a "1" on the MXDI line which is changed to a "0" by the NAND 464. The "0" is applied to the write enable input 441-9 to write the "1" at the input 441-10 into the selected storage position. If the car signal is not present, the receiver will maintain the MXDI line at "0". The NAND 464 will place a "1" at the write enable input 441-9 and no data will be written into the RAM 441. Therefore, the received data bits are witten into the RAM 441 if they represent the presence of a car signal. The address input signals to the RAM 441 from the "B" inputs of the data selector/multiplexers 442 and 443 will be incremented in synchronizm with the MXDI signal to place that input data into the correct storage positions.

The flip flop 465 may be preset by the processor to disable the NAND 464. The A6 address signal on the line 393-7 is applied to an input 466-1 of a NAND 466. The A8 address signal on the line 393-8 is applied to an input 467-1 of a NOR 467. If the A6 signal is at "1" and the A8 signal is at "0", the NAND 466 and the NOR 467 are enabled. An input 467-2 of the NOR 467 is connected to the output 447-3 of the NAND 447 and an output 467-3 is connected to an input 466-2 of the NAND 466. When the output 447-3 goes to "0", the NOR 467 will generate a "1" and the NAND 466 will generate a "0" which is applied to a preset input 465-6 of the flip flop 465. The "0" at the preset input 465-6 will generate a "0" at the output 465-4 to disable the NAND 464.

The output signals W1 through W4 on the lines 234 pass through the bus temporary memory 235 and are generated on the $\overline{D0}$ line 236. Each of the lines 234-1 through 234-4 is connected to a positive potential direct current power supply (not shown) through a resistor such as the resistor 468 connected to the line 234-1 to provide a "1" signal when an unused input of one of the data selector/multiplexers 222, 224, 226 or 228 of FIG. 8 is selected. The lines 234-1 through 234-4 are connected to a plurality of inputs 469-1 through 469-4 respectively of a NAND 469.

The EW line 394 is connected to an input 471-1 of a NAND 471. When EW = "0", the NAND 471 will be disabled to generate a "1" at an output 471-3 on the $\overline{D0}$ line 236. When it is desired to read the hall call signals, the processor will cause a EW = "1" to be generated to enable the NAND 471. The three data selector/multiplexers of FIG. 8 which are not selected will generate a "1" at the corresponding inputs of the NAND 469. The selected signal will be inverted by the NAND 469 and changed back by the NAND 471 on the $\overline{D0}$ line 236. If the address signals to the data selector/multiplexers are incremented, the hall calls signals will be generated on the $\overline{D0}$ line 236 in multiplexed form.

In summary, the bus temporary memory 235 stores those data bits which are to be transmitted to the car panel (slave) multiplexer and the lobby panel (slave) demultiplexer or are to be placed on the bus for the processor to read. The memory 235 includes a RAM 441 which stores the data bits. Circuitry in the memory 235 is responsive to clock pulse trains from the transmitter and clock of FIG. 10 to generate a RCV signal on the line 297 to enable the receiver to decoder sixty-four data bits from the car panel (slave) multiplexer. The decoded data bits are received on the MXDI line 247 and, if they represent the presence of a car signal, they are written into RAM 441 at a storage position determined by an address generated by a pair of counters 455 and 456. The address is incremented once for each data bit and is synchronized with the MXDI signal by the clock pulse trains.

During the time the RCV signal is being generated, the address inputs of the RAM 441 are alternately connected to the outputs of the counters 455 and 456 and the address lines 393. Therefore, the storage positions in the RAM 441 may also have data written into them which is sent by the processor on the D0 line 241. For example, the D0 signal may represent the cancellation of a car call which was previously entered and then serviced. A BUSW signal must also be generated by the processor to write the data from the D0 line 241 into the RAM 441.

After sixty-four data bits have been received, the XMT signal is generated on the line 351 to enable transmitter and clock to transmit sixty-four bits of data. The counters 455 and 456 will again supply the incremented address signals so that data bits read from the RAM 441 are read onto the XDAT line 242 in multiplexed form.

During the time the XMT signal is being generated, the address inputs of the RAM 441 are alternately connected to the outputs of the counters 455 and 456 and the address lines 393. Therefore, the data bits in the RAM storage positions may also be read out onto the $\overline{D0}$ line to the processor. For example, the D0 signal may represent a car call which must be serviced by the car. A BUSR signal must be generated by the processor to read the data from the RAM 441 onto the $\overline{D0}$ line 236.

The hall call signals from the data selector/multiplexers of FIG. 8 on the lines 234 may also be placed on the $\overline{D0}$ line 236. The EW enable write signal on the line 394 enables the NAND 471 to pass the W1 through W4 signals onto the $\overline{D0}$ line 236.

The parallel input/output circuit 58, shown in block diagram form in FIG. 8 and in more detail in FIGS. 9 through 16, functions as an interface between the processor and the hall call circuits, the car panel circuits, the lobby panel circuits and the hall lantern circuits. Referring to FIG. 8, the generation of a hall call with latch a hall call input signal onto the line 95 from a sense and clear circuit 92 associated with the hall call station. The hall call input signal is applied to one input of one of four data selector/multiplexers 222, 224, 226 and 228. The processor will send address signals through the bus 56 on the address lines 229 to the bus interface circuit 231. The bus interface circuit will generate the address signals A0 through A3 on the lines 232 and an enable signal on one of the enable lines 233 to select the inputs of the data selector/ multiplexers in sequence. When the input to which the hall call input signal is applied is selected, an output signal is generated on the associated one of the output lines 234 to the bus temporary memory 235. The memory 235 generates the hall call signal on the $\overline{D0}$ line 236, through the bus interface circuit 231, and onto the $\overline{D0}$ line 237 where it is read from the bus 56 by the processor.

A hall call signal from any hall call station also generates a hall call entered signal on the line 97 from the one hall call entered circuit 91 connected to all the sense and clear circuits 92. This signal is applied to an input of the data selector/multiplexer 222. Therefore, the processor can check the input connected to the line 97 to determine if a hall call has been generated. If a hall call has been entered, the processor can then check all the inputs to read one or more hall call inputs signals.

When a hall call has been serviced, the processor can cancel the hall call input signal by generating the proper set of address signals. The bus interface circuit 231 will generate address signals on the lines 232 and enable signals on the lines 233 to select the proper output of one of the decoder/demultiplexers 221, 223, 225 and 227. A clear signal will be generated at the selected output to reset the sense and clear circuit 92 and to remove the hall call input signal from the input of the data selector/multiplexer. Thus, it may be seen that hall calls are temporarily stored in the sense and clear circuits 92 to be read by the processor through the parallel input/output circuit 58. The hall calls are cancelled by the processor through the parallel input/output circuit 58.

When the elevator car is approaching the floor at which it is to stop for a hall call or a car call, the processor sends a signal to the parallel input/output circuit to light a hall lantern. The signal is sent through the bus 56 on the data lines 237 to the bus interface circuit 231. The bus interface circuit generates address signals on the lines 98 to the hall lantern decoder/driver 93 to light the correct hall lantern. The address signals are latched onto the lines 98 by bus interface circuit 231 until the processor sends a new set of signals to cancel the lighted hall lantern.

A third set of signals that pass through the parallel input/output circuit 58 are the car panel signals and the lobby panel signals. The car panel signals include car calls and car supervisory signals and the lobby panel signals are utilized to actuate indicators for car position in the lobby.

The transmitter and clock 243 and the receiver 246 alternate transmitting signals to the car panel (slave) multiplexer 101 and the lobby panel (slave) demultiplexer 102 and receiving signals from the car panel (slave) multiplexer 101 through a transmitter/receiver interface circuit 239. A failure detector 249 monitors the transmitter output and the receiver input and generates a failure signal on a line 250 if either the transmitter and clock 243 or the car panel (slave) multiplexer fails. The failure signal is an input to the data selector/multiplexer 222 where it is read by the processor for the further action.

The bus temporary memory stores the data bits which are sent on the XDAT line 242 to the transmitter and clock 243 to be transmitted on the lines 64 and 103 to the car panel (slave) multiplexer 101 and the lobby panel (slave) demultiplexer 102. The data bits which are received by the receiver 246 are generated on the MXDI line 247 to the bus temporary memory 235 to update the data bits in storage. The processor can change the data bits in storage by sending the address of the storage position and the new data bit through the bus interface circuit 231 and can read any data bit in storage by addressing the storage position through the bus interface circuit. Therefore, the parallel input/output circuit 58 functions as a temporary storage for the car panel and lobby panel signals.

FIG. 17 PROCESSOR

Figure 17:
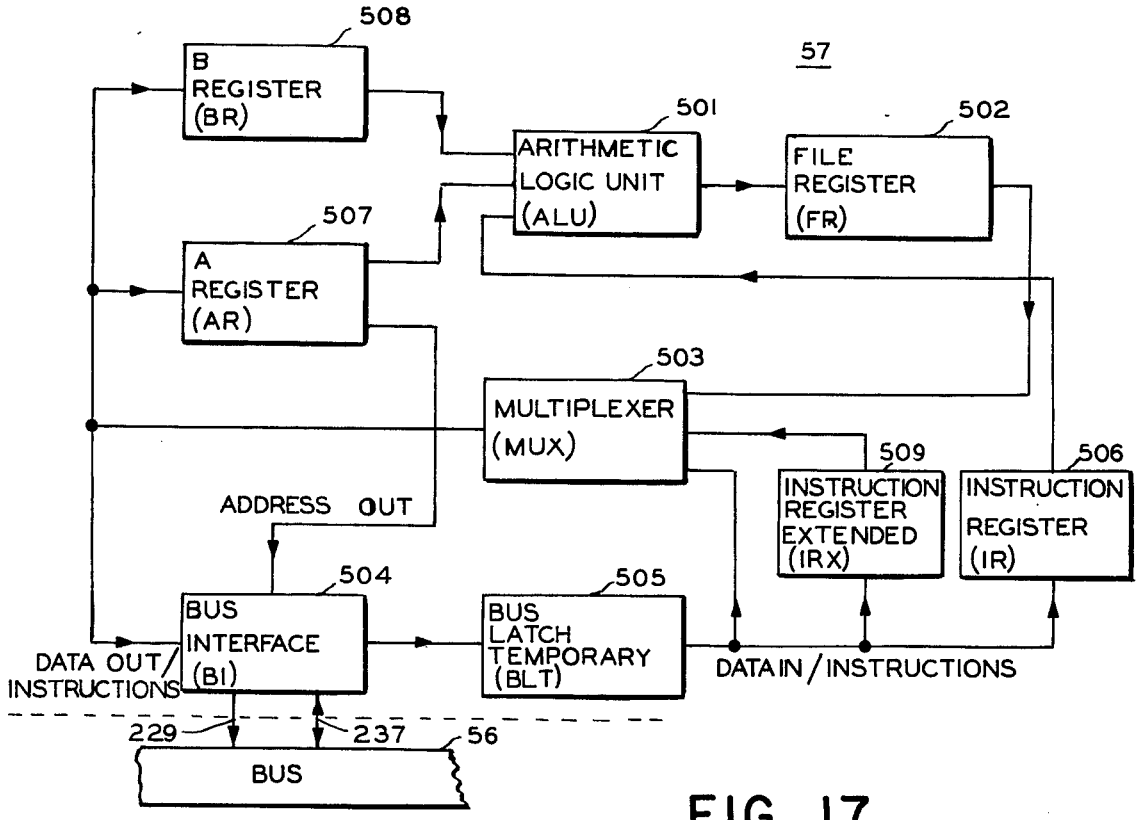
FIG. 17 is a block diagram of the bus and processor of FIG. 3.

FIG. 17 is a block diagram of the bus 56 and the processor 57 of FIG. 3. The processor 57 controls the operation of the elevator system utilizing a program written as a predetermined combination of basic instructions. The processor therefore initiates the reading of all data from the other circuits of the elevator system and the sending data to those elements. The processor is connected to the bus 56 by a plurality of address lines 229 and a plurality of data lines 237. The address and the data lines extend the length of the bus and are connected to each of the elements of the supervisor 55 of FIG. 3.

The processor 57 is a sixteen bit arithmetic processor with 4K of direct coupled read only memory (ROM) and up to 16K of bus accessible memory. The processor 57 includes an arithmetic logic unit (ALU) 501 which may be addressed to perform certain arithmetic and logic functions on a sixteen bit word. The output from the ALU 501 may be stored in a file register (FR) 502 which includes four sets of eight registers each, with each register having a sixteen bit capacity. Information may be outputed from the FR 502 through a multiplexer (MUX) 503 and a bus interface (BI) 504 to the bus 56. This information may be in the form of data or instructions. The data may include, for example, a value of velocity for the velocity/position circuit of FIG. 3 and the instructions may include, for example, a door close command. The information is sent out of the BI 504 on the data lines 237.

When information is received by the processor 57, it is inputed from the bus 56 on the data lines 237 into the BI 504. Since there are only eight data lines, a first eight bit byte is read into an instruction register (IR) 506 through a bus latch temporary (BLT) 505. The IR 506 generates the signals to select the function which the ALU will perform on a sixteen bit word from either an A register (AR) 507 or a B register (BR) 508. This word is received from the MUX 503.

A second byte may be read through the BLT 505 into an instruction register extended (IRX) 509. The IRX 509 also generates signals to aid the IR 506 in selecting the ALU function. A third byte may then be read into the BLT 505. The MUX 503 may be directed to send a sixteen bit word to the AR 507 or the BR 508 comprising the bytes from the BLT 505 and the IRX 509. The MUX 503 may also send a sixteen bit word to the AR 507 or the BR 508 from the FR 502. A sixteen bit word in the AR 507 may be sent to the ALU 501 or may be sent through the BI 504 as an address to the bus 56.

The following list of element abbreviations and reference numerals is provided as an aid in understanding FIGS. 17 through 39.

| | | |
|---|---|---|
| Arithmetic logic unit | ALU | 501 |
| Arithmetic logic unit/function generator | ALU/FG | 771-774 |
| Address multiplexer | AM | 536 |
| A register | AR | 507 |
| Bus control/distributed arbitrator | BC/DA | 532 |

-continued

| | | |
|---|---|---|
| Bus interface | BI | 504 |
| Bus latch temporary | BLT | 505 |
| B register | BR | 508 |
| Control | C | 511 |
| Clock | CK | 533 |
| Flag generator | FG | 535 |
| File register | FR | 502 |
| File register/multiplexer control | FR/MC | 532 |
| Instruction decoder | ID | 531 |
| Instruction register | IR | 506 |
| Instruction register extended | IRX | 509 |
| Multiplexer | MUX | 503 |
| Position counter | PC | FR |
| State counter | SC | 537 |
| Trap pointer | TP | FR |
| Extended control | XC | 512 |

FIG. 18 PROCESSOR SIGNAL FLOW

Figure 18:
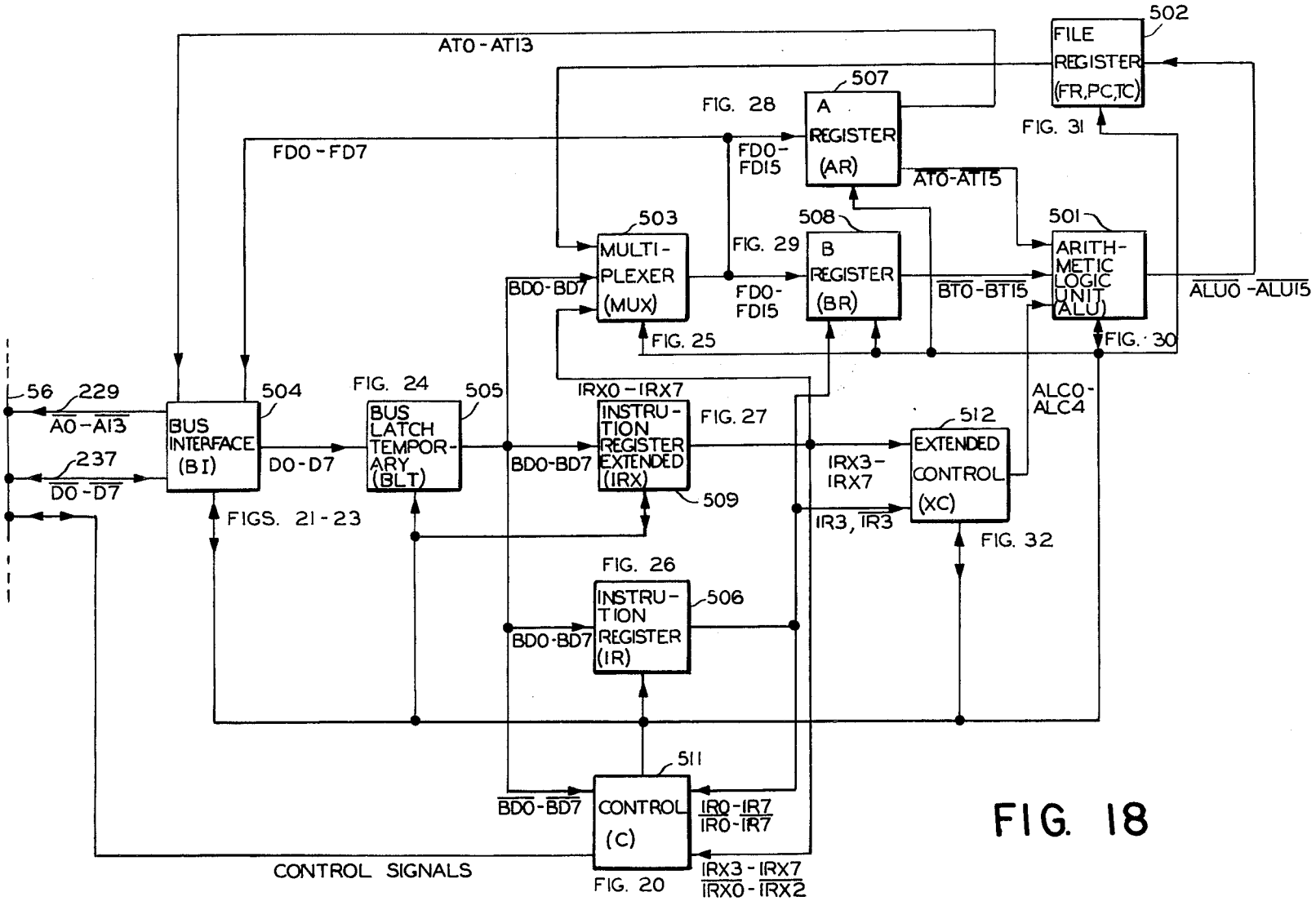
FIG. 18 is a more detailed block diagram of the processor of FIG. 17 showing the signal flow.

FIG. 18 is a more detailed block diagram of the processor 57 shown in FIG. 17 including signal designations for the signal flow between elements of the processor. The bus interface (BI) 504 is connected to the bus 56 to generate the address signals $\overline{A0}$ through $\overline{A13}$ and to generate and receive the data signals $\overline{D0}$ through $\overline{D7}$. The BI 504 also includes the 4K direct coupled read only memory (ROM) which may contain all or a portion of the elevator system program. The BI 504 is connected to generate to the bus latch temporary (BLT) 505 the bus data or the program instructions as the D0 through D7 data signals. The BLT 505 latches the D0 through D7 data signals to temporarily store them until they are to be utilized in another element of the processor.

The BLT 505 inverts the D0 through D7 data signals to generate the $\overline{BD0}$ through $\overline{BD7}$ bus data signals which are sent to a control circuit (C) 511. The BLT 505 also generates the D0 through D7 signals as the BD0 through BD7 signals to the multiplexer (MUX) 503, the instruction register extended (IRX) 509 and the instruction register (IR) 506. The IR 506 generates the instruction signal bits $\overline{IR0}$ through $\overline{IR7}$ and the instruction signal bits IR0 through IR7. These instruction signal bits are utilized to operate the C 511, an extended control (XC) 512 and the BR 508. The C 511 receives the IR0 through IR7 and the $\overline{IR0}$ through $\overline{IR5}$ signals, the XC 512 receives the IR3 and $\overline{IR3}$ signals and the BR 508 also receives the IR3 and $\overline{IR3}$ signals.

The IRX 509 generates the IRX0 through IRX7 instruction signal bits and the $\overline{IRX0}$ through $\overline{IRX7}$ instruction signal bits which are utilized to operate the multiplexer (MUX) 503 and to supplement the IR 506 instruction signal bits to operate the C 511 and the XC 512. The MUX 503 receives the IRX0 through IRX7 signals, the C 511 receives the IRX3 through IRX7 signals and the $\overline{IRX0}$ through $\overline{IRX2}$ signals and the XC 512 receives the IRX3 through IRX7 signals.

The file register (FR) 502 outputs a sixteen bit word to the MUX 503. The MUX 503 is controlled to select among the FR 502 output, the BD0 through BD7 signals and the IRX0 through IRX7 signals to generate the file data output singals FD0 through FD15. The FD0 through FD15 signals are applied to the AR 507 and the BR 508 for temporary storage and the FD0 through FD7 signals are applied to the BI 504 to be sent out on the bus as the $\overline{D0}$ through $\overline{D7}$ signals.

The XC 512 generates the ALC0 through ALC4 signals which select the logic or arithmetic function that the ALU 501 will perform. The selected function may require $\overline{AT0}$ through $\overline{AT15}$ AR 507 output signals and- /or the $\overline{BT0}$ through $\overline{BT15}$ BR 508 output signals. The ALU 501 generates the result of the function as the $\overline{ALU0}$ through $\overline{ALU15}$ signals to the FR 502. The AR 507 also generates the AT0 through AT13 output signals to the BI 504 to be outputed as the address signals $\overline{A0}$ through $\overline{A13}$.

The C 511, which receives signals from the BLT 505, the IR 506 and the IRX 509, generates clock and control signals to all of the other circuits in the processor. The clock signals determine the timing of the data transfer in the processor and the control signals determine what data is transferred. The C 511 also generates and receives control signals over the bus 56 which determine which of the circuits connected to the bus has control of the bus at any particular time.

FIG. 19 TABLE OF PROCESSOR INSTRUCTIONS

There is shown in Table I of FIG. 19 the basic instructions utilized in the processor 57. These instructions may be combined in a predetermined order to form a program which may control the operation of an elevator system. Each instruction may require up to four states to complete its operations. These are the F1, F2, F3 and X states and each state has a duration determined by the duration of three successively generated clock signals M0, M1 and M2.

There are ten basic instructions which may be modified to expand the capability of the processor. These instructions are: LOAD — which directs the processor to read data from the bus and carries its own address for the destination of the data; LOAD INDEXED — which directs the processor to read a list of data from the bus and requires that the destination address be obtained from the file; LOAD IMMEDIATE — which directs the processor to read a constant; STORE — which directs the processor to place data on the bus; STORED INDEXED — which directs the processor to place a list of data on the bus; ALU OPERATION — which directs the processor to perform one of the ALU functions; JUMP — which directs the processor to branch to another point in the program; CALL — which directs the processor to branch to another point in the program and return when it is finished; TRAP — which directs the processor to return from a CALL instruction; INC/DEC — which directs the processor to increase or decrease the contents of a register by one; and FLAG — which directs the processor to set or clear a set of internal flag signals.

For the purposes of FIG. 19, the term "BUS" will be used to designate the group of data lines which carry the D0 through D7 data signal between BI 504 and BLT 505. The data signals may be received from the bus 56, from the program instructions memory in the BI 504 or from the various circuit elements as control signals.

Each instruction begins in the F1 state with the M0 clock signal. One of the registers in the file register (FR) 502 is designated as the position counter (PC) and is utilized to remember the address of the present position in the stored program. Since each instruction represents one or more steps in the program, the sixteen bit word of address information stored in the PC is sent through the multiplexer (MUX) 503 to the A register (AR) 507. The control signals for the arithmetic logic unit (ALU) 501 are generated by the extended control (XC) 512 to cause the ALU 501 to read the word from the AR 507, increment the word by one and place the word back into the PC of the FR 502. Also during the F1 state a $\overline{DIP}$ data input signal is generated by the control (C) 511 to the bus 56 to enable data on the bus 56 to be read by the processor. A first eight bit byte of data is read from the BUS and into the instruction register (IR) 506 through the bus interface (BI) 504 and the bus latch temporary (BLT) 505. This data is a binary coded representative of the instruction which is utilized to generate the instruction register signals from the IR 506 to determine which one or more of the F2, F3 and X states are to be generated and what function will be performed by the ALU 501.

During the F2 state of the LOAD, LOAD IMMEDIATE, STORE, ALU OPERATION, JUMP and CALL instructions, the PC is incremented, the $\overline{DIP}$ signal is generated and a second eight bit byte of data is read from the BUS and into the instruction register extended (IRX) 509 through the BI 504 and the BLT 505. During he F3 state of LOAD, LOAD IMMEDIATE, STORE, JUMP and CALL instructions, the PC is incremented, the $\overline{DIP}$ signal is generated and a third input bit byte of data is read from the BUS and into the BLT 505 through the BI 504. Instructions which pass through the F2 state or the F2 and F3 states carry their own addresses which are stored in the program instruction memory. Thus, one or two eight bit bytes of address data must be read from the BUS.

During the X state, the instructions are executed according to the one to three bytes of data previously read from the BUS. During the X state of the LOAD instruction, the address bytes from the IRX 509 and the BLT 505 are placed in the AR 507. The current file information is read from the FR 502 into the B register (BR) 508 through the MUX 503. The $\overline{DIP}$ signal is generated to enable data to be read from the bus 56. The data is read from the bus 56 at the address in the AR 507 through the BI 504, the BLT 505 and the MUX 503 into the BR 508 to update the present file information. The updated information in the BR 508 is then read into the FR 502 through the ALU 501 for storage at the same file register location.

During the X state of the LOAD INDEXED instruction, an address is obtained from the FR 502 through the MUX and placed in the AR 507. The current file information is read from the FR 502 through the MUX 503. The $\overline{DIP}$ signal is generated to enable data to be read from the bus 56. The data is read from the bus 56 at the address in the AR 507 through the BI 504, the BLT 505 and the MUX 503 into the BR to update the present file information. The updated information in the BR 508 is then read into the FR 502 through the ALU 501 for storage at the same file register location.

During the X state of the LOAD IMMEDIATE instruction, bytes from the IRX 509 and the BLT 505 are placed in the AR 507. These bytes represent a constant which is read into the FR 502 througjh the ALU 501.

During the X state of the STORE instruction, the address bytes from the IRX 509 and the BLT 505 are placed in the AR 507. The $\overline{DOP}$ data output signal is generated by the C 511 to enable data to be placed on the bus 56. The data from the FR 502, either a high or low byte, is placed on the bus 56 through the MUX 503 and the BI 504 and sent to the address in the AR 507 which is placed on the bus 56 through the BI 504. The STORE INDEXED instruction is similiar to the STORE instruction except that the address is obtained from the FR 502 through the MUX 503 and placed in the AR 507. A piece of data from the FR 502 is placed on the bus 56 through the MUX 503 and the BI 504 along with the address from the AR 507 as the $\overline{DOP}$ signal is generated.

During the X state of the ALU OPERATION, one information word is placed in the AR 507 and another information word is placed in the BR 508 from the FR 502 through the MUX 503. The ALU 501 performs an arithmetic or logic function on the two words and the result is placed in the FR 502. During the X state of the JUMP instruction, the byte from the IRX 509 and the byte from the BLT 505 are placed in the AR 507 through the MUX 503. The two bytes in the AR 507 are placed in the PC of the FR 502 through the ALU 501 as the program branch.

During the X state of the CALL instruction, the byte from the IRX 509 and the byte from the BLT 505 are placed in the AR 507 through the MUX 503. The PC information is placed in the BR 508 through the MUX 503. The two bytes in the AR 507 represent the program branch and are placed in the PC of the FR 502 through the ALU 501. The previous PC word in the BR 508 is placed in the TP trap pointer of the FR 502 through the ALU 501 to store the location to which the program will return. During the X state of the TRAP instruction, the word in the TP of the FR 502 is placed in the AR 507 and the word in the PC of the FR 502 is placed in the BR 508. The word in the AR 507 is then placed in the PC through the ALU 501 to return the program from the CALL instruction. The word in the BR 508 is placed in the TP through the ALU 501.

During the X state of the INC/DEC instruction, the contents of a register of the FR 502 are placed in the AR 507 through the MUX 503. The contents of the AR 507 are either incremented by one or decremented by one by the ALU 501 and the result is placed in the FR 502. During the X state of the FLAG instruction, the byte in the IR 506 is utilized to set the flags in the C 511 of FIG. 18.

The eight bits of data read from the BUS during the F1 state is the program instruction signal, the eight bits read during the F2 state is the least significant byte of the address and the eight bits read during the F3 state is the most significant byte of the address. The address may be a file register address for storing or reading data, it may be a memory address for directing the processor to a different point in the program or it may be an address of a circuit connected to the bus 56 for reading data into or out of the processor.

FIG. 20 CONTROL

Figure 20:
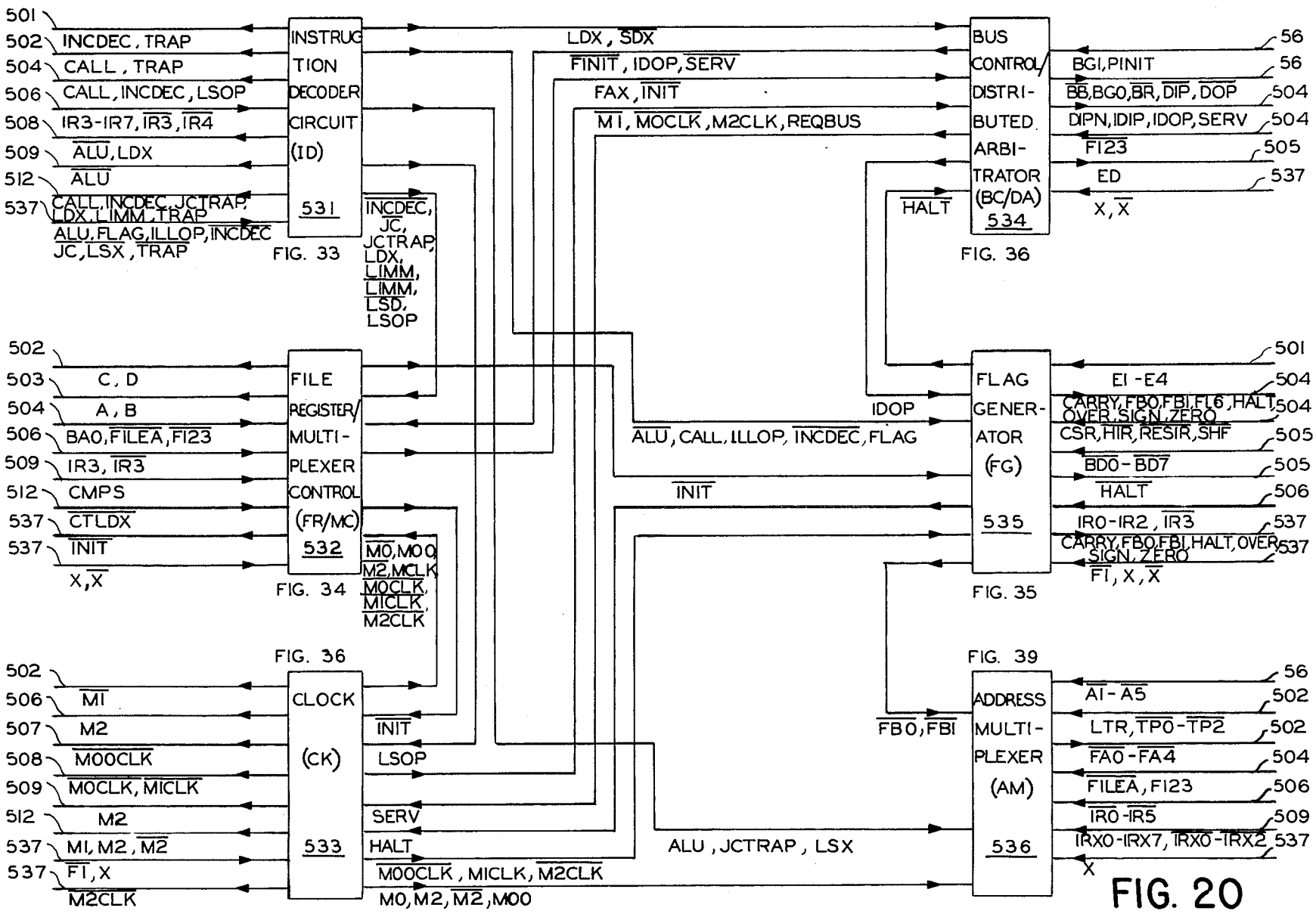
FIG. 20 is a block diagram of the various circuits of the control circuit in the processor of FIG. 18.

FIG. 20 is a block diagram of the various circuits (excluding the state counter (SC) 537) of the control circuit (C) 511 of FIG. 18, showing the signal flow from, to and between the instruction decoder circuit (ID) 531, the file register/multiplexer control (FR/MC) 532, the clock (CK) 533, the bus control/distributed arbitrator (BC/DA) 534, the flag generator (FG) 535 and the address multiplexer (AM) 536. The signal designations will appear in the following FIGS. and descriptions thereof as an aid in the comprehension of the cooperation among the circuits of the processor. The following is a list of the signals generated in the processor and shown in FIGS. 18 through 39 together with their definitions. The output line for each signal is also listed.

| SIGNAL | OUTPUT | DEFINITION |
|---|---|---|
| A | 532-1 | Control signal for MUX |
| A0 to A15 | 299-1 to -14 | Address signals on bus |
| ALC0 to ALC4 | 512-1 to -5 | Arithmetic logic unit/function generator function selection signals |
| ALU | 531-8 | Logic or arithmetic instruction signal |
| $\overline{ALU}$ | 531-9 | |
| ALU0 to ALU15 | 501-1 to -16 | ALU output signals |
| AT0 to AT13 | 507-1 to -14 | AR output signals |
| $\overline{AT0}$ to $\overline{AT15}$ | 507-15 to -30 | |
| B | 532-2 | Control signal for MUX |
| BAO | 504-4 | Inverted A0 signal |
| $\overline{BB}$ | 534-3 | Bus busy signal |
| BD0 to BD7 | 505-1 to -8 | Bus data signals |
| $\overline{BD0}$ to $\overline{BO7}$ | 505-9 to -16 | |
| BGI | 56-2 | Bus grant in signal |
| BGO | 534-2 | Bus grant out signal |
| $\overline{BR}$ | 534-1 | Bus request signal |
| $\overline{BT0}$ to $\overline{BT15}$ | 508-1 to -16 | BR output signals |
| BUSY | 537-9 | Processor is in a state signal |
| C | 532-5 | Control signal for FR |
| CALL | 531-7 | Call instruction signal |
| CARRY | 535-9 | Last arithmetic operation generated a carry flag signal |
| $\overline{CMPS}$ | 509-17 | Compare signal |
| CSR | 504-5 | Add select to status register signal |
| $\overline{CTLDX}$ | 512-6 | Current instruction is a call, trap, load direct or load indexed instruction signal |
| D | 532-6 | Control signal for FR |
| $\overline{DIP}$ | 534-8 | Data input signal |
| DIPN | 534-7 | Internal data signal |
| $\overline{DOP}$ | 534-10 | Data output signal |
| D0 to D7 | 504-18 to -11 | Data signals |
| $\overline{D0}$ to $\overline{D7}$ | 237-1 to -8 | Data signals on bus |
| E1 to E4 | 501-17 to -20 | Flag set signals |
| ED | 534-9 | External data signal |
| F1 to F3 | 537-1, -3, -5 | State signals |
| $\overline{F1}$ to $\overline{F3}$ | 537-2, -4, -6 | |
| F123 | 504-2 | Presence of F1 to F2 or F3 state signal |
| $\overline{F123}$ | 504-1 | |
| $\overline{FA0}$ to $\overline{FA4}$ | 536-1 to -5 | Memory address signals |
| FAX | 532-3 | Bus connected to FR signal |
| FB0, FB1 | 535-7 -5 | File buffer select bits flag signals |
| $\overline{FB0}$, $\overline{FB1}$ | 535-8, -6 | |
| FD0 to FD15 | 503-1 to -16 | File data signals |

-continued

| SIGNAL | OUTPUT | DEFINITION |
|---|---|---|
| $\overline{\text{FILEA}}$ | 504-3 | Addressing internal files signal |
| FINIT | 534-6 | Processor initialize signal |
| FLAG | 531-1 | Instruction is a flag set instruction signal |
| $\overline{\text{FLAG}}$ | 531-2 | |
| FL6 | 535-4 | UP/down flag signal |
| HALT | 535-1 | Halt flag signal |
| $\overline{\text{HALT}}$ | 535-2 | |
| HIR | 504-8 | Halt for interrupt signal |
| $\overline{\text{HIR}}$ | 504-9 | |
| IDIP | 534-13 | Internal data output signal |
| IDOP | 534-11 | Internal data input signal |
| ILLOP | 531-19 | Illegal operation instruction signal |
| INCDEC | 531-12 | Increment or decrement register instruction signal |
| $\overline{\text{INCDEC}}$ | 531-13 | |
| INIT | 532-4 | Initialize signal |
| $\overline{\text{INTR}}$ | 56-1 | Interrupt signal |
| IR0 to IR7 | 501-1 to -8 | Instruction signal bits |
| $\overline{\text{IR0}}$ to $\overline{\text{IR7}}$ | 506-9 to -16 | |
| IRX0 to IRX7 | 509-1 to -8 | Instruction signal bits |
| $\overline{\text{IRX0}}$ to $\overline{\text{IRX7}}$ | 509-9 to -16 | |
| JC | 531-6 | Jump or call instruction signal |
| JCTRAP | 531-5 | Jump or call or trap instruction signal |
| LDX | 531-16 | Load direct or load indexed instruction signal |
| $\overline{\text{LDX}}$ | 531-15 | |
| LIMM | 531-20 | Load immediate instruction signal |
| $\overline{\text{LIMM}}$ | 531-21 | |
| LSD | 531-14 | Load or store direct instruction signal |
| LSOP | 531-17 | Load or store operation instruction signal |
| LSX | 531-10 | Load or store indexed instruction signal |
| $\overline{\text{LSX}}$ | 531-11 | |
| LTR | | Move instruction signal (call or trap in F2 state during memory transfer) |
| M0 to M2 | 533-8, -9, -10 | Clock signals |
| $\overline{\text{M0}}$ to $\overline{\text{M2}}$ | 533-13, -12, -11 | |
| M1CLK, M2CLK | 533-6, -15 | Clock signals |
| M0CLK to M2CLK | 533-2, -5, -14 | |
| M00 | 533-7 | Clock signal |
| $\overline{\text{M00CLK}}$ | 533-1 | Clock signal |
| MCLK | 533-3 | Clock signal |
| OVER | 535-12 | ALU overflow flag signal |
| PINIT | 56-3 | Initial power up signal |
| PROCR | 535-3 | Processor is running signal to the bus |
| REQBUS | 533-4 | Request for bus signal |
| RESIR | | Reset interrupt routine signal |
| SDX | 531-18 | Store direct or store indexed instruction signal |
| SERV | 534-4 | Processor has control of the bus signal |
| $\overline{\text{SERV}}$ | 534-5 | |
| SHF | 504-6 | Select half flag signal |
| SIGN | | Most significant bit of result is "1" flag signal |
| $\overline{\text{TP0}}$ to $\overline{\text{TP2}}$ | 501-18 to -20 | |
| TRAP | 531-5 | Trap instruction signal |
| $\overline{\text{TRAP}}$ | 531-4 | |
| X | 537-7 | State signal |
| $\overline{\text{X}}$ | 537-8 | |
| ZERO | 535-10 | Result of operation is zero flag signal |

FIGS, 21, 22 and 23 BUS INTERFACE

Figure 21:
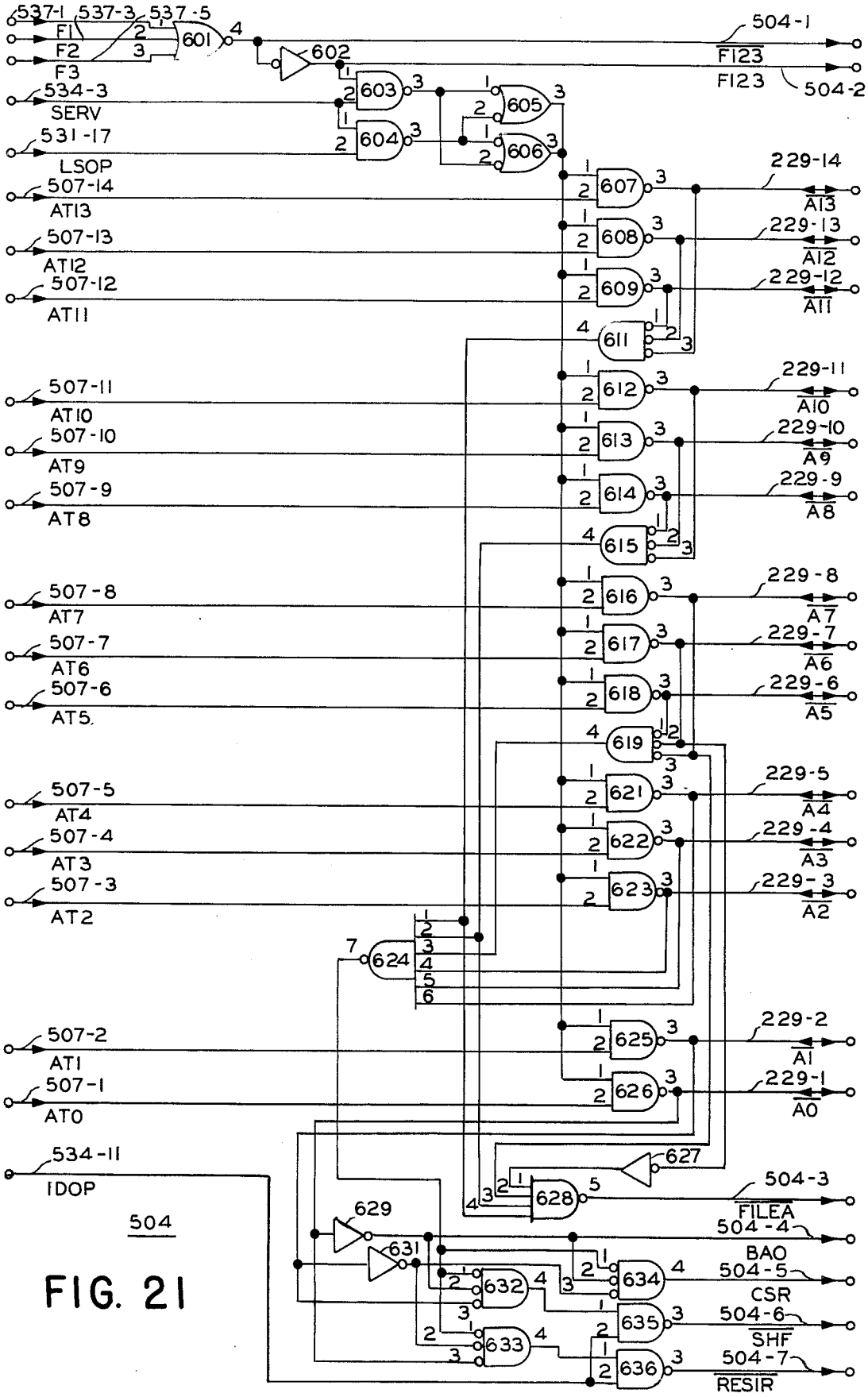
FIGS. 21, 22 and 23 are schematic diagrams of the bus interface circuit of FIG. 18.
Figure 22:
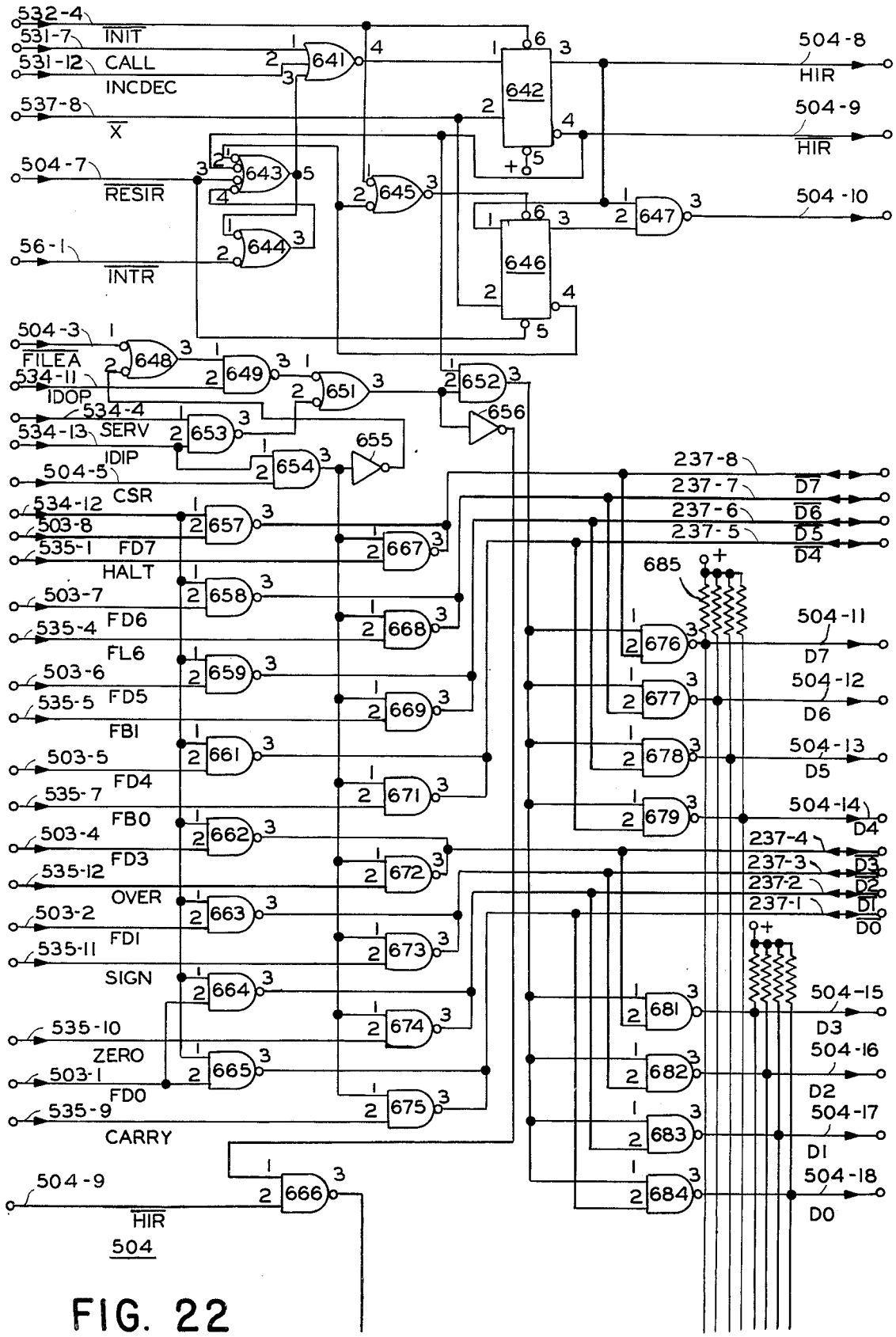
Figure 23:
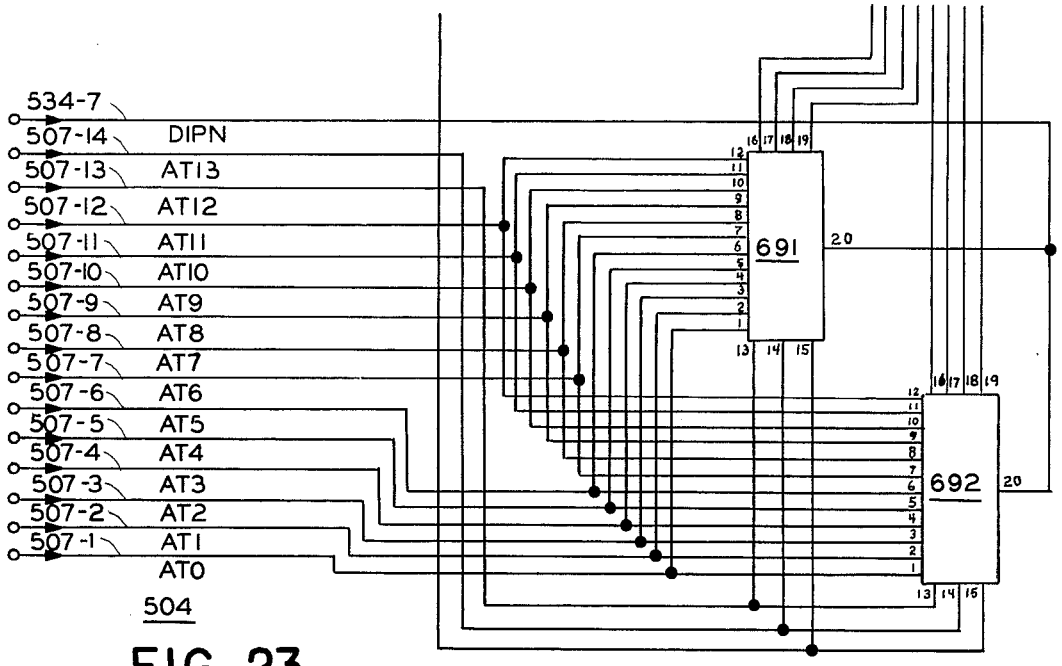

FIGS. 21, 22 and 23 are schematic diagrams of the bus interface (BI) circuit 504 of FIGS. 17 and 18. All address and data signals transmitted between the processor 57 and the other circuits of the supervisor must pass through the bus interface.

FIG. 21 shows the address portion of the bus interface. Inputs to the interface circuit are the F1, F2 and F3 state signals from the state counter (SC) 537 on the lines 537-1, 537-3 and 537-5 respectively; the processor has control of the bus signal SERV and the internal data output signal IDOP from the bus control/distributed arbitrator (BC/DA) 534 on the lines 534-4 and 534-11 respectively; the load or store operation signal LSOP from the instruction decoder (ID) 531 on the line 531-17; and the A register output signals AT0 through AT13 from the A register (AR) 507 on the lines 507-1 through 507-14 respectively. Outputs from the interface circuit are the $\overline{\text{A0}}$ to $\overline{\text{A13}}$ address lines 229-1 through 229-14 respectively; the $\overline{\text{F123}}$ and F123 state signals on the lines 504-1 and 504-2 respectively; the addressing internal files signal $\overline{\text{FILEA}}$ on the line 504-3; the inverted $\overline{\text{A0}}$ address signal BAO on the line 504-4; the add select to status register signal CSR on the line 504-4; the select halt flag signal $\overline{\text{SHF}}$ on the line 504-6; and the reset interrupt routine signal $\overline{\text{RESIR}}$ on the line 504-7.

The address portion of the bus circuit (BI) 504 receives the A register output signals AT0 through AT13 and places them on the address lines 229 of the bus. The A register output lines 507-1 through 507-14 are each connected to a −2 input of a corresponding NAND which has a −3 output connected to one of the address lines 229-1 through 229-14 respectively. All the −1 inputs are connected together to receive an enabling signal which causes the NANDs to invert the signals from the A register as they are outputed as the address signals.

When the processor is not in control of the bus, the SERV signal on the line 534-4 is at "0". The line 534-4 is connected to a pair of inputs 603-2 and 604-1 of a pair of NANDs 603 and 604. The NANDs have a pair of outputs 603-3 and 604-3 which are each connected to a pair of inputs, 605-1 and 606-2 for 603-3 and 605-2 and 606-1 for 604-3, of a pair of NANDs 605 and 606. The "0" on the line 534-4 will disable the NANDs 603 and 604 which each generate a "1" so that all the inputs to the NANDs 605 and 606 are at "1". The NANDs 605 and 606 each generate a "0" at a pair of outputs 605-3 and 606-3 which are connected to the 1-inputs of the NANDs 607, 608, 609, 612, 613, 614, 616, 617, 618, 621, 622, 623, 625 and 626 which are connected between the A register output lines and the address output lines. These NANDs all are disabled, disconnecting the AT0 to AT13 lines 507-1 to 507-14 from the $\overline{A0}$ to $\overline{A13}$ address lines 299-1 to 229-14.

When the processor is in control of the bus, SERV is at "1" to enable the NANDs 603 and 604. The F1, F2 and F3 state signals are on the lines 537-1, 537-3 and 537-5 respectively which are connected to the inputs 601-1, 601-2 and 601-3 respectively of a NOR 601. An output 601-4 of the NOR 601 is connected to the $\overline{F123}$ line 504-1 to generate the state signal $\overline{F123}$ as the logical "or" of the F1, F2 and F3 state signals. If any one of the state signals F1, F2 or F3 is at "1", the NOR 601 will generate a "0" on the line 504-1. The output signal from the NOR 601 is inverted by the inverter 602 to generate the F123 state signal on the line 504-2. The inverter output is also connected to an input 603-1 of the NAND 603. When any one of the state signals F1, F2 or F3 is at "1", the inverter 602 will generate a "1" at the input 603-1 and the NAND 603 will generate a "0" to disable the NANDs 605 and 606. The NANDs 605 and 606 will each generate a "1" to enable the NANDs connected to the address output lines to pass the inverse of the A register output signals.

If the LSOP signal on the line 531-17 connected to an input 604-2 is at "1", the NAND 604 will generate a "0" to disable the NANDs 605 and 606. The NANDs 605 and 606 will each generate a "1" to enable the NANDs connected to the address output lines to pass the inverse of the A register output signals. Therefore, if the SERV signal is at "1" and one of the F1, F2, F3 or LSOP signals is at "1", the data from the A register will be inverted and placed on the address output lines 229-1 through 229-14 to address a circuit or memory location connected to the bus.

Certain predetermined combinations of address signals are also utilized to generate output signals on the lines 504-3 through 504-7. The $\overline{A6}$ address line 229-7 is connected through an inverter 627 to an input 628-1 of a NAND 628. The $\overline{A7}$ address line 229-8 is connected to an input 628-2. The $\overline{A8}$, $\overline{A9}$ and $\overline{A10}$ address lines 229-9, 229-10 and 229-11 are connected to the inputs 615-1, 615-2 and 615-3 respectively of a NOR 615. The NOR 615 has an output 615-4 connected to an input 628-3. The $\overline{A11}$, $\overline{A12}$ and $\overline{A13}$ address lines 229-12, 229-13 and 229-14 are connected to the inputs 611-1, 611-2 and 611-3 respectively of a NOR 611. The NOR 611 has an output 611-4 connected to an input 628-4. When the address bit $\overline{A7}$ is at "1" and the address bits $\overline{A6}$ and $\overline{A8}$ through $\overline{A13}$ are at "0", all the inputs to the NAND 628 will be at "1" to generate a "0" $\overline{FILEA}$ signal at an output 628-5 on the line 504-3.

The $\overline{A0}$ addressline 229-1 is connected to an inverter 629 which has an output connected to the BAO signal line 504-4. Therefore, when the address bit $\overline{A0}$ is at "0", the BAO = "1" signal will be generated on the line 504-4.

The outputs 611-4 and 615-4 are connected to a pair of inputs 624-1 and 624-2 respectively of a NAND 624. The $\overline{A5}$, $\overline{A6}$ and $\overline{A7}$ address lines 229-6, 229-7 and 229-8 are connected to the inputs 619-1, 619-2 and 619-3 respectively of a NOR 619. The NOR 619 has an output 619-4 connected to an input 624-3. The $\overline{A2}$, $\overline{A3}$ and $\overline{A4}$ address lines 229-3, 229-4 and 229-5 are connected to the inputs 624-4, 624-5 and 624-6 respectively. An output 624-7 is connected to an input 634-1 of a NOR 634. The $\overline{A1}$ address line 229-2 is connected through an inverter 631 to an input 634-3 and the $\overline{A0}$ address line 229-1 is connected through the inverter 629 to an input 634-2. When the $\overline{A0}$ through $\overline{A4}$ address bits are at "1" and the $\overline{A5}$ through $\overline{A13}$ address bits are at "0", the NOR 634 will generate a CSR = "1" signal at an output 634-4 on the line 504-5.

The output 624-7 fo the NAND 624 is connected to an input 632-1 of a NOR 632, the inverter 629 is connected to an input 632-2 and the $\overline{A1}$ address line 229-2 is connected to an input 632-3. An output 632-4 is connected to an input 635-1 of a NAND 635. The IDOP line 534-11 is connected to an input 635-2. When the IDOP signal is at "1" and the $\overline{A0}$ and $\overline{A5}$ through $\overline{A13}$ address signals are at "0", the NAND 635 will generate a $\overline{SHF}$ = "0" signal at an output 635-3 on the line 504-6.

The output 624-7 of the NAND 624 is also connected to an input 633-1 of a NOR 633, the inverter 631 is connected to an input 633-2 and the $\overline{A0}$ address line 229-1 is connected to an input 633-3. An output 633-4 is connected to an input 636-1 of a NAND 636 which also has an input 636-2 connected to the IDOP line 534-11. When the IDOP signal is at "1", the $\overline{A1}$ through $\overline{A4}$ address bits are at "1", and the $\overline{A0}$ and $\overline{A5}$ through $\overline{A13}$ address bits are at "0", the NAND 636 will generate a $\overline{RESIR}$ = "0" signal at an output 636-3 on the line 504-7.

FIG. 22 shows the data portion of the bus interface (BI) 504. Inputs to the bus interface are the $\overline{INIT}$ signal on the line 532-4 from the file register/multiplexer control (FR/MC) 532; the CALL signal on the line 531-7 and the INCDEC signal on the line 531-13 from the instruction decoder circuit (ID) 531; the $\overline{X}$ state signal on the line 537-8 from the state counter (SC) 537; the $\overline{RESIR}$ signal on the line 504-7, the $\overline{FILEA}$ signal on the line 504-3, the CSR signal of the line 504-5 and the $\overline{HIR}$ signal on the line 504-9 from the bus interface of FIGS. 21 and 22; the $\overline{INTR}$ signal on the line 56-1 from the bus 56; the IDOP signal on the line 534-10, the SERV signal on the line 534-3, the IDIP signal on the line 534-13 and the signal on the line 534-12 from the bus control/distributed arbitrator (BC/DA) 534; the FD0, FD1 and FD3 through FD7 file data signals on the lines 503-1, 503-2 and 503-4 through 503-8 respectively from the multiplexer (MUX) 503; and the HALT signal on the line 535-1, the FL6 signal on the line 535-4, the FB1 signal on the line 535-5, the FB0 signal on the line 535-7, the OVER signal on the line 535-12, the SIGN signal on the line 535-11, the ZERO signal on the line 535-10 and the CARRY signal on the line 535-9 from the flag generator (FG) 535. Outputs from the data portion of the bus interface are the HIR signal on the line 504-8, the $\overline{HIR}$ signal on the line 504-9, and a signal on the line 504-10, the $\overline{D0}$ through $\overline{D7}$ signals on the lines 237-5 through 237-8 respectively and the D0 through D7 signals on the lines 504-18 through 504-11 respectively.

The $\overline{INIT}$ line 532-4 is connected to a preset input 642-6 of a D-type flip flop 642. When power is first applied to the processor, there will be a "1" to "0" transition on the $\overline{INIT}$ line to set a non-inverting output 642-3 to "1" and an inverting output 642-4 to "0". The output 642-3 is connected to the line 504-8 to generate the $\overline{HIR}$ signal and the output 642-4 is connected to the line 504-9 to generate the HIR signal. A data input 642-1 is connected to an output 641-4 of a NOR 641. If all inputs to the NOR 641 are at "0", a "1" will be generated at the output 641-4 and a "0" will be generated for any other combination of input signals. An input 641-1 is connected to the CALL line 531-7, an input 641-2 is connected to the INCDEC line 531-12 and an input 641-3 is connected to an output 643-5 of a NAND 643. A clock input 642-2 of the flip flop 642 is connected to the $\overline{X}$ state signal line 537-8 such that each time a "0" to "1" transition of the $\overline{X}$ state signal occurs, the signal at the data input 642-1 is set at the output 642-3 and the inverse signal is set at the output 642-4. A clear input 642-5 is disabled by a "1" supplied from a positive polarity direct current power supply (not shown).

The NAND 643 is cross coupled with a NAND 644 to form a NAND flip flop. The output 643-5 is connected to an input 644-1 and an output 644-3 is connected to an input 643-4. An input 643-1 is connected to an inverting output 646-4 of a D-type flip flop 646, an input 643-2 is connected to the output 642-4 and an input 643-3 is connected to the $\overline{RESIR}$ line 504-7. An input 644-2 is connected to the $\overline{INTR}$ line 56-1. If the inputs 643-1 and/or 643-2 and/or 643-3 and 644-2 are at "0", the outputs 643-5 and 644-3 will be at "1". If the inputs 643-1 and/or 643-2 and/or 643-3 are at "0" and the input 644-2 is at "1", the output 643-5 will be at "1" and the output 644-3 will be at "0". If the inputs 643-1, 643-2 and 643-3 are at "1" and the input 644-2 is at "0", the output 643-5 will be at "0" and the output 644-3 will be at "1". If the inputs 643-1, 643-2, 643-3 and 644-2 are at "1", the outputs 643-5 and 644-3 will remain at the signal levels being generated before the last input signal changed from "0" to "1".

The flip flop 646 has a data input 646-1 connected to the output 642-3 and a clock input 646-2 connected to the $\overline{X}$ state signal line 537-8. Generally the flip flop 646 is locked in the preset condition as described below, but, when the preset and clear inputs are at "1", a "0" to "1" transition of the $\overline{X}$ state signal will set the HIR and $\overline{HIR}$ signals at a non-inverting output 646-3 and an inverting output 646-4 respectively. A clear input 646-5 is connected to the $\overline{RESIR}$ line 504-7. When the $\overline{RESIR}$ signal changes from "1" to "0", the output 646-3 will be set to "0" and the output 646-4 will be set to "1". The output 642-3 is connected to an input 647-1 and the output 646-3 is connected to an input 647-2 of a NAND 647. An output 647-3 is connected to the line 504-10. When both inputs are at "1", the NAND 647 generates a "0" and will generate a "1" for any other combination of input signals. The $\overline{INIT}$ line 532-4 is also connected to an input 645-1 of a negative logic AND 645 having an input 645-2 connected to the output 646-4 and an output 645-3 connected to a preset input 646-6.

When the power is applied to the processor, a "1" to "0" transition will occur on the $\overline{INIT}$ line 532-4 to generate a "0" from the AND 645 and set the flip flop output 646-3 to "1" and the output 646-4 to "0". The "0" from the output 646-4 is applied to the input 645-2 to maintain the "0" at the preset input and lock the flip flop 646 in the preset condition. When the $\overline{RESIR}$ signal changes from "1" to "0" to clear the flip flop 646 while the preset input 646-6 is at "0", both outputs will be set to "1". Since the $\overline{INIT}$ line has returned to "1", the AND 645 will generate a "1" at the preset input 646-6. Now that only the clear input 646-5 is at "0", the output 646-3 is set to "0". The flip flop 646 is now ready to respond to a "0" to "1" transition of the $\overline{X}$ state signal to set the output 646-3 at the HIR signal and the output 646-4 at the $\overline{HIR}$ signal. If the HIR signal is at "1", the flip flop 646 will again lock in the preset condition until another "1" to "0" transition occurs on the $\overline{RESIR}$ line 504-7.

The FD0, FD1 and FD3 through FD7 signals may be outputed on the data line 237 in inverted form as the $\overline{D0}$ through $\overline{D7}$ data signals. The FD7 line 503-8 is connected to an input 657-2 of a NAND 657 having an output 657-3 connected to the $\overline{D7}$ line 237-8, the FD6 line 503-7 is connected to an input 658-2 of a NAND 658 having an output 658-3 connected to the $\overline{D6}$ line 237-7, the FD5 line 503-6 is connected to an input 659-2 of a NAND 659 having an output 659-3 connected to the $\overline{D5}$ line 237-6, the FD4 line 503-5 is connected to an input 661-2 of a NAND 661 having an output 661-3 connected to the $\overline{D4}$ line 237-5, the FD3 line 503-4 is connected to an input 662-2 of a NAND 662 having an output 662-3 connected to the $\overline{D3}$ line 237-4, the FD1 line 503-2 is connected to an input 663-2 of a NAND 663 having an output 663-3 connected to the $\overline{D2}$ line 237-3, and the FD0 line 503-1 is connected to a pair of inputs 664-2 and 665-2 of a pair of NANDs 664 and 665 respectively. The NAND 664 has an output 664-3 connected to the $\overline{D1}$ line 237-2 and the NAND 665 has an output 665-3 connected to the $\overline{D0}$ line 237-1. A plurality of inputs 657-1, 658-1, 659-1, 661-1, 662-1, 663-1, 664-1 and 665-1 are connected to the line 534-12. A "1" on the line 534-12 enables the NANDs to invert the input signals as the $\overline{D0}$ through $\overline{D7}$ data signals on the lines 237-1 through 237-8 respectively.

The flag signals generated by the flag generator (FG) 535 may be outputed on the data lines in inverted form as the $\overline{D0}$ through $\overline{D7}$ data signals. The HALT line 535-1 is connected to an input 667-2 of a NAND 667 having an output 667-3 connected to the $\overline{D7}$ line 237-8, the FL6 line 535-4 is connected to an input 668-2 of a NAND 668 having an output 668-3 connected to the $\overline{D6}$ line 237-7, the FB1 line 535-5 is connected to an input 669-2 of a NAND 669 having an output 669-3 connected to the $\overline{D5}$ line 237-6, the FB0 line 535-7 is connected to an input 671-2 of a NAND 671 having an output 671-3 connected to the $\overline{D4}$ line 237-5, the OVER line 535-12 is connected to an input 672-2 of a NAND 672 having an output 672-3 connected to the $\overline{D3}$ line 237-4, the SIGN line 535-11 is connected to an input 673-2 of a NAND 673 having an output 673-3 connected to the $\overline{D2}$ line 237-3, the ZERO line 535-10 is connected to an input 674-2 of a NAND 674 having an output 674-3 connected to the $\overline{D1}$ line 237-2 and the CARRY line 535-9 is connected to an input 675-2 of a NAND 675 having an output 675-3 connected to the $\overline{D0}$ line 237-1. A plurality of inputs 667-1, 668-1, 669-1, 671-1, 672-1, 673-1, 674-1 and 675-1 are connected to an output 654-3 of an AND 654. If the AND 654 generates a "1", the NANDs will be enabled to invert the flag signals as the $\overline{D0}$ through $\overline{D7}$ data signals on the lines 237-1 through 237-8 respectively. The AND 654 has an input 654-1 connected to the IDIP line 534-13 and an input 654-2 connected to the CSR line 504-5. If both the IDIP and CSR signals are at "1", a "1" will be generated at the output 654-3.

The $\overline{D0}$ through $\overline{D7}$ data signals may be generated in inverted form as the D0 through D7 data signals to the bus latch temporary (BLT) 505. The $\overline{D7}$ line 237-8 is connected to an input 676-2 of a NAND 676 having an output 676-3 connected to the D7 line 504-11, the $\overline{D6}$ line 237-7 is connected to an input 677-2 of a NAND 677 having an output 677-3 connected to the D6 line 504-12, the $\overline{D5}$ line 237-6 is connected to an input 678-2 of a NAND 678 having an output 678-3 connected to the D5 line 504-13, the $\overline{D4}$ line 237-5 is connected to an input 679-2 of a NAND 679 having an output 679-3 connected to the D4 line 504-14, the $\overline{D3}$ line 237-4 is connected to an input 681-2 of a NAND 681 having an output 681-3 connected to the D3 line 504-15, the $\overline{D2}$ line 237-3 is connected to an input 682-2 of a NAND 682 having an output 682-3 connected to the D2 line 504-16, the $\overline{D1}$ line 237-2 is connected to an input 683-2 of a NAND 683 having an output 683-3 connected to the D1 line 504-17 and the $\overline{D0}$ line 237-1 is connected to an input 684-2 of a NAND 684 having an output 684-3 connected to the D0 line 504-18. A plurality of inputs 676-1, 677-1, 678-1, 679-1, 681-1, 682-1, 683-1 and 684-1 are connected to an output 652-3 of an AND 652. If both inputs of the AND 652 are at "1", a "1" will be generated to enable the NANDs to invert the D0 through D7 data signals as the $\overline{D0}$ through $\overline{D7}$ data signals.

An input 652-1 is connected to the output 642-4 to receive the $\overline{HIR}$ signal and an input 652-2 is connected to an output 651-3 of a NAND 651. If both inputs to the AND 652 are at "1", a "1" will be generated at the output 652-3. An input 651-1 is connected to an output 649-3 of a NAND 649 and an input 651-2 is connected to an output 653-3 of a NAND 653. If both inputs to the NAND 651 are at "1", a "0" will be generated and a "1" will be generated for any other combination of input signals. The NAND 649 has an input 649-1 connected to an output 648-3 of a NAND 648 and an input 649-2 connected to the IDOP line 534-11. If both inputs to the NAND 649 are at "1", a "0" will be generated and a "1" will be generated for any other combination of input signals.

The NAND 648 has an input 648-1 connected to the $\overline{FILEA}$ line 504-3 and an input 648-2 connected to the output 654-3 through an inverter 655. The NAND 654 may generate a "1" or a "0" as was previously described. The NAND 653 has an input 653-1 connected to the SERV line 534-4 and an input 653-2 connected to the IDIP line 534-13. If the SERV and IDIP signals are at "1", a "0" will be generated and a "1" will be generated for any other combination of input signals.

The output lines 504-11 through 504-18 are connected through individual resistors to a power source for "OR" operation with the circuits of FIG. 23. For example, the D7 line 504-11 is connected to a positive polarity direct current power supply through a resistor 685. If the NANDs connected to the D0 through D7 lines are enabled at the same time as one of the other groups of NANDs, either the file data signals or the flag signals will be placed on the D0 through D7 data lines.

Referring to FIG. 23, there is shown a schematic diagram of the memory portion of the bus interface (BI) 504 which includes a pair of read only memories (ROM) 691 and 692. The ROMs each contain "4096" four bit words of preprogrammed information. Since the ROMs 691 and 692 are similar, only the operation of the ROM 691 will be explained in detail. Each word is separately addressed by a plurality of binary coded word address signals at a plurality of address inputs 691-1 through 691-12. The input 691-1 represents binary one and the input 691-12 represents binary "2048". Therefore, if all word address inputs are at "0", the first four bit word will appear at the outputs 691-16 through 691-19 and if all the word address inputs are at "1", the last four bit word will appear at the outputs. A predetermined binary address must also be provided at three chip select inputs 691-13 through 691-15 to enable the ROM and the selected four bit word will appear at the outputs when the signal at a read input 691-20 changes from "1" to "0". As long as the ROM is enabled at the chip select inputs, the selected word will be outputed until the word address input signals change and there is a subsequent "1" to "0" transition at the read input 691-20.

Lines connected to the outputs of the NANDs 666, 676 through 679 and 681 through 684 of FIG. 22 are continued in FIG. 23 in the same relative positions. The AT0 through AT11 lines 507-1 through 507-12 respectively from the A register (AR) 507 are connected to the word address inputs 691-1 through 691-12 respectively and to the word address inputs 692-1 through 692-12 respectively to provide the word address signals to the ROMs 691 and 692. The AT12 signal line 507-13 is connected to the chip select inputs 691-13 and 692-13 and the AT13 line 507-14 is connected to the chip select inputs 691-14 and 692-14. The chip select inputs 691-15 and 692-15 are connected to an output 666-3 of a NAND 666 of FIG. 22. If both inputs of the NAND 666 are at "1", a "0" will be generated at the output 666-3 and a "1" will be generated for any other combination of input signals. An input 666-1 is connected to the output 651-3 of the NAND 651 through an inverter 656. The NAND 651 may generate a "1" or a "0" as was previously discussed. An input 666-2 is connected to the $\overline{HIR}$ line 504-9.

The outputs 691-16 through 691-19 are connected to the D7 through D4 data lines 504-11 through 504-14 respectively. The outputs 692-16 through 692-19 are connected to the D3 through D0 data lines 504-15 through 504-18 respectively. The read inputs 691-20 and 692-20 are connected to the DIPN line 534-7. If the predetermined chip select address signals are generated, the two four bit words selected by the AT0 through AT11 A register output signals will be generated as the D0 through D7 data signals on the lines 504-18 through 504-11 respectively.

All the address data and control signals which are transmitted between the processor and the other circuits of the elevator supervisor pass through the bus interface (BI) 504. FIG. 21 shows the address portion of the BI 504 which receives the AT0 through AT13 A register output signals and generates the $\overline{A0}$ through $\overline{A13}$ bus address signals or certain internal signals. The bus address signals may be generated only during the F1, F2 or F3 states of the processor for any instruction and druing the X state for a load or store instruction.

FIG. 22 shows the data portion of the BI 504 which receives the FD0, FD1 and FD3 through FD7 file data signals from the file register and generates them as the $\overline{D0}$ through $\overline{D7}$ bus data signals to the bus. The data portion also receives flag signals from the flag generator and generates them as the $\overline{D0}$ through $\overline{D7}$ data signals to the bus. The $\overline{D0}$ through $\overline{D7}$ bus data signls from memory or other circuits in the elevator supervisor are generated as the D0 through D7 data signals to the bus latch temporary.

FIG. 23 shows the memory portion of the BI 504. A pair of read only memories can be addressed by the AT0 through AT13 A register output signals to generate an eight bit program instruction signal to the data portion of the BI 504 where it is generated to the bus latch temporary as the D0 through D7 data signals. The program instructions for controlling the operation of the procesor are stored in the ROMs in a predetermined order. The instructions are addressed in sequence as the address is incremented to step through the program. The program may branch with a JUMP or CALL instruction and return from a CALL with a TRAP instruction as the address is changed accordingly.

FIG. 24 BUS LATCH TEMPORARY

Figure 24:
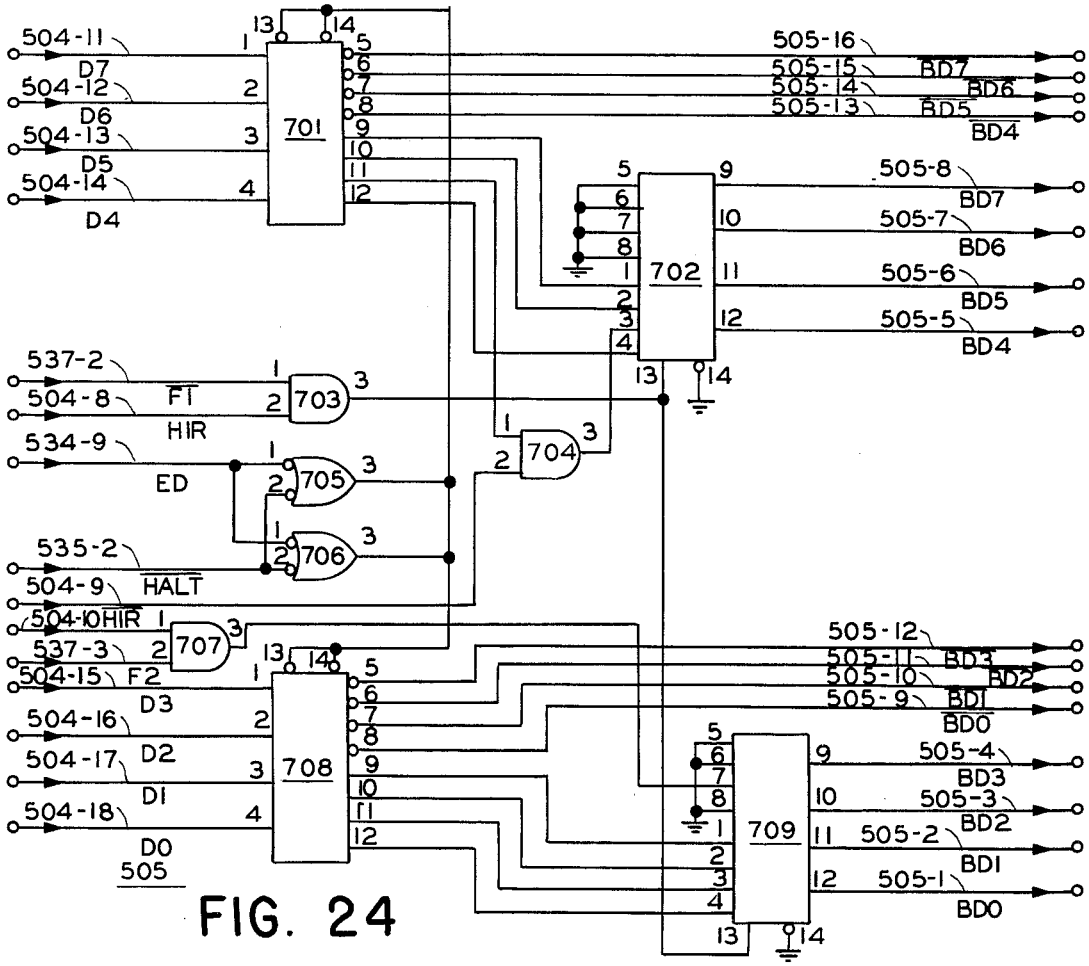
FIG. 24 is a schematic diagram of the bus temporary latch circuit of FIG. 18.

FIG. 24 shows the bus latch temporary (BLT) 505 as a schematic circuit. The bus latch temporary, along with the instruction register (IR) 506 and the instruction register extended (IRX) 509, provides storage for data bits which are received through the bus interface circuit (BI) 504 of FIG. 22 on the lines 504-11 through 504-18. These data bits may be latched in inverted form on the $\overline{BD0}$ through $\overline{BD7}$ but data output lines 505-9 through 505-16 respectively. The data bits may also be selected to be placed on the BD0 through BD7 bus data output lines 505-1 through 505-8.

Inputs to the bus latch temporary circuit are the data bits D0 through D7 on the lines 504-18 through 504-11, the halt for interrupt signal $\overline{HIR}$ on the line 504-8, the inverse halt for interrupt signal HIR on the line 504-9 and the signal on the line 504-10 from the bus interface circuit (BI) 504; the $\overline{F1}$ state signal on the line 537-2 and the F2 state signal on the line 537-3 from the state counter (SC) 537; the external data signal ED on the line 534-9 from the bus control/distributed arbitrator (BC/DA) 534; and the inverse halt flag signal $\overline{HALT}$ on the line 535-2 from the flag generator (FG) 535. Outputs from the bus latch temporary are the bus data and inverse bus data signals on the lines 505-1 through 505-16.

The data lines 504-11 through 504-18 are connected to the inputs of a pair of four bit bistable latches 701 and 708. Since the latches are similar, only the latch 701 will be decribed in detail. The signals at a plurality of inputs 701-1 through 701-4 are transferred to a plurality of inverting outputs 701-5 through 701-8 respectively and a plurality of non-inverting outputs 701-9 through 701-12 respectively when the signal at a pair of clock inputs 701-13 and 701-14 changes from "1" to "0". The inputs 701-1 through 701-4 are connected to the data lines 504-11 through 504-14 respectively. The inverting outputs 701-5 through 701-8 are connected to the bus data lines 505-16, 505-15, 505-14 and 505-13 respectively. The latch 708 also has a plurality of inputs 708-1 through 708-4 which are connected to the data lines 504-15 through 504-18 respectively. The inverting outputs 708-5 through 708-8 are connected to the bus data lines 505-12, 505-11, 505-10 and 505-9 respectively.

The data bits on the data lines are transferred to the latch outputs when the absence of the $\overline{HALT}$ signal coincides with the presence of the ED signal. The ED signal line 534-9 is connected to a pair of inputs 705-1 and 706-1 of a pair of NANDs 705 and 706 respectively. The $\overline{HALT}$ signal line 535-2 is connected to a pair of inputs 705-2 and 706-2. When $\overline{HALT}$ and ED both are at "1", the NANDs 705 and 706 will generate a "0" at a pair of outputs 705-3 and 706-3 to the clock inputs 705-13, 705-14, 706-13 and 706-14 to latch the input data bits at the latch outputs.

The non-inverting latch outputs are connected to a pair of quad-two line to one line data selector/multiplexers 702 and 709. The outputs 701-9, 701-10 and 701-12 are connected to the inputs 702-1, 702-2 and 702-4 respectively and the outputs 708-9 through 709-12 are connected to the inputs 709-1 through 709-4 respectively. The output 701-11 is connected to an input 704-1 of an AND 704 which has an output 704-3 connected to the input 702-3. The $\overline{HIR}$ signal line 504-9 is connected to an input 704-2 so that when $\overline{HIR}$ = "1", the data bit from the output 701-11 is placed at the input 702-3. When the signal at the select inputs 702-13 and 709-13 is at "0" the data bits from the latches 701 and 709 will be placed at the outputs 702-9 through 702-12 and 709-9 through 709-12 which are connected to the bus data lines 505-1 through 505-8. The select inputs are connected to an output 703-3 of an AND 703 having an input 703-1 connected to the $\overline{F1}$ signal line 537-2 and an input 703-2 connected to the HIR signal line 504-8. Therefore, the presence of the $\overline{F1}$ signal or the absence of the HIR signal will generate the "0" required to select the data bits from the latches as the output signals on the bus data lines. If HIR = "0", then $\overline{HIR}$ = "1" and the data bit from the output 701-11 will be transferred to the bus data line 505-6.

A "1" at the select inputs will place the data at the inputs 702-5 through 702-8 and 709-5 through 709-8 at the outputs of the data selector/multiplexers. This occurs at the absence of the $\overline{F1}$ signal and the presence of the HIR signal. All of the inputs except the input 709-7 are connected to the circuit ground and will supply a "0" when selected. The input 709-7 is connected to an output 707-3 of an AND 707 which has an input 707-1 connected to the line 504-10 and an input 707-2 connected to the F2 signal line 537-3. When both inputs are at "1", a "1" will be generated to the bus data line 505-2 and a "0" will be generated for any other combination of input signals.

FIG. 25 MULTIPLEXER

Figure 25:
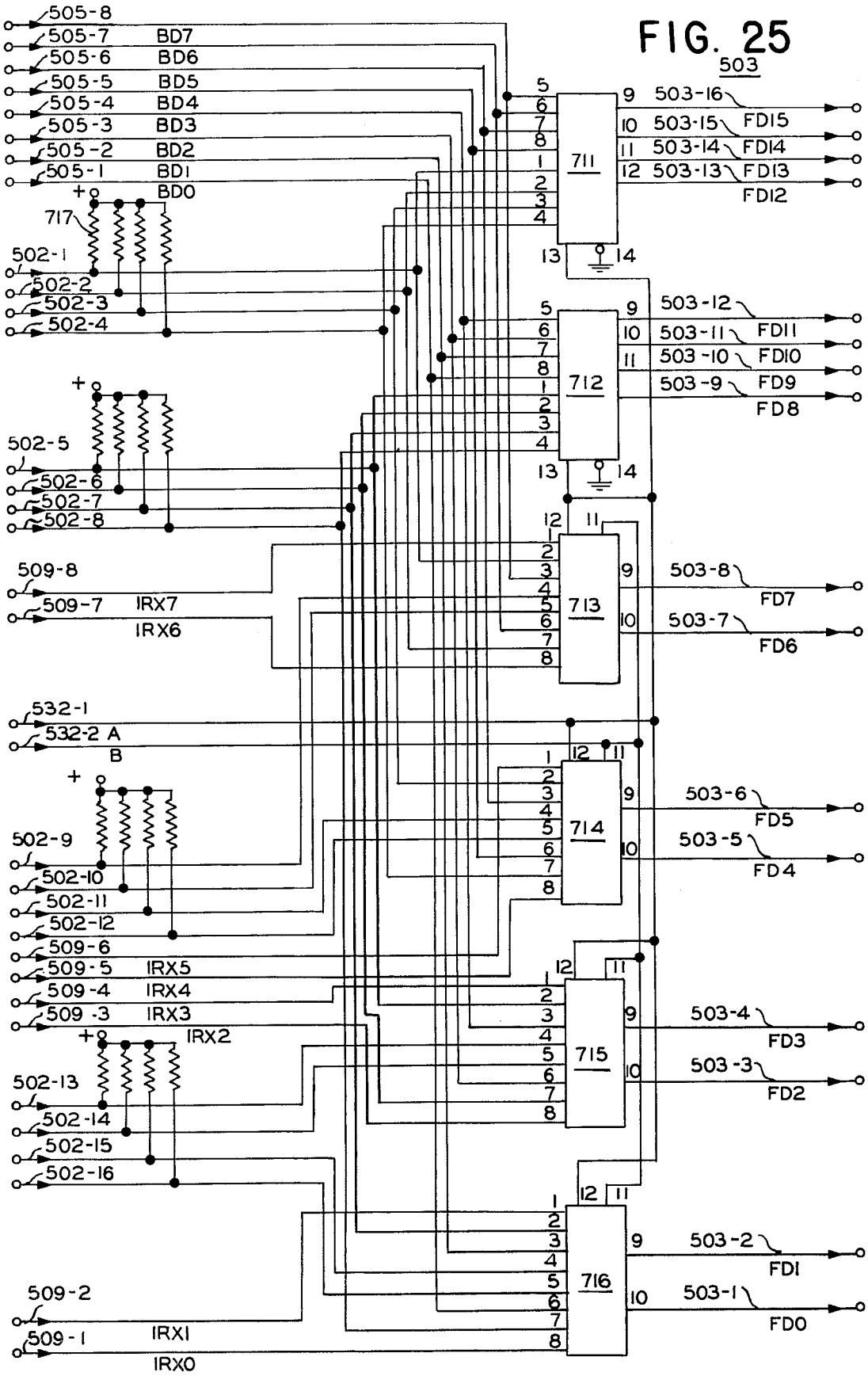
FIG. 25 is a schematic diagram of the multiplexer circuit of FIG. 18.

FIG. 25 is a scehmatic diagram of the multiplexer (MUX) 503 which selects data bits from the bus temporary latch (BLT) 505, the file register (FR) 502 and the instruction register extended (IRX) 509 and transfers these data bits to the A register (AR) 507, the B register (BR) 508 and the bus interface (BI) 504. Inputs to the multiplexer are the bus data signals BD0 through BD7 from the bus latch temporary (BLT) 505 on the lines 505-1 through 505-8 respectively, the output signals from the file register (FR) 502 on the lines 502-1 through 502-16, the IRX0 through IRX7 instruction signals from the instruction register extended (IRX) 509 on the lines 509-1 through 509-8 respectively and the A and B control signals on the lines 532-1 and 532-2 respectively from the file register/multiplexer control circuit (FR/MC) 532. Outputs from the multiplexer are the file data signals FD0 through FD15 on the lines 503-1 through 503-16 respectively.

The multiplexer (MUX) 503 includes a pair of quad-two line to one line data selector/multiplexers 711 and 712 and four dual-four line to one line data selector/-multiplexers 713 through 716. The lines 505-1 through 505-4 are connected to the inputs 712-8 through 712-5 respectively and the lines 505-5 through 505-8 are connected to the inputs 711-8 through 711-5 respectively.

The select inputs 711-13 and 712-13 are connected to receive the A control signal on the line 532-1. When A = "1", the data selector/multiplexers 711 and 712 will generate the BD0 through BD7 bus data bits on the file data lines 503-9 through 503-16 respectively. The lines 502-1 through 502-4 are connected to the inputs 711-1 through 711-4 respectively and the lines 502-5 through 502-8 are connected to the inputs 712-1 through 712-4 respectively. When A = "0", the output signals from the file register on lines 502-1 through 502-8 will be generated on the file data lines 503-16 through 503-9 respectively. Each of the input lines from the file register (FR) 502 is connected through a resistor to a positive polarity direct current power supply to provide current to the data selector/multiplexers of the multiplexer since the memory elements of the file register are not high output current devices. For example, the line 502-1 is connected through a resistor 717 to a power supply (not shown).

Each of the data selector/multiplexers 713 though 716 has a first select input -11 connected to the B control signal line 532-2 and a second select input connected to the A control signal line 532-1. When both A and B are at "0", the -4 and -5 inputs are selected to place the signals on the lines 502-16 through 502-9 on the file data lines 503-1 through 503-8 respectively. When A = "0" B = "1", the -3 and -6 inputs are selected to place the BD0 through BD7 signals on the file data lines 503-1 through 503-8 respectively. When A = "1" and B = "0", the -2 and -7 inputs are selected to place the signals on the lines 502-8 through 502-1 on the file data lines 503-1 through 503-8 respectively. When both A and B are at "1", the -1 and -8 inputs are selected to place the IRX0 through IRX7 signals on the file data lines 503-1 through 503-8 respectively.

The multiplexer (MUX) 503 controls the transfer of data between the various elements of the processor. Data enters the MUX 503 as the BD0 through BD7 bus data signals from the bus latch temporary, the output signals from the file register on the lines 502-1 through 502-16 and the IRX0 through IRX7 instruction signals from the instruction register extended. Selected combinations of the input signals are sent to the A register, the B register and the bus interface as the FD0 through FD15 file data signals. These combinations are selected by the A and B control signals from the file register/-multiplexer control according to the instructions and flags which are generated.

FIG. 26 INSTRUCTION REGISTER

FIG. 26 is a schematic diagram of the instruction register (IR) 506 which receives the bus data bits from the bus latch temporary and generates instruction signal bits to the various circuits in the processor. Inputs to the instruction register are the bus data bits BD0 through BD7 on the lines 505-1 through 505-8 respectively from the bus latch temporary (BLT) 505, the F1 state signal on the line 537-1 from the state counter (SC) 537 and the M2 clock signal on the line 533-10 from the clock (CK) 533. Outputs from the instruction register are the IR0 through IR7 instruction signals on the lines 506-1 through 506-8 respectively and the $\overline{IR0}$ through $\overline{IR7}$ inverted instruction signals on the lines 506-9 through 506-16 respectively.

A four bit bistable latch 724 has a plurality of inputs 724-1 through 724-4 connected to the lines 505-8 through 505-5 respectively and a four bit bistable latch 725 has a plurality of inputs 725-1 through 725-4 connected to the lines 505-4 through 505-1 respectively. The F1 line 537-1 is connected to an input 721-1 and the M2 line 533-10 is connected to an input 721-2 of a NAND 721. An output 721-3 of the NAND 721 is connected to a pair of clock inputs 724-13 and 724-14 through an inverter 722 and is connected to a pair of clock inputs 725-13 and 725-14 through an inverter 723. When the F1 and M2 signals are both at "1", the NAND 721 generates a "0" which is changed to a "1" by the inverters 722 and 723. When either one or both of the F1 and M2 signals changes to "0", the NAND 721 will generate a "1" which is changed to a "0" to clock the latches.

When the latches are clocked, the bus data bits BD0 through BD7 will be latched at the latch non-inverting outputs 725-12 through 725-9 and 724-12 through 724-9 respectively as the $\overline{IR0}$ through $\overline{IR7}$ instruction signal bits on the output lines 506-1 through 506-3 respectively. The bus data bits BD0 through BD7 will also be inverted and latched at the inverting outputs 725-8 through 725-5 and 724-8 through 724-5 respectively as the IR0 through IR7 inverted instruction signal bits on the output lines 506-9 through 506-16 respectively. As long as one or both of the F1 and M2 signals remains at "0", the instruction signal bits will remain latched at the latch outputs. When the F1 and M2 signals are both at "1", the instruction signal bits at the latch outputs will follow the bus data bits at the latch inputs. Thus, the IR 506 decodes the bus data bits to generate instruction signal bits to the various elements of the processor.

FIG. 27 INSTRUCTION REGISTER EXTENDED

FIG. 27 is a schematic diagram of the instruction register extended (IRX) 509 which receives the bus data bits from the bus latch temporary (BLT) 505 and generates instruction signal bits to the various circuits in the processor. Inputs to the instruction register extended are the bus data bits BD0 through BD7 on the lines 505-1 through 505-8 respectively from the bus latch temporary (BLT) 505, the F2 state signal on the line 537-3 and the X inverted state signal on the line 537-8 from the state counter (SC) 537, the M2 clock signal on the line 533-10 from the clock (CK) 533 and the $\overline{ALU}$ inverted logic or arithmetic instruction signal on the line 531-9 from the instruction decoder circuit (ID) 531. Outputs from the instruction register extended are the $\overline{IRX0}$ through $\overline{IRX7}$ instruction signal bits on the output lines 509-1 through 509-8 respectively, the IRX0 through IRX7 inverted instruction signal bits on the output lines 509-9 through 509-16 respectively and the $\overline{CMPS}$ compare signal on the line 509-17.

A four bit bistable latch 734 has a plurality of inputs 734-1 through 734-4 connected to the lines 505-8 through 505-5 respectively and a four bit bistable latch 735 has a plurality of inputs 735-1 through 735-4 connected to the lines 505-4 through 505-1 respectively. The F2 line 537-3 is connected to an input 731-1 and the M2 line 533-10 is connected to an input 731-2 of a NAND 731. An output 731-3 of the NAND 731 is connected to a pair of clock inputs 734-13 and 734-14 through an inverter 732 and is connected to a pair of clock inputs 735-13 and 735-14 through an inverter 733. When the F2 and M2 signals are both at "1", the NAND 731 generates a "0" which is changed to a "1" by the inverters 732 and 733. When either one or both of the F2 and M2 signals changes to "0", the NAND 731 will generate a "1" which is changed to a "0" to clock the latches.

When the latches are clocked, the bus data bits BD0 through BD7 will be latched at the latch non-inverting outputs 735-12 though 735-9 and 734-12 through 734-9 respectively as the $\overline{IRX0}$ through IRX7 instruction signal bits on the output lines 509-1 through 509-8 respectively. The bus data bits BD0 through BD7 will also be inverted and latched at the inverting outputs 735-8 through 735-5 and 734-8 through 734-5 respectively as the IRX0 through IRX7 inverted instruction signal bits on the output lines 509-9 through 509-16 respectively. As long as one or both of the F2 and M2 signals remains at "0", the instruction signal bits will remain latched at the latch outputs. When the F2 and M2 signals are both at "1", the instruction signal bits at the latch outputs will follow the bus data bits at the latch inputs.

The output 734-10 for the instruction signal bit IRX6 is connected to an input 736-1 or a NOR 736. The $\overline{ALU}$ line 531-9 is connected to an input 736-2 and the X line 537-8 is connected to an input 736-3. The NOR 736 has an output 736-4 connected to an input 737-4 of a NAND 737. The output 735-9 for the instruction signal bit IRX3 is connected to an input 737-1, the output 734-12 for the instruction signal bit IRX4 is connected to an input 737-2 and the output 734-11 for the instruction signal bit IRX5 is connected to an input 737-3 of the NAND 737. When the IRX6, the $\overline{ALU}$ and the $\overline{X}$ signals are at "0", the NOR 736 will generate a "1" to the input 737-4. If the IRX3, IRX4 and IRX5 signals are all at "1", the NAND 737 will generate the $\overline{CMPS}$ compare signal as a "0" at an output 737-5 on the line 509-17. Thus, the IRX 509 also decodes the bus data bits to generate additional instruction signal bits to the various elements of the processor.

FIG. 28 A REGISTER

Figure 28:
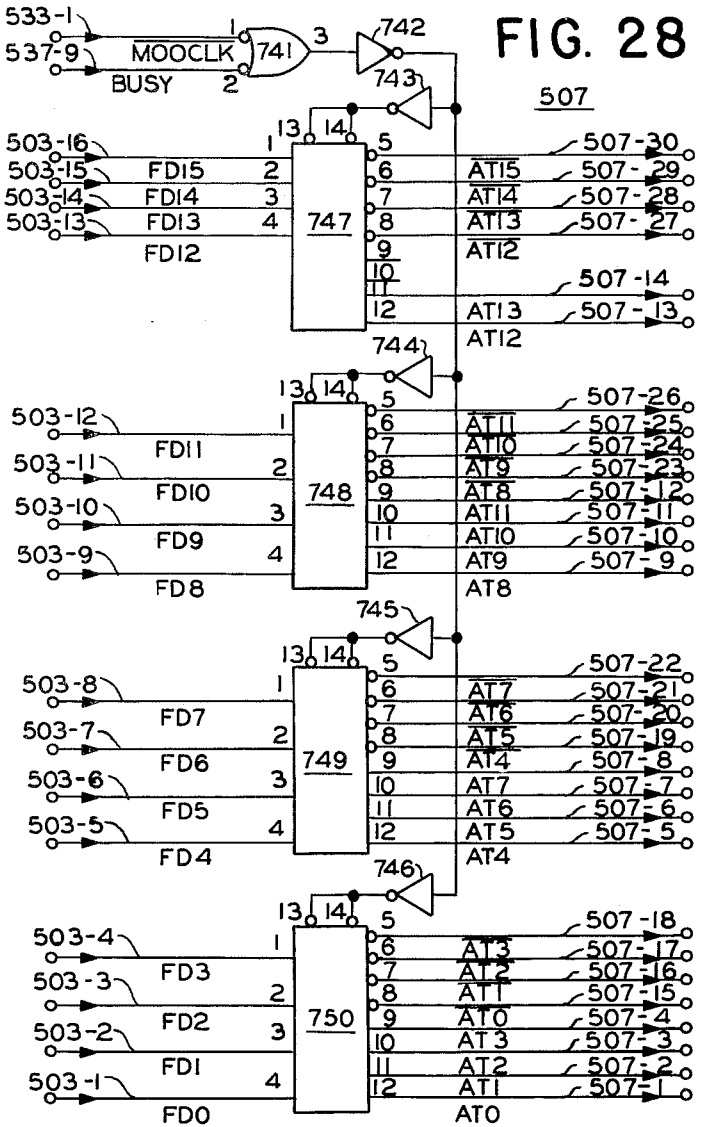
FIG. 28 is a schematic diagram of the A register circuit of FIG. 18.

FIG. 28 is a schematic diagram of the A register (AR) 507 which stores the file data signals from the multiplexer and generates them to the bus interface as address signals for the bus and to the arithmetic logic unit in inverted form. Inputs to the A register are the file data bits FD0 through FD15 on the lines 503-1 through 503-16 respectively from the multiplexer (MUX) 503, the $\overline{M00CLK}$ clock signal on the line 533-1 from the clock (CK) 533 and the BUSY processor in a state signal on the line 537-9 from the state counter (SC) 537. Outputs from the A register are the AT0 through AT13 output signals on the lines 507-1 through 507-14 respectively and the $\overline{AT0}$ through $\overline{AT15}$ output signals on the lines 507-15 through 507-30 respectively.

A four bit bistable latch 747 has a plurality of inputs 747-1 through 747-4 connected to the file data bit lines 503-16 through 503-13 respectively, a four bit bistable latch 748 has a plurality of inputs 748-1 through 748-4 connected to the file data bit lines 503-12 through 503-9 respectively, a four bit bistable latch 749 has a plurality of inputs 749-1 through 749-4 connected to the file data bit lines 503-8 through 503-5 respectively and a four bit bistable latch 750 which has a plurality of inputs 750-1 through 750-4 connected to the file data bit lines 503-4 through 503-1 respectively. The $\overline{M00CLK}$ line 533-1 is connected to an input 741-1 and the BUSY line 537-9 is connected to an input 741-2 of a NAND 741. An output 741-3 is connected to an inverter 742. The inverter 742 is connected to a pair of clock inputs 747-13 and 747-14 through an inverter 743, to a pair of clock inputs 748-13 and 748-14 through an inverter 744, to a pair of clock inputs 749-13 and 749-14 through an inverter 745 and to a pair of clock inputs 750-13 and 750-14 through an inverter 746. When the $\overline{M00CLK}$ and BUSY signals are both at "1", the NAND 741 will generate a "0" which is inverted twice to clock the latches. When either one or both of the $\overline{M00CLK}$ and BUSY signals is at "0", the NAND 741 will generate a "1" which is inverted twice before being applied to the clock inputs of the latches.

When the latches are clocked, the file data bits FD0 through FD13 will be latched at the latch non-inverting outputs 750-12 through 750-9, 749-12 through 749-9, 748-12 through 748-9, 747-12 and 747-11 respectively as the AT0 through AT13 A register output bits on the output lines 507-1 through 507-14 respectively. The file data bits FD0 through FD15 will also be inverted and latched at the inverting outputs 750-8 through 750-5, 749-8 through 749-5, 748-8 through 748-5 and 747-8 through 747-5 respectively as the $\overline{AT0}$ through $\overline{AT15}$ A register output bits on the output lines 507-15 through 507-30 respectively. As long as both of the $\overline{M00CLK}$ and BUSY signals remain at "1", the A register output bits will remain latched at the latch outputs. When one or both of the $\overline{M00CLK}$ and BUSY signals is at "0", the A register output bits at the latch outputs will follow the file data bits at the latch inputs. The AR 507 provides temporary storage and means for inverting the FD0 through FD15 file data bits.

FIG. 29 B REGISTER

Figure 29:
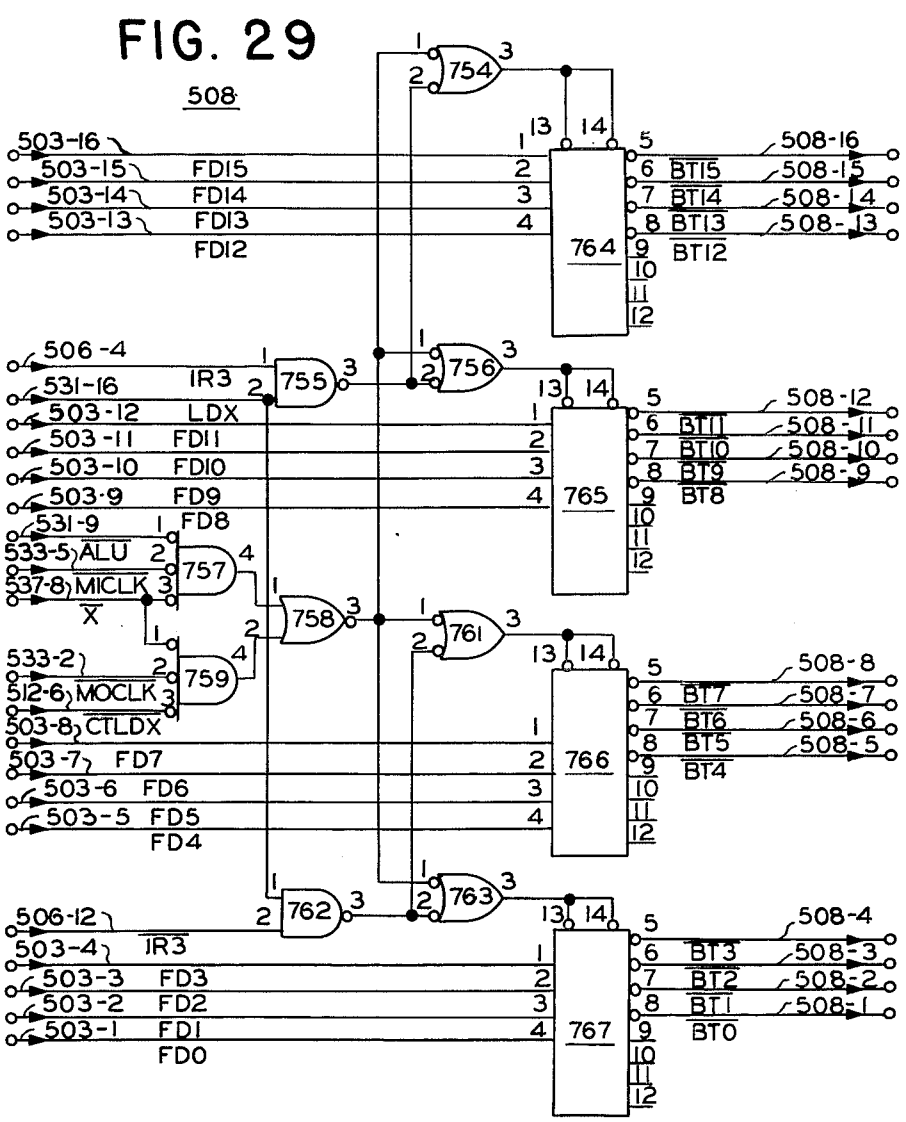
FIG. 29 is a schematic diagram of the B register circuit of FIG. 18.

FIG. 29 is a schematic diagram of the B register (BR) 508 which stores the file data signals from the multiplexer and generates them in inverted form to the arithmetic logic unit. Inputs to the B register are the file data bits FD0 through FD15 on the lines 503-1 through 503-16 respectively from the multiplexer (MUX) 503, the IR3 and $\overline{IR3}$ instruction signal bits on the lines 506-4 and 506-12 from the instruction register (IR) 506, the LDX load direct or indexed signal on line 531-16 and the $\overline{ALU}$ inverse logic or arithmetic instruction signal on the line 531-9 from the instruction decoder circuit (ID) 531, the $\overline{M1CLK}$ clock signal on the line 533-5 and the $\overline{M0CLK}$ clock signal on the line 533-2 from the clock 533, the $\overline{X}$ inverse state signal on the line 537-8 from the state counter (SC) 537 and the $\overline{CTLDX}$ (CALL, TRAP or LDX) signal on the line 512-6 from the extended control (XC) 512. Outputs from the B register are the B register output bits $\overline{BT0}$ through $\overline{BT15}$ on the output lines 508-1 through 508-16.

A four bit bistable latch 764 has a plurality of inputs 764-1 through 764-4 connected to the file data bit lines 503-16 through 503-13 respectively, a four bit bistable latch 765 has a plurality of inputs 765-1 through 765-4 connected to the file data bit lines 503-12 through 503-9 respectively, a four bit bistable latch 766 has a plurality of inputs 766-1 through 766-4 connected to the file data bit lines 503-8 through 503-5 respectively and a four bit bistable latch 767 has a plurality of inputs 767-1 through 767-4 connected to the file data bit lines 503-4 through 503-1 respectively.

The $\overline{ALU}$ lines 531-9 is connected to an input 757-1, the $\overline{M1CLK}$ line 533-5 is connected to an input 757-2 and the $\overline{X}$ line 537-8 is connected to an input 757-3 of a NOR 757. An output 757-4 is connected to an input 758-1 of a NOR 758. The $\overline{X}$ line 537-8 is also connected to an input 759-1, the $\overline{M0CLK}$ line 533-2 is connected to an input 759-2 and the $\overline{CTLDX}$ line 512-6 is connected to an input 759-3 of a NOR 759. An output 759-4 is connected to an input 758-2. An output 758-3 is connected to an input 754-1 of a NAND 754 which has an output 754-3 connected to a pair of clock inputs 764-13 and 764-14 of the latch 754. The output 758-3 is also connected to an input 756-1 of a NAND 756 which has an output connected to a pair of clock inputs 765-13 and 765-14 of the latch 765. When the $\overline{X}$ signal, or one or both of the $\overline{ALU}$ and $\overline{M1CLK}$ signals and one or both of the $\overline{M0CLK}$ and $\overline{CTLDX}$ signals, is at "1", the NORs 757 and 759 will generate a "0" at each input of the NOR 758 which in turn generates a "1" to enable the NANDs 754 and 756.

The IR3 line 506-4 is connected to an input 755-1 and the LDX line 731-16 is connected to an input 755-2 of a NAND 755 having an output 755-3 connected to a pair of inputs 754-2 and 756-2. When either or both the IR3 and LDX signals are at "0", the NAND 755 will generate a "1". If the NANDs 754 and 756 are enabled by the NOR 758, each NAND will generate a "0" to clock its associated latch.

The output 758-3 is also connected to an input 761-1 of a NAND 761 which has an output 761-3 connected to a pair of clock inputs 766-13 and 766-14 of the latch 766. The output 758-3 is further connected to an input 763-1 of a NAND 763 which has an output connected to a pair of clock inputs 767-13 and 767-14 of the latch 767. The LDX line 531-16 is connected to an input 762-1 and the $\overline{IR3}$ line 506-12 is connected to an input 762-2 of a NAND 762 having an output 762-3 connected to a pair of inputs 761-2 and 763-2. When either or both the $\overline{IRX}$ and LDX signals are at "0", the NAND 762 will generate a "1". If the NANDs 761 and 763 are enabled by the NOR 758, each NAND will generate a "0" to clock its associated latch. Since the IR3 signal is the inverse of the IR3 signal, only the latches 764 and 765 or the latches 766 and 767 can be clocked at the same time.

When the latches are clocked, the file data bits FD0 through FD15 will be inverted and latched at the latch inverting outputs 767-12 through 767-9, 766-12 through 766-9, 765-12 through 765-9 and 766-12 through 766-9 respectively as the $\overline{BT0}$ through $\overline{BT15}$ B register output bits on the output lines 508-1 through 508-16 respectively. As long as the signals at the latch clock inputs remain at "0", the B register output bits will remain latched at the latch outputs. When the signals at the clock inputs are at "1", The B register output bits at the latch outputs will follow the file data bits at the latch inputs. Thus, The BR 508 provides temporary storage and means to invert the FD0 through FD15 file data bits.

FIG. 30A ARITHMETIC LOGIC UNIT

FIG. 30B TABLE OF FUNCTIONS

Figure 30A:
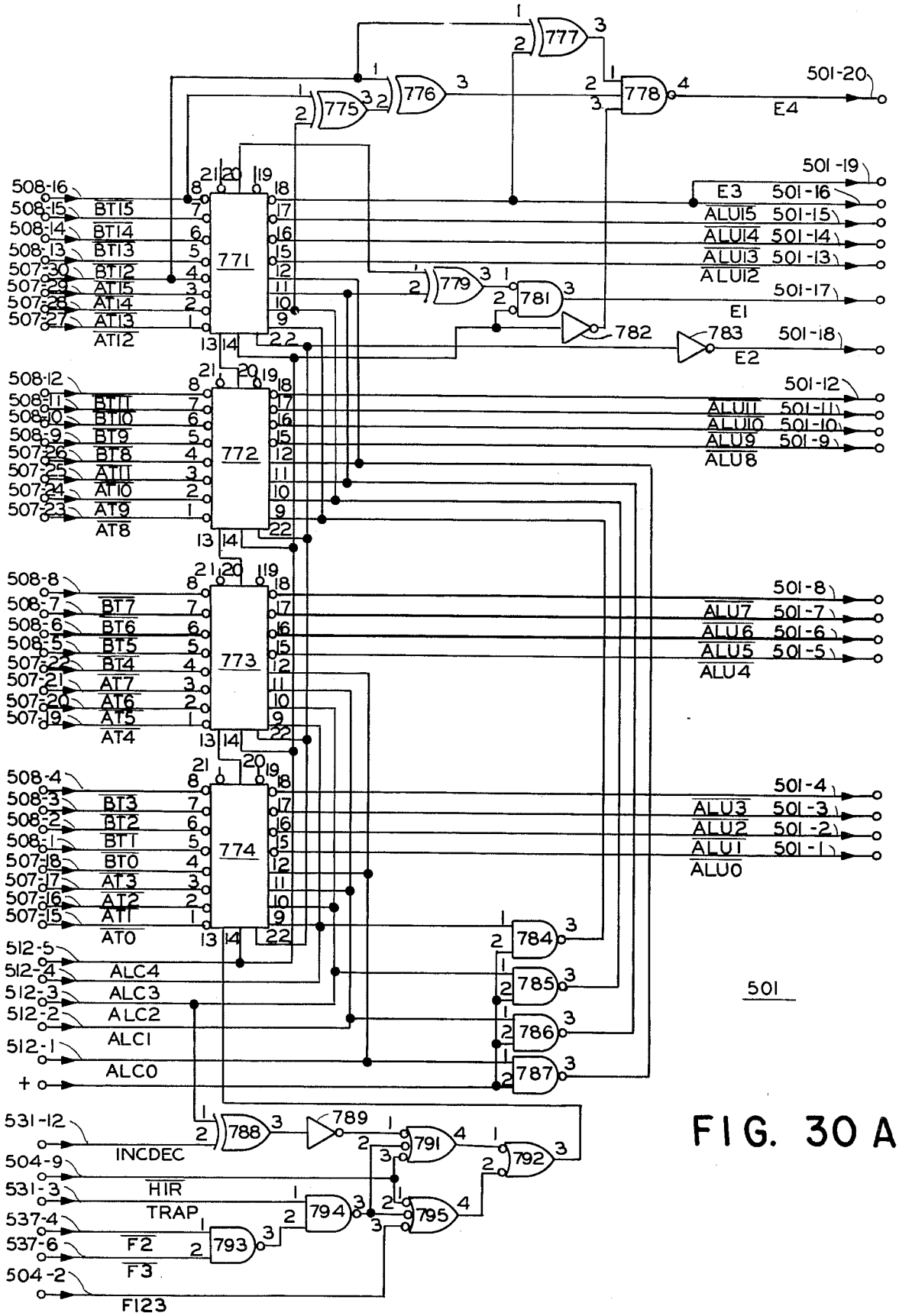
FIG. 30A is a schematic diagram of the arithmetic logic unit circuit of FIG. 18.

FIG. 30A is a schematic diagram of the arithmetic logic unit (ALU) 501 which receives data from the A register (AR) 507 and the B register (BR) 508, performs an arithmetic or logic function on the data and outputs the result to the file register (FR) 502. Inputs to the arithmetic logic unit are the $\overline{BT0}$ through $\overline{BT15}$ signals on the lines 508-1 through 508-16 respectively from the B register (BR) 508, the $\overline{AT0}$ through $\overline{AT15}$ signals on the lines 507-15 through 507-30 respectively from the A register (AR) 507, the ALC0 through ALC4 signals on the lines 512-1 through 512-5 respectively from the extended control (XC) 512, the INCDEC signal on the line 531-12 and the TRAP signal on the line 531-3 from the instruction decoder circuit (ID) 531, the $\overline{HIR}$ signal on the line 504-9 and the F123 signal on the line 504-2 from the bus interface (BI) 504 and the $\overline{F2}$ state signal on the line 537-4 and the $\overline{F3}$ state signal on the line 537-6 from the state counter (SC) 537. Outputs form the arithmetic logic unit are the $\overline{ALU0}$ through $\overline{ALU15}$ signals on the lines 501-1 through 501-16 respectively to the file register (FR) 502 and the E1 through E4 signals on the lines 501-17 through 501-20 respectively to the flag generator (FG) 535.

The arithmetic logic unit (ALU) 501 includes four arithmetic logic unit/function generators ALU/FG 771, 772, 773 and 774. Since the operation of each ALU/FG is similar, only the operation of the ALU/FG 771 will be explained in detail. Data is inputed into the ALU/FG in two four bit words, the "A" word at a plurality of inputs 771-1 through 771-4 and the "B" word at a plurality of inputs 771-5 through 771-8. The result of the function utilizing the two four bit words is outputed as a four bit word at a plurality of outputs 771-15 through 771-18. A plurality of selection inputs 771-9 through 771-12 may be utilized to select one of sixteen logic functions if a mode input 771-14 is at "1" or one of sixteen arithmetic funcions if the mode input is at "0". Two or more ALU/FG elements may be connected in parallel to perform the functions on words larger than four bits. If an arithmetic operation results in a one bit carry, a "1" is generated at an individual carry output 771-20. A one bit carry from a lower order four bits is received at an individual carry input 771-13 and is added to the result obtained from the selected arithmetic function. The ALU/FG may also be utilized as a comparator. When the "A" and "B" words are equal in magnitude, a "1" will be generated at an A = B output 771-22 if the subtraction function has been selected.

There is shown in FIG. 30B a table of logic and arithmetic functions performed by the arithmetic logic unit/-function generators 771 through 774. In Table II, the "A" word is designated as "A", the "B" word is designated as "B" and the output word is designated as "F". The logic and arithmetic functions include logic inversion represented by "$\overline{S}$" where "S" may be either "A" or "B" or any combination of "A" and "B", logic conjunction (AND) represented by "SS", logic disjunction (OR) represented by "S+S", exclusive-OR represented by "S ⊕S", arithmetic addition represented by "PLUS" and arithmetic subtraction represented by "MINUS". The functions are selected by the combinations of signals shown.

The ALU/FGs 771, 772, 773 and 774 are connected in parallel to perform functions on sixteen bit words. The lines 507-15 through 507-18 are connected to the inputs 774-1 through 774-4 respectively and the lines 508-1 through 508-4 are connected to the inputs 774-5 through 774-8 respectively to supply the lower order four bits of the "A" and "B" words. The outputs 774-15 through 774-18 are connected to the lines 501-1 through 501-4 respectively to generate the $\overline{ALU0}$ through $\overline{ALU3}$ signals. The carry output 774-20 is connected to the carry input 773-13 of the ALU/FG 773. The next four bits of the "A" and "B" words are supplied to the ALU/FG 773 on the lines 507-19 through 507-22 connected to the inputs 773-1 through 773-4 respectively and the lines 508-5 through 508-8 connected to the inputs 773-5 through 773-8 respectively to generate the $\overline{ALU4}$ through $\overline{ALU7}$ signals. The carry output 773-20 is connected to the carry input 772-13 of the ALU/FG 772. The next four bits of the "A" and "B" words are supplied to the ALU/FG 772 on the lines 507-23 through 507-26 connected to the inputs 772-1 through 772-4 respectively and the lines 508-9 through 508-12 connected to the inputs 772-5 through 772-8 respectively to generate the $\overline{ALU8}$ through $\overline{ALU11}$ signals. The carry output 772-20 is connected to the carry input 771-13 of the ALU/FG 771. The fourth group of four bits of the "A" and "B" words are supplied to the ALU/FG 771 on the lines 507-27 through 507-30 connected to the inputs 771-1 through 771-4 respectively and the lines 508-13 through 508-16 connected to the inputs 771-5 through 771-8 respectively to generate the $\overline{ALU12}$ through $\overline{ALU15}$ signals.

The ALC0 through ALC3 lines 512-1 through 512-4 are connected to the selection inputs 774-9 through 774-12 and 773-9 through 773-12 respectively. The lines 512-1 through 512-4 are also connected to a plurality of inputs 787-1, 786-1, 785-1 and 784-1 respectively of a plurality of NANDs 784 through 787. A plurality of inputs 784-2, 785-2, 786-2 and 787-2 are connected to a positive polarity direct current power supply (now shown) to supply a "1" to enable the NANDs. The NANDs have outputs 784-3, 785-3, 786-3 and 787-3 connected to a plurality of selection inputs 772-9 through 772-12 respectively and 771-9 through 771-12 respectively to supply the inverse ALC0 through ALC3 signals. The ALC4 line 512-5 is connected to the mode inputs 771-14, 772-14, 773-14 and 774-14 to select the logic functions or the arithmetic functions.

The carry input 774-13 is connected to an output 792-3 of a NAND 792. If both inputs to the NAND 792 are at "1", a "0" will be generated at the carry input 774-13 and a "1" will be generated for any other combination of input signals. An input 792-1 is connected to an output 791-4 of a NAND 791 which will generate a "0" if all inputs are at "1" and a "0" for any other combination of input signals. An input 791-1 is connected to an output 788-3 of an exclusive-OR 788 through an inverter 789. The exclusive-OR 788 has an input 788-1 connected to the ALC2 line 512-3 and an input 788-2 connected to the INCDEC line 531-12. If the ALC2 and INCDEC signals are the same, a "0" will be generated at the output 788-3 and if they are different a "1" will be generated. An input 791-2 is connected to an output 794-3 of a NAND 794. If both inputs of the NAND 794 are at "1", a "0" will be generated and a "1" will be generated for any other combination of input signals. An input 794-1 is connected to the TRAP line 531-3 and an input 794-2 is connected to an output 793-3 of a NAND 793. An input 793-1 is connected to the $\overline{F2}$ line 537-4 and an input 793-2 is connected to the $\overline{F3}$ line 537-6. If the $\overline{F2}$ and $\overline{F3}$ signals are at "1", a "0" will be generated and a "1" will be generated for any other combinations of input signals. An input 791-3 is connected to the $\overline{HIR}$ line 504-9.

Another input 792-2 of the NAND 792 is connected to the output 795-4 of a NAND 795. If all inputs of the NAND 795 are at "1", a "0" will be generated and a "1" will be generated for any other combination of input signals. An input 795-1 is connected to the $\overline{HIR}$ line 504-9, an input 795-2 is connected to the output 794-3 of the NAND 794 which may generate a "0" or a "1" as was previously described and an input 795-3 is connected to the F123 line 504-2.

The carry output 771-20 is connected to an input 779-1 of an exclusive-OR 779 having another input 779-2 connected to the output 786-3 of the NAND 786 to receive the inverted ALC1 signal. When the inverted ALC1 signal and the signal at the carry output are the same, the exclusive-OR 779 will generate a "0" and when the input signals are different will generate a "1" at an output 779-3 connected to an input 781-1 of a NOR 781. The NOR 781 has an input 781-2 connected to the ALC4 line 512-5 so that the output signal from the exclusive-OR 779 is inverted at an output 781-3 when the ALC4 signal is at "0" to select the arithmetic functions. The output 781-3 is connected to the line 501-27 to generate the E1 flag set signal.

The compare outputs 771-22, 772-22, 773-22 and 774-22 are connected together to the line 501-18 through an inverter 783. If the sixteen bits of the "A" and "B" words are the same, all the compare outputs will generate a "1" which is changed to a "0" by the inverter 783 to generate the E2 flag set signal. The highest order bit output 771-18 is connected to the line 501-19 to generate the E3 flag set signal.

The $\overline{BT15}$ signal line 508-16 is connected to an input 775-1 of an exclusive-OR 775 having another input 775-2 connected to the output 785-3 of the NAND 785 to receive the inverted ALC2 signal. If both input signals are the same, a "0" will be generated and if the input signals are different, a "1" will be generated at an output 775-3 connected to an input 776-2 of an exclusive-OR 776. An input 776-1 is connected to the $\overline{AT15}$ line 507-30. If both input signals are the same, a "0" will be generated and if the input signals are different, a "1" will be generated at an output 776-3 connected to an input 778-2 of a NAND 778.

An input 778-1 of the NAND 778 is connected to an output 777-3 of an exclusive-OR 777 having an input 777-1 connected to the $\overline{AT15}$ line 507-30 and an input 777-2 connected to the output 771-18. If both input signals are the same, a "0" will be generated and if the signals are different, a "1" will be generated. An input 778-3 is connected to the ALC4 line 512-5 through an inverter 782. If all the inputs to the NAND 778 are at "0", a "1" will be generated and a "0" will be generated for any other combination of input signals at an output 778-4. The output 778-4 is connected to the line 501-20 to generate the E4 flag set signal.

The arithmetic logic unit (ALU) 501 performs an arithmetic or logic function on sixteen bit words from the A register and/or the B register and sends the result to the file register. The functions are selected by ALC0 through ACL4 function selection signals generated by the extended control in response to the program instruction signal from the bus interface.

FIG. 31 FILE REGISTER

Figure 31:
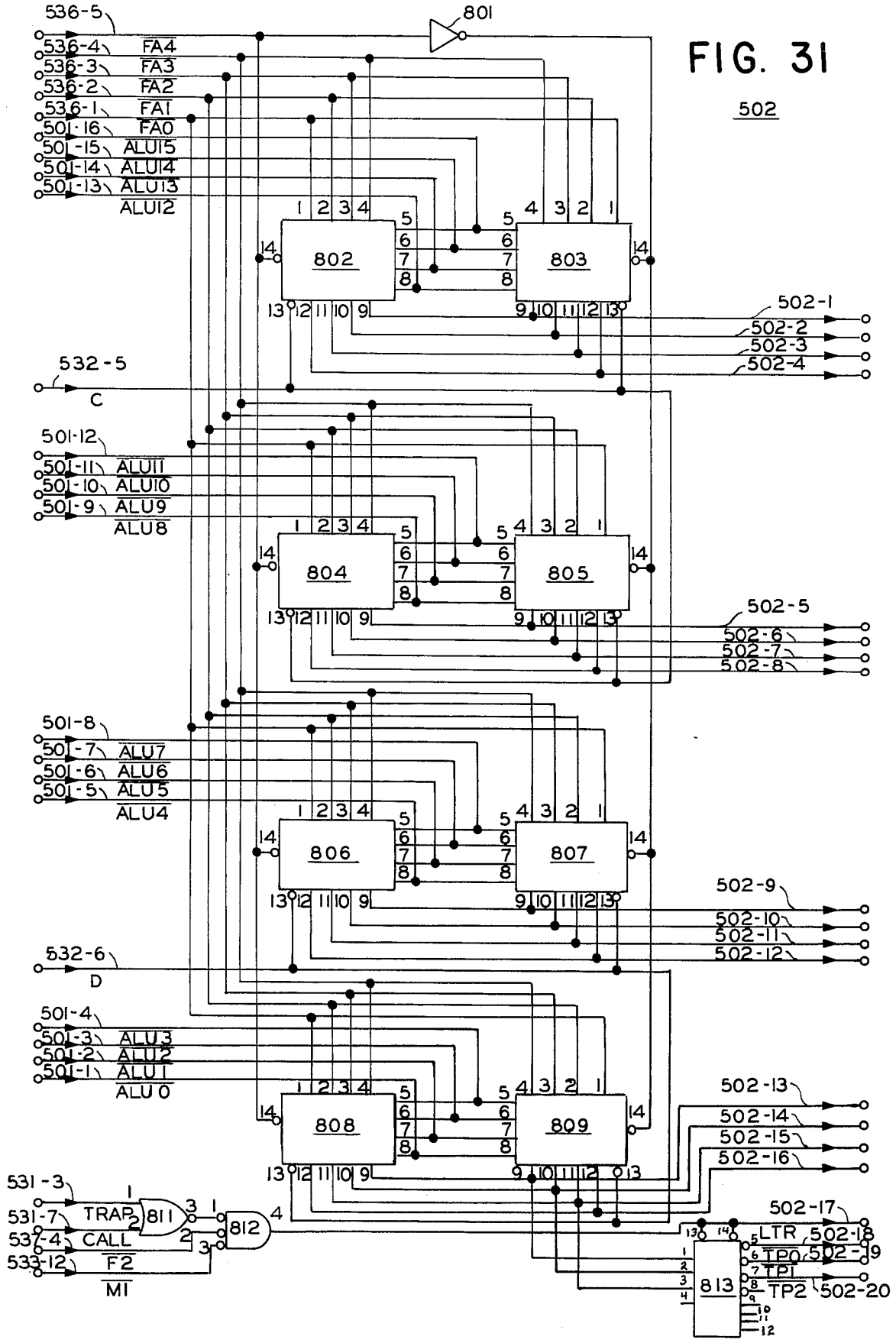
FIG. 31 is a schematic diagram of the file register circuit of FIG. 18.

FIG. 31 is a schematic diagram of the file register (FR) 502 which stores data from the arithmetic logic unit in eight sixty-four bit read/write memories and generates that data to the multiplexer. Inputs to the file register are the $\overline{FA0}$ through $\overline{FA4}$ memory address signals on the lines 536-1 through 536-5 respectively from the address multiplexer (AM) 536, the $\overline{ALU0}$ through $\overline{ALU15}$ arithmetic logic unit output signals on the lines 501-1 through 501-16 respectively from the arithmetic logic until (ALU) 501, the C control signal on the line 532-5 and the D control signal on the line 532-6 from the file register/multiplexer control (FR/MC) 532, the trap decoded instruction signal on the line 531-3 and the CALL decoded instruction signal on the line 531-7 from the instruction decoder circuit (ID) 531, the $\overline{F2}$ state signal on the line 537-4 from the state counter (SC) 537 and the $\overline{M1}$ clock signal on the line 533-12 from the clock (CK) 533. Outputs from the file register are the output bits on the output lines 502-1 through 502-16, the LTR move instruction on the line 502-17 and the $\overline{TP0}$ through $\overline{TP2}$ signals on the lines 502-18 through 502-20 respectively.

Since the memories 802 through 809 are similar, only the operation of the memory 802 will be described. The memory 802 contains storage locations for sixteen four bit words which may be addressed for reading and writing. The address is received at the address inputs 802-1 through 802-4 with the signal at the input 802-1 representing the lowest bit in a four bit binary address. If both the write enable input 802-13 and the memory enable input 802-14 are at "1", there will be a "1" generated at each of the data outputs 802-9 through 802-12 for all addresses. If the memory enable signal is changed to "0", the complement of the addressed four bit word will be generated at the data outputs. If both the write enable and memory enable signals are at "0", the data bits applied at the data inputs 802-5 through 802-8 are written into the memory and the complement appears at the data outputs 802-9 through 802-12 respectively. If the memory enable signal is changed to "1", the data bits at the data inputs are not stored, but the complements will appear at the data outputs.

The $\overline{FA0}$ through $\overline{FA3}$ memory address lines 536-1 through 536-4 respectively are connected to the 802-1 through 802-4 address inputs respectively and to the corresponding address inputs for the memories 803 through 809. The $\overline{ALU0}$ through $\overline{ALU3}$ lines 501-1 through 501-4 are connected to the data inputs 808-8 through 808-5 respectively and to the data inputs 809-8 through 809-5 respectively of the memories 808 and 809. The $\overline{ALU4}$ through $\overline{ALU7}$ lines 501-5 through 501-8 are connected to the data inputs 806-8 through 806-5 respectively and to the data inputs 807-8 through 807-5 respectively. The $\overline{ALU8}$ through $\overline{ALU11}$ lines 501-9 through 501-12 are connected to the data inputs 804-8 through 804-5 respectively and to the data inputs 805-8 through 805-5 respectively. The $\overline{ALU12}$ through $\overline{ALU15}$ lines 501-13 through 501-16 are connected to the data inputs 802-8 through 802-5 respectively and to the data inputs 803-8 through 803-5 respectively. The $\overline{FA4}$ line 536-5 is connected to the -14 memory enable inputs for the 802, 804 806 and 808 memories and connected through an inverter 801 to the -14 memory enable inputs for the 803, 805, 807 and 809 memories. The C control signal line 532-5 is connected to the -13 write enable inputs for the 802 through 805 memories and the D control signal line 532-6 is connected to the -13 write enable inputs for the 806 through 809 memories.

The data outputs 802-9 through 802-12 are connected to the output lines 502-1 through 502-4 respectively as are the corresponding data outputs of the memory 803. In a similar manner the data outputs of the 804 and 805 memories are connected to the output lines 502-5 through 502-8, the data outputs of the 806 and 807 memories are connected to the output lines 502-9 through 502-12 and the data outputs of the 808 and 809 memories are connected to the output lines 502-13 through 502-16. If the $\overline{FA4}$ signals is at "1", the 802, 804, 806 and 808 memories will either generate a "1" at each data output if the C or D signal is "1" or generate the complements of the applied data bits if the C or D signal is at "0". The 803, 805, 807 and 809 memories will either write in the applied data bits and generate the complements at the data outputs if the C or D signal is "0" will read out the complement of the word if the C or D signal is "1". The responses of the memories are reversed if the $\overline{FA4}$ signal is changed to "0".

The TRAP line 531-3 is connected to an input 811-1 and the CALL line 531-7 is connected to an input 811-2 of a NOR 811. An output 811-3 is connected to an input 812-1, the $\overline{F2}$ line 537-4 is connected to an input 812-2 and the $\overline{M1}$ line 533-12 is connected to an input 812-3 of a NOR 812. The NOR 812 generates the LTR signal at an output 812-4 connected to the output line 502-17 and to a pair of clock inputs of a four bit bistable latch 813. The latch 813 has the inputs 813-1 through 813-3 connected to the -9, -10 and -11 data outputs of the 808 and 809 memories. When the latch is clocked, the input signals are inverted and generated as the $\overline{TP0}$ through $\overline{TP2}$ signals at the inverting outputs 813-5 through 813-7 on the output lines 502-18 through 502-20 respectively.

If either the TRAP or CALL signal is at "1" and the $\overline{F2}$ and $\overline{M2}$ signals are at "0", all the inputs to the NOR 812 will be at "0" to generate a "1" to the latch 813. During this time the output signals will follow the complement of the input signals. If either both the TRAP and CALL signals are at "0", or the $\overline{F2}$ signal is at "1" or the $\overline{M2}$ signal is at "1", one of the inputs to the NOR 812 will be at "1" to generate a "0" LTR signal and clock the latch 813 which stores the complements of the input signals.

FIG. 32 EXTENDED CONTROL

Figure 32:
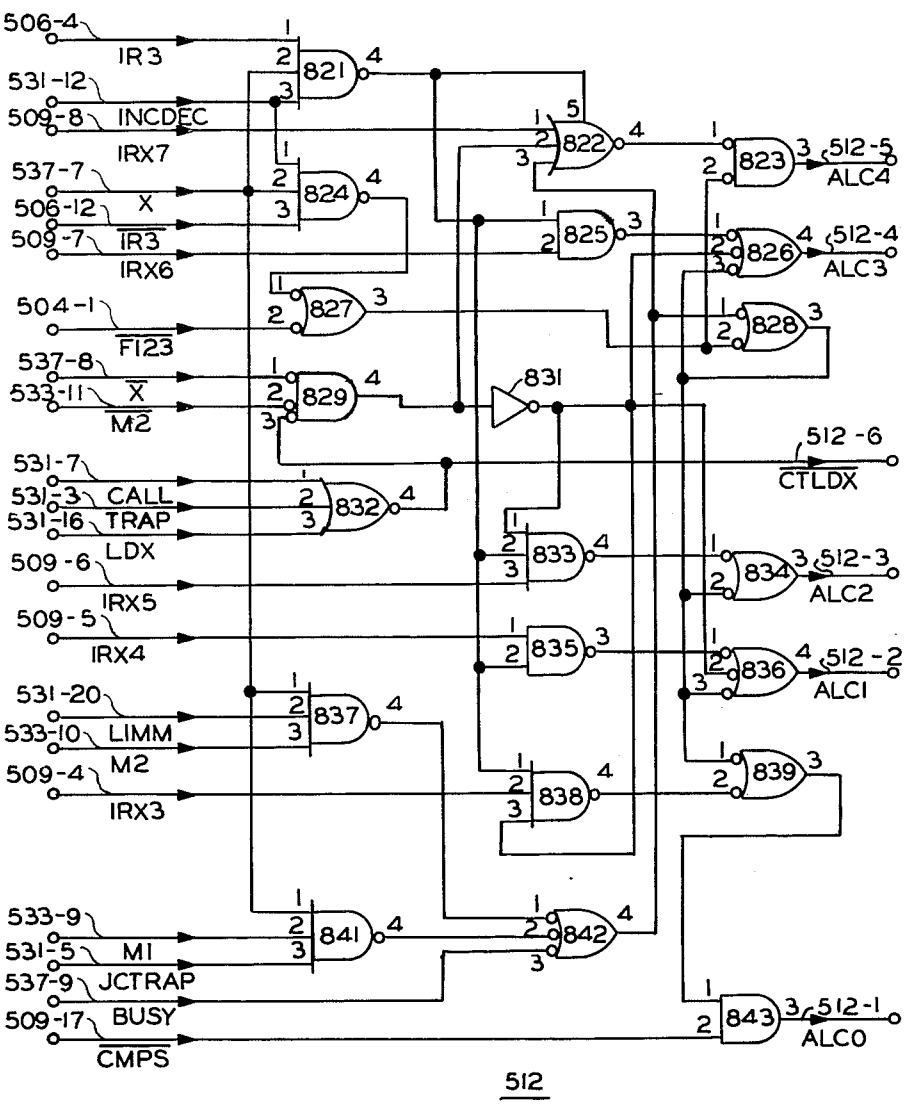
FIG. 32 is a schematic diagram of the extended control circuit of FIG. 18.

FIG. 32 is a schematic diagram of the extended control (XC) 512 which generates the ALC0 through ALC4 control signals to the arithmetic logic unit. Inputs to the extended control are the IR3 instruction signal bit on the line 506-4 and the $\overline{IR3}$ instruction signal bit on the line 506-12 from the instruction register (IR) 506; the INCDEC increment or decrement register instruction signal on the line 531-12, the CALL decoded instruction signal on the line 531-7, the TRAP decoded instruction signal on the line 531-3, the LDX load direct or load indexed signal on the line 531-16, the LIMM load immediate signal on the line 531-20 and the JCTRAP jump or call or trap signal on the line 531-5 from the instruction decoder circuit (ID) 531; the IRX3 through IRX7 instruction signal bits on the lines 509-4 through 509-8 respectively and the $\overline{CMPS}$ compare signal on the line 509-17 from the instruction register extended (IRX) 509; the X state signal on the line 537-7, the X state signal on the line 537-8 and the BUSY processor in a state signal on the line 537-9 from the state counter (SC) 537; the $\overline{F123}$ state signal F1 or F2 or F3 signal on the line 504-1 from the bus interface (BI) 504; and the $\overline{M2}$ clock signal on the line 533-11, the M2 clock signal on the line 533-10 and the M1 clock signal on the line 533-9 from the clock (CK) 533. Outputs from the extended control are the ALC0 through ALC4 control signals on the lines 512-1 through 512-5 to the arithmetic logic unit (ALU) 501 and the $\overline{CTLDX}$ current instruction is a call, trap, load direct or load indexed instruction signal on a line 512-6 to the B register (BR) 508 and to the file register/multiplexer control (FR/MC) 532.

The ALC4 control signal is generated at an output 823-3 of a NOR 823 from the IRX7 instruction signal bit. The IRX7 line 509-8 is connected to an input 822-1 of a tri-state logic NOR 822. The NOR 822 has three output states "1", "0" or off. When a "0" is applied to an enable input 822-5, an output 822-4 is placed in a high impedance condition which neither sinks nor sources current at a definable logic level. When a "1" is applied to the enable input 822-5, the NOR 822 functions as a NOR element. The enable input 822-5 is connected to an output 821-4 of a NAND 821. The IR3 line 506-4, the X line 537-7 and the INCDEC line 531-12 are connected to a plurality of inputs 821-1 through 821-3 respectively. When any one of the IR3, X or INCDEC signals are at "0", a "1" will be generated to enable the NOR 822.

The IRX7 signal will be generated in inverted form at the output 882-4 if a "0" is applied to a pair of inputs 822-2 and 822-3. The input 822-2 is connected to an output 829-4 of a NOR 829. An input 829-1 is connected to the X line 537-8, an input 829-2 is connected to the $\overline{M2}$ line 533-11 and an input 829-3 is connected to an output 832-4 of a NOR 832. If the $\overline{X}$ or $\overline{M2}$ signals or the output 832-4 is at "1", a "0" will be generated at the input 822-2. The CALL line 531-7, the TRAP line 531-3 and the LDX line 531-16 are connected to a plurality of inputs 832-1 through 832-3 respectively. If the CALL, TRAP and LDX signals are at "0", the NOR 832 will generate a "1".

The input 822-3 is connected to an output 842-4 of a NAND 842. If a "1" is applied at each of a plurality of inputs 842-1 through 842-3, an enabling "0" will be generated at the input 822-3. The input 842-1 is connected to an output 837-4 of a NAND 837 having an input 837-1 connected to the X line 537-7, an input 837-2 connected to the LIMM line 531-20 and an input 837-3 connected to the M2 line 533-10. If any one of the X, LIMM or M2 signals at "0", a "1" will be generated at the input 842-1. The input 842-2 is connected to an output 841-4 of a NAND 841 having an input 841-1 connected to the X line 537-7, an input 841-2 connected to the M1 line 533-9 and an input 841-3 connected to the JCTRAP line 531-5. If any one of the X, M1 or JCTRAP signals are at "0", a "1" will be generated at the input 842-2. The input 842-3 is connected to the BUSY line 537-9.

The output 822-4 is connected to an input 823-1 of the NOR 823 to receive the inverted IRX7 instruction signal bit. An input 823-2 is connected to an output 827-3 of a NAND 827 having an input 827-1 connected to an output 824-4 of a NAND 824 and an input 827-2 connected to the $\overline{F123}$ line 504-1. If both inputs are at "1", a "0" will be generated to enable the NOR 823 which generates the IRX7 instruction signal bit at the output 823-3 as the ALC4 control signal on the line 512-5. The INCDEC line 531-12 is connected to an input 824-1, the X line 537-7 is connected to an input 824-2 and the $\overline{IR3}$ line 506-12 is connected to an input 824-3. If either the INCDEC, X or $\overline{IR3}$ signals are at "0", a "1" will be generated at the input 827-1.

The ALC3 control signal is generated at an output 826-4 of a NAND 826 from the IRX6 instruction signal bit. The IRX6 line is connected to an input 825-2 of a NAND 825 having an output 825-3 connected to an input 826-1 of the NAND 826. The IRX6 signal will be generated in inverted form at the output 825-3 if a "1" is applied to an input 825-1. The input 825-1 is connected to the output 821-3 which may generate a "1" as previously discussed.

If a pair of inputs 826-2 and 826-3 are at "1", the IRX6 signal will be generated at the output 826-4 as the ALC3 control signal on the line 512-4. The input 826-2 is connected to the output 829-4 of the NOR 829 through an inverter 831. The NOR 829 may generate a "0" as was previously discussed which is changed to a "1" by the inverter 831. The input 826-3 is connected to an output 828-3 of a NAND 828. An input 828-1 is connected to an output 842-4 and an input 828-2 is connected to an output 827-3. Either the NAND 827 or the NAND 842 may generate a "0" as was previously described. The NAND 828 will then generate a "1" to the input 826-3.

The ALC2 control signal is generated at an output 834-3 of a NAND 834 from the IRX5 instruction signal bit. The IRX5 line 509-6 is connected to an input 833-3 of a NAND 833 having an output 833-4 connected to an input 834-1 of the NAND 834. The IRX5 signal will be generated in inverted form at the output 833-4 if a "1" is applied to a pair of inputs 833-1 and 833-2.

The input 833-1 is connected to the inverter 831 and the input 833-2 is connected to an output 821-4 which may each generate a "1" as was previously discussed to enable the NAND 833. The input 834-2 is connected to the output 828-3 of the NAND 828 which may supply a "1" as was previously discussed to enable the NAND 834. The NAND 834 will then generate the IRX5 signal at the output 834-3 as the ALC2 control signal on the line 512-3.

The ALC1 control signal is generated at an output 836-4 of a NAND 836 from the IRX4 instruction signal bit. The IRX4 line 509-5 is connected to the input 835-1 of a NAND 835 having an output 835-3 connected to an input 836-1 of the NAND 836. The IRX4 signal will be generated in inverted form at the output 835-3 if a "1" applied to an input 835-2. The input 835-2 is connected to the output 821-4 of the NAND which may generate a "1" as was previously discussed. The input 836-2 is connected to the inverter 831 and the input 836-3 is connected to the output 828-4 which may each generate a "1" as was previously discussed. The NAND 836 is then enabled to generate the IRX4 signal at the output 836-4 as the ALC1 control signal on the line 512-2.

The ALC0 control signal is generated at an output 843-3 of an AND from the IRX3 instruction signal bit. The IRX3 line 509-4 is connected to an input 838-2 of a NAND 838 having an output connected to an input 839-2 of a NAND 839. The IRX3 signal will be generated in inverted form at the output 838-4 if a "1" is applied to a pair of inputs 838-1 and 838-3. The input 838-1 is connected to the output 821-4 of the NAND 821 and the input 838-3 is connected to the inverter 831. Both the NAND 821 and the inverter 831 may generate a "1" as was previously described. An input 839-1 of the NAND 839 is connected to the output 828-3 of the NAND 828. The NAND 828 may generate a "1" as was previously discussed to enable the NAND 839 to generate the IRX3 signal at the input 843-1. An input 843-2 is connected to the $\overline{CMPS}$ line 509-17 and may receive a "1" to enable the AND 843 to generate the IRX3 signal at the output 843-3 as the ALC0 control signal on the line 512-1.

The output 832-4 of the NOR 832 is connected to the $\overline{CTLDX}$ line 512-6. If one of the CALL, TRAP or LDX signals is "1" at an input of the NOR 832, a $\overline{CTLDX}$ = "0" signal will be generated at the output 832-4 on the line 512-6.

FIG. 33 INSTRUCTION DECODER CIRCUIT

Figure 33:
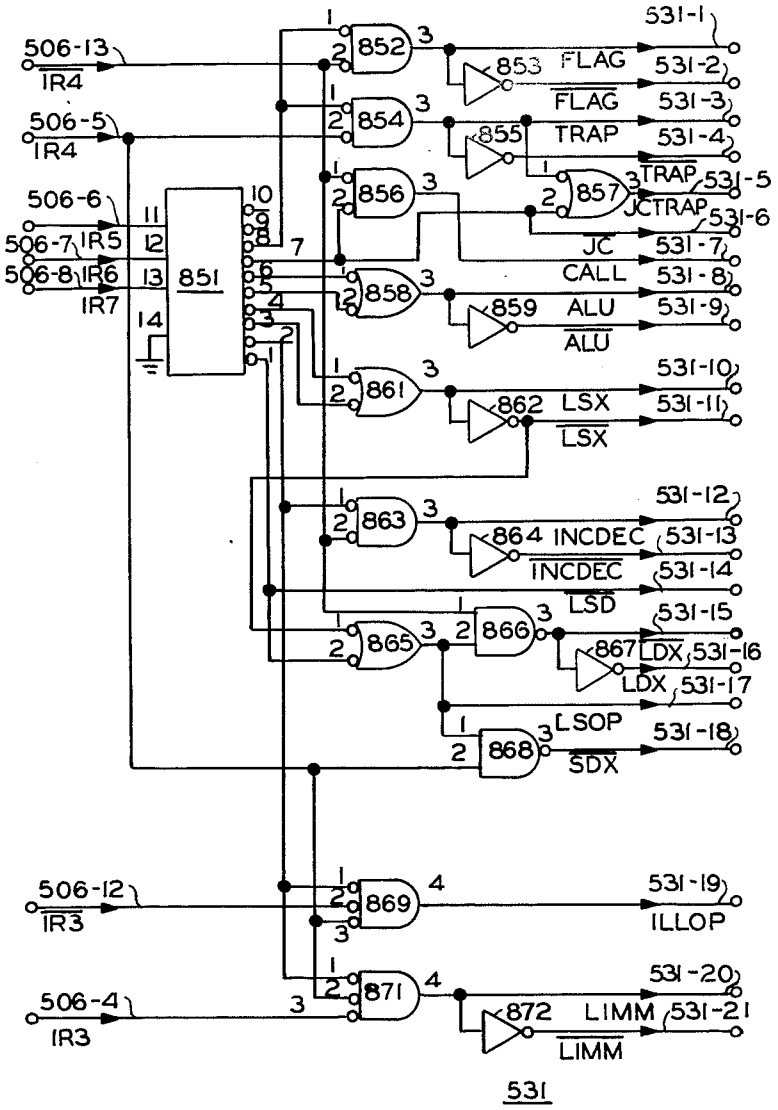
FIG. 33 is a schematic diagram of the instruction decoder circuit of FIG. 20.

FIG. 33 is a schematic diagram of the instruction decoder circuit (ID) 531 which decodes instruction signal bits from the instruction register to generate decoded instruction signals. Inputs to the instruction decoder are the IR3 through IR7 instruction signal bits on the lines 506-4 through 506-8 respectively, the $\overline{IR3}$ bit on the line 506-12 and the $\overline{IR4}$ bit on the line 506-13 from the instruction register (IR) 506. Outputs from the instruction decoder are the decoded instruction signals on the output lines 531-1 through 531-21.

The IR5 through IR7 lines 506-6 through 506-8 are connected to the address inputs 851-11 through 851-13 of a four line to ten line decoder 851. The fourth address input 851-14 is connected to the circuit ground to supply a "0". A "0" at each of the address inputs will generate a "0" at the output 851-1 and a "1" at each of the inputs 851-11 through 851-13 will generate a "0" at the output 851-8.

The output 851-8 is connected to an input 852-1 and the $\overline{IR4}$ line 506-13 is connected to an input 852-2 of a NOR 852. If the $\overline{IR4}$ signal is at "0" and the IR5, IR6 and IR7 signals are at "1", both inputs to the NOR 852 will be at "0" to generate the FLAG = "1" signal at an output 852-3 on the line 531-1. The FLAG signal is changed to a "0" by an inverter 853 to generate the $\overline{FLAG}$ signal on the line 531-2. The output 851-8 is also connected to an input 854-1 and the IR4 line 506-5 is connected to an input 854-2 of a NOR 854. If the IR4 signal is at "0" and the IR5, IR6 and IR7 signals are at "1", both inputs to the NOR 854 will be at "0" to generate the TRAP = "1" signal at the output 854-3 on the line 531-3. The TRAP signal is changed to a "0" by an inverter 855 to generate the $\overline{TRAP}$ signal on the line 531-4.

The output 851-7 is connected to an input 857-2 of a NAND 857 and to the output line 531-6. An input 857-1 is connected to the output 854-3. If the IR5 signal is at "0" and the IR6 and IR7 signals are at "1", the $\overline{JC}$ = "0" signal will be generated on the line 531-6 and both inputs to the NAND 857 will be at "0" to generate the JCTRAP = "1" signal at an output 857-3 on the line 531-5. The $\overline{IR4}$ line 506-13 is connected to an input 856-1 and 851-7 output is connected to an input 856-2 of a NOR 856. If the $\overline{IR4}$ and IR5 signals are at "0" and the IR6 and IR7 signals are at "1", both inputs to the NOR 856 will be at "0" to generate the CALL = "1" signal at an output 856-3 on the line 531-7.

The output 851-6 is connected to an input 858-1 and the output 851-5 is connected to an input 858-2 of a NAND 858. If the IR7 signal is at "1", the IR6 signal is at "0" and the IR5 signal is at "0" or "1", one of the inputs to the NAND 858 will be at "0" to generate the ALU = "1" signal at an output 858-3 on the line 531-8. An inverter 859 is connected to the output 858-3 to generate the $\overline{ALU}$ = "0" signal on the line 531-9. The output 851-4 is connected to an input 861-1 and the output 851-3 is connected to an input 861-2 of a NAND 861. If the IR7 signal is at "0", the IR6 signal is at "1" and the IR5 signal is at "0" or "1", one of the inputs to the NAND 861 will be at "0" to generate the LSX = "1" signal at an output 861-3 on the line 531-10. An inverter 862 is connected to the output 861-3 to generate the $\overline{LSX}$ = "0" signal on the line 531-11.

The $\overline{IR4}$ line 506-13 is connected to an input 863-2 and the output 851-2 is connected to an input 863-1 of a NOR 863. If the IR5 signal is at "1" and the $\overline{IR4}$, IR6 and IR7 signals are at "0", both inputs of the NOR 863 will be at "0" to generate the INCDEC = "1" signal on the line 531-12. An inverter 864 is connected to the output 863-3 to generate the $\overline{INCDEC}$ = "0" signal on the line 532-13. The output 851-1 is connected to the line 531-14. If the IR5, IR6 and IR7 signals are at "0", the $\overline{LSD}$ = "0" signal will be generated on the line 531-14.

The inverter 862 is connected to an input 865-1 to supply the $\overline{LSX}$ signal and the output 851-1 is connected to an input 865-2 of a NAND 865. The $\overline{IR4}$ line 506-13 is connected to an input 866-1 and the output 865-3 is connected to an input 866-2 of a NAND 866. If the $\overline{IR4}$ signal is at "1" and either the IR5, IR6 and IR7 signals are at "0" or the $\overline{LSX}$ = "0" signal is generated, both inputs to the NAND 866 will be at "1" to generate the $\overline{LDX}$ = "0" signal at an output 866-3 on the line 531-15. An inverter 867 is connected to the output 866-3 to generate the LDX = "1" signal on the line 531-16. The output 865-3 is also connected to the line 531-17. If either the IR5, IR6 and IR7 signals are at "0" or the $\overline{LSX}$ = "0" signal is generated, the LSOP = "1" signal will be generated on the line 531-17.

The output 865-3 is connected to an input 868-1 and the IR4 line 506-5 is connected to an input 868-2 of a NAND 868. If the IR4 signal is at "1" and the LSOP = "1" signal is generated, both inputs to the NAND 868 will be at "1" to generate a $\overline{SDX}$ = "0" signal at an output 868-3 on the line 531-18. The output 851-2 is connected to an input 869-1, the $\overline{IR3}$ line 506-12 is connected to an input 869-2 and the IR4 line 506-5 is connected to an input 869-3 of a NOR 869. If the IR5 signal is at "1" and the $\overline{IR3}$, IR4, IR6 and IR7 signals are at "0", all the inputs to the NOR 869 will be at "0" to generate the ILLOP = "1" signal at an output 869-4 on the line 531-19. The output 851-2 is connected to an input 871-1, the IR4 line 506-5 is connected to an input 871-2 and the IR3 line 506-4 is connected to an input 871-3 of a NOR 871. If the IR5 signal is at "1" and the IR3, IR4, IR6 and IR7 signals are at "0", all the inputs to the NOR 871 will be at "0" to generate the LIMM = "1" signal at an output 871-4 on the line 531-20. An inverter 872 is connected to the output 871-4 to generate the $\overline{LIMM}$ = "0" signal on the line 531-21.

FIG. 34 FILE REGISTER/MULTIPLEXER CONTROL

FIG. 34 is a schematic diagram of the file register/-multiplexer control (FR/MC) 532 which generates the A, B, C and D control signals to the file register and multiplexer. Inputs to the file register/multiplexer control are the decoded instruction signals $\overline{LSD}$ on the line 531-14. $\overline{LIMM}$ on the line 531-21, $\overline{JC}$ on the line 531-6, LDX on the line 531-16, LSOP on the line 531-17, LIMM on the line 531-20, INCDEC on the line 531-13 and JCTRAP on the line 531-5 from the instruction decoder circuit (ID) 531; the X state signal on the line 537-7 and the X state signal on the line 537-8 from the state counter (SC) 537; the clock signals M00 on the line 533-7, $\overline{M2}$ on the line 533-11, $\overline{M0}$ on the line 533-13, $\overline{M0CLK}$ on the line 533-2, $\overline{M2CLK}$ on the line 533-14, $\overline{M1CLK}$ on the line 533-5 and MCLK on the line 533-3 from the clock (CK) 533; the $\overline{IR3}$ signal on the line 506-12 and the IR3 signal on the line 506-4 from the instruction register (IR) 506; the $\overline{FILEA}$ signal on the line 504-3, the BA0 signal on the line 504-4 and $\overline{F123}$ signal on the line 504-1 from the bus interface (BI) 504; the $\overline{SERV}$ signal on the line 534-4, the $\overline{FINIT}$ signal on the line 534-5 and the IDOP signal on the line 534-10 from the bus control/distributed arbitrator (BC/DA) 534; the $\overline{CTDLX}$ signal on the line 512-6 from the extended control (XC) 512; and the $\overline{CMPS}$ signal on the line 509-17 from the instruction register extended (IRX) 509. Outputs from the file register/multiplexer control are the A and B control signals on the lines 532-1 and 532-2 respectively to the multiplexer (MUX) 503, the C and D control signals on the lines 532-5 and 532-6 respectively to the file register (FR) 502, the FAX bus connected to the file register signal on the line 532-3 to the bus control/distributed arbitrator (BC/DA) 534 and the $\overline{INIT}$ initialize signal on the line 532-4 to various circuits in the system.

The BA0 signal or its inverse is generated as the A, B. C and D signals for various combinations of the input signals. The A control signal is generated at an output 888-4 of a NAND 888 from the BA0 signal. The BA0 line 504-4 is connected to an inverter 905 to generate the inverse of the BA0 signal at an input 908-2 of a NAND 908. If a pair of inputs 908-1 and 908-3 are at "1", the BA0 signal will be generated at an output 908-4. The input 908-1 is connected to an output 892-3 of a NOR 892 which has an input 892-1 connected to the $\overline{FILEA}$ line 504-3 and an input 892-2 connected to an output 891-3 of a NOR 891. The $\overline{SERV}$ line 534-4 is connected to an input 891-1 and the $\overline{M0}$ line 533-13 is connected to an input 891-2. If the $\overline{FILEA}$ signal is at "0" and either or both the $\overline{SERV}$ signal and the $\overline{M0}$ signal is at "1", the NOR 892 will generate a "1" at the input 908-1. The output 892-3 is also connected to the line 532-3 to generate the FAX = "1" signal. The input 908-3 is connected to the IDOP line 534-10. If both the FAX and the IDOP signals are at "1", the BA0 signal will be generated at the output 908-4.

The output 908-4 is connected to an input 888-3 of the NAND 888. If a pair of inputs 888-1 and 888-2 are at "1", the BA0 signal will be inverted at the output 888-4. The input 888-1 is connected to an otput 884-4 of a NAND 884. If at least one of a plurality of inputs is at "0", a "1" will be generated at the output 884-4. An input 884-1 is connected to an output 883-3 of a NAND 883. An input 883-1 is connected to the $\overline{LSD}$ line 531-14 and an input 883-2 is connected to an output 881-3 of a NAND 881 through an inverter 882. An input 881-1 is connected to the $\overline{LIMM}$ line 534-21 and an input 881-2 is connected to the $\overline{JC}$ line 531-6. If the $\overline{LSD}$, $\overline{LIMM}$ and $\overline{JC}$ signals are all at "1", will be generated at the input 884-1. An input 884-2 is connected to the X line 537-7 and an input 884-3 is connected to the M00 line 533-7. If either the X or M00 signal is at "0", a "1" will be generated at the output 884-4.

The input 888-2 is connected to an output 886-4 of a NAND 886. If one of the inputs to the NAND 886 is at "0", a "1" will be generated at the input 888-2. An input 886-1 is connected to the LDX line 531-16, an input 886-2 is connected to the $\overline{IR3}$ line 506-12 and an input 886-3 is connected to an output 885-3 of a NOR 885. An input 885-1 is connected to the $\overline{M2}$ line 533-11 and an input 885-2 is connected to the $\overline{X}$ line 537-8 so that if either or both of the $\overline{M2}$ and $\overline{X}$ signals are at "1", a "0" will be generated at the input 886-3. If both inputs 888-1 and 888-2 are at "1", the BA0 signal at the input 888-3 will be inverted at the output 888-4 to generate the A control signal on the line 532-1.

The B control signal is generated at an output 889-4 of a NAND 889 from the BA0 signal. The BA0 line 504-4 is connected to an input 893-2 of a NAND 893 which has an input 893-1 connected to the output 892-3 of the NOR 892. If the NOR 892 generates a FAX = "1" signal as was previously discussed, the inverse of the BA0 signal will be generated at the input 889-3. If a pair of inputs 889-1 and 889-2 are at "1", the BA0 signal will be generated at an output 889-4.

The input 889-1 is connected to the output 884-4 of the NAND 884 which may generate a "1" as was previously discussed. The input 889-2 is connected to an output 887-4 of a NAND 887. An input 887-1 is connected to an output 885-3 of a NOR 885. The $\overline{M2}$ line 533-11 is connected to an input 885-1 and the $\overline{X}$ line 537-8 is connected to an input 885-2. If either or both the $\overline{M2}$ and $\overline{X}$ signals are at "1", a "0" will be generated at the input 887-1. An input 887-2 is connected to the LSOP line 531-17 and an input 887-3 is connected to the IR3 line 506-4. If any one or more of the inputs to the NAND 887 is at "0", a "1" is generated at the input 889-2. If both the inputs 889-1 and 889-2 are at "1", the inverted BA0 signal at the input 889-3 will be generated as the BA0 signal at the output 889-4 representing the B control signal on the line 532-2.

The C control signal is generated at an output 907-3 of a NAND 907 from the BA0 signal. The BA0 line 504-4 is connected to an input 906-2. If a pair of inputs 906-1 and 906-3 are at "1", the BA0 signal will be generated in inverted form at an output 906-4 connected to an input 907-2 of the NAND 907. The input 906-1 is connected to the output 892-3 of the NOR 892 which may generate a "1" as was previously discussed. The input 906-3 is connected to the IDOP line 534-11.

The input 907-1 is connected to an output 897-5 of a NOR 897. If all the inputs to the NOR 897 are at "0", a "1" will be generated at the input 907-1. An input 897-1 is connected to an output 894-3 of a NOR 894. The $\overline{M0CLK}$ line 533-2 is connected to an input 894-1 and the $\overline{F123}$ line 504-1 is connected to an input 894-2. If either or both of the $\overline{M0CLK}$ and $\overline{F123}$ signals are at "1", a "0" will be generated at the input 897-1. An input 897-2 is connected to an output 896-4 of a NOR 896. If one or more of the inputs to the NOR 896 are at "1", a "0" will be generated at the input 897-2. The $\overline{X}$ line 537-8 is connected to an input 896-1 an input 896-2 is connected to an output 895-3 of a NOR 895 and the $\overline{M2CLK}$ line 533-14 is connected to an input 896-3. The LIMM line 531-20 is connected to an input 895-1 and an input 895-2 is connected to an output 898-4 of a NAND 898. If both inputs 895-1 and 895-2 are at "0", a "1" will be generated at the input 896-2. The $\overline{INCDEC}$ line 531-13 is connected to an input 898-1, the $\overline{CTLDX}$ line 512-6 is connected to an input 898-2 and the $\overline{CMPS}$ line 509-17 is connected to an input 898-3 through an inverter 899. If the $\overline{INCDEC}$ AND $\overline{CTLDX}$ signals are at "1" and the $\overline{CMPS}$ signal is at "0", a "0" will be generated at the input 895-2.

An input 897-3 is connected to an output 902-3 of a NOR 902. If either or both inputs to the NOR 902 are at "1", a "0" will be generated at the input 897-3. The $\overline{M1CLK}$ line 533-5 is connected to an input 902-2 and an input 902-1 is connected to an output 901-3 of a NAND 901. The X line 537-7 is connected to an input 901-1 and the JCTRAP line 531-5 is connected to an input 901-2. If either or both of the X and JCTRAP signals are at "0", a "1" is generated at the input 902-1. An input 897-4 is connected to the MCLK line 533-3. When all the inputs to the NAND 897 are at "0", the inverted BA0 signal will be generated as the BA0 signal at the output 907-3 representing the C control signal on the line 532-5.

The D control signal is generated at an output 909-3 of a NAND 909 from the BA0 signal. An input 909-2 is connected to the output 908-4 of the NAND 908 which may generate the BA0 signal as was previously discussed. An input 909-1 is connected to the output 897-5 of the NOR 897 which may generate a "1" as was previously discussed. A "1" at the input 909-1 enables the NAND 909 to generate the inverse of the BA0 signal at the output 909-3 representing the D control signal on the line 532-6.

The MCLK line 533-3 is connected to a clock input 903-2 of a D-type flip flop 903. A data input 903-1 and a preset input 903-6 are connected to a positive polarity direct current power supply (not shown) to receive a "1". A clear input 903-5 is connected to the $\overline{\text{FINIT}}$ line 534-6. At the time of the supervisor start up, the $\overline{\text{FINIT}}$ signal will change from "1" to "0" to generate a "1" at an inverting output 903-4. This "1" is changed to a "0" by an inverter 904 to generate the $\overline{\text{INIT}}$ = "0" signal on the line 532-4 to set initial conditions in the various circuits of the processor. When the MCLK signal changes from "0" to "1", a "0" will be generated at the output 903-4 to remove the $\overline{\text{INIT}}$ signal. The $\overline{\text{INIT}}$ signal will not be generated again until power is removed and reapplied to the supervisor.

The file register/multiplexer control (FR/MC) 532 generates the A and B control signals to select the combinations of input signals to the multiplexer which are sent to the A register, the B register and the bus interface. The file register/multiplexer control also generates the C and D control signals which are the write enable signals to the memories of the file register for controlling the reading in and the writing out of data.

FIG. 35 FLAG GENERATOR

Figure 35:
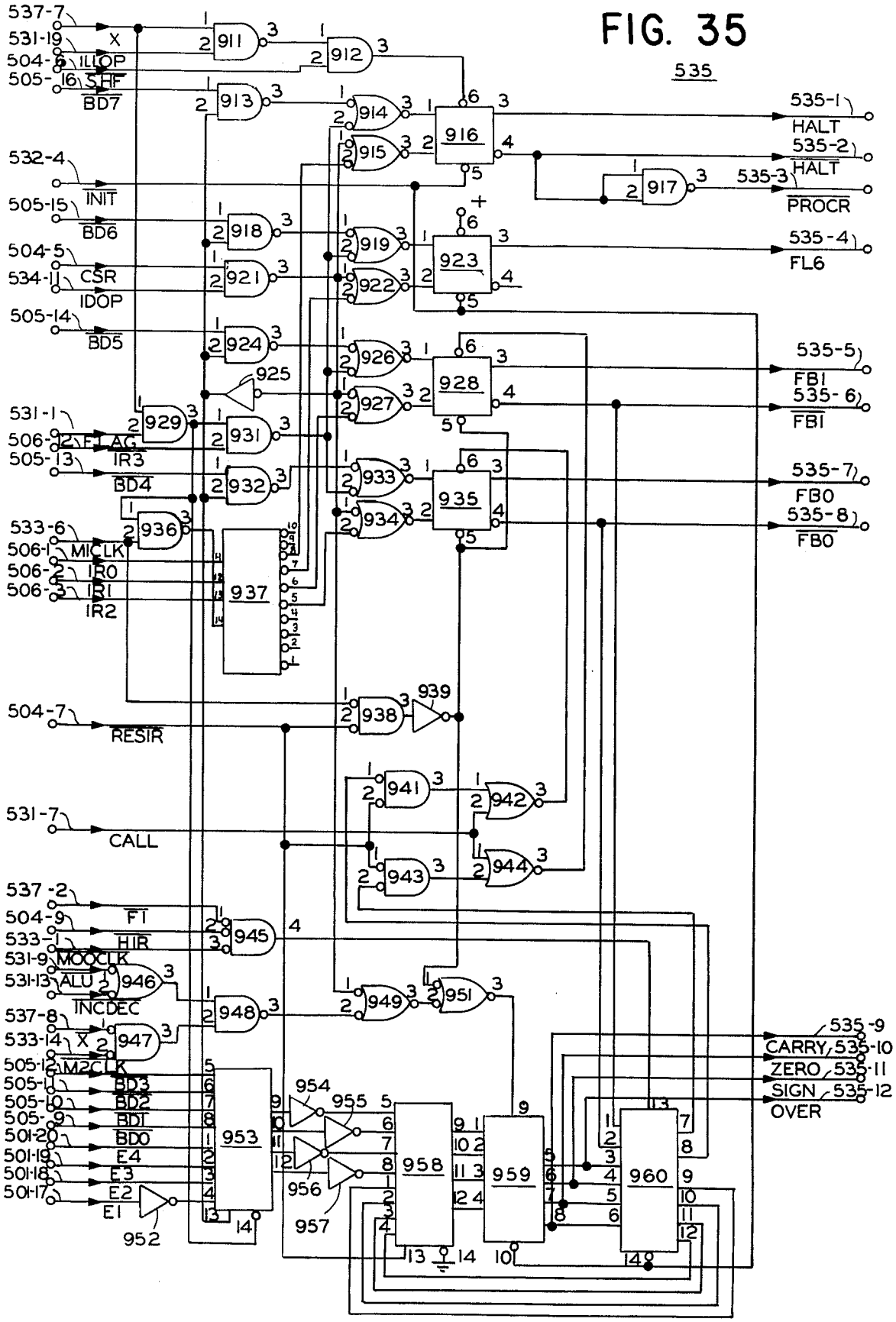
FIG. 35 is a schematic diagram of the flag generator circuit of FIG. 20.

FIG. 35 is a schematic diagram of the flag generator (FG) 535 which utilizes the $\overline{\text{BD0}}$ through $\overline{\text{BD7}}$ bus data bits to generate flag signals to various elememts of the processor. These flag signals are used for conditional program branching to modify basic instructions. Inputs to the flag generator are the X state signal on the line 537-7, the $\overline{\text{F1}}$ state signal on the line 537-2 and the $\overline{\text{X}}$ state signal on the line 537-8 from the state counter (SC) 537; the decoded instruction signals ILLOP on the line 531-19, FLAG on the line 531-1, CALL on the line 531-7, $\overline{\text{ALU}}$ on the line 531-9 and $\overline{\text{INCDEC}}$ on the line 531-13 from the instruction decoder circuit (ID) 531; the $\overline{\text{SHF}}$ signal on the line 504-6, the CSR signal on the line 504-5, the $\overline{\text{RESIR}}$ signal on the line 504-7 and the $\overline{\text{HIR}}$ signal on the line 504-9 from the bus interface (BI) 504; the $\overline{\text{BD0}}$ through $\overline{\text{BD7}}$ bus data bits on the lines 505-9 through 505-16 respectively from the bus latch temporary (BLT) 505; the $\overline{\text{INIT}}$ signal on the line 532-4 from the file register/multiplexer control (FR/MC) 532; the IDOP signal on the line 534-11 from the bus control/distributed arbitrator (BC/DA) 534; the IR0 through IR2 instruction signal bits on the lines 506-1 through 506-3 respectively and the $\overline{\text{IR3}}$ instruction signal bit on the line 506-12 from the instruction register (IR) 506; the clock signals M1CLK on the line 533-6, $\overline{\text{M00CLK}}$ on the line 533-1 and $\overline{\text{M2CLK}}$ on the line 533-14 from the clock (CK) 533; and the E1 through E4 flag set signals on the lines 501-17 through 501-20 respectively from the arithmetic logic unit (ALU) 501. Outputs from the flag generator are the flag signals on the lines 535-1 through 535-12.

The HALT, $\overline{\text{HALT}}$ and $\overline{\text{PROCR}}$ flag signals are generated from the $\overline{\text{BD7}}$ bus data bit. The $\overline{\text{BD7}}$ line 505-16 is connected to an input 913-1 of a NAND 913. An input 913-2 is connected to an output 921-3 of a NAND 921 through an inverter 925. The CSR line 504-5 is connected to an input 921-1 and the IDOP line 534-11 is connected to an input 921-2. If both the signals CSR and IDOP are at "1", a "0" will be generated at the output 921-3 and will be changed to a "1" by the inverter 925 to enable the NAND 913 to generate an inverted $\overline{\text{BD7}}$ signal at an output 913-3. The output 913-3 is connected to an input 914-1 of an OR 914 having another input 914-2 connected to an output 931-3 of a NAND 931. The $\overline{\text{IR3}}$ line 506-12 is connected to an input 931-2 and an output 929-3 of an AND 929 is connected to an input 931-1. The X line 537-7 is connected to an input 929-1 and the FLAG line 531-1 is connected to an input 929-2. If the X and FLAG signals are both at "1", a "1" will be generated at the input 931-1. If both inputs to the NAND 931 are at "1", a "0" will be generated at the input 914-2 to enable the OR 914 to generate the inverted $\overline{\text{BD7}}$ signal at an output 914-3 which is connected to a data input 916-1 of a D-type flip flop 916.

A clock input 916-2 is connected to an output 915-3 of an OR 915 which has an input 915-1 connected to the output 921-3 of the NAND 921. The NAND 921 may generate a "0" as was previously described to enable the OR 915. An input 915-2 is connected to an output 937-8 of a four line to ten line decoder 937. The IR0 through IR2 lines 506-1 through 506-3 are connected to a plurality of inputs 937-11 through 937-13 respectively. An input 937-14 is connected to an output 936-3 of a NAND 936 having an input 936-1 connected to the output 929-3 and an input 936-2 connected to the M1CLK line 533-6. If the AND 929 generates a "1" as was previously described and the M1CLK signal is at "1", the NAND 936 will generate a "0". If the IR0 through IR2 signals are at "1", a "0" will be generated at the output 937-8. When either or both inputs to the NAND 936 change to "0", the output 937-8 will change from "0" to "1". The transition from "0" to "1" is transmitted through the OR 915 to clock the flip flop 916 which generates the inverted $\overline{\text{BD7}}$ signal at a non-inverting output 916-3 as the HALT signal on the line 535-1. The $\overline{\text{BD7}}$ signal is generated at an inverting output 916-4 as the $\overline{\text{HALT}}$ signal on the line 535-2. The output 916-4 is connected to a pair of inputs 917-1 and 917-2 of a NAND 917 to generate the inverse of the $\overline{\text{HALT}}$ signal at an output 917-3 as the $\overline{\text{PROCR}}$ signal on the line 535-3 to the bus.

The $\overline{\text{INIT}}$ line 532-4 is connected to a clear input 916-5. A "1" to "0" transition on the $\overline{\text{INIT}}$ line will generate a HALT = "0" signal and a $\overline{\text{HALT}}$ = "1" signal. A preset input 916-6 is connected to an output 912-3 of an AND 912 having an input 912-1 connected to an output 911-3 of a NAND 911 and an input 912-2 connected to the $\overline{\text{SHF}}$ line 504-6. An input 911-1 is connected to the X line 537-7 and an input 911-2 is connected to the ILLOP line 531-19. If either or both of the X and ILLOP signals are at "0", a "1" will be generated at the input 912-1. If both inputs of the AND 912 are at "1", a "1" will be generated at the output 912-3. If both the signals X and ILLOP are at "1" or the $\overline{\text{SHF}}$ signal is at "0", a "0" will be generated at the output 912-3. A "1" to "0" transition at the output 912-3 will preset the flip flop 916 to generate the HALT = "1" and a $\overline{\text{HALT}}$ = "0" signals.

The FL6 flag signal is generated from the $\overline{\text{BD6}}$ bus data bit. The $\overline{\text{BD6}}$ line 505-15 is connected to an input 918-1 of a NAND 918 having an input 918-2 connected to the inverter 925. If a "1" is generated by the inverter 925 as was previously described, the $\overline{\text{BD6}}$ signal will be inverted at an output 918-3 connected to an input 919-1 of an OR 919 having an output 919-3 connected to a data input 923-1 of a D-type flip flop 923. Another input 919-2 of the OR 919 is connected to the output 931-3 of the NAND 931 which may generate a "0" as was previously discussed to enable the OR 919 to generate the inverted $\overline{BD6}$ signal at the data input 923-1.

A clock input 923-2 is connected to an output 922-3 of an OR 922 having an input 922-1 connected to the output 921-3 of the NAND 921 which may generate an enabling "0" as was previously described. Another input 922-2 is connected to an output 937-7 of the decoder 937. If the IRO signal is at "0", the IR1 and IR2 signals are at "1" and the output of the NAND 936 changes from "0" to "1", a "0" to "1" transition is generated at the output 937-7 which is transmitted through the OR 922 to clock the flip flop 923. The flip flop 923 will then generate the inverted $\overline{BD6}$ signal at a non-inverting output 923-3 as the FL6 signal on the line 535-4. A clear input 923-5 is connected to the $\overline{INIT}$ line 532-4 such that a "1" to "0" transition will set FL6= "0". A preset input 923-6 is connected to a positive potential direct current power supply so that the flip flop 923 cannot be preset.

The FB1 and $\overline{FB1}$ flag signals are generated from the $\overline{BD5}$ bus data bit. The $\overline{BD5}$ 505-14 is connected to an input 924-1 of a NAND 924 having another input 924-2 connected to the inverter 925. If the inverter 925 generates a "1" as was previously discussed, the $\overline{BD5}$ signal will be inverted at an output 924-3 which is connected to an input 926-1 of an OR 926. Another input 926-2 is connected to an output 931-3 of the NAND 931 which may generate a "0" as was previously discussed. The OR 926 will then generate the inverted $\overline{BD5}$ signal at an output 926-3 which is connected to a data input 928-1 of a flip flop 928.

A clock input 928-2 is connected to an output 927-3 of an OR 927 having an input 927-1 connected to an output 921-3 of the NAND 921. Another input 927-2 is connected to an output 937-6 of the decoder 937. If IR1 is at "0", IR0 and IR2 are at "1", and the output 936-3 changes from "0" to "1", a "0" to "1" transition is generated at the output 937-6 which is transmitted through the OR 927 to clock the flip flop 928 if the NAND 921 generates a "0" as was previously discussed. The flip flop 928 will then generate the inverted $\overline{BD5}$ signal at a non-inverting output 928-3 as the FB1 signal on the line 535-5 and the $\overline{BD5}$ signal at an inverting output 928-4 as the $\overline{FB1}$ signal on the line 535-6.

A clear input 928-5 is connected to an output 938-3 of a NOR 938 through an inverter 939. The $\overline{MICLK}$ line 533-6 is connected to an input 938-1 and the $\overline{RESIR}$ line 504-7 is connected to an input 938-1. If one or both the MICLK and the $\overline{RESIR}$ signals are at "1", a "0" will be generated at the output 938-3 and will be changed to a "1" at the clear input 928-5 by the inverter 939. If both the MICLK and $\overline{RESIR}$ signals are at "0", a "1" will be generated and will be changed to a "0" by the inverter 939. A "1" to "0" transition at the clear input 928-5 will set FB1 = "0" and $\overline{FB}$ = "1".

A preset input 928-6 is connected to an output 944-3 of a NOR 944 having an input 944-1 connected to the CALL line 531-7 and an input 944-2 connected to an output 943-3 of a NOR 943. The $\overline{RESIR}$ line 504-7 is connected to an input 943-1 and an input 943-1 is connected to an output 960-7 of a hex D-type flip flop 960. The flip flop 960 has a plurality of data inputs 960-1 through 960-6 from which data may be clocked to a plurality of non-inverting outputs 960-7 through 960-12 respectively. A commmon clear input 960-14 is connected to the $\overline{INIT}$ line 532-4 such that when there is a "1" to "0" transition all the outputs will be set to "0". The input 960-1 is connected to the output 928-4. A common clock input 960-13 is connected to an output 945-4 of a NOR 945. The $\overline{F1}$ line 537-2 is connected to an input 945-1, the $\overline{HIR}$ line 504-9 is connected to an input 945-2 and the $\overline{MOOCLK}$ line 533-1 is connected to an input 945-3. If at least one of the inputs to the NOR 945 is at "1", a "0" will be generated at the clock input 960-13. If all the inputs are at "0", a "1" will be generated. A "0" to "1" transition will clock the flip flops 960.

If both inputs of NOR 944 are at "0", a "1" is generated at the preset input 928-6. The NOR 943 will generate a "0" if one of its inputs is at "1". The output 960-7 will be at "1" if the $\overline{FB1}$ signal is at "1" and the flip flop 960 has been clocked. A "1" at either or both of the inputs of the NOR 944 will generate a "0" to preset FB1 = "1" and $\overline{FB1}$ = "0". The NOR 943 will generate a "1" if both inputs are at "0" and a "0" will be generated at the output 960-7 if $\overline{FB1}$ = "0" and the flip flop 960 has been clocked.

The FB0 and $\overline{FB0}$ flag signals are generated from the $\overline{BD4}$ bus data bit. The $\overline{BD4}$ line 505-13 is connected to an input 932-1 of a NAND 932 having another input 932-2 connected to the invertor 925. If the inverter 925 generates a "1" as was previously discussed, the inverted $\overline{BD4}$ signal will be generated at an output 932-3 which is connected to an input 933-1 of an OR 933. Another input 933-2 is connected to the output 931-3 of the NAND 931. The NAND 931 may generate a "0" as was previously discussed to enable the OR 933 to generate the inverted $\overline{BD4}$ signal at an output 933-3 to a data input 935-1 of a D-type flip flop 935.

A clock input 935-2 is connected to an output of an OR 934 having an input 934-1 connected to an output 921-3 of a NAND 921 and an input 934-2 connected to an output 937-5 of the decoder 937. If the IR0 and IR1 signals are at "0", the IR2 signal is a "1" and the output 936-3 changes from "0" to "1", a "0" to "1" transition will be generated at the input 934-2. The NAND 921 may generate a "0" as was previously discussed to enable the OR 934 to generate the "0" to "1" transition to clock the flip flop 935. The flip flop 935 will then generate the inverted $\overline{BD4}$ signal at a non-inverting output 935-3 as the FB0 signal on the line 535-7 and $\overline{BD4}$ signal at an inverting output 935-4 as the $\overline{FB0}$ signal on the line 535-8.

A clear input 935-5 is connected to the inverter 939 which may generate a "1" to "0" transition as was previously discussed to set FB0 = "0" and $\overline{FB0}$ = "1". A preset input 935-6 is connected to an output 942-3 of a NOR 942 having an input 942-1 connected to an output 941-3 of a NOR 941 and an input 942-2 connected to the CALL line 531-7. If both inputs to the NOR 942 are at "0", a "0" will be generated at the preset input 935-6 and if one or both of the inputs receive a "1", a "1" to "0" transition will be generated to preset FB0 = "1" and $\overline{FB0}$ = "0". The NOR 941 will generate "0" if one or both of its inputs are at "1" and will generate a "1" if both of its inputs are at "0". An input 941-1 is connected to an output 960-8 of the flip flop 960 and an input 941-2 is connected to the $\overline{RESIR}$ line 504-7. The flip flop 960 will generate a "1" if $\overline{FB0}$ = "1" or will generate a "0" if $\overline{FB0}$ = "0" when clocked as was previously discussed since the input 960-2 is connected to the output 935-4.

The $\overline{BD0}$ through $\overline{BD3}$ bus data signals or the E1 through E4 flag set signals may be utilized to generate the CARRY, ZERO, SIGN and OVER flag signals. The E1 through E4 signal lines 501-17 through 501-20 are connected to a plurality of inputs 953-4 through 953-1 respectively of a two line to one line data selector/multiplexer 953 with the E1 line 501-17 connected through an inverter 952. The $\overline{BD0}$ through $\overline{BD3}$ bus data bit lines 505-9 through 505-12 are connected to a plurality of inputs 953-8 through 953-5 respectively. A strobe input 953-14 is connected to the output 929-3 of the AND 929. If both of the inputs to the AND 929 are at "1", a "1" will be generated at the output 929-3 to the strobe input 953-14 to place a "0" at each of a plurality of outputs 953-9 through 953-12. If at least one of the inputs to the AND 929 is at "0", a "0" will be generated to enable the data selector/ multiplexer 953. A select input 953-13 is connected to the output 921-3 of the NAND 923 through the inverter 925. If the strobe input is at "1" and both inputs to the NAND 921 are at "1", a "1" will be generated at the select input 953-13 to place the $\overline{BD3}$ through $\overline{BD0}$ signal at the outputs 953-9 through 953-12 respectively. If the strobe input is at "0" and at least one of the inputs to the NAND 921 is at "0", a "0" will be generated at the select input 953-13 to place the E4 through E2 and $\overline{E1}$ signals at the outputs 953-9 through 953-12 respectively.

The outputs 953-9 through 953-12 are connected to a plurality of inputs 958-5 through 958-8 of a two line to one line data selector/multiplexer 958 through a plurality of inverters 954, 955, 956 and 957 respectively. A plurality of inputs 958-1 through 958-4 are connected to a plurality of outputs 960-9 through 960-12 of the hex D-type flip flop 960. A strobe input 958-14 is connected to the circuit ground potential to receive a "0" which enables the data selector/multiplexer. A select input 958-13 is connected to the $\overline{RESIR}$ line 504-7. When the $\overline{RESIR}$ signal is at "1", the signals at the inputs 958-5 through 958-8 will be generated at the outputs. When the $\overline{RESIR}$ signal is at "0", the signals at the inputs 958-1 through 958-4 will be generated and at the outputs 958-9 through 958-12 respectively.

The outputs 958-9 through 958-12 are connected to a plurality of inputs 959-1 through 959-4 respectively of a quadruple D-type flip flop 959. A clear input 959-10 is connected to the $\overline{INIT}$ line 532-4. A "1" to "0" transition at the clear input 959-10 will set the outputs to "0". A clock input 959-9 is connected to an output 951-3 of an OR 951. A "0" to "1" transition at the clock input 959-9 will place the signals at the inputs 959-1 through at the outputs 959-5 through 959-8 respectively.

An input 951-1 is connected to the inverter 939 and an input 951-2 is connected to an output 949-3 of an OR 949. If both inputs to the OR 951 are at "0", a "0" will be generated at the clock input 959-9 and if at least one of the inputs to the OR 951 is at "1", a "1" will be generated at the clock input 959-9. The inverter 939 may generate a "0"or a "1" as was previously discussed. The OR 949 has an input 949-1 connected to the output 921-3 of the NAND 921 and an input 949-2 connected to an output 948-3 of a NAND 948. If both of the inputs to the OR 949 are at "0", a "0"will be generated at the input 951-2 and if at least one of the inputs to the OR 949 is at "1", a "1" will be generated at the input 951-2. The NAND 921 may generate a "0"or a "1" as was previously discussed.

The NAND 948 has an input 948-1 connected to an output 946-3 of a NAND 946 and an input 948-2 connected to an output 947-3 of a NOR 947. If both inputs of the NAND 948 are at "1", a "0" will be generated at the input 949-2 and if at least one of the inputs is at "0", a "1" will be generated at the input 949-2. An input 946-1 is connected to the $\overline{ALU}$ line 531-9 and an input 946-2 is connected to the $\overline{INCDEC}$ line 531-13. If at least one of the inputs of the NAND 946 is at "0", a "1" will be generated at the input 948-1 and if both of the inputs are at "1", a "0" will be generated at the input 948-1. An input 947-1 is connected to the X line 537-8 and an input 947-2 is connected to the $\overline{M2CLK}$ line 533-14. If both inputs to the NOR 947 are at "0", a "1" will be generated at the input 948-2 and if at least one of the inputs is at "1", a "0" will be generated at the input 948-2.

The outputs 959-5 through 959-8 are connected to the output lines 535-9 through 535-12 and a plurality of inputs 960-3 through 960-6 respectively. A "0" to "1" transition at the clock input 959-9 will generate the CARRY flag signal on the line 535-9, the ZERO flag signal on the line 535-10, the SIGN flag signal on the line 535-11 and the OVER flag signal on the line 535-12. These flag signals are also applied to the inputs 960-3 through 960-6 of the hex D-type flip flop 960 which may be clocked as was previously discussed to generate the signals at the outputs 960-9 through 960-12 respectively.

FIG. 36 CONTROL/DISTRIBUTED ARBITRATOR AND CLOCK

FIG. 37 CLOCK PULSE TRAINS

Figure 36:
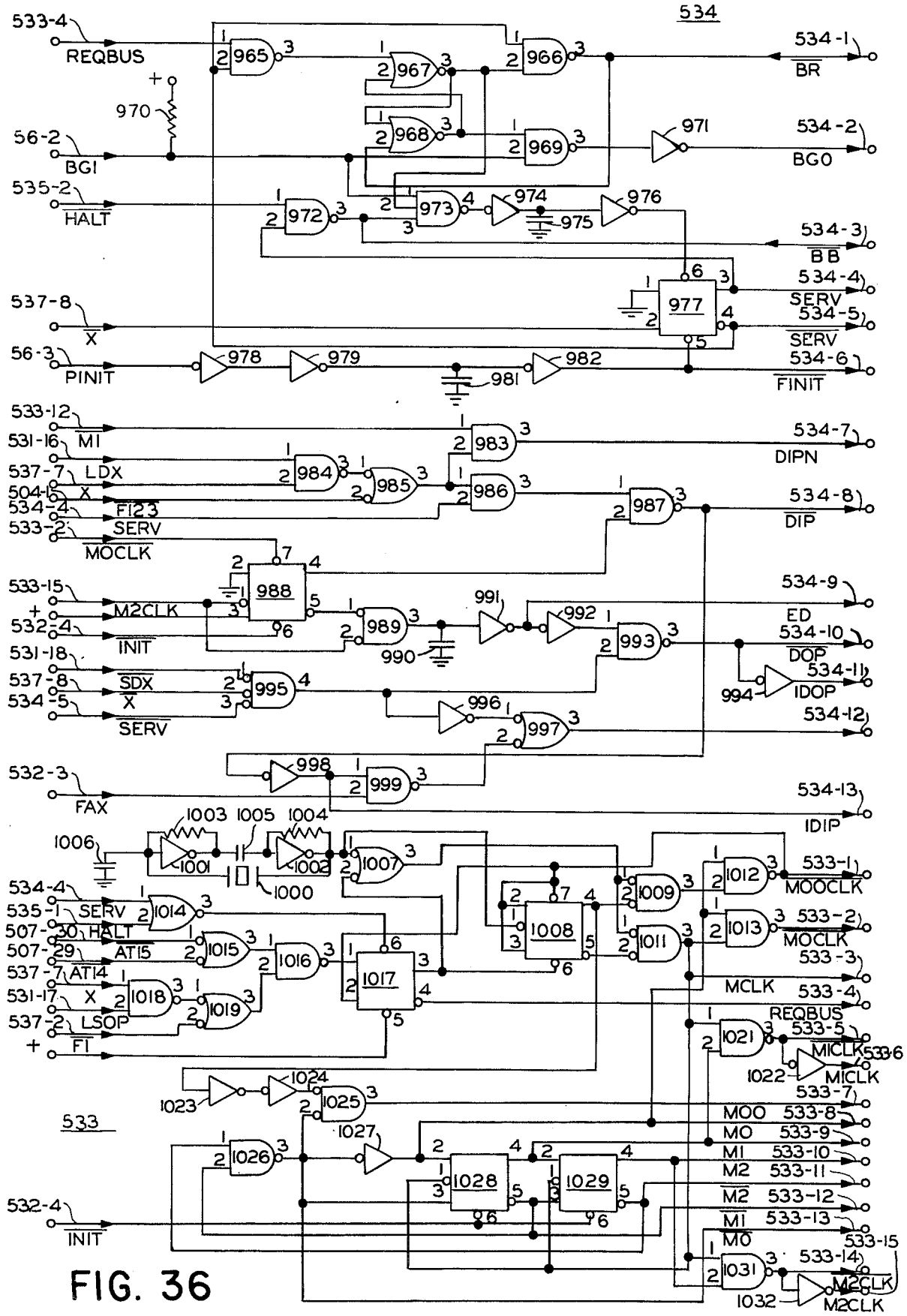
FIG. 36 is a schematic diagram of the bus control/-distributed arbitrator circuit and the clock circuit of FIG. 20.

FIG. 36 is a schematic diagram of the bus control/-distributed arbitrator (BC/DA) 534 and the clock (CK) 533. Where two or more devices are connected to a bus and may control the transfer of information on that bus, some form of bus arbitrator must be utilized to prevent more than one device from controlling the bus at any instant in time. Previous arbitration circuits have taken the form of a lumped arbitrator resident on the bus at all times which reads and stores requests for the bus and then grants the requests in a predetermined order. The present invention includes an arbitrator distributed among those devices which may control the bus.

The distributed arbitrator of FIG. 36 divides requests for the bus into two groups: the first request to occur, and all other requests. All the devices are connected in series or a chain so that if two or more requests occur simultaneously, the one nearest the head of the chain will be deemed to have occurred first. Once a first request has occurred, each distributed arbitrator assumes one of two states, requesting information or transmitting information. Each device in the transmitting state, beginning at the head of the chain, generates a bus grant out (BGO) signal to the next distributed arbitrator which receives that signal as a bus grant in (BGI) signal. The first distributed arbitrator in the requesting information state will inhibit its bus grant out (BGO) signal and when the bus is free, represented by a bus busy ($\overline{BB}$) signal at "0", that distributed arbitrator will assume control of the bus.

If only one device requests the bus at any time, then when it assumes control of the bus, the next bus request will be a first bus request. However, if another device has requested control as the first device is assuming control, there will be a cycle of bus grant signals up to the next device in the chain where a request exists. After a device has assumed control of the bus, any remaining requests will be granted before any new requests are allowed so that any devices which request the bus will assume control within a reasonable time.

Inputs to the distributed arbitrator are the REQBUS request for bus signal on the line 533-4 from the clock (CK) 533, the BGI bus grant in signal on the line 56-2 and the PINIT initial power up signal on the line 56-3 from the bus 56, the $\overline{HALT}$ signal on the line 535-2 from the flag generator (FG) 535 and the $\overline{X}$ state signal on the line 537-8 from the state counter (SC) 537. Outputs are the BGO bus grant out signal on the line 534-2 to the bus; the SERV signal on the line 534-4 to the bus control, the clock and the bus interface (BI) 504; the $\overline{SERV}$ signal on the line 534-5 to the file register/multiplexer control (FR/MC) 532 and to the bus control; and the $\overline{FINIT}$ processor initialize signal on the line 534-6 to the file register/multiplexer control. Signals which are both inputs and outputs are the $\overline{BR}$ bus request signal on the line 534-1 connected to the bus and the $\overline{BB}$ bus busy signal on the line 534-3 also connected to the bus.

When power is first applied to the system, the PINIT = "1" signal will be generated on the line 56-3. The "1" is changed to a "0" by an inverter 978 and is changed back to a "1" by an inverter 979 to charge a capacitor 981. The capacitor 981 delays the PINIT signal to allow the various circuits in the processor to respond to the application of the power. When the capacitor 981 has charged to a positive logic level potential, an inverter 982 will change its output from "1" to "0". The inverter output is connected to the line 534-6 to generate the $\overline{FINIT}$ signal and to a clear input 977-5 of a D-type flip flop 977. A "1" to "0" transition at the clear input 977-5 will set a non-inverting output 977-3 to "0" and an inverting output 977-4 to "1". The output 977-3 is connected to the line 534-4 to generate the SERV signal and the output 977-4 is connected to the line 534-5 to generate the $\overline{SERV}$ signal. The output 977-3 is also connected to an input 972-2 of a NAND 972 which has an output 972-3 connected to the line 534-3. When the flip flop 977 is cleared, a "0" is applied to the input 972-2 to generate a "1" at the output 972-3 which represents the absence of the $\overline{BB}$ bus busy signal on the line 534-3.

The REQBUS request for bus line 533-4 is connected to an input 965-1 of a NAND 965 having an output 965-3 connected to an input 967-1 of a NOR 967. If the processor has not generated a REQBUS signal, a "0" will be applied to the input 965-1 to generate a "1" at the input 967-1. The NOR 967 and a NOR 968 are cross coupled as a NOR flip flop. An output 967-3 is connected to an input 968-1 and an output 968-3 is connected to an input 967-2. With a "1" at the input 967-1, the NOR 967 will generate a "0" at the output 967-3 which is connected to an input 966-2 of a NAND 966. The NAND 966 will generate a "1" at output 966-3 which is connected to an input 968-2 of the NOR 968. With a "1" at the input 968-2, the NOR 968 will also generate a "0" to set the NOR flip flop in a stable state.

The output 966-3 is connected to line 534-1 such that the "1" generated by the NAND 966 represents the absence of the $\overline{BR}$ bus request signal. The output 968-3 is connected to an input 969-1 of a NAND 969 having an output 969-3 connected to the line 534-2 through an inverter 971. The "0" at the output 968-3 generates a "1" at the output 969-3 which is changed to a "0" to represent the absence of a BGO bus grant out signal on the line 534-2.

Assume now that the processor generates a REQBUS = "1" signal on the line 533-4. The output 977-4 of the flip flop 977 is connected to an input 965-2 to supply a "1". With both inputs at "1", the NAND 965 generates a "0" at the input 967-1 and since the input 967-2 is also at "0" from the output 968-3, the NOR 967 will generate a "1" at the input 966-2. The output 977-4 is also connected to an input 966-1 to supply a "1" and since both inputs are at "1", the $\overline{BR}$ signal will change from "1" to "0". This $\overline{BR}$ = "0" signal is applied to the $\overline{BR}$ input/output line for each device connected to the bus. The distributed arbitrator for the first device in the chain will have the $\overline{BR}$ = "0" signal applied to an input of its NOR flip flop similar to the input 968-2. Assuming that it has not received a REQBUS signal from its associated device, the NOR similar to the NOR 968 will generate a "1" to enable a NAND similar to the NAND 969. The NAND 969 has an input 969-2 connected to the BGI bus grant in line 56-2 which is connected to the BGO bus grant out line of the preceding distributed arbitrator. Since the first distributed arbitrator does not have a BGI bus grant in line, the input similar to the input 969-2 is connected to a positive polarity direct current power supply (not shown) through a resistor such as a resistor 970 to receive a "1" to generate a "0" at an output similar to the output 969-3. The "0" is inverted to a "1" BGO bus grant out signal which is received by the distributed arbitrator in the chain. The $\overline{BR}$ = "0" signal will set each distributed arbitrator in the chain into the transmitting state when the bus grant signal is received.

When the bus grant signal reaches the distributed arbitrator shown in FIG. 36, a "1" is applied to an input 973-1 of a NAND 973 which is connected to a BGI bus grant in line 56-2. An input 973-3 is connected to an output 972-3 of a NAND 972 having an input 972-2 connected to the output 977-3. Since the output 977-3 is at "0", a "1" will be generated at the input 973-3. When the output 967-3, which is connected to an input 973-2, changes from "0" to "1", a "0" is generated at an output 973-4 and is changed to a "1" by an inverter 974. The inverter 974 is connected to a preset input 977-6 of the flip flop 977 through an inverter 976. When the output of the inverter 974 changes from "1" to "0", the transition is delayed by a capacitor 975 connected between the output of the inverter 974 and the circuit ground potential. The delayed "0" to "1" transition is applied to the preset input 977-6 as a "1" to "0" transition to set the SERV signal at "1" and the $\overline{SERV}$ signal at "0". Since the output 977-3 is connected to the input 972-2 and the $\overline{HALT}$ line 535-2 is connected to an input 972-1, both inputs to the NAND 972 will be at "1" at the output 972-3 representing the $\overline{BB}$ bus busy signal on the line 534-3. The $\overline{BB}$ = "0" signal alerts other devices connected to the bus that some device has control of the bus by disabling the NAND in each distributed arbitrator similar to the NAND 973. The "0" from the output 977-4 is applied to the input 966-1 to generate a "1" on the line 534-1 representing the absence of a $\overline{BR}$ bus request signal. Now another distributed arbitrator can honor a REQBUS request for bus signal and will gain control of the bus when a BGI bus grant in signal is received.

The $\overline{X}$ signal line 537-8 is connected to a clock input 977-2 and a data input 977-1 is connected to the circuit ground potential to supply a "0". Therefore, each time the state counter generates the X = "0" state signal, the flip flop will be set to SERV = "0" and $\overline{SERV}$ = "1".

The bus control circuit of FIG. 36 has as inputs the clock signals $\overline{M1}$ on the line 533-12, $\overline{M0CLK}$ on the line 533-2 and M2CLK on the line 533-15 from the clock (CK) 533; the LDX signal on the line 531-16 and the $\overline{SDX}$ signal on the line 531-18 from the instruction decoder circuit (ID) 531; the X state signal on the line 537-7 and the $\overline{X}$ state signal on the line 537-8 from the state counter (SC) 537; the $\overline{F123}$ signal on the line 504-1 from the bus interface (BI) 504; the SERV signal on the line 534-4 and the $\overline{SERV}$ signal on the line 534-5 from the distributed arbitrator; and the $\overline{INIT}$ signal on the line 532-4 and the FAX signal on the line 532-3 from the file register/multiplexer control (FR/MC) 532. Outputs from the bus control are the $\overline{DIP}$ data input signal on the line 534-8 and the $\overline{DOP}$ data output signal on the line 534-10 to the bus; the DIPN Internal data signal on the line 534-7, the control signal on the line 534-12 and the IDIP internal data input signal on the line 534-13 to the bus interface (BI) 504; the ED external data signal on the line 534-9 to the bus latch temporary (BLT) 505; and the IDOP internal data output signal on the line 534-11 to the file register/multiplexer control (FR/MC) 532, the flag generator (FG) 535 and the bus interface (BI) 504.

The DIPN signal line 534-7 is connected to an output 983-3 of an AND 983 having an input 983-1 connected to the $\overline{M1}$ clock signal line 533-12 and an input 983-2 connected to an output 985-3 of an NAND 985. If both inputs to the AND 983 are at "1", a "1" will be generated at the output 983-3 as the DIPN signal on the line 534-7. An input 985-1 is connected to an output 984-3 of a NAND 984 and an input 985-2 is connected to the $\overline{F123}$ signal line 504-1. If either or both inputs of the NAND 985 are at "0", a "1" will be generated at the input 983-2. An input 984-1 of the NAND 984 is connected to the LDX signal line 531-16 and an input 984-2 is connected to the X signal line 537-7. If both the LDX and X signals are at "1", a "0" will be generated at the input 985-1.

The $\overline{DIP}$ signal line 534-8 is connected to an output 987-3 of a NAND 987 having an input 987-1 connected to an output 986-3 of an AND 986 and an input 987-2 connected to a non-inverting output 988-4 of a J-K flip flop 988. If both inputs to the NAND 987 are at "1", a "0" will be generated at the output 987-3 as the $\overline{DIP}$ signal on the line 534-8. The output 987-3 is also connected to the IDIP line 534-13 through an inverter 998 to generate the IDIP = "1" signal. The AND 986 has an input 986-1 connected to the output 985-3 of the NAND 985 and an input 986-2 connected to the SERV line 534-4. If both inputs to the AND 986 are at "1", a "1" will be generated at the input 987-1. The NAND 985 may generate a "1" as was previously described.

The J-K flip flop 988 has a J input 988-2 connected to the circuit ground potential to supply a "0" and a K input 988-3 connected to a positive polarity direct current power supply (not shown) to supply a "1". A clock input 988-1 is connected to the M2CLK clock signal line 533-15. When there is a "1" to "0" transition of the M2CLK clock signal, a "0" will be generated at the non-inverting output 988-4 and a "1" will be generated at an inverting output 988-5. A clear input 988-6 is connected to the $\overline{INIT}$ signal line 532-4 and a "1" to "0" transition of the $\overline{INIT}$ signal will set a "0" at the output 988-4 and a "1" at the output 988-5. A preset input 988-7 is connected to the $\overline{M0CLK}$ clock signal line 533-2 and a "1" to "0" transition of the $\overline{M0CLK}$ signal will generate a "1" at the output 988-4 and a "0" at the output 988-5.

The $\overline{DOP}$ signal line 534-10 is connected to an output 993-3 of a NAND 993 having an input 993-1 connected to an inverter 992 and an input 993-2 connected to an output 995-4 of a NOR 995. If both inputs to the NAND 993 are at "1", a "0" will be generated at the output 993-3 as the $\overline{DOP}$ signal on the line 534-10. The output 993-3 is also connected to the line 534-11 through an inverter 994 to generate the IDOP signal on the line 534-11. An inverter 991 and the inverter 992 are connected in series an output 989-3 of a NOR 989 and the input 993-1. A capacitor 990 is connected between the output 989-3 and the circuit ground potential. If both inputs to the NOR 989 are at "0", a "1" will be generated and delayed by the capacitor 990. The inverters 991 and 992 will generate the "1" at the input 993-1. The ED signal line 534-9 is connected between the inverters 991 and 992. If one of the inputs to the NOR 989 is at "1", a "1" will be generated as the ED signal on the line 534-9.

The NOR 989 has an input 989-1 connected to the output 988-5 of the flip flop 988 and input 989-2 connected to the M2CLK clock signal line 533-15. The flip flop 988 may generate a "0" or a "1" at the output 988-5 as was previously discussed. The NOR 995 has an input 995-1 connected to the $\overline{SDX}$ signal line 531-18, an input 995-2 connected to the X signal line 537-8 and an input 995-3 connected to the $\overline{SERV}$ signal line 534-5. If all the inputs to the NOR 995 are at "0", a "1" will be generated at the input 993-2.

The control signal line 534-12 is connected to an output 997-3 of a NAND 997 having an input 997-1 connected to the output 995-4 through an inverter 996 and an input 997-2 connected to an output 999-3 of a NAND 999. If one of the inputs to the NAND 997 is at "0", a "1" will be generated on the line 534-12 as the control signal. The NOR 995 may generate a "1" as was previously discussed. The "1" is changed to a "0" by the inverter 996. The NAND 999 has an input 999-1 connected to the output 987-3 through an inverter 998 and an input 999-2 connected to the FAX signal line 532-3 If both inputs to the NAND 999 are at "0", a "1" will be generated at the input 997-2. The NAND 987 may generate a "0" as was previously discussed. The "0" will be changed to a "1" by the inverter 998.

The clock (CK) 533 of FIG. 36 generates the various clock pulse trains which determine the timing of and sequence of operation of the processor. Inputs to the clock are the SERV signal on the line 534-4 from the bus control/distributed arbitrator (BC/DA) 534, the HALT signal on the line 535-1 from the flag generator (FG) 535, the $\overline{AT14}$ signal on the line 507-29 and the $\overline{AT15}$ signal on the line 507-30 from the A register (AR) 507, the X state signal on the line 537-7 and the $\overline{F1}$ state signal on the line 537-2 from the state counter (SC) 537, the LSOP signal on the line 531-17 from the instruction decoder circuit (ID) 531 and the $\overline{INIT}$ signal on the line 531-4 from the file register/multiplexer control (FR/MC) 532. Outputs from the clock are the clock signals $\overline{M00CLK}$ on the line 533-1, $\overline{M0CLK}$ on the line 533-2, MCLK on the line 533-3, $\overline{M1CLK}$ on the line 533-5, M1CLK on the line 533-6 M00 on the line 533-7, M0 on the line 533-8, M1 on the line 533-9, M2 on the line 533-10, $\overline{M2}$ on the line 533-11, $\overline{M1}$ on the line 533-12, $\overline{M0}$ on the line 533-13, $\overline{M2CLK}$ on the line 533-14 and M2CLK on the line 533-15 and the REQ-BUS request for bus signal on the line 533-4.

The clock (CK) 533 includes a crystal controlled oscillator which generates a basic frequency which is divided to obtain the clock signals. A pair of inverters 1001 and 1002 cooperate with a crystal 1000 to generate a train of clock pulses having a frequency "F" as shown in FIG. 37. The crystal 1000 has one lead connected to an input of the inverter 1001 and the other lead connected to an output of the inverter 1002. A resistor 1003 is connected between the input and an output of the inverter 1001 and a resistor 1004 is connected between an input and the output of the inverter 1002. A capacitor 1005 is connected between the output of the inverter 1001 and the input of the inverter 1002. Another capacitor 1006 is connected between the input to the inverter 1001 and the circuit ground potential.

The inverters 1001 and 1002 represent an amplifier and the crystal 1000 represents a feedback network of a free running squarewave oscillator. Assuming that the signal at the input of the inverter 1001 changes from a "0" to a "1", the output will change from a "1" to a "0". The capacitor 1005 is a direct current blocking capacitor which will pass the relatively high frequency signal transitions of the oscillator. Therefore, the signal at the input to the inverter 1002 will change from a "1" to a "0". This will change the output from a "0" to a "1". This change is coupled to the input of the inverter 1001 through the crystal 1000. As long as there is a positive feedback, the circuit will tend to oscillate at the resonant frequency of the crystal. The resistors 1003 and 1004 provide biasing for the inverters 1001 and 1002 respectively. The capacitor 1006 is utilized to surpress a tendency to oscillate for oscillation at mechanical overtone frequencies of the crystal. The output is a frequency stabilized squarewave basic clock pulse train which is applied to an input 1007-1 of a NAND 1007.

The inverse of the basic clock pulse train may be generated at an output 1007-3 of the NAND 1007 if an input 1007-2 is enabled with a "1". The input 1007-2 is connected to a non-inverting output 1017-3 of a D-type flip flop 1017 having a data input 1017-1 connected to an output 1016-3 of a NAND 1016, a clock input 1017-2 connected to the $\overline{\text{M00CLK}}$ clock signal line 533-1, a clear input 1017-5 connected to a positive polarity direct current power supply (not shown) to receive a "1" and a preset input 1017-6 connected to an output 1014-3 of a NOR 1014. A "1" will be generated at the output 1017-3 if there is a "1" at the data input 1017-1 and a "0" to "1" transition at the clock input 1017-2 or if there is a "1" to "0" transition at the preset input 1017-6.

The SERV line 534-4 is connected to an input 1014-1 and the HALT line 535-1 is connected to an input 1014-2. If both the SERV and HALT signals are at "0", a "1" will be generated at the preset input 1017-6. If one or both of the SERV and HALT signals change to "1", a "0" will be generated and the "1" to "0" transition will preset the output 1017-3 to "1" to enable the NAND 1007. When the NAND 1007 has been enabled, the $\overline{\text{M00CLK}}$ clock signal will be generated to clock the flip flop 1017. The "1" at the output 1017-3 will be maintained if at least one of the inputs to the NAND 1016 is at "0" to generate a "1" at the data input 1017-1. An input 1016-1 is connected to an output 1015-3 of a NAND 1015. The $\overline{\text{AT15}}$ line 507-30 is connected to an input 1015-1 and the $\overline{\text{AT14}}$ line 507-29 is connected to an input 1015-2. If both the $\overline{\text{AT14}}$ and $\overline{\text{AT15}}$ signals are at "1", a "0" will be generated at the input 1016-1. An input 1016-2 is connected to an output 1019-3 of a NAND 1019. An input 1019-1 is connected to an output 1018-3 of a NAND 1018 and an input 1019-2 is connected to the $\overline{\text{F1}}$ line 537-2. If both inputs to the NAND 1019 are at "1", a "0" will be generated at the input 1016-2. The X line 537-7 is connected to an input 1018-1 and the LSOP line 531-17 is connected to an input 1018-2. If either or both of the X and LSOP signals are at "0", a "1" will be generated at the input 1019-1.

The output 1007-3 is connected to a pair of inputs 1009-1 and 1011-1 of a pair of NORs 1009 and 1011 respectively. The output from the oscillator is connected to a clock input 1008-1 of a J-K flip flop 1009. A J input 1008-2, a K input 1008-3 and a preset input 1008-7 are connected to a positive polarity direct current power supply (not shown) to receive a "1". A clear 1008-6 is connected to the output 1017-3 to receive a "1" to enable the flip flop. The basic clock frequency at the clock input 1008-1 is divided by two at a non-inverting output 1008-4 and is inverted and divided by two at an inverting output 1008-5. The output 1008-4 is connected to an input 1009-2 of the NOR 1009 and the output 1008-5 is connected to an input 1011-2 of the NOR 1011. Since the NORs 1009 and 1011 will only generate a "1" if both inputs are at "0", the signal at an output 1009-3 will comprise a "1" pulse followed by three "0" pulses wherein the "1" pulse occurs at the same time as the first and each subsequent odd numbered "1" pulse in the basic clock pulse train. The signal at an output 1011-13 will also comprise a "1" pulse followed by three "0" pulses wherein the "1" pulse occurs at the same time as the second and each subsequent even numbered pulse in the basic clock pulse train. The output 1011-3 is connected to the line 533-3 to generate the MCLK clock signal which has a frequency of "F/2". The output 1009-3 is connected to an input 1012-2 of a NAND 1012 and the output 1011-3 is connected to an input 1013-2 of a NAND 1013. A pair of inputs 1012-1 and 1013-1 are connected to the M0 clock signal line 533-8 to generate the $\overline{\text{M00CLK}}$ clock signal at an output 1012-3 connected to the line 533-1 and the $\overline{\text{M0CLK}}$ clock signal at an output 1013-3 connected to the line 533-2. The $\overline{\text{M00CLK}}$ clock signal is a "1" interrupted by a "0" pulse occurring at the first "1" pulse of the basic pulse train and every sixth "1" pulse thereafter with a frequency of "F/6". The $\overline{\text{M0CLK}}$ clock signal is a "1" interrupted by a "0" pulse occurring at the second "1" pulse of the basic pulse train and every sixth "1" pulse thereafter with a frequency of "F/6". The $\overline{\text{M00CLK}}$, $\overline{\text{M0CLK}}$ and MCLK clock signals are shown in FIG. 37.

The output 1011-3 is also connected to an input 1021-1 of a NAND 1021 having another input 1021-2 connected to the M1 clock signal line 533-9 to receive the M1 clock signal. The NAND 1021 generates the $\overline{\text{M1CLK}}$ clock signal at an output 1021-3 connected to the line 533-5. The $\overline{\text{M1CLK}}$ pulse signal is a "1" interrupted by a "0" pulse at the fourth "1" pulse of the basic pulse train and every sixth "1" pulse thereafter with a frequency of "F/6". The output 1021-3 is connected to the line 533-6 through an inverter 1022 to generate the M1CLK clock signal. The M1CLK signal is a "0" interrupted by a "1" pulse at the fourth "1" pulse of the basic pulse train and every sixth "1" pulse thereafter with a frequency of "F/6". The M1CLK and $\overline{\text{M1CLK}}$ clock signals are shown in FIG. 37.

The output 1011-3 is also connected to an output 1031-1 of a NAND 1031 having another input 1031-2 connected to the M2 clock signal line 533-10 to receive the M2 clock signal. The NAND 1031 generates the $\overline{\text{M2CLK}}$ clock signal at an output 1031-3 connected to the line 533-14. The $\overline{\text{M2CLK}}$ pulse signal is at "1" interrupted by a "0" pulse at the sixth "1" pulse of the basic pulse train and every sixth "1" pulse thereafter with a frequency of "F/6". The ouput 1031-3 is connected to the line 533-15 through an inverter 1032 to generate the M2CLK clock signal. The M2CLK signal is a "0" interrupted by "1" pulse at the sixth "1" pulse of the basic pulse train and ever sixth "1" pulse thereafter with a frequency of "F/6". The $\overline{M2CLK}$ and M2CLK clock signals are shown in FIG. 37.

The output 1011-3 is also connected to a pair of clock input 1028-1 and 1029-1 of a pair of J-K flip flops 1028 and 1029 which are utilized to generate the M0 through M2 and $\overline{M0}$ through $\overline{M2}$ clock signals. The $\overline{INIT}$ line 532-4 is connected to a pair of clear inputs 1028-6 and 1029-6 wuch that when power is first applied to the processor, a "1" to "0" transition will be generated to set a pair of non-inverting outputs 1028-4 and 1029-4 at "0" and a pair of inverting outputs 1028-5 and 1029-5 and "1". The outputs 1028-5 and 1029-5 are connected to a pair of inputs 1026-2 and 1026-1 respectively of a NAND 1026. An output 1026-3 is connected to a J input 1028-2 through an inverter 1027 and to a K input 1028-3. Since both inputs are at "1", the NAND 1026 will generate a "1" at the J input 1028-2 and a "0" at the K input 1028-3. The output 1028-4 is connected to a J input 1029-2 to apply a "0" and the output 1028-5 is connected to a K input 1029-3 to apply a "1". When the $\overline{INIT}$ signal returns to "1", as shown in FIG. 37, the flip flops 1028 and 1029 are enabled to respond to the MCLK clock signal.

The first "1" to "0" transition of the MCLK clock signal will set the output 1028-4 to "1" and the output 1028-5 to "0". Since the output 1028-4 is connected to the line 533-9 and the output 1028-5 is connected to the line 533-12, the M1 and $\overline{M1}$ clock signals will change from "0" to "1" and from "1" to "0" respectively. The "0" at the output 1028-5 is applied to the input 1026-2 to change the output from the NAND 1026 from "0" to "1". Since the inverter 1027 is connected to the line 533-8 and the output 1026-3 is connected to the line 533-13, the M0 and $\overline{M0}$ clock signals will change from "1" to "0" and "0" to "1" respectively.

The second "1" to "0" transition of the MCLK clock signal will set the output 1029-4 to "1" and the output 1029-5 to "0". Since the output 1029-4 is connected to the line 533-10 and the output 1029-5 is connected to the line 533-11, the M2 and $\overline{M2}$ clock signals will change from "0" to "1" and "1" to "0" respectively. The second "1" to "0" transition of the MCLK clock signal will also set the output 1029-4 to "0" and the output 1028-5 to "1" since the M0 clock signal is "0" and the $\overline{M0}$ clock signal is "1" at the inputs to the flip flop 1028. Thus the M1 and $\overline{M1}$ clock signals will change from "1" to "0" and "0" to "1" respectively.

The third "1" to "0" transition of the MCLK clock signal will set the output 1029-4 to "0" and the output 1029-5 to "1" to change the M2 and $\overline{M2}$ clock signals from "1" to "0" and "0" to "1" respectively. Now both the M1 and $\overline{M2}$ clock signals are at "1" to change the M0 and $\overline{M0}$ clock signals from "0" to "1" and "1" to "0" respectively. Each successive group of three "1" to "0" transitions of the MCLK clock signal will generate another cycle of the M0 through M2 and $\overline{M0}$ through $\overline{M2}$ clock signals as was described above. These clock signals are shown in FIG. 37 and each has a frequency of "F/6".

The output 1008-4 of the flip flop 1008 is connected to an input 1025-1 of a NOR 1025 through a pair of inverters 1023 and 1024. The ouput 1026-3 of the NAND 1026 is connected to an input 1025-2 to supply the $\overline{M0}$ clock signal. The NOR 1025 will generate the M00 clock signal to an output 1025-3 connected to the line 533-7. The NOR 1025 will generate a "1" only when both inputs are at "0". Since the signal generated at the output 1008-4 corresponds to the basic clock frequency divided by two ("f/2"), both inputs to the NOR 1025 will be at "0" during the first "1" pulse and each sixth "1" pulse thereafter and the sixth "0" pulse and each sixth "0" pulse thereafter of the basic clock frequency. The M00 clock signal is shown in FIG. 37 and has a frequency of "F/6".

An inverting output 1017-5 of the flip flop 1017 is connected to the line 533-4 to generate the REQBUS signal. When the flip flop 1017 is preset or when a "1" is applied to the data input 1017-1 and there is a "0" to "1" transition of the $\overline{M00CLK}$ clock signal, a "0" will be generated to represent the absence of the REQBUS signal. If a "0" is present at the data input 1017-1, when there is a "0" to "1" transition, a REQBUS = "1" signal will be generated.

FIG. 38 STATE COUNTER

FIG. 38 is a schematic diagram of the state counter (SC) 537 which generates the state signals to the various elements of the processor. Inputs to the state counter are the $\overline{TRAP}$ signal on the line 531-4, the $\overline{JC}$ signal on the line 531-6, the ALU signal on the line 531-8, the ILLOP signal on the line 531-19, the FLAG signal on the line 531-1, the $\overline{LSX}$ signal on the 531-11 and the $\overline{INCDEC}$ signal on the line 531-13 from the instruction decoder circuit (ID) 531; the $\overline{HALT}$ signal on the line 535-2, the CARRY signal on the line 535-9, the ZERO signal on the line 535-10, the SIGN signal on the line 535-11, the OVER signal on the line 535-12, the FBO signal on the line 535-7 and the FB1 signal on the line 535-5 from the flag generator (FG) 535; the IR0 through IR3 instruction signal bits on the lines 506-1 through 506-4 from the instruction register (IR) 506; the $\overline{M2CLK}$ clock signal on the line 533-14 from the clock (CK) 533; and the $\overline{INIT}$ signal on the line 532-4 from the file register/multiplexer control (FR/MC) 532. Outputs from the state counter are the F1 and $\overline{F1}$ state signals on the lines 537-1 and 537-2 respectively, the F2 and $\overline{F2}$ state signals on the lines 537-3 and 537-4 respectively, the F3 and $\overline{F3}$ state signals on the lines 537-5 and 537-6 respectively, the X and $\overline{X}$ state signals on the lines 537-7 and 537-8 respectively and the BUSY signal on the line 537-9.

The state signals are generated in a predetermined order according to the requirements of the present instruction which is one of the instructions shown in the table of FIG. 19. All instructions begin in the F1 state with the generation of the F1 = "1" and $\overline{F1}$ = "0" state signals. The $\overline{INIT}$ line 532-4 is connected to a plurality of clear inputs 1044-5, 1052-5, 1056-5 and 1064-5 of a plurality of D-type flip flops 1044, 1052, 1056 and 1064 respectively. When power is first applied to the processor, a "1" to "0" transition will clear the flip flops. Therefore, a plurality of non-inverting outputs 1044-3, 1052-3, 1056-3 and 1064-3 will be set at "0" and a plurality of inverting outputs 1044-4, 1052-4, 1056-4 and 1064-4 will be set at "1".

If the $\overline{HALT}$ signal is at "0", the state counter will be disabled. The output 1044-3 is connected to an input 1042-1 of a NAND 1042 having an output 1042-3 connected to an input 1043-1 of a NAND 1043. Since the output 1044-3 is at "0", a "1" is generated at the input 1043-1. The $\overline{HALT}$ line 535-2 is connected to an input 1045-2 of a NAND 1045 having an output 1045-3 connected to an input 1043-2. Since $\overline{HALT}$ = "0", a "0" will be generated at the input 1043-2. The $\overline{HALT}$ line 535-2 is also connected to an input 1046-1 of a NAND 1046 having an output 1046-3 connected to an input 1043-3. Since $\overline{HALT}$ = "0", a "0" will be generated at the input 1043-3. The output 1056-3 is connected to an input 1049-2 of a NAND 1049 having an output 1049-3 connected to an input 1043-4. Since the output 1056-3 is set at "0", a "1" will be generated at the input 1043-4. With all its inputs at "1", the NAND 1043 will generate a "0" at an output 1043-5 which is connected to a data input 1044-1. The $\overline{M2CLK}$ clock signal line 533-14 is connected to a clock input 1044-2 such that each time a "0" to "1" transition occurs, the "0" at the input 1044-1 is set an the output 1044-3 and is inverted to a "1" which is set at the output 1044-4 to maintain the F1 = "0" signal on the line 537-1 connected to the output 1044-3 and the $\overline{F1}$ = "1" signal on the line 537-2 connected to the output 1044-4. Since the generation of each of the F2, F3 and X states depends directly or indirectly on the generation of the F1 state, the state counter is disabled.

When the $\overline{HALT}$ signal is at "1", the F1 state will be generated. An input 1045-1 of the NAND 1045 is connected to an output 1065-5 of a NAND 1065 through an inverter 1066. The output 1044-4 connected to an input 1065-1, the output 1052-4 is connected to an input 1065-2, the output 1056-4 is connected to an input 1065-3 and the output 1064-4 is connected to an input 1065-4. Since inverting outputs of the flip flops have been initially set to "1", the NAND 1065 will generate a "0" which is changed to a "1" at the input 1045-1. Since both inputs are at "1", the NAND 1045 will generate a "0" at the input 1043-2 and the NAND 1043 will generate a "1" at the input 1044-1. The next "0" to "1" transition of the $\overline{M2CLK}$ clock signal which occurs will set $\overline{F1}$ = "1" and F1 = "0" to generate the F1 state.

The output 1065-5 is also connected to the line 537-9 to generate the BUSY signal. When all the inputs are at "1", the NAND 1065 will generate a "0" to indicate the absence of the BUSY signal. When one of the states is generated, the corresponding input will be at "0" to generate the BUSY = "1" signal indicating that the processor is in one of the states.

According to the previous instruction, the state counter may be required to generate the F1 state for the next instruction after having generated the F1 state or the F3 state or the X state. The return of the F1 state from the F1 state is determined by the $\overline{TRAP}$ decoded instruction signal and one of the flag signals from the flag generator (FG) 535. An input 1042-2 of the NAND 1042 is connected to an output 1041-3 of a NOR 1041. The $\overline{TRAP}$ signal line 531-4 is connected to an input 1041-1 and an input 1041-2 is connected to an output 1054-3 of an exclusive-OR 1054. If both inputs to the NAND 1042 are at "1", a "0" will be generated at the input 1043-1 and a "1" will be generated at the input 1044-1 to maintain the F1 = "1" and $\overline{F1}$ = "0" state signals when the next "0" to "1" transition of the $\overline{M2CLK}$ clock signal occurs. Since F1 = "1", the input 1042-1 is at "1". The NOR 1041 will generate a "1" if both inputs are at "0". The exclusive-OR 1054 will generate a "0" if the signals at both its inputs are the same.

An input 1054-1 is connected to a non-inverting output 1053-13 of a data selector/multiplexer 1053. The IR0 through IR2 lines 506-1 through 506-3 are connected to a plurality of address inputs 1053-9 through 1053-11 respectively. A signal at one of a plurality of inputs 1053-1 through 1053-8 will be placed at the output 1053-13 when the input is selected according to the binary address at the address inputs and a strobe input 1053-14 is connected to the circuit ground potential. For example, when the IRO through IR2 instruction signal bits are at "0", the input 1053-1 will be selected and when they are at "1" the input 1053-8 will be selected. The input 1053-1 is connected to the CARRY line 535-9, the input 1053-2 is connected to the ZERO line 535-10, the input 1053-3 is connected to the SIGN line 535-11, the input 1053-4 is connected to the OVER line 535-12, the input 1053-5 is connected to the FB0 line 535-7 and the input 1053-6 is connected to the FB line 535-5. The IR3 line 506-4 is connected to an input 1054-2. If the selected flag signal is the same as the IR3 instruction signal bit, the exclusive-OR 1054 will generate a "0" to the NOR 1041 to place both of its inputs at "0". The TRAP instruction is the only instruction for which $\overline{TRAP}$ may be at "0" such that the F2, F3 and X states may be bypassed.

The return to the F1 state from the F3 state is determined by the JC decoded instruction signal and one of the flag signals. An input 1049-1 of the NAND 1049 is connected to an output 1047-3 of a NOR 1047. The JC signal line 531-6 is connected to an input 1047-1 and an input 1047-2 is connected to the output 1054-3. If both inputs to the NAND 1049 are at "1", a "0" will be generated at the input 1043-4 and a "1" will be generated at the input 1044-1 to set the F1 signal at "1" and the $\overline{F1}$ signal at "0" when the next "0" to "1" transition of the $\overline{M2CLK}$ clock signal occurs. Since F3 = "1" state, the input 1049-2 is at "1". The NOR 1047 will generate a "1" if both inputs are at "0". The exclusive-OR 1054 will generate a "0" as was previously discussed. The JUMP and CALL instructions are the only instructions for which $\overline{JC}$ may be at "0" such that after the F3 state the X state may be bypassed.

The return to the F1 state from the X state will occur if the $\overline{HALT}$ signal remains at "1". An input 1046-2 is connected to the output 1064-3. Since X = "1" during the X state, both inputs to the NAND 1046 will be at "1" to generate a "0" at the input 1043-3. The NAND 1043 will generate a "1" to set the F1 signal at "1" and the $\overline{F1}$ signal at "0" when the next "0" to "1" transition of the $\overline{M2CLK}$ clock signal occurs.

The F2 state may be generated only after the F1 state has been generated. A data input 1052-1 of the flip flop 1052 is connected to an output 1051-4 of a NOR 1051. A clock input 1052-2 is connected to the $\overline{M2CLK}$ clock signal line 533-14. If all the inputs to the NAND 1051 are at "0", a "1" will be generated at the input 1052-1. The F2 signal will be set to "1" and the $\overline{F2}$ signal will be set to "0" when the next "0" to "1" transition of the $\overline{M2CLK}$ clock signal occurs to generate the F2 state. The output 1052-3 is connected to the line 537-3 and the output 1052-4 is connected to the line 537-4.

An input 1051-1 is connected to the ouput 1044-4 to receive a "0" during the generation of the F1 state. An input 1051-2 is connected to the output 1041-3 to receive a "0" if at least one of the inputs to the NOR 1041 is at "1". The $\overline{TRAP}$ signal will be at "1" for all instructions other than the TRAP instruction. An input 1051-3 is connected to an output 1058-4 of a NAND 1058 which will generate a "0" if all of its inputs are at "1". An input 1058-1 is connected to an output 1057-3 of a NOR 1057. An input 1057-1 is connected to the ILLOP line 531-19 and an input 1057-2 is connected to the FLAG line 531-1. If either or both the ILLOP and FLAG signals are at "0", a "1" will be generated at the input 1058-1. An input 1058-2 is connected to the $\overline{LSX}$ line 531-11 and an input 1058-3 is connected to the $\overline{INCDEC}$ line 531-13. The FLAG signal will be "0" if the instruction is not a FLAG instruction, the $\overline{LSX}$ signal will be "1" if the instruction is not a LOAD INDEXED instruction or a STORE INDEXED instruction and the $\overline{INCDEC}$ signal will be "1" if the instruction is not an INC/DEC instruction.

The F3 state may be generated only after the F2 state has been generated. A data input 1056-1 is connected to an output 1055-3 of a NOR 1055. A clock input 1056-2 is connected to the $\overline{M2CLK}$ clock signal line 533-14. If both the inputs to the NOR 1055 are at "0", a "1" will be generated at the input 1056-1. The F3 signal will be set to "1" and the $\overline{F3}$ signal will be set to "0" when the next "0" to "1" transition of the $\overline{M2CLK}$ clock signal occurs to generate the F3 state. The output 1056-3 is connected to the line 537-5 and the ouput 1056-4 is connected to the line 537-6. An input 1055-1 is connected to the output 1052-4 to receive a "0" during the generation of the F2 state. An input 1055-2 is connected to the ALU line 531-8 to receive a "0" if the instruction is not an ALU instruction.

The X state may be generated after any of the other states have been generated. A data input 1064-1 is connected to an output 1063-4 of a NAND 1063. A clock input 1064-3 is connected to the $\overline{M2CLK}$ clock signal line 533-14. If any of the inputs to the NAND 1063 are at "0", a "1" will be generated at the input 1064-1. The X signal will be set to "1" and the $\overline{X}$ signal will be set to "0" when the next "0" to "1" transition of the $\overline{M2CLK}$ clock signal occurs to generate the X state. The output 1064-3 is connected to the line 537-7 and the output 1064-4 is connected to the line 537-8.

An input 1063-1 is connected to an output 1059-3 of a NAND 1059. If both inputs of the NAND 1059 are at "1", a "0" will be generated at the input 1063-1. An input 1059-1 is connected to the output 1056-3 to receive a "1" during the generation of the F3 state. An input 1059-2 is connected to the output 1047-3 of the NOR 1047 through an inverter 1048. The NOR 1047 will generate a "1" as was previously described, but will generate a "0" for all other instructions. With both inputs to the NAND 1059 at "1", the X state will be generated after the F3 state.

An input 1063-2 is connected to an output 1061-3 of a NAND 1061. If both inputs to the NAND 1061 are at "1", a "0" will be generated at the input 1063-2. An input 1061-1 is connected to the output 1052-3 to receive a "1" during the generation of the F2 state. Another input 1061-2 is connected to the ALU signal line 531-8 to receive a "1" if the current instruction is an ALU instruction. With both inputs to the NAND 1061 at "1", the X state will be generated after the F2 state.

An input 1063-3 is connected to an output 1062-3 of a NAND 1062. If both inputs to the NAND 1062 are at "1", a "0" will be generated at the input 1063-3. An input 1062-1 is connected to an output 1044-3 to receive a "1" during the generation of the F1 state. An input 1062-2 is connected to the output 1058-4 of the NAND 1058. The NAND 1058 will generate a "0" as was previously described and a "1" for all other instructions. With both inputs to the NAND 1062 at "1", the X state will be generated after the F1 state.

The state counter (SC) 537 determines the timing and the sequence of the F1, F2, F3 and X states for each program instruction according to the signals from the instruction decoder, the flag generator and the instruction register. The state signals are utilized to enable the various circuits of the processor to operate on data in accordance with the program instructions shown in Table I of FIG. 19.

FIG. 39 ADDRESS MULTIPLEXER

Figure 39:
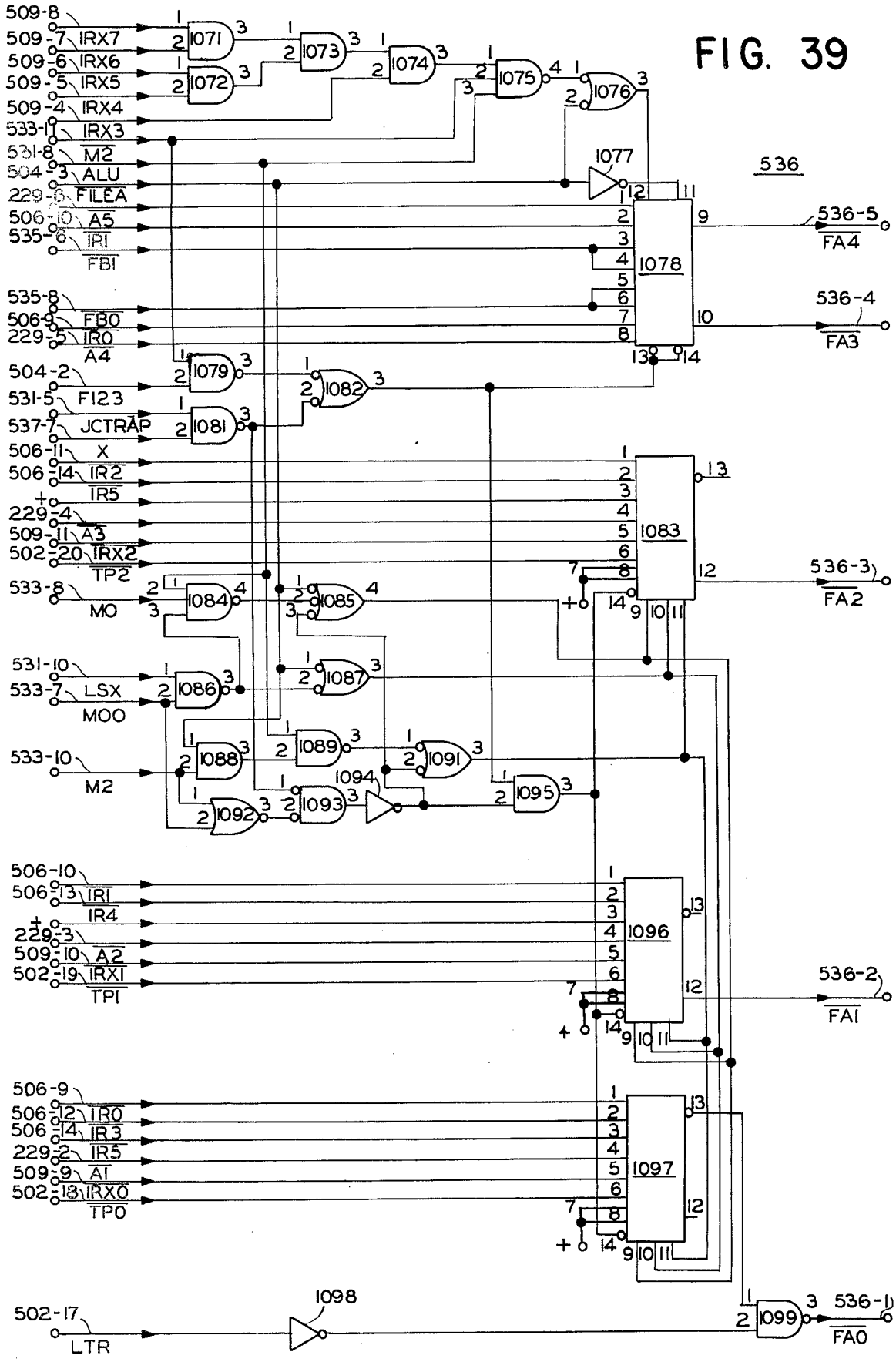
FIG. 39 is a schematic diagram of the address multiplexer circuit of FIG. 20.

FIG. 39 is a schematic diagram of the address multiplexer (AM) 536 which generates the $\overline{FA0}$ through $\overline{FA4}$ memory address signals to the file register (FR) 536. Inputs to the address multiplexer are the $\overline{IRX0}$ through $\overline{IRX2}$ signals on the lines 509-9 through 509-11 and the IRX3 through IRX7 signals on the lines 509-4 through 509-8 from the instruction register extended (IRX) 509; the clock signals $\overline{M2}$ on the line 533-11, M0 on the line 533-8, M00 on the line 533-7 and M2 on the line 533-10 from the clock (CK) 533; the ALU signal on the line 531-8, the JCTRAP signal on the line 531-5 and the LSX signal on the line 531-10 from the instruction decoder circuit (D) 531; the $\overline{FILEA}$ signal on the line 504-3, the $\overline{A1}$ through $\overline{A5}$ signals on the lines 229-2 through 229-6 respectively and the F123 signal on the line 504-2 from the bus interface (BI) 504; the $\overline{IR0}$ through $\overline{IR5}$ signals on the lines 506-9 through 506-14 respectively from the instruction register (IR) 506; the $\overline{FB1}$ signal on the line 535-6 and the $\overline{FB0}$ signal on the line 535-8 from the flag generator (FG) 535; the X state signal on the line 537-7 from the state counter (SC) 537; and the $\overline{TP0}$ through $\overline{TP2}$ signals on the lines 502-18 through 502-20 respectively and the LTR signal on the line 502-17 from the file register (FR) 502. Outputs from the address multiplexer are the $\overline{FA0}$ through $\overline{FA4}$ signals on the lines 536-1 through 536-5 respectively to the file register.

The $\overline{FILEA}$ line 504-3 is connected to an address input 1078-11 of a four line to one line data selector/multiplexer 1078 through an inverter 1077. A second address input 1078-12 is connected to an output 1076-3 of a NAND 1076. The combination of signals at the address inputs determines which one of the signals at a plurality of inputs 1078-1 though 1078-4 is placed at an output 1078-9 and which one of the signals at a plurality of inputs 1078-5 through 1078-8 is placed at an output 1078-10 when a pair of strobe inputs 1078-13 and 1078-14 are at "0". The output 1078-9 is connected to the line 536-5 to generate the $\overline{FA4}$ signal and the output 1078-10 is connected to the line 536-4 to generate the $\overline{FA3}$ signal.

The $\overline{FILEA}$ line 504-3 is also connected to an input 1076-2 of the NAND 1076. When the $\overline{FILEA}$ signal is at "1", the NAND 1076 will be enabled and the inverter 1077 will placed a "0" at the address input 1078-11. If both inputs to the NAND 1076 are at "1", a "0" will be generated at the address input 1078-12 to select the input 1078-4 which is connected to the $\overline{FB1}$ line 535-6 and the input 1078-5 which is connected to the $\overline{FB0}$ line 535-8. An input 1076-1 is connected to an output 1075-4 of a NAND 1075 which will generate a "1" if any one or more of its inputs is at "0". An input 1075-1 is connected to an output 1074-3 of an AND 1074, an input 1075-2 is connected to the $\overline{M2}$ clock signal line 533-11 and an input 1075-3 is connected to the ALU line 531-8. The AND 1074 will generate a "0" if either one or both of its inputs are at "0". An input 1074-1 is connected to an output 1073-3 of an AND 1073 and an input 1074-2 is connected to the IR3 line 509-4. The AND 1073 will generate a "0" if either or both of its inputs are at "0". An input 1073-1 is connected to an output 1071-3 of an AND 1071 and an input 1073-2 is connected to an output 1072-3 of an AND 1072. The AND 1071 has an input 1071-1 connected to the IRX7 line 509-8 and an input 1071-2 connected to the IRX6 line 509-7 and will generate a "0" if either or both IRX6 and IRX7 signals are "0". The AND 1072 has an input 1072-1 connected to the IRX5 line 509-6 and an input 1072-2 connected to the IRX4 line 509-5 and will generate a "0" if either or both the IRX4 and IRX5 signals are at "0".

If the $\overline{\text{FILEA}}$ signal is at "1" and the output 1076-3 is at "1", the input 1078-2 which is connected to the $\overline{\text{IR1}}$ line 506-10 and the input 1078-7 which is connected to the $\overline{\text{IR0}}$ line 506-9 will be selected. Since the $\overline{\text{FILEA}}$ signal at the input 1076-2 is at "1", the NAND 1075 must generate a "0". In order to generate a "0", all of the inputs to the NAND 1075 must be at "1". A "1" will be generated at the input 1075-1 only if the IRX3 through IRX7 signals are at "1". Therefore, when the $\overline{\text{FILEA}}$ signal is at "1", the NAND 1076 will generate a "1" if the ALU, $\overline{\text{M2}}$ and IRX3 through IRX7 signals are at "1" and will generate a "0" if any one of those signals is at "0".

When the $\overline{\text{FILEA}}$ signal is at "0", the inverter 1077 will place a "1" at the address input 1078-11 and the NAND 1076 will place a "1" at the address input 1078-12 to select the input 1078-1 which is connected to the $\overline{\text{A5}}$ line 229-6 and the input 1078-8 which is connected to the $\overline{\text{A4}}$ line 229-5. The inputs 1078-3 and 1078-6 are not selected and are connected to the inputs 1078-4 and 1078-5 respectively.

The strobe inputs 1078-13 and 1078-14 are connected to an output 1082-3 of a NAND 1082. If both inputs are at "1", the NAND 1082 will generate a "0" to enable the data selector/multiplexer 1078. An input 1082-1 is connected to an output 1079-3 of a NAND 1079 having an input 1079-1 connected to the $\overline{\text{M2}}$ line 533-11 and an input 1079-2 connected to the F123 line 504-2. If either or both of the $\overline{\text{M2}}$ and F123 signals are at "0", a "1" is generated at the input 1082-1. An input 1082-2 is connected to an output 1081-3 of a NAND 1081 having an input 1081-1 connected to the JCTRAP line 531-5 and an input 1081-2 connected to the X line 537-7. If either or both of the JCTRAP and X signals are at "0", a "1" is generated at the input 1082-2. The data selector/multiplexer 1078 can be disabled to generate a "0" at the outputs 1078-9 and 1078-10 if the NAND 1082 generates a "1". The NAND 1082 will generate a "1" if either or both inputs of either or both NANDs 1079 and 1081 are at "0".

A non-inverting output 1083-12 of a data selector/-multiplexer 1083 is connected to the line 536-3 to generate the FA2 signal, a non-inverting output 1096-12 of a data selector/multiplexer 1096 is connected to the line 536-2 to generate the $\overline{\text{FA2}}$ signal and an inverting output 1097-13 of a data selector/multiplexer 1097 is connected to the line 536-1 through a NAND 1099 to generate the $\overline{\text{FA1}}$ signal. The output 1082-3 of the NAND 1082 is connected to an output 1095-1 of an AND 1095 having an output 1095-3 connected to a plurality of strobe inputs 1083-14, 1096-14 and 1097-14. If the NAND 1082 generates a "0" to enable the data selector/multiplexer 1078, the AND 1095 will generate a "0" to enable the data selectors/multiplexer 1083, 1096 and 1097. If the NAND 1082 generates a "1", the AND 1095 will generate the signal applied to an input 1095-2.

The input 1095-2 is connected to an output 1093-3 of a NOR 1093 through an inverter 1094. The NOR 1093 will generate a "1" if both inputs are at "0" and will generate a "0" for any other combination of input signals. An input 1093-1 is connected to the output 1081-3 of the NAND 1081 which may generate a "0" or a "1" as was previously disucssed. An input 1093-2 is connected to an output 1092-3 of a NOR 1092. An input 1092-1 is connected to the M2 line 533-10 and an input 1092-2 is connected to the M00 line 533-7. If both the M2 and M00 signals are at "0", a "1" will be generated at the input 1093-2. If one or both of the M2 and M00 signals are at "1", a "0" will be generated at the input 1093-2.

Each of the data selector/multiplexers 1083, 1096 and 1097 has three address inputs which are utilized to select one of eight input signals to be placed at an output. An output 1085-4 of a NAND 1085 is connected to the address inputs 1083-9, 1096-9 and 1097-9; an output 1087-3 of a NAND 1087 is connected to the address inputs 1083-10, 1096-10 and 1097-10; and an output 1091-3 is connected to the address inputs 1083-11, 1096-11 and 1097-11. A "0" at all the address inputs will select the inputs 1083-1, 1096-1 and 1097-1. A "1" at the -9 inputs and a "0" at the other inputs will select the inputs 1083-2, 1096-2 and 1097-2. Therefore, the signals at the address inputs represent the binary coded address for the input -1 through -8 respectively.

The NAND 1085 will generate a "0" if all inputs are at "1" and a "1" for all other input signal combinations. An input 1085-1 is connected to the $\overline{\text{FILEA}}$ line 504-3, an input 1085-2 is connected to an output 1084-4 of a NAND 1084 and an input 1085-3 is connected to the inverter 1094. The NAND 1084 will generate a "0" if all inputs are at "1" and a "1" for any other input signal combination. An input 1084-1 is connected to the ALU line 531-8, an input 1084-2 is connected to the M0 line 533-8 and an input 1084-3 is connected to an output 1086-3. The NAND 1086 has an input 1086-1 connected to the LSX line 531-10 and an input 1086-2 connected to the M00 line 533-7. If both the LSX and M00 signals are at "1", a "0" will be generated and a "1" will be generated for any other combinations of input signals. An input 1085-3 is connected to the inverter 1094 and may receive a "0" or a "1" as was previously discussed.

The NAND 1087 will generate a "0" if both inputs are at "1" and will generate a "1" for any other combination of input signals. An input 1087-1 is connected to the $\overline{\text{FILEA}}$ line 504-3. An input 1087-2 is connected to the output 1086-3 of the NAND 1086 which may generate a "0" or a "1" as was previously discussed.

The NAND 1091 will generate a "0" if both inputs are at "1" and will generate a "1" for any other combination of input signals. An input 1091-1 is connected to an output 1089-3 of a NAND 1089 which will generate a "0" if both inputs are at "1" and will generate a "1" if one or both inputs are at "0". An input 1089-1 is connected to the ALU line 531-8. An input 1089-2 is connected to an output 1088-3 of an AND 1088. The AND 1088 will generate a "1" if both inputs are at "1" and a "0" if one or both inputs are at "0". An input 1088-1 is connected to the $\overline{\text{FILEA}}$ line 504-3 and an input 1088-2 is connected to the M2 line 533-10. An input 1091-2 of the NAND 1091 is connected to the inverter 1094 and may receive a "0" or a "1" as was previously discussed.

The output 1097-13 is connected to an input 1099-1 of the NAND 1099 which has an output 1099-3 connected to the line 536-1. An input 1099-2 is connected to the LTR 502-17 through an inverter 1098. If the LTR signal is at "0". the NAND 1099 will be enabled to place the inverted output signal from the data selector/multiplexer 1097 on the line 536-1 as the $\overline{\text{FA0}}$ signal.

The inputs 1083-1, 1096-1 and 1097-1 are connected to the $\overline{IR2}$ line 506-11, the $\overline{IR1}$ line 506-10 and the $\overline{IR0}$ line 506-9 respectively. The inputs 1083-2, 1096-2 and 1097-2 are connected to the $\overline{IR5}$ line 506-14, the $\overline{IR4}$ line 506-13 and the $\overline{IR3}$ line 506-12 respectively. The inputs 1083-3 and 1096-3 are connected to a positive polarity direct current power supply (not shown) to receive a "1" and the input 1097-3 is connected to the $\overline{IR5}$ line 506-14. The inputs 1083-4, 1096-4 and 1097-4 are connected to the $\overline{A3}$ line 229-4, the $\overline{A2}$ line 229-3 and the $\overline{A1}$ line 229-2 respectively. The inputs 1083-5, 1096-5 and 1097-5 are connected to the $\overline{IRX2}$ line 509-11, the $\overline{IRX1}$ line 509-10 and the $\overline{IRX0}$ line 509-9 respectively. The 1083-6, 1096-6 and 1097-6 inputs are connected to the $\overline{TP2}$ line 502-20, the $\overline{TP1}$ line 502-19 and the $\overline{TP0}$ line 502-18 respectively. The inputs 1083-7, 1083-8, 1096-7, 1096-8, 1097-7 and 1097-8 are connected to a positive polarity direct current power supply (not shown) to receive a "1".

The address multiplexer (AM) 536 generates the FA0 through FA4 memory address signals to the file register to select one of sixteen four bit memory locations in each of eight memories. Since the file register has circuitry which permits only one of two groups of four memories each to respond to the address signals, a sixteen bit word may be written into or read out of the file register at the selected locations.

FIG. 40 MULTI-CAR SUPERVISOR CIRCUIT

Figure 40:
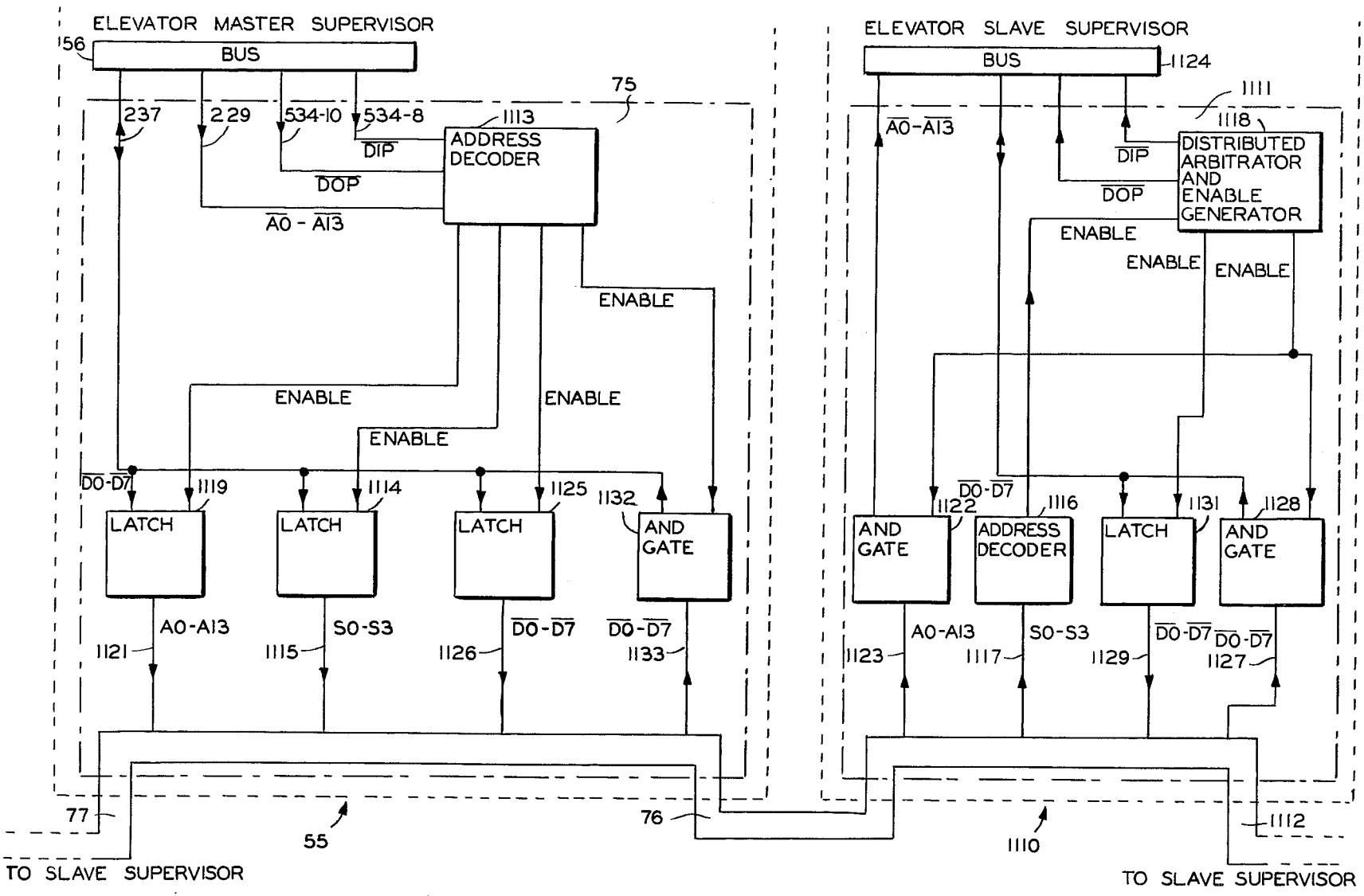
FIG. 40 is a block diagram of the master and slave multi-car supervisor circuits which may be used with the control circuits of FIG. 3.

FIG. 40 is a block diagram of the multi-car supervisor circuits for a two car elevator system. The master multi-car supervisor circuit 75 of FIG. 3 is connected to the bus 56 of the supervisor 55 which is designated as the elevator master supervisor. The processor (not shown) of the master supervisor is designated as the master processor and is programmed to allot the system hall calls to slave processors in the slave supervisors through their associated multi-car supervisor circuits and the bi-directional lines 76 and 77 connecting the master supervisor to the slave supervisors. A slave supervisor 1110 is shown as having a slave multi-car supervisor circuit 1111 connected to the master multi-car supervisor circuit 75 through the bi-directional lines 76. The slave supervisor 1110 may be connected to another slave supervisor (not shown) by the bi-directional lines 1112 and the master multi-car supervisor circuit 75 may be connected to another slave supervisor (not shown) by the bi-directional lines 77. Therefore, a plurality of slave supervisors may be connected in parallel to the bi-directional lines to receive hall calls from a single master supervisor.

The master multi-car supervisor circuit 75 is connected to the bus 56 by the data lines 237, the address lines 229, the $\overline{DOP}$ line 534-10 and the $\overline{DIP}$ line 534-8. The $\overline{A0}$ through $\overline{A13}$ address bits, the $\overline{DIP}$ signal and the $\overline{DOP}$ signal are the inputs to an address decoder 1113. The master processor will generate the address bits and the $\overline{DOP}$ signal when hall call data is to be sent to a slave supervisor and will generate the address bits and the $\overline{DIP}$ signal when hall call data is to be read from a slave supervisor. The master supervisor addresses the desired slave supervisor by generating slave address bits as the $\overline{D0}$ through $\overline{D3}$ data bits and the address bits which are decoded to generate an enable signal to the latch 1114. The latch 1114 responds to the enable signal and the $\overline{D0}$ through $\overline{D3}$ data bits to generate the S0 through S3 slave address bits on the lines 1115 to the bi-directional lines 76 and 77. Each slave multi-car supervisor circuit includes an address decoder such as the address decoder 1116 of the slave multi-car supervisor circuit 1111. When the multi-car circuit 1111 is addressed, the address decoder 1116 receives the S0 through S3 slave address bits on the lines 1117 and generates an enable signal to a distributed arbitrator and enable generator 1118 to prepare the multi-car circuit to send or receive hall call data.

Now the master processor generates two sets of $\overline{D0}$ through $\overline{D7}$ data bits representing a hall call data address to a latch 1119. The processor also generates the address bits $\overline{A0}$ through $\overline{A13}$ and the $\overline{DOP}$ signal to the address decoder 1113 which responds by generating an enable signal to the latch 1119. The latch 1119 responds to each of the two sets and the enable signal to generate the A0 through A13 address bits on the lines 1121 to the bi-directional lines 76 and 77. The address bits are received by all the slave supervisors. However, since the slave supervisor 1110 has been addressed, the distributed arbitrator and enable generator 1118 will generate an enable signal to an AND gate 1122. The AND gate 1122 receives the address bits on lines 1123 to generate the $\overline{A0}$ through $\overline{A13}$ address bits to a bus 1124 of the slave supervisor. Each slave supervisor is programmed to check to determine if the master supervisor is allotting hall calls. If the master supervisor 55 is allotting hall calls and the slave supervisor 1110 has been addressed, the distributed arbitrator and enable generator 1118 will have requested control of the bus 1124. When the slave processor is ready for some hall call data, the bus control is granted and the enable signal is generated to the AND gate 1122 to place the address bits on the bus 1124. The distributed arbitrator and enable generator 1118 will also generate a $\overline{DIP}$ signal to enable the address bits to be read by the slave processor.

Now the master processor generates the hall call data as the data bits $\overline{D0}$ through $\overline{D7}$ and the address bits to enable a latch 1125 in the master multi-car supervisor circuit to generate the data bits on lines 1126 to the bi-directional lines 76 and 77. The data bits are received on lines 1127. The distributed arbitrator and enable generator will generate a $\overline{DIP}$ signal to the bus 1124 and an enable signal to an AND gate 1128 to place the data bits on the bus to be read by the slave processor.

If the master processor is allotting the hall calls on the basis of calls previously allotted to the cars and their relative positions in the system, hall call and position data must be sent from the slave processors to the master processor. Data from the slave processor on the bus 1124 is generated as the $\overline{D0}$ through $\overline{D7}$ data bits on lines 1129 when a latch 1131 is enabled and a $\overline{DOP}$ signal is generated by the distributed arbitrator and enable generator 1118. These data bits are received over the bi-directional lines 76 which are connected to an AND gate 1132 by lines 1133. The master processor generates a $\overline{DIP}$ signal and address bits to the address decoder 1113 which generates an enable signal to the AND gate 1132 to place the data bits on the bus 56. The address for the data is generated by the master processor to the slave processor as was previously discussed.

Each slave processor monitors the bi-directional lines to determine if the master processor is functioning to allot hall calls. If the master processor has failed, the slave processors are programmed to function in a selective-collective mode of operation. Each processor will look at all the system hall calls through its own parallel input/output circuit. The master processor is also responsive to a slave processor failure to prohibit the allotment of hall calls to that slave processor. Furthermore, each slave processor may be programmed to assume the duties of the master processor in some predetermined order of processor failures if it is also provided with a master multi-car supervisor circuit.

SUMMARY OF THE PROCESSOR

The processor controls the operation of the elevator system utilizing a program written as a predetermined combination of the basic instructions listed in Table I of FIG. 19. All signals representing service conditions, including car position input signals, motor tachometer signals, floor vane signals, multiplexed car signals, hall call signals, car relay input signals and control relay input signals are entered into interface circuits connected to a bus in the elevator supervisor. When the program requires data, the processor reads the data over the bus by addressing the corresponding interface circuit. When the program generates a control signal, the processor sends the control signal to the corresponding interface circuit over the bus.

The processor includes an arithmetic logic unit which may be addressed to perform the arithmetic and logic functions listed in Table II of FIG. 30B on a sixteen bit word. The processor also includes two groups of registers for temporary data storage. One group is the A and B registers which store data before it is accepted by the arithmetic logic unit or, in the case of the A register, store an address which will be placed on the bus. The other group of registers is the file register which stores the output from the arithmetic logic unit. Data is routed through the processor under the control of a multiplexer.

When the processor is turned on, the program is set to start at the first program instruction in the ROM to generate a binary coded program instruction signal. The MUX 503, under the control of the FR/MC 532, generates a zero address sixteen bit word to the AR 507 which sends the word to the BI 504 to address the ROMs. The ROMs are addressed at the first memory location to output the program instruction as a binary coded signal on the D0 through D7 lines through the BLT 505 to the IR 506. The program instruction signal in the IR 506 is decoded to determine the state signals to be generated by the SC 537 and the functions to be performed by the ALU 501. The FR 502 contains a position counter to remember the address of the present position in the program such that the position counter is incremented as required to generate the ROM addresses and guide the processor through the program.

Since the registers and the internal data paths are sixteen bits wide and the memory path is only eight bits wide, the basic instructions of FIG. 19 must be modified to specify which eight bit byte of the file register is to be affected. The following is a list of the basic instructions in modified form and the octal codes which may be stored in the ROM for use with the above-disclosed circuits.

| Basic | Octal Code | | | | |
|---|---|---|---|---|---|
| Instruction | Mnemonic | IR | IRX | BLT | Description |
| LOAD | LDHr | 01r | LSB | MSB | MEM to r, High Byte |
| | LDLr | 00r | LSB | MSB | MEM to r, Low Byte |
| LOAD IND. | LXHr | 15r | — | — | MEM to r, High Byte |
| | LXLr | 14r | — | — | MEM to r, Low Byte |
| | LYHr | 11r | — | — | MEM to r, High Byte |
| | LYLr | 10r | — | — | MEM to r, Low Byte |
| LOAD IMM. | LIr | 04r | LSB | MSB | MEM to r |
| STORE | SDHr | 03r | LSB | MSB | r to MEM, High Byte |
| | SDLr | 02r | LSB | MSB | r to MEM, Low Byte |
| STORE IND. | SXHr | 13r | — | — | r to MEM, High Byte |
| | SXLr | 12r | — | — | r to MEM, Low Byte |
| | SYHr | 17r | — | — | r to MEM, High Byte |
| | SYLr | 16r | — | — | r to MEM, Low Byte |
| ALU OP. | ADDr1r2 | 2r1r2 | 11m | — | F=A plus B |
| | SUBr1r2 | 2r1r2 | 06m | — | F=A minus B |
| | CLRr1 | 20r1 | 34m | — | F=0 |
| | MOVr1r2 | 2r1r2 | 37m | — | F=A |
| | SETr1 | 20r1 | 23m | — | F=1 |
| | SLr1 | 2r1r2 | 14m | — | F=A plus A |
| | COMr1r2 | 2r1r2 | 20m | — | $F=\overline{A}$ |
| | ANDr1r2 | 2r1r2 | 36m | — | F=AB |
| | BICr1r2 | 2r1r2 | 30m | — | $F=\overline{AB}$ |
| | ORr1r2 | 2r1r2 | 33m | — | $F=A+B$ |
| | NORr1r2 | 2r1r2 | 24m | — | $F=\overline{A+B}$ |
| | NANDr1r2 | 2r1r2 | 21m | — | $F=\overline{AB}$ |
| | XORr1r2 | 2r1r2 | 31m | — | $F=A \oplus B$ |
| | XNORr1r2 | 2r1r2 | 26m | — | $F=\overline{A+B}$ |
| | CMPr1r2 | 2r1r2 | 07m | — | $F=A+\overline{B}$ |
| JUMP | JMP | 317 | LSB | MSB | ADR to PC |
| | JTf | 30f | LSB | MSB | IF f = 1, ADR to PC |
| | JFt | 31f | LSB | MSB | IF f = 0, ADR to PC |
| CALL | CALL | 337 | LSB | MSB | PC to TP, ADR to PC |
| | CTf | 32f | LSB | MSB | IF f = 1, PC to TP, ADR to PC |
| | CFf | 33f | LSB | MSB | IF f = 0, PC to TP, ADR to PC |
| TRAP | TRP | 357 | — | — | PC to TP, TP to PC |
| | TTf | 34f | — | — | IF f = 1, PC to TP, TP to PC |
| | TFf | 35f | — | — | IF f = 0, PC to TP, TP to PC |
| INC/DEC | INCr1 | 06r1 | — | — | r1+1 to r1 |
| | DECr1 | 07r1 | — | — | r1−1 to r1 |
| FLAG | SEf | 37f | — | — | SET FLAG, f=1 |

-continued

| Basic Instruction | Octal Code Mnemonic | IR | IRX | BLT | Description |
|---|---|---|---|---|---|
| | CLf | 36f | — | — | SET FLAG, f=0 |

r - one of eight registers in FR 502
r1 - first register, one of eight in FR 502
r2 - second register, one of eight in FR 502
LSB - least significant byte, address or data
MSB - most significant byte, address or data
MEM - memory location
m - IRX2 through IRXO signals
F, A, B - see FIG. 30B
PC - position counter
TP - trap pointer
ADR - address
f - flag It may be seen that the program instruction signal in IR 506 is utilized to generate the decoded instruction signals from the ID 531 and the flag signals from the FG 535 to direct the processor to perform the desired operation. LOAD, STORE, JUMP and CALL instructions may also require two bytes from the IR 509 and the BLT 505 as an address or data. The ALU OPERATION instructions require a byte from the IRX 509 to determine the function to be performed.

SUMMARY OF THE SYSTEM

The processor and the interface circuits according to the present invention comprise an elevator supervisor for controlling a single elevator car. A single car elevator system typically may include an elevator car for serving a plurality of landings, a hoist motor for the car and call registering means for registering calls for service at the landings. The elevator supervisor functions to serially issue control signals for the hoist motor to control its speed and operating control signals to control the response and service of the car to the calls for service.

Two or more cars may be controlled in a defined relationship by utilizing multi-car supervisor circuits such as the circuit 75 of FIG. 3. Each elevator supervisor must include a multi-car supervisor circuit which is connected to bi-directional lines which couple the multi-car supervisor circuits in parallel. One of the elevator supervisors is designated as the master supervisor and its master processor is programmed to allot the system hall calls to the slave processors in the slave supervisors through the multi-car supervisor circuits and the bi-directional lines. The number of elevator supervisors which may be connected in parallel is limited only by the data handling capability of the master processor.

Typically, a two car elevator system may include a first and a second car for serving at least two stations. Each car includes control means for instituting a change in the operation of its associated car in response to a plurality of control signals for that car. There is also for each car a source of signals characteristic of service conditions for that car and a supervisor with means for processing different ones of the service condition signals and generating a portion of each of the pluralities of control signals. The control means and the service condition signals source for each car are connected to the processing means for that car. A third source of service condition signals which are common to both cars is connected to the processing means for the second car where they are processed and the remainder of the first and secone pluralities of control signals are generated. The first and second processing means are connected so that the remainder of the first plurality of control signals can be transmitted to the first processing means. The third service condition signals may represent calls for service at the stations and the second processing means may allot the control signals generated from these service condition signals. Therefore, the first car is the slave and the second car is the master.

Data is also transmitted from the slave processors to the master processor. Position data for each elevator car is provided for use by the master processor in the allotment of hall calls. A slave supervisor will generate position data which is stored in the slave multi-car supervisor circuit. The slave multi-car supervisor circuit then sends the position data to the master multi-car supervisor circuit from which it is read by the master processor.

The supervisors for each of the cars in an elevator system according to the present invention are identical except for the multi-car supervisor circuits which are either the master or the slave circuits. The supervisor includes a bus having a plurality of signal transmission lines, one or more supervisor interface circuits connecting the service condition signals source and the control means to the signal transmission lines, and a processing means connected to the bus means for receiving the service condition signals and for generating the control signals in response thereto through the supervisor interface circuits. The processing means includes a bus interface means connected to the bus for controlling the admission of the service condition signals to and the transmission of the control signals from the processing means, a first register means for storing one of the service condition signals, an arithmetic logic unit for performing a selected one of a plurality of arithmetic and logic functions on an address signal and the service condition signal to generate a control signal wherein the arithmetic logic unit is connected to receive the service condition signal and the address signal from the first register means, a second register means connected to the arithmetic logic unit for receiving and storing the address and the control signal and multiplexing means for controlling the signal flows between these elements. The processing means also includes a memory for storing a plurality of program instructions in a predetermined order wherein a selected program instruction signal is generated in response to the address signal and a processor control means responsive to the program instruction signal for generating multiplexing means control signals and a function signal to select the arithmetic or logic function to be performed.

Thus, the elevator system according to the present invention utilizes a processor to perform all the logic and control functions for a single elevator car. Furthermore, in a multi-car system, a master processor also allots system hall calls to the other processors in the system while other control functions are handled on an individual basis. Although the present invention has been illustrated as an elevator system, it may be utilized to control a system having vehicles which selectively stop at stations along a predetermined path of travel such as mass transportation systems.

We have disclosed our invention in terms of what we believe to be its best embodiment. However, we wish it to be understood that our invention may be practiced otherwise than as illustrated within the spirit and scope of the appended claims.

What we claim is:

1. In an elevator system including an elevator car movable along an elevator hatchway for serving at least two floors having landings, control means for controlling the elevator car in response to control signals, a source of data signals characteristic of service conditions for the system and an elevator supervisor responsive to the service condition signals for generating the control signals, the elevator supervisor comprising:

a bus means having a plurality of signal transmission lines;

at least one supervisor interface circuit connecting the service condition signals source and the control means to said bus means signal transmission lines; and a processing means connected to said bus means signal transmission lines for reading the service condition signals and for generating the control signals in response thereto through said supervisor interface circuit and said bus means wherein said one supervisor interface circuit is a position-velocity circuit and the service condition signals source includes a source of car position signals and car velocity signals connected to said position-velocity circuit whereby said processing means reads said car position signals and said car velocity signals through said position-velocity circuit and said bus means.

2. An elevator supervisor according to claim 1 wherein said bus means signal transmission lines include a plurality of address lines, data lines and control lines for transmitting information.

3. An elevator supervisor according to claim 1 wherein said processor includes memory means for storing velocity pattern data and means for generating velocity pattern control signals in response to said car position signals, said car velocity signals and said velocity pattern data and wherein said processing means transmits said velocity pattern control signals through said bus means and said position-velocity circuit to the elevator system control means for controlling the velocity of the elevator car.

4. An elevator supervisor according to claim 1 including another one of said supervisor interface circuit is a parallel input/output cricuts which and the service condition signals source includes a source of hall call signals connected to said parallel input/output circuit, said parallel input/output circuit having means for selecting said hall call signals, whereby said processing means reads said hall call signals from said parallel input/output circuit through said bus means.

5. An elevator supervisor according to claim 1 including another one of said supervisor interface circuit is a parallel input/output cricuts which and the service condition signals source includes a source of car input signals representing car service condition signals connected to said parallel input/output circuit, said parallel input/output circuit having storage means for storing said car input signals, whereby said processing means reads said car input signals from said parallel input/output circuit through said bus means.

6. An elevator supervisor according to claim 1 wherein said supervisor interface circuit generates information signals in response to said service condition signals and generates said control signals in response to processed information signals and wherein said processing means includes:

a bus interface means connected to said bus means signal transmission lines for transmitting said information signals and said processed information signals;

a first storage means for storing said information signals;

an arithmetic logic unit for performing a selected one of a plurality of arithmetic and logic functions on said information signals to generate said processed information signals and connected to receive said information signals from said first storage means;

a second storage means for storing said processed information signals and connected to receive said processed information signals from said arithmetic logic unit;

multiplexing means connected between said first storage means and said bus interface means for controlling the flow of said information signals from said bus interface means to said first storage means and connected between said second storage means and said bus interface means for controlling the flow of said processed information signals from said second storage means to said bus interface means; and control means for generating multiplexing means control signals to said multiplexing means to determine the sequence and timing of the flow of said information signals and said processed information signals.

7. An elevator supervisor according to claim 6 wherein said processing means includes instruction register means connected between said bus interface means and said arithmetic logic unit for generating a function selection signal to said arithmetic logic unit in response to a program instruction signal, said bus interface means includes means for storing a plurality of program instructions in a predetermined order and generating a selected program instruction signal in response to an address signal, said second storage means includes a position counter for storing the address of the next program instruction to be performed and said multiplexing means applies said address to said first storage means to generate said address signal to said bus interface means for storing a plurality of program instructions.

8. An elevator supervisor according to claim 6 wherein said control means includes a clock for generating a plurality of state signals each having a predetermined duration corresponding to an instruction state wherein each program instruction must be generated during at least one of said plurality of state signals.

9. An elevator system comprising:

a plurality of elevator cars each movable along an associated hatchway for serving at least one common floor;

a source of signals for each of said cars characteristic of service conditions for that car;

a control means for each of said cars for instituting a change in operation of said car in response to a plurality of control signals; and a supervisor for each of said cars including a means for processing said service condition signals and for generating said control signals for said car wherein one of said supervisors is designated as the master supervisor and is responsive to at least one of said service condition signals associated with said common floor for generating a control signal to direct said other cars to stop at said common floor.

10. An elevator system according to claim 9 wherein said service condition signal source includes means for issuing signals representing calls for service at said common floor and wherein said master supervisor processes said call signals individually and generates corresponding control signals to condition a selected one of said plurality of cars to serve said calls.

11. An elevator system according to claim 10 wherein said master supervisor processing means includes means to store said call signals.

12. An elevator system according to claim 10 wherein the other supervisors are designated as slave supervisors and including means connecting said master supervisor and said slave supervisors in parallel for transmitting said car stop signal from said master supervisor to a selected one of said slave supervisors.

13. An elevator system according to claim 12 wherein said connecting means includes means associated with said master supervisor for generating a selected one of a plurality of slave address signals, means associated with each of said slave supervisors and responsive to a different one of said plurality of slave address signals for enabling the selected slave supervisor to receive said car stop signal and means for connecting said slave address generating means to each of said slave enabling means wherein said slave enabling means are connected in parallel.

14. An elevator system according to claim 12 wherein said connecting means includes means associated with each one of said plurality of slave supervisors for generating a car service condition signal, means associated with said master supervisor for receiving said car service condition signal and means for connecting each of said car service condition signal means to said car service condition signal receiving means wherein said car service condition signal means are connected in parallel.

15. In an elevator system including an elevator car movable along an elevator hatchway for serving at least two floors having landings, control means for controlling the elevator car in response to control signals, a source of data signals characteristic of service conditions for the system and an elevator supervisor responsive to the service condition signals for generating the control signals, a hall call circuit for registering calls for service at the landings, comprising:

hall call registering means at each of the landings for generating a hall call input signal representing a request for service at the landing;

hall call indicating means at each of the landings for indicating that a request for service at the landing has been registered;

means for latching said registering means and said indicating means in an on state in response to said hall call input signal;

means for generating a hall call entered signal in response to the generation of any one or more of said hall call input signals; and input circuit means for generating said hall call input signals and said hall call entered signal as a portion of the service condition signals.

16. A hall call circuit according to claim 15 wherein said hall call registering means includes a normally open push button switch connected across a power source and a hall call signal line connected between one side of said switch and said input circuit means wherein a hall call input signal is generated on said hall call signal line when said switch is closed.

17. A hall call circuit according to claim 16 wherein said indicating means is a lamp connected between said switch and said power source.

18. A hall call circuit according to claim 16 wherein the closure of said push button switch connects said indicating means to said power source to turn on said indicating means and wherein said latching means includes a second normally open switch connected in parallel with said push button switch and means responsive to said hall call input signal for latching said second switch in a closed state to connect said indicating means to said power source.

19. A hall call circuit according to claim 18 wherein said second switch is a transistor having a collector connected to said hall call signal line and an emitter connected to the opposite side of said push button switch and wherein said second switch latching means includes an inverter connected between said hall call signal line and a base of said transistor.

20. A hall call circuit according to claim 15 wherein the elevator supervisor generates a hall call clear signal when the elevator car has serviced the landing and wherein said hall call circuit includes means responsive to said hall call clear signal for resetting said latching means.

21. A hall call circuit according to claim 15 wherein said input circuit means includes means responsive to an address signal for selecting one of said hall call input signals or said hall call entered signal and wherein the elevator supervisor generates said address signal as one of the control signals.

22. A hall call circuit according to claim 21 wherein the elevator supervisor includes a processor for generating said address signal, said processor including means for storing program instructions in a predetermined order for directing the operation of said processor during the generation of said address signal.

23. In an elevator system including a plurality of elevator cars movable along separate hatchways for serving at least two floors each having a common landing, each of the cars including control means for controlling the elevator car in response to control signals, a source of data signals characteristic of service conditions for the system and an elevator supervisor responsive to the service condition signals for generating the control signals, a hall call circuit for registering calls for service at the common landing, comprising:

a hall call registering means at each of the common landings for generating a hall call input signal representing a request for service at the common landing;

a hall call indicating means at each of the common landings for indicating that a request for service at the common landing has been registered;

means associated with each of the common landings for latching said registering means and said indicating means in an on state in response to said hall call input signal;

means for generating a hall call entered signal in response to the generation of any one or more of said hall call input signals; and input circuit means for each of the elevator cars for generating said hall call input signals and said hall call entered signal as a portion of the service condition signals for the associated elevator car.

24. A hall call circuit according to claim 23 wherein each of said input circuit means include means responsive to an address signal for selecting one of said hall call input signals or said hall call entered signal and wherein the associated elevator supervisor generates said address signal as one of the control signals.

25. A hall call circuit according to claim 23 wherein each of the elevator supervisors includes a processor for generating said address signal, each of said processors including means for storing program instructions in a predetermined order for directing the operation of said processor during the generation of said address signal.

26. In an elevator system including an elevator car movable along an elevator hatchway for serving at least two floors having landings, control means for controlling the elevator car in response to control signals, a source of data signals characteristic of service conditions for the system and an elevator supervisor responsive to the service conditions for generating the control signals, a hall lantern circuit for indicating when the elevator car is to stop at the landings, comprising:

a plurality of hall lantern signals lines;

hall lantern indicating means at each of the landings, each of said hall lantern indicating means connected to a different pair of said hall lantern signals lines and responsive to hall lantern signals on said pair of hall lantern signals lines for indicating when the elevator car will stop at the associated landing;

a source of hall lantern address signals for selecting the one of the hall lantern indicating means associated with the landing at which the elevator car will stop;

hall call lantern decoder/driver means responsive to said hall lantern address signals for generating said hall lantern signals; and a plurality of hall lantern address signals lines connected between said hall lantern address signals source and said hall lantern decoder/driver means.

27. A hall lantern circuit according to claim 26 wherein said hall lantern address signals source generates a binary coded address and said hall lantern address signals lines each carry one bit of said binary coded adress.

28. A hall lantern circuit according to claim 26 wherein said hall lantern indicating means is responsive to a binary "1" on one of said pair of said hall lantern signals lines and a binary "0" on the other one of said pair of said hall lantern signals lines.

29. A hall lantern circuit according to claim 28 wherein said hall lantern indicating means indicates an up direction of travel for the elevator car in response to a binary "1" on said one line and a binary "0" on said other line and indicates a down direction of travel for the elevator car in response to a binary "0" on said one line and a binary "1" on said other line.

30. A hall lantern circuit according to claim 26 wherein said hall lantern address signals source generates a binary coded address and said hall lantern decoder/driver means includes means for decoding said address signals and generating a plurality of zone signals and subzone signals in response to the decoded address signals and means responsive to said zone signals and said subzone signals for generating said hall lantern signals.

31. A hall lantern circuit according to claim 30 wherein said hall lantern address signals source generates a different binary coded address for each hall lantern indicating means, wherein said decoding means generates a different combination of one of said zone signals and one of said subzone signals for each different binary coded address and wherein said means responsive to said zone signals and said subzone signals generates said hall lantern signals on a different pair of hall lantern signals lines for each different binary coded address.

32. A hall lantern circuit according to claim 31 wherein one bit of said binary coded address represents the direction of travel of the elevator car and wherein said means responsive to said zone signals and said subzone signals is also responsive to said direction of travel bit to generate different ones of said hall lantern signals on a pair of said hall lantern signals lines for each direction of travel of the elevator car.

33. A hall lantern circuit according to claim 26 wherein said hall lantern address signals source is a processor in the elevator supervisor, said processor being responsive to a portion of said service condition signals for generating said hall lantern address signals.

34. A transportation system comprising:

a predetermined path of travel including at least two stations;

a first vehicle movable along said path of travel for serving said stations and including control means for instituting a change in operation of said vehicle in response to a first plurality of control signals;

a first source of signals characteristic of service conditions for said first vehicle;

a first supervisor for said first vehicle including a first means for processing a plurality of different ones of said first service condition signals and generating a portion of said first plurality of control signals and a first means connecting said first vehicle control means and said first service condition signals source to said first processing means;

a second vehicle movable along said path of travel for serving said stations and including control means for instituting a change in operation of said vehicle in response to a second plurality of control signals;

a second source of signals characteristic of service conditions for said second vehicle;

a second supervisor for said second vehicle including a second means for processing a plurality of different ones of said second service condition signals and generating a portion of said second plurality of control signals and a second means connecting said second vehicle control means and said second service condition signals source of said second processing means;

a third source of signals characteristic of service conditions which are common to said first and second vehicles connected to said second processing means by said second connecting means wherein said second processing means processes a plurality of different ones of said third service condition signals and generates the remainder of said first and second pluralities of control signals; and a third means connecting said first processing means to said second processing means for transmitting the remainder of said first plurality of control signals to said first processing means.

35. A transportation system according to claim 34 wherein said third service conditions signals source includes means for issuing signals representing calls for service at said stations and wherein said second processing means processes said call signals individually and generates corresponding control signals to condition said first and second vehicles to service said calls.

36. A transportation system according to claim 35 wherein said second processing means allots individual ones of said call signals to said first or said second vehicles in accordance with their ability to serve the calls.

37. A transportation system according to claim 36 wherein said second processing means includes storage means for said call signals.

38. A transportation system according to claim 34 wherein said third connecting means includes means for storing said remainder of said first and second pluralities of control signals.

39. A transportation system according to claim 34 wherein said second supervisor includes a bus connected to said second processing means and said second connecting means includes a plurality of interface circuits connected between said second service conditions signal source and said bus.

40. A transportation system according to claim 39 wherein said third service conditions signal source includes means for issuing signals representing calls for service at said stations, wherein said second connecting means includes an interface circuit connected between said signal issuing means and said bus and wherein said second processing means processes said call signals individually and generates corresponding ones of said remainder of said first and second pluralities of control signals to condition said first and second vehicles to service said calls.

41. A transportation system according to claim 40 wherein said signal issuing means includes a call station having means for generating one of said call signals and means responsive to the actuation of said generating means for indicating that said one call signal has been generated, a sense and clear circuit including means responsive to said call signal for generating a latch signal to said indicating means to maintain the indication that said call signal has been generated after said generating means ceases to generate said call signal.

42. A transportation system according to claim 34 wherein said third connecting means includes means connected to said second processing means and responsive to selected ones of said second plurality of control signals for generating slave address signals, means connected to said first processing means and responsive to one of said slave address signals for enabling said first processor to receive the remainder of said first plurality of control signals and bus means connecting said slave address signal generating means to said first processor enabling means.

43. A transportation system according to claim 42 wherein said slave address signal generating means includes storage means for said slave address signals.

44. A transportation system according to claim 43 wherein said first processor enabling means includes decoding means responsive to said one of said slave address signals for generating an enable signal to enable said first processing means to receive the remainder of said first plurality of control signals.

45. A transportation system according to claim 42 wherein said second processing means generates a first control signal representing the address of said slave address signal generating means, wherein said slave address signal generating means includes address decoding means responsive to said first control signal for generating a first enable signal, wherein said second processing means generates a second control signal representing said one slave address signal and wherein said slave address signal generating means includes storage means responsive to said second control signal and said first enable signal for generating said slave address signal and for storing said slave address signal at said bus means.

46. A transportation system according to claim 45 wherein said second processing means generates a third control signal representing one of said remainder of said first plurality of control signals, wherein said address decoding means generates a second enable signal and wherein said slave address signal generating means includes storage means responsive to said third control signal and said first enable signal for generating said one of said remainder of said first plurality of control signals and for storing said one signal at said bus means.

47. A transportation system according to claim 34 wherein said third connecting means includes means connected to said second processing means and responsive to selected ones of said second plurality of control signals for generating slave address signals, means connected to said first processing means and responsive to one of said slave address signals for enabling said first processing means to generate a first control signal, bus means for connecting said slave address generating means to said first processor enabling means wherein said second processing means receives said first control signal.

48. A transportation system according to claim 47 wherein said second processing means generates a second control signal representing the address of said slave address signal generating means, wherein said slave address signal generating means includes address decoding means responsive to said second control signal for generating a first enable signal, and wherein said slave address generating means includes means reponsive to said first enable signal and said first control signal for generating said first control signal to said second processing means.

49. A transportation system including a vehicle movable along a predetermined path of travel having at least two stations which the vehicle serves, control means for controlling the vehicle in response to control signals, a source of data signals characteristic of service conditions for the system and a supervisor for the vehicle responsive to the service conditions signals for generating the control signals, the supervisor comprising:

a bus means having a plurality of signal transmission lines;

at least one supervisor interface circuit connecting the service condition signal source and the control means to said bus means signal transmission lines; and a processing means connected to said bus means for receiving said service condition signals and for generating said control signals in response thereto through said supervisor interface circuits, said processing means including:

a bus interface means connected to said bus means for controlling the admission of said service condition signals to and the transmission of said control signals from said processing means;

a first register means for storing one of said service condition signals;

an arithmetic logic unit for performing a selected one of a plurality of arithmetic and logic functions on an address signal and on said service condition signal to generate one of said control signals and connected to receive said service condition signal and said address signal from said first register means;

a second register means for storing said control signal and said address signal and connected to receive said control signal and said address signal from said arithmetic logic unit; multiplexing means connected between said first register means and said bus interface means for controlling the flow of said service condition signals from said bus interface means to said first register means, connected between said second register means and said bus interface means for controlling the flow of said control signals from said second register means to said bus interface means and connected between said second register means and said first register means for controlling the flow of said address signal from said second register means to said arithmetic logic unit;

memory means for storing a plurality of program instructions in a predetermined order and for generating a selected program instruction signal in response to said address signal; and processor control means responsive to said program instruction signal for generating multiplexing means control signals to said multiplexing means to determine the sequence and timing of the flow of said service condition signals, said control signals and said address signal and for generating a function select signal to said arithmetic logic unit to select the functions to be performed.

50. A supervisor according to claim 49 wherein said processor control means includes a clock for generating a plurality of state signals each having a predetermined duration corresponding to an instruction state wherein each of said program instruction signals must be generated during at least one of said plurality of state signals.

51. A supervisor according to claim 50 wherein said clock means generates at least one state signal during which said program instruction signal is read from said memory means and at least one other state signal during which said program instruction is executed.

52. A supervisor according to claim 50 wherein said processor control means is responsive to said program instruction signal and at least one of said state signals for generating a multiplexing means control signal to direct said multiplexing means to place said address signal into said arithmetic logic unit and for generating a function select signal to direct said arithmetic logic unit to increment said address signal.

53. A supervisor according to claim 49 wherein said memory means includes at least one read only memory responsive to said address signal for generating said program instruction signal.

* * * * *

UNITED STATES PATENT AND TRADEMARK OFFICE

CERTIFICATE OF CORRECTION

PATENT NO. : 4,114,730

DATED : September 19, 1978

INVENTOR(S) : DAVID K. MEANS and CLYDE A. BOENKE

It is certified that error appears in the above-identified patent and that said Letters Patent are hereby corrected as shown below:

| | |
|---|---|
| Column 1, line 12 | Change "February 2, 1975" to - - February 3, 1975 - - . |
| Column 1, line 33 | Change "care" to - - cars - - . |
| Column 6, line 44 | Change "cell" to - - call - - . |
| Column 8, line 24 | Change "signal" to - - circuit - - . |
| Column 8, line 60 | Change "counter buffer" to - - counter weight buffer - - . |
| Column 15, line 29 | Change "$\overline{LO}$" to - - LO - - . |
| Column 15, line 30 | Change "LO" to - - $\overline{LO}$ - - . |
| Column 16, line 17 | Change "section" to - - selection - - . |
| Column 21, line 25 | Change 'A "O"' to - - a "1" - - . |
| Column 21, line 45 | Change' "O",' to - - "O" or "1", - - . |
| Column 22, line 20 | Change "98-1 to" to - - 98-6 to - - . |
| Column 27, line 65 | Change "284-9" to - - 284-8 - - . |
| Column 27, line 66 | Change "rain" to - - train - - . |
| Column 28, line 29 | Change "cock" to - - clock - - . |
| Column 28, line 31 | Change "cock" to - - clock - - . |
| Column 32, line 18 | Change "RB" to - - $\overline{RB}$ - - . |

UNITED STATES PATENT AND TRADEMARK OFFICE

CERTIFICATE OF CORRECTION

PATENT NO. : 4,114,730

DATED : September 19, 1978

INVENTOR(S) : DAVID K. MEANS and CLYDE A. BOENKE

It is certified that error appears in the above-identified patent and that said Letters Patent are hereby corrected as shown below:

| | |
|---|---|
| Column 42, line 21 | Change "DO" to - - $\overline{DO}$ - - . |
| Column 42, line 22 | Change "$\overline{DO}$" to - - DO - - . |
| Column 50, line 43 | Change "MUX" to - - MUX 503 - - . |
| Column 50, line 48 | Change "BR" to - - BR 508 - - . |
| Column 55, line 16 | Change "lines 299-1" to - - lines 229-1- -. |
| Column 57, line 7 | Change "the $\overline{HIR}$ signal" to - - the HIR signal - - . |
| Column 57, line 8 | Change "the HIR signal"to - - the $\overline{HIR}$ signal - - . |
| Column 59, line 27 and 28 | Change "$\overline{DO}$ through D7" to - - $\overline{DO}$ through $\overline{D7}$ - - . |
| Column 59, line 28 | Change "$\overline{DO}$ through $\overline{D7}$" to - - DO through D7 - - . |
| Column 61, line 31 | Change "signal $\overline{HIR}$"to - - signal HIR - - . |
| Column 61, line 32 | Change "signal HIR" to - - signal $\overline{HIR}$ - - . |
| Column 64, line 17 | Change "$\overline{IRO}$ through $\overline{IR7}$"to - - IRO through IR7 - - . |
| Column 64, line 22 | Change "$\overline{IRO}$ through IR7" to - - $\overline{IRO}$ through $\overline{IR7}$ - - . |

UNITED STATES PATENT AND TRADEMARK OFFICE

CERTIFICATE OF CORRECTION

PATENT NO. : 4,114,730

DATED : September 19, 1978

INVENTOR(S) : DAVID K. MEANS and CLYDE A. BOENKE

It is certified that error appears in the above-identified patent and that said Letters Patent are hereby corrected as shown below:

| | |
|---|---|
| Column 64, line 47 | Change "$\overline{\text{IRXO}}$ through $\overline{\text{IRX7}}$"to - - IRXO through IRX7 - - . |
| Column 64, line 48 and 49 | Change "IRXO through IRX7" to - - $\overline{\text{IRXO}}$ through $\overline{\text{IRX7}}$ - - . |
| Column 65, line 4 | Change "$\overline{\text{IRXO}}$" to - - IRXO - - . |
| Column 65, line 9 | Change "IRXO through IRX7" to - - $\overline{\text{IRXO}}$ through $\overline{\text{IRX7}}$ - - . |
| Column 73, line 8 | Change "output 882-4" to - - output 822-4 - - . |
| Column 77, line 38 | Change ", will" to - - , a "O" will - - . |
| Column 81, line 60 | Change "943-1 and an input 943-1" to - - 943-1 and an input 943-2 - - . |
| Column 82, line 53 | Change "a "O" to - - a "1" - - . |
| Column 83, line 45 | Change "through" to - - through 959-4 - - . |
| Column 84, line 5 | Change "to the X line" to - - to the $\overline{\text{X}}$ line - - . |
| Column 86, line 45 | Change "1" to - - "1" to generate a "O" - - . |
| Column 88, line 51 | Change "the line 531-4" to - - the line 532-4 --. |

UNITED STATES PATENT AND TRADEMARK OFFICE

CERTIFICATE OF CORRECTION

PATENT NO. : 4,114,730

DATED : September 19, 1978

INVENTOR(S) : DAVID K. MEANS and CLYDE A. BOENKE

It is certified that error appears in the above-identified patent and that said Letters Patent are hereby corrected as shown below:

| | |
|---|---|
| Column 90, line 21 | Change "1011-13" to - - 1011-3 - - . |
| Column 90, line 58 | Change "to an output" to - - to an input - - . |
| Column 91, line 45 | Change "1029-4" to - - 1028-4 - - . |
| Column 92, line 67 | Change ' a "O"' - - to - - a "1" - - . |
| Column 93, line 3 | Change ' a "O"' to - - a "1" - - . |
| Column 94, line 21 | Change "by the JC" to - - by the $\overline{JC}$ - - . |
| Column 94, line 24 | Change "The JC" to - - The $\overline{JC}$ - - . |
| Column 94, line 30 | Change '"1"' to - - "1" in the F3 - - . |
| Column 110, line 53 | Change "of" to - - to - -. |

Signed and Sealed this

***Third* Day of *July 1979***

[SEAL]

*Attest:*

*Attesting Officer*

LUTRELLE F. PARKER

*Acting Commissioner of Patents and Trademarks*